US012404732B2

(12) United States Patent
Kibbe et al.

(10) Patent No.: US 12,404,732 B2
(45) **Date of Patent: *Sep. 2, 2025**

(54) TRAPDOOR-STYLE DRILLING MUD SCREEN SYSTEM AND METHODS THEREOF

(71) Applicant: Black Diamond Oilfield Rentals LLC, Houston, TX (US)

(72) Inventors: Charles G. Kibbe, New Iberia, LA (US); Ross J. Robin, New Iberia, LA (US)

(73) Assignee: Black Diamond Oilfield Rentals LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/984,193

(22) Filed: Nov. 9, 2022

(65) Prior Publication Data

US 2023/0063617 A1 Mar. 2, 2023

Related U.S. Application Data

(63) Continuation-in-part of application No. 17/126,415, filed on Dec. 18, 2020, now Pat. No. 11,802,453,
(Continued)

(51) Int. Cl.
*E21B 21/06* (2006.01)
*E21B 19/16* (2006.01)
(Continued)

(52) U.S. Cl.
CPC ..... *E21B 21/065* (2013.01); *E21B 19/16* (2013.01); *E21B 21/08* (2013.01); *E21B 21/106* (2013.01)

(58) Field of Classification Search
CPC ..... E21B 21/08; E21B 19/16; E21B 21/065; E21B 21/10; E21B 21/12; E21B 21/106
See application file for complete search history.

(56) References Cited

U.S. PATENT DOCUMENTS 4,226,726 A 10/1980 Rehm
4,421,170 A 12/1983 Swift et al.
(Continued)

OTHER PUBLICATIONS

Final Office Action on U.S. Appl. No. 15/959,070 dated Aug. 26, 2020, 14 pages.
(Continued)

*Primary Examiner* — Blake Michener
(74) *Attorney, Agent, or Firm* — Foley & Lardner LLP

(57) ABSTRACT

A trapdoor-style drilling mud screen system, comprising a first body having a first portion, a second portion and a third portion, a first drilling mud inlet at a first end of the first portion of the first body, a first drilling mud outlet at a second end of the third portion of the first body, a rotating trapdoor subassembly, wherein the rotating trapdoor subassembly is disposed within the second portion of the first body, wherein the first portion of the first body is fluidly connected to a first end of the rotating subassembly, and wherein a second end of the rotating subassembly is fluidly connected to the third portion of the first body, a pivot subassembly, wherein the pivot subassembly is disposed through the rotating trapdoor subassembly and through the second portion of the first body; and a drilling mud screen, wherein the drilling mud screen is disposed within the rotating trapdoor subassembly between the first drilling mud inlet and the first drilling mud outlet. Methods of installing and using the drilling mud screen system are also disclosed.

57 Claims, 87 Drawing Sheets

Related U.S. Application Data which is a continuation-in-part of application No. 15/959,070, filed on Apr. 20, 2018, now Pat. No. 11,028,656.

(60) Provisional application No. 62/598,521, filed on Dec. 14, 2017, provisional application No. 62/491,700, filed on Apr. 28, 2017.

(51) Int. Cl.
*E21B 21/08* (2006.01)
*E21B 21/10* (2006.01)

(56) References Cited

U.S. PATENT DOCUMENTS

| | | | |
|---|---|---|---|
| 6,263,969 | B1 | 7/2001 | Stoesz et al. |
| 6,517,125 | B2 | 2/2003 | Brisco |
| 6,598,685 | B1 | 7/2003 | Mashburn |
| 6,782,952 | B2 | 8/2004 | Garay et al. |
| 6,976,546 | B2 | 12/2005 | Herst |
| 7,243,740 | B2 | 7/2007 | Frith |
| 7,913,760 | B2 | 3/2011 | Robichaux et al. |
| 8,127,867 | B1 | 3/2012 | Droke |
| 8,381,808 | B2 | 2/2013 | Rogers et al. |
| 8,695,715 | B2 | 4/2014 | Rogers et al. |
| 9,151,124 | B2 | 10/2015 | Iblings et al. |
| 9,353,605 | B2 | 5/2016 | Hailey et al. |
| 9,598,919 | B1 | 3/2017 | Cantrell et al. |
| 9,624,727 | B1 | 4/2017 | Hutton |
| 9,677,361 | B2 | 6/2017 | Patterson |
| 10,280,719 | B1 | 5/2019 | O'Neal |
| 10,323,484 | B2 | 6/2019 | Liess |
| 10,415,352 | B2 | 9/2019 | Thomas et al. |
| 10,557,323 | B2 | 2/2020 | Pope |
| 11,802,453 | B2 * | 10/2023 | Comeaux ..... E21B 21/10 |
| 2003/0136584 | A1 | 7/2003 | Risher et al. |
| 2003/0150616 | A1 | 8/2003 | Mashburn |
| 2004/0079551 | A1 | 4/2004 | Herst |
| 2006/0065443 | A1 | 3/2006 | Hall et al. |
| 2008/0087433 | A1 | 4/2008 | Mashburn et al. |
| 2013/0306304 | A1 | 11/2013 | Cherewyk et al. |
| 2015/0101804 | A1 | 4/2015 | Vu |
| 2015/0198016 | A1 | 7/2015 | Langlais |
| 2015/0267511 | A1 | 9/2015 | Patterson |
| 2016/0327191 | A1 | 11/2016 | Walker et al. |
| 2017/0058644 | A1 | 3/2017 | Andreychuk et al. |
| 2018/0128067 | A1 | 5/2018 | Gao et al. |
| 2018/0135371 | A1 | 5/2018 | Cherewyk |
| 2018/0258721 | A1 | 9/2018 | Pawar et al. |
| 2018/0306000 | A1 | 10/2018 | Deboer |
| 2018/0313178 | A1 | 11/2018 | Biggerstaff et al. |
| 2019/0085663 | A1 | 3/2019 | Thomas et al. |
| 2019/0106954 | A1 | 4/2019 | Brown-Kerr et al. |
| 2019/0112884 | A1 | 4/2019 | Biggerstaff et al. |
| 2019/0128454 | A1 | 5/2019 | Chirko et al. |
| 2019/0264546 | A1 | 8/2019 | O'Neal |

OTHER PUBLICATIONS

Final Office Action on U.S. Appl. No. 16/230,597 dated Jun. 2, 2020, 8 pages.
International Search Report and Written Opinion corresponding to PCT/US2018/029620, dated Aug. 30, 2018, 13 pages.
International Search Report and Written Opinion corresponding to PCT/US2020/059416, dated Feb. 4, 2021, 12 pages.
International Search Report and Written Opinion of PCT/US2020/059134, dated Mar. 10, 2021, 24 pages.
International Search Report and Written Opinion on PCT/US2020/058868 dated Mar. 10, 2021, 19 pages.
Non-Final Office Action on U.S. Appl. No. 15/959,070 dated Jun. 23, 2020, 18 pages.
Non-Final Office Action on U.S. Appl. No. 16/230,597 dated Nov. 17, 2020, 8 pages.
Non-Final Office Action on U.S. Appl. No. 17/010,678 dated Apr. 4, 2022, 13 pages.
Non-Final Office Action on U.S. Appl. No. 17/083,201 dated Jul. 28, 2022, 16 pages.
Non-Final Office Action on U.S. Appl. No. 17/123,401 dated Aug. 12, 2022, 25 pages.
Non-Final Office Action on U.S. Appl. No. 15/959,070 dated Apr. 20, 2020 (16 pages).
Non-Final Office Action on U.S. Appl. No. 16/230,597 dated Apr. 28, 2020 (7 pages).
Notice of Allowance on U.S. Appl. No. 15/959,070 dated Jan. 6, 2021, 6 pages.
Notice of Allowance on U.S. Appl. No. 16/230,597 dated Mar. 9, 2021, 5 pages.
US Office Action on U.S. Appl. No. 16/677,084 dated Mar. 23, 2021, 14 pages.

* cited by examiner

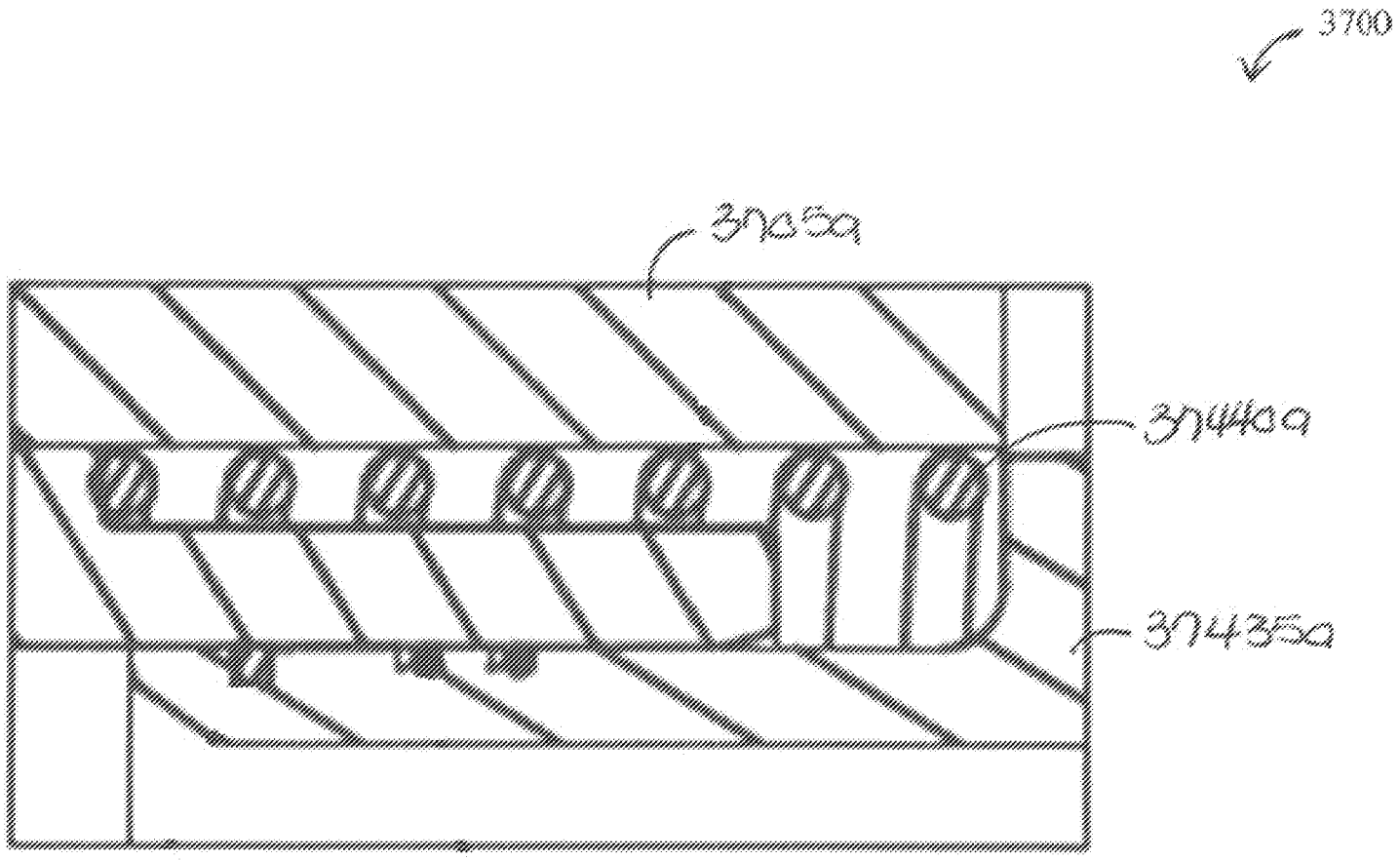
3700
3744a
3744b
3744c
3744d
3744e
3744f
3744g
3744h
3744i
3744j
3744k
3744l
3744m
3744n
3744o
3744p
3744q
3744r
3744s
3744t
3744u
3744v
3744w
3744x
3744y
3744z
3744aa
3744ab
3744ac
3744ad
3744ae
3744af
3744ag
3744ah
3744ai
3744aj
3744ak
3744al
3744am
3744an
3744ao
3744ap
3744aq
3744ar
3744as
3744at
3744au
3744av
3744aw
3744ax
3744ay
3744az
3744ba
3744bb
3744bc
3744bd
3744be
3744bf
3744bg
3744bh
3744bi
3744bj
3744bk
3744bl
3744bm
3744bn
3744bo
3744bp
3744bq
3744br
3744bs
3744bt
3744bu
3744bv
3744bw
3744bx
3744by
3744bz
3744ca
3744cb
3744cc
3744cd
3744ce
3744cf
3744cg
3744ch
3744ci
3744cj
3744ck
3744cl
3744cm
3744cn
3744co
3744cp
3744cq
3744cr
3744cs
3744ct
3744cu
3744cv
3744cw
3744cx
3744cy
3744cz
3744da
3744db
3744dc
3744dd
3744de
3744df
3744dg
3744dh
3744di
3744dj
3744dk
3744dl
3744dm
3744dn
3744do
3744dp
3744dq
3744dr
3744ds
3744dt
3744du
3744dv
3744dw
3744dx
3744dy
3744dz
3744ea
3744eb
3744ec
3744ed
3744ee
3744ef
3744eg
3744eh
3744ei
3744ej
3744ek
3744el
3744em
3744en
3744eo
3744ep
3744eq
3744er
3744es
3744et
3744eu
3744ev
3744ew
3744ex
3744ey
3744ez
3744fa
3744fb
3744fc
3744fd
3744fe
3744ff
3744fg
3744fh
3744fi
3744fj
3744fk
3744fl
3744fm
3744fn
3744fo
3744fp
3744fq
3744fr
3744fs
3744ft
3744fu
3744fv
3744fw
3744fx
3744fy
3744fz
3744ga
3744gb
3744gc
3744gd
3744ge
3744gf
3744gg
3744gh
3744gi
3744gj
3744gk
3744gl
3744gm
3744gn
3744go
3744gp
3744gq
3744gr
3744gs
3744gt
3744gu
3744gv
3744gw
3744gx
3744gy
3744gz
3744ha
3744hb
3744hc
3744hd
3744he
3744hf
3744hg
3744hh
3744hi
3744hj
3744hk
3744hl
3744hm
3744hn
3744ho
3744hp
3744hq
3744hr
3744hs
3744ht
3744hu
3744hv
3744hw
3744hx
3744hy
3744hz
3744ia
3744ib
3744ic
3744id
3744ie
3744if
3744ig
3744ih
3744ii
3744ij
3744ik
3744il
3744im
3744in
3744io
3744ip
3744iq
3744ir
3744is
3744it
3744iu
3744iv
3744iw
3744ix
3744iy
3744iz
3744ja
3744jb
3744jc
3744jd
3744je
3744jf
3744jg
3744jh
3744ji
3744jj
3744jk
3744jl
3744jm
3744jn
3744jo
3744jp
3744jq
3744jr
3744js
3744jt
3744ju
3744jv
3744jw
3744jx
3744jy
3744jz
3744ka
3744kb
3744kc
3744kd
3744ke
3744kf
3744kg
3744kh
3744ki
3744kj
3744kk
3744kl
3744km
3744kn
3744ko
3744kp
3744kq
3744kr
3744ks
3744kt
3744ku
3744kv
3744kw
3744kx
3744ky
3744kz
3744la
3744lb
3744lc
3744ld
3744le
3744lf
3744lg
3744lh
3744li
3744lj
3744lk
3744ll
3744lm
3744ln
3744lo
3744lp
3744lq
3744lr
3744ls
3744lt
3744lu
3744lv
3744lw
3744lx
3744ly
3744lz
3744ma
3744mb
3744mc
3744md
3744me
3744mf
3744mg
3744mh
3744mi
3744mj
3744mk
3744ml
3744mm
3744mn
3744mo
3744mp
3744mq
3744mr
3744ms
3744mt
3744mu
3744mv
3744mw
3744mx
3744my
3744mz
3744na
3744nb
3744nc
3744nd
3744ne
3744nf
3744ng
3744nh
3744ni
3744nj
3744nk
3744nl
3744nm
3744nn
3744no
3744np
3744nq
3744nr
3744ns
3744nt
3744nu
3744nv
3744nw
3744nx
3744ny
3744nz
3744oa
3744ob
3744oc
3744od
3744oe
3744of
3744og
3744oh
3744oi
3744oj
3744ok
3744ol
3744om
3744on
3744oo
3744op
3744oq
3744or
3744os
3744ot
3744ou
3744ov
3744ow
3744ox
3744oy
3744oz
3744pa
3744pb
3744pc
3744pd
3744pe
3744pf
3744pg
3744ph
3744pi
3744pj
3744pk
3744pl
3744pm
3744pn
3744po
3744pp
3744pq
3744pr
3744ps
3744pt
3744pu
3744pv
3744pw
3744px
3744py
3744pz
3744qa
3744qb
3744qc
3744qd
3744qe
3744qf
3744qg
3744qh
3744qi
3744qj
3744qk
3744ql
3744qm
3744qn
3744qo
3744qp
3744qq
3744qr
3744qs
3744qt
3744qu
3744qv
3744qw
3744qx
3744qy
3744qz
3744ra
3744rb
3744rc
3744rd
3744re
3744rf
3744rg
3744rh
3744ri
3744rj
3744rk
3744rl
3744rm
3744rn
3744ro
3744rp
3744rq
3744rr
3744rs
3744rt
3744ru
3744rv
3744rw
3744rx
3744ry
3744rz
3744sa
3744sb
3744sc
3744sd
3744se
3744sf
3744sg
3744sh
3744si
3744sj
3744sk
3744sl
3744sm
3744sn
3744so
3744sp
3744sq
3744sr
3744ss
3744st
3744su
3744sv
3744sw
3744sx
3744sy
3744sz
3744ta
3744tb
3744tc
3744td
3744te
3744tf
3744tg
3744th
3744ti
3744tj
3744tk
3744tl
3744tm
3744tn
3744to
3744tp
3744tq
3744tr
3744ts
3744tt
3744tu
3744tv
3744tw
3744tx
3744ty
3744tz
3744ua
3744ub
3744uc
3744ud
3744ue
3744uf
3744ug
3744uh
3744ui
3744uj
3744uk
3744ul
3744um
3744un
3744uo
3744up
3744uq
3744ur
3744us
3744ut
3744uu
3744uv
3744uw
3744ux
3744uy
3744uz
3744va
3744vb
3744vc
3744vd
3744ve
3744vf
3744vg
3744vh
3744vi
3744vj
3744vk
3744vl
3744vm
3744vn
3744vo
3744vp
3744vq
3744vr
3744vs
3744vt
3744vu
3744vv
3744vw
3744vx
3744vy
3744vz
3744wa
3744wb
3744wc
3744wd
3744we
3744wf
3744wg
3744wh
3744wi
3744wj
3744wk
3744wl
3744wm
3744wn
3744wo
3744wp
3744wq
3744wr
3744ws
3744wt
3744wu
3744wv
3744ww
3744wx
3744wy
3744wz
3744xa
3744xb
3744xc
3744xd
3744xe
3744xf
3744xg
3744xh
3744xi
3744xj
3744xk
3744xl
3744xm
3744xn
3744xo
3744xp
3744xq
3744xr
3744xs
3744xt
3744xu
3744xv
3744xw
3744xx
3744xy
3744xz
3744ya
3744yb
3744yc
3744yd
3744ye
3744yf
3744yg
3744yh
3744yi
3744yj
3744yk
3744yl
3744ym
3744yn
3744yo
3744yp
3744yq
3744yr
3744ys
3744yt
3744yu
3744yv
3744yw
3744yx
3744yy
3744yz
3744za
3744zb
3744zc
3744zd
3744ze
3744zf
3744zg
3744zh
3744zi
3744zj
3744zk
3744zl
3744zm
3744zn
3744zo
3744zp
3744zq
3744zr
3744zs
3744zt
3744zu
3744zv
3744zw
3744zx
3744zy
3744zz

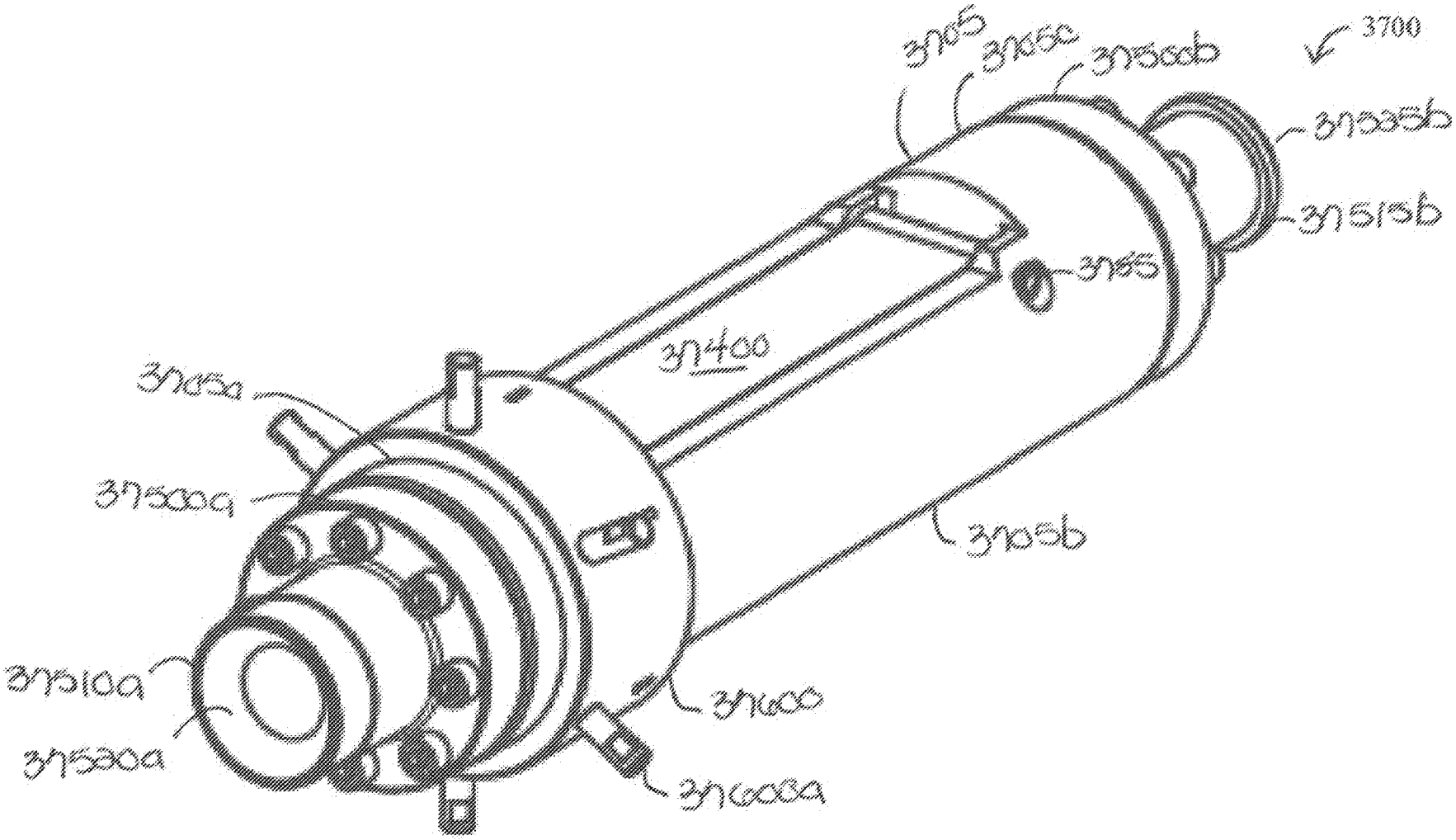
3700
3705b
3705b
3705b
3705c
3705c
3705
3705b
3705b
3705
3705a
3705a
3705a

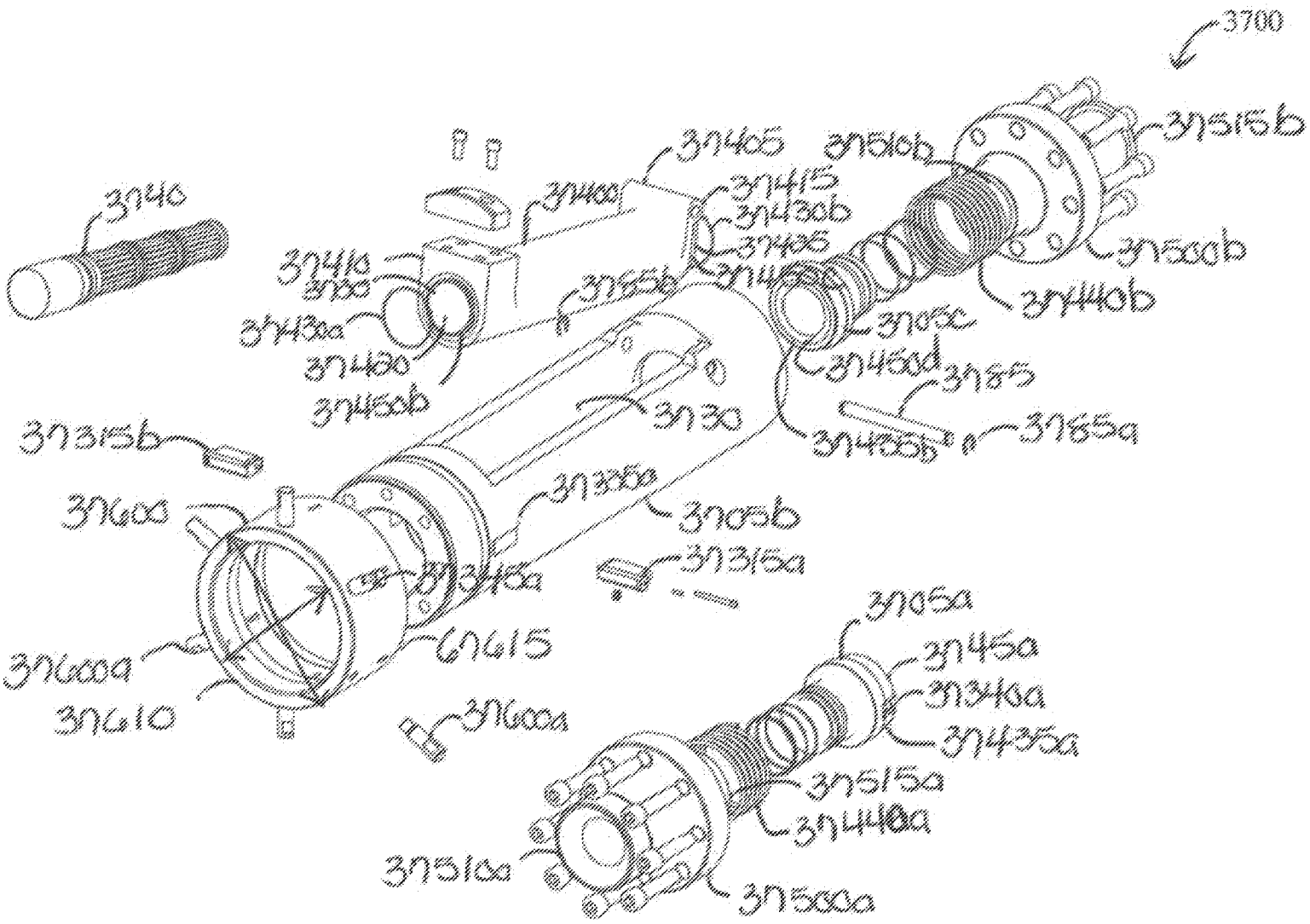
3700
3315b
3500b
3440b
3165b
3415
3405
3440a
3415b
3405
3440
3415a
3440a
3415b
3440a
3440
3415b
3440a
3415b
3440
3440a
3415b
3440a
3415b
3440a
3415b

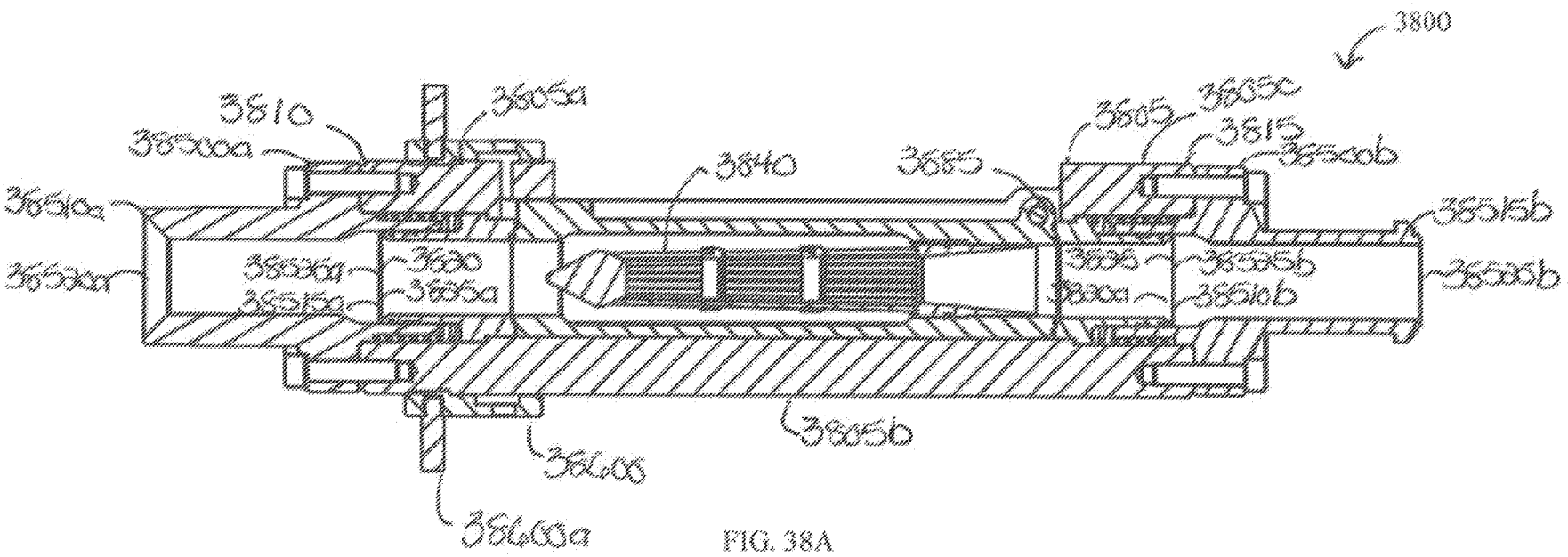
3800
3810
3815
3840
3845
3845b
3845c
3845a
3845b
3845b
3845b

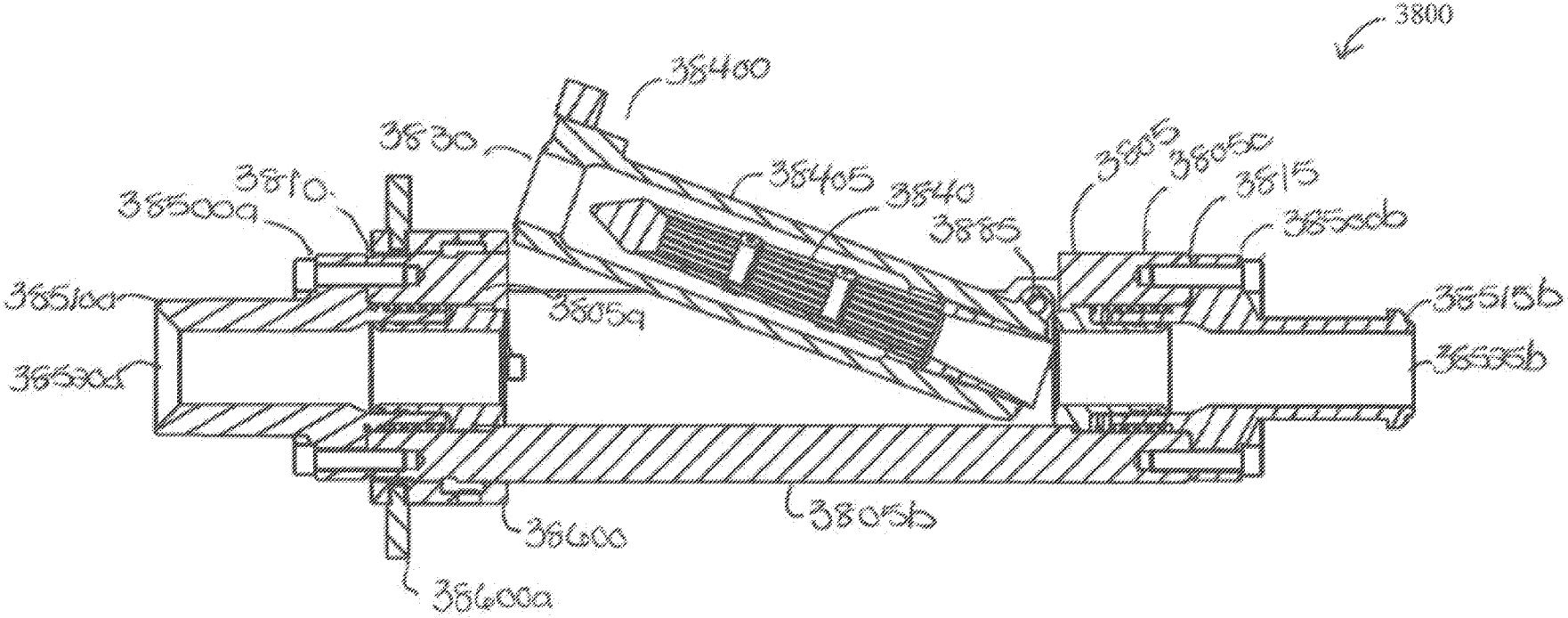
3800
3810
3815
3830
3840
3860
3860a
3860b
3860c
3860d
3860e
3860f
3860g
3860h
3860i
3860j
3860k
3860l
3860m
3860n
3860o
3860p
3860q
3860r
3860s
3860t
3860u
3860v
3860w
3860x
3860y
3860z
3860aa
3860ab
3860ac
3860ad
3860ae
3860af
3860ag
3860ah
3860ai
3860aj
3860ak
3860al
3860am
3860an
3860ao
3860ap
3860aq
3860ar
3860as
3860at
3860au
3860av
3860aw
3860ax
3860ay
3860az
3860ba
3860bb
3860bc
3860bd
3860be
3860bf
3860bg
3860bh
3860bi
3860bj
3860bk
3860bl
3860bm
3860bn
3860bo
3860bp
3860bq
3860br
3860bs
3860bt
3860bu
3860bv
3860bw
3860bx
3860by
3860bz
3860ca
3860cb
3860cc
3860cd
3860ce
3860cf
3860cg
3860ch
3860ci
3860cj
3860ck
3860cl
3860cm
3860cn
3860co
3860cp
3860cq
3860cr
3860cs
3860ct
3860cu
3860cv
3860cw
3860cx
3860cy
3860cz
3860da
3860db
3860dc
3860dd
3860de
3860df
3860dg
3860dh
3860di
3860dj
3860dk
3860dl
3860dm
3860dn
3860do
3860dp
3860dq
3860dr
3860ds
3860dt
3860du
3860dv
3860dw
3860dx
3860dy
3860dz
3860ea
3860eb
3860ec
3860ed
3860ee
3860ef
3860eg
3860eh
3860ei
3860ej
3860ek
3860el
3860em
3860en
3860eo
3860ep
3860eq
3860er
3860es
3860et
3860eu
3860ev
3860ew
3860ex
3860ey
3860ez
3860fa
3860fb
3860fc
3860fd
3860fe
3860ff
3860fg
3860fh
3860fi
3860fj
3860fk
3860fl
3860fm
3860fn
3860fo
3860fp
3860fq
3860fr
3860fs
3860ft
3860fu
3860fv
3860fw
3860fx
3860fy
3860fz
3860ga
3860gb
3860gc
3860gd
3860ge
3860gf
3860gg
3860gh
3860gi
3860gj
3860gk
3860gl
3860gm
3860gn
3860go
3860gp
3860gq
3860gr
3860gs
3860gt
3860gu
3860gv
3860gw
3860gx
3860gy
3860gz
3860ha
3860hb
3860hc
3860hd
3860he
3860hf
3860hg
3860hh
3860hi
3860hj
3860hk
3860hl
3860hm
3860hn
3860ho
3860hp
3860hq
3860hr
3860hs
3860ht
3860hu
3860hv
3860hw
3860hx
3860hy
3860hz
3860ia
3860ib
3860ic
3860id
3860ie
3860if
3860ig
3860ih
3860ii
3860ij
3860ik
3860il
3860im
3860in
3860io
3860ip
3860iq
3860ir
3860is
3860it
3860iu
3860iv
3860iw
3860ix
3860iy
3860iz
3860ja
3860jb
3860jc
3860jd
3860je
3860jf
3860jg
3860jh
3860ji
3860jj
3860jk
3860jl
3860jm
3860jn
3860jo
3860jp
3860jq
3860jr
3860js
3860jt
3860ju
3860jv
3860jw
3860jx
3860jy
3860jz
3860ka
3860kb
3860kc
3860kd
3860ke
3860kf
3860kg
3860kh
3860ki
3860kj
3860kk
3860kl
3860km
3860kn
3860ko
3860kp
3860kq
3860kr
3860ks
3860kt
3860ku
3860kv
3860kw
3860kx
3860ky
3860kz
3860la
3860lb
3860lc
3860ld
3860le
3860lf
3860lg
3860lh
3860li
3860lj
3860lk
3860ll
3860lm
3860ln
3860lo
3860lp
3860lq
3860lr
3860ls
3860lt
3860lu
3860lv
3860lw
3860lx
3860ly
3860lz
3860ma
3860mb
3860mc
3860md
3860me
3860mf
3860mg
3860mh
3860mi
3860mj
3860mk
3860ml
3860mm
3860mn
3860mo
3860mp
3860mq
3860mr
3860ms
3860mt
3860mu
3860mv
3860mw
3860mx
3860my
3860mz
3860na
3860nb
3860nc
3860nd
3860ne
3860nf
3860ng
3860nh
3860ni
3860nj
3860nk
3860nl
3860nm
3860nn
3860no
3860np
3860nq
3860nr
3860ns
3860nt
3860nu
3860nv
3860nw
3860nx
3860ny
3860nz
3860oa
3860ob
3860oc
3860od
3860oe
3860of
3860og
3860oh
3860oi
3860oj
3860ok
3860ol
3860om
3860on
3860oo
3860op
3860oq
3860or
3860os
3860ot
3860ou
3860ov
3860ow
3860ox
3860oy
3860oz
3860pa
3860pb
3860pc
3860pd
3860pe
3860pf
3860pg
3860ph
3860pi
3860pj
3860pk
3860pl
3860pm
3860pn
3860po
3860pp
3860pq
3860pr
3860ps
3860pt
3860pu
3860pv
3860pw
3860px
3860py
3860pz
3860qa
3860qb
3860qc
3860qd
3860qe
3860qf
3860qg
3860qh
3860qi
3860qj
3860qk
3860ql
3860qm
3860qn
3860qo
3860qp
3860qq
3860qr
3860qs
3860qt
3860qu
3860qv
3860qw
3860qx
3860qy
3860qz
3860ra
3860rb
3860rc
3860rd
3860re
3860rf
3860rg
3860rh
3860ri
3860rj
3860rk
3860rl
3860rm
3860rn
3860ro
3860rp
3860rq
3860rr
3860rs
3860rt
3860ru
3860rv
3860rw
3860rx
3860ry
3860rz
3860sa
3860sb
3860sc
3860sd
3860se
3860sf
3860sg
3860sh
3860si
3860sj
3860sk
3860sl
3860sm
3860sn
3860so
3860sp
3860sq
3860sr
3860ss
3860st
3860su
3860sv
3860sw
3860sx
3860sy
3860sz
3860ta
3860tb
3860tc
3860td
3860te
3860tf
3860tg
3860th
3860ti
3860tj
3860tk
3860tl
3860tm
3860tn
3860to
3860tp
3860tq
3860tr
3860ts
3860tt
3860tu
3860tv
3860tw
3860tx
3860ty
3860tz
3860ua
3860ub
3860uc
3860ud
3860ue
3860uf
3860ug
3860uh
3860ui
3860uj
3860uk
3860ul
3860um
3860un
3860uo
3860up
3860uq
3860ur
3860us
3860ut
3860uu
3860uv
3860uw
3860ux
3860uy
3860uz
3860va
3860vb
3860vc
3860vd
3860ve
3860vf
3860vg
3860vh
3860vi
3860vj
3860vk
3860vl
3860vm
3860vn
3860vo
3860vp
3860vq
3860vr
3860vs
3860vt
3860vu
3860vv
3860vw
3860vx
3860vy
3860vz
3860wa
3860wb
3860wc
3860wd
3860we
3860wf
3860wg
3860wh
3860wi
3860wj
3860wk
3860wl
3860wm
3860wn
3860wo
3860wp
3860wq
3860wr
3860ws
3860wt
3860wu
3860wv
3860ww
3860wx
3860wy
3860wz
3860xa
3860xb
3860xc
3860xd
3860xe
3860xf
3860xg
3860xh
3860xi
3860xj
3860xk
3860xl
3860xm
3860xn
3860xo
3860xp
3860xq
3860xr
3860xs
3860xt
3860xu
3860xv
3860xw
3860xx
3860xy
3860xz
3860ya
3860yb
3860yc
3860yd
3860ye
3860yf
3860yg
3860yh
3860yi
3860yj
3860yk
3860yl
3860ym
3860yn
3860yo
3860yp
3860yq
3860yr
3860ys
3860yt
3860yu
3860yv
3860yw
3860yx
3860yy
3860yz
3860za
3860zb
3860zc
3860zd
3860ze
3860zf
3860zg
3860zh
3860zi
3860zj
3860zk
3860zl
3860zm
3860zn
3860zo
3860zp
3860zq
3860zr
3860zs
3860zt
3860zu
3860zv
3860zw
3860zx
3860zy
3860zz

TRAPDOOR-STYLE DRILLING MUD SCREEN SYSTEM AND METHODS THEREOF

PRIOR RELATED APPLICATIONS

This application is a continuation-in-part of U.S. Nonprovisional patent application Ser. No. 17/126,415 entitled "Valve-Style Drilling Mud Screen System and Methods Thereof," filed on Dec. 18, 2020, which is a continuation-in-part of U.S. Nonprovisional patent application Ser. No. 15/959,070 entitled "Drilling Mud Screen System and Methods Thereof," filed on Apr. 20, 2018, which claims the benefit of U.S. Provisional Patent Application Ser. No. 62/598,521 entitled "Improved Drilling Mud Screen System and Methods Thereof," filed on Dec. 14, 2017, and U.S. Provisional Patent Application Ser. No. 62/491,700 entitled "Drilling Mud Screen System and Methods Thereof," filed on Apr. 28, 2017. All of said priority applications are incorporated by references in their entirety.

FEDERALLY SPONSORED RESEARCH STATEMENT

Not Applicable (N/A)

REFERENCE TO MICROFICHE APPENDIX

N/A

FIELD OF INVENTION

The present invention relates generally to an improved drilling mud screen system and methods thereof and, more particularly, to an improved drilling mud screen system with a drilling mud screen puller/installer tool and methods thereof.

BACKGROUND OF THE INVENTION

Many drilling rigs use drill pipe mud screens that are in-line with the drilling assembly. Typically, drilling mud screens, commonly Type 3 drilling mud screens, are installed on the drill floor or at the bottom of the drill string. If the drilling mud screen is installed on the drill floor, the drilling mud screen must be reinstalled or replaced every time a section of stand pipe is added to the drill string. In other words, the drilling mud screens must be installed at the top of each 90-foot stand of pipe above the rig crew. As each stand of drill pipe is drilled down to the derrick floor, the top drive sub-connection is separated from the drill pipe stand connection and the drilling mud screen is installed to the top of the next stand of pipe going in the hole. This is a dangerous practice that can result in accidents to the crew below.

Although the Type 3 drilling mud screen appears to work for single-shoulder API rotary shouldered connection types, it does not work for proprietary double-shoulder high-strength connection types that eliminate the space where the drilling mud screen is typically located inside the pipe. Instead, the nose of the double-shoulder pin connection on the top of the drive sub-connection is decreased to the exact width of the drilling mud screen flange, so that "theoretically" the nose of the double-shoulder pin connection may have the same contact inside the mating drill pipe box and same shoulder bearing stress at optimal connection make-up torque as it would in an unmodified assembly. Further, the dimensions of the shortened nose of the double-shoulder pin may not be adequate for the selected drilling mud screen flange. When the dimensions of the shortened nose of the double-shoulder pin are outside the acceptable connection tolerances of about ±0.000-inch to about ±0.0010-inch, the mating pin and/or box is damaged. Further, rig crews often forget to install the drilling mud screen. This oversight frequently results in damage as the shortened nose of the double-shoulder pin continuously tries to make-up inside the box but fails. These are dangerous practices that can result in drilling mud leaking onto the drilling rig floor creating a slip hazard and/or in a double-shoulder connection failure. Further, this is an expensive practice that rapidly consumes drilling mud screens long before they need to be replaced.

If the drilling mud screen is installed at the bottom of the drill string, the drilling mud screen must be brought to the surface to be replaced. This is an inefficient practice that can results in lost drilling time.

Thus, an improved drilling mud screen system with a drilling mud screen puller/installer tool is needed to eliminate these problems.

SUMMARY OF THE INVENTION

In an embodiment, a drilling mud screen system comprises a first body having a first drilling mud inlet, an optional first drilling mud inlet, a first drilling mud outlet and a drilling mud screen access port, an optional drilling mud screen insert, a drilling mud screen, and a first end cap.

In an embodiment, the first body has a first end, a second end and a first centerline from the first end to the second end.

In an embodiment, the first drilling mud inlet has a second centerline forming a first angle with the first centerline and extending to the first centerline, wherein the first drilling mud inlet is offset from the first end of the first body. In an embodiment, the first angle is from about 20-degrees to about 120-degrees.

In an embodiment, the optional first drilling mud inlet has an optional second centerline forming an optional first angle with the first centerline and extending to the first centerline and forming an optional second angle with the second centerline, wherein the optional first drilling mud inlet is offset from the first end of the first body and wherein the optional first drilling mud inlet is offset from the second centerline radially about the first centerline. In an embodiment, the optional first angle is from about 20-degrees to about 120-degrees.

In an embodiment, the first drilling mud outlet is at the second end of the first body.

In an embodiment, the drilling mud screen access port is at the first end of the first body. In an embodiment, the first end cap is disposed within the drilling mud access port to close and seal the drilling mud access port.

In an embodiment, the drilling mud screen is disposed within the first body between the first drilling mud inlet and the first drilling mud outlet.

In an embodiment, the drilling mud screen comprises a second body having a second drilling mud inlet, a second drilling mud outlet, a second end cap and a filter.

In an embodiment, the drilling mud screen is constructed from AISI 4145 or equivalent, stainless steel or combinations thereof. In an embodiment, the filter has a hardened coating.

In an embodiment, the optional drilling mud screen insert is disposed within the first body between the first drilling mud inlet and the drilling mud screen.

In an embodiment, the second body has a first end and a second end, wherein the first end and/or the second end of the body has a means to engage a drilling mud screen puller/installer tool.

In an embodiment, the second drilling mud inlet is at the first end of the second body.

In an embodiment, the filter has a first end, a second end, and openings, wherein the filter is fluidly connected to the second end of the second body via a first connection and/or an optional first end retaining ring. In an embodiment, the filter is straight or tapered from the first end to the second end of the filter. In an embodiment, the filter is tapered from the first end to the second end of the filter.

In an embodiment, the filter comprises a plurality of rods having a first end and a second end, wherein the rods are spaced a distance apart to form the openings in the filter. In an embodiment, the rods are tapered from the first end to the second end of the filter.

In an embodiment, the filter comprises a formed sheet having drilled holes or slots spaced a distance apart to form the openings in the filter. In an embodiment, the drilled holes or slots are drilled in any configuration and orientation from the first end to the second end of the filter. In an embodiment, the drilled holes or slots are drilled in offset rows or straight rows from the first end to the second end of the filter.

In an embodiment, the second drilling mud outlet is at the openings of the filter.

In an embodiment, the second end cap is fluidly connected at the second end of the filter via a second connection. In an embodiment, the filter has an optional retaining ring disposed between the first connection and the second connection.

In an embodiment, the first body comprises a third body and a fourth body, and wherein the third body is fluidly connected to the fourth body via a union.

In an embodiment, one or more of the first body, the second body, the third body and the fourth body are constructed from AISI 4130/75k or equivalent material, AISI 4145 or equivalent, or combinations thereof.

In an embodiment, the first body has a first portion and a second portion surrounding the filter, and wherein a second inner diameter of the second portion is larger than a first inner diameter of the first portion to provide a high flow rate of drilling mud through the filter.

In an embodiment, the second end cap is a flat plate or a flat plate with holes or slots. In an embodiment, the second end cap is an inverted cone or an inverted cone with holes or slots.

In an embodiment, the first centerline of the first body and an inner surface of the second end cap form a cap angle, wherein the cap angle is from about 30-degrees to about 60-degrees. In an embodiment, the first centerline of the first body and an inner surface of the second end cap form a cap angle, wherein the cap angle is from about 35-degrees to about 45-degrees.

In an embodiment, a drilling mud screen system, comprises a first body having a first drilling mud inlet, a first drilling mud outlet and a drilling mud screen access port, a drilling mud screen, a plug and a first end cap.

In an embodiment, the first body has a first end, a second end and a first centerline from the first end to the second end.

In an embodiment, the first drilling mud inlet has a second centerline forming a first angle with the first centerline and extending to the first centerline, wherein the first drilling mud inlet is offset from the first end of the first body.

In an embodiment, the first drilling mud outlet is at the second end of the first body.

In an embodiment, the drilling mud screen access port is at the first end of the first body. In an embodiment, the first end cap is disposed within the drilling mud access port to close and seal the drilling mud access port.

In an embodiment, the first end cap is disposed within the drilling mud access port to close and seal the drilling mud access port.

In an embodiment, the plug is disposed within the first body between the drilling mud access port and the first drilling mud inlet.

In an embodiment, the drilling mud screen is disposed within the first body between the first drilling mud inlet and the first drilling mud outlet.

In an embodiment, the drilling mud screen comprises a second body having a second drilling mud inlet, a second drilling mud outlet, a second end cap and a filter.

In an embodiment, the drilling mud screen is constructed from AISI 4145 or equivalent, stainless steel or combinations thereof. In an embodiment, the optional drilling mud screen insert, the optional first end retaining ring and/or the optional retaining ring is constructed from AISI 4145 or equivalent, stainless steel or combinations thereof and/or has a hardened coating. In an embodiment, the filter has a hardened coating.

In an embodiment, the second body has a first end and a second end, wherein the first end and/or the second end of the body has a means to engage a drilling mud screen puller/installer tool.

In an embodiment, the second drilling mud inlet is at the first end of the second body.

In an embodiment, the filter has a first end, a second end, and openings, wherein the filter is fluidly connected to the second end of the second body. In an embodiment, the filter is straight or tapered from the first end to the second end of the filter. In an embodiment, the filter is tapered from the first end to the second end of the filter.

In an embodiment, the filter comprises a plurality of rods having a first end and a second end, wherein the rods are spaced a distance apart to form the openings in the filter. In an embodiment, the rods are tapered from the first end to the second end of the filter.

In an embodiment, the filter comprises a formed sheet having drilled holes or slots spaced a distance apart to form the openings in the filter. In an embodiment, the drilled holes or slots are drilled in any configuration and orientation from the first end to the second end of the filter. In an embodiment, the drilled holes or slots are drilled in offset rows or straight rows from the first end to the second end of the filter.

In an embodiment, the second drilling mud outlet is at the openings of the filter.

In an embodiment, the end cap is fluidly connected at the second end of the filter.

In an embodiment, the plug comprises a third body having a first end and a second end, wherein the first end of the third body has a means to engage a drilling mud screen puller/installer tool.

In an embodiment, the first end of the third body has an optional cavity extending towards but not through the flow surface of the plug.

In an embodiment, the third body has an optional port extending from an outer surface of the plug into the optional cavity.

In an embodiment, the second end of the third body has a flow surface to direct the drilling mud from the first drilling mud inlet to the second drilling mud inlet. In an embodiment, the flow surface may be selected from the group consisting of a backwards "J" shape, a curved shape, an "L" shape and combinations and variations thereof.

In an embodiment, one or more of the first body, the second body and the third body are constructed from AISI 4130/75k or equivalent material, AISI 4145 or equivalent, or combinations thereof.

In an embodiment, the first body has a first portion and a second portion surrounding the filter, and wherein a second inner diameter of the second portion is larger than a first inner diameter of the first portion to provide a high flow rate of drilling mud through the filter.

In an embodiment, the second end cap is a flat plate or a flat plate with holes or slots. In an embodiment, the second end cap is an inverted cone or an inverted cone with holes or slots.

In an embodiment, the first centerline of the first body and an inner surface of the second end cap form a cap angle, wherein the cap angle is from about 30-degrees to about 60-degrees. In an embodiment, the first centerline of the first body and an inner surface of the second end cap form a cap angle, wherein the cap angle is from about 35-degrees to about 45-degrees.

In an embodiment, the drilling mud screen system further comprises a transducer subassembly. In an embodiment, the transducer subassembly comprises a transducer body having a drilling mud inlet, a drilling mud outlet and a transducer access port, and a transducer.

In an embodiment, the transducer body has a first end, a second end and a first centerline from the first end to the second end.

In an embodiment, the drilling mud inlet is at the first end of the transducer body.

In an embodiment, the first drilling mud outlet is at the second end of the transducer body.

In an embodiment, the transducer access port has a second centerline forming a transducer angle with the first centerline and extending to the first centerline, wherein the transducer access port is offset from the first end of the transducer body. In an embodiment, the transducer angle is from about 20-degrees to about 120-degrees.

In an embodiment, the transducer is disposed within the transducer access port to close and seal the transducer access port.

In an embodiment, the drilling mud outlet of the transducer subassembly is fluidly connected to the first drilling mud inlet of the drilling mud screen system.

In an embodiment, a drilling mud screen puller/installer tool comprises a hollow body, a striker plate, a shaft having a puller/installer plate and an optional stop plate, groove or painted line, a movable sleeve disposed around a portion of the shaft, and a handle.

In an embodiment, the hollow body has a first end, a second end and a first length.

In an embodiment, the striker plate has a first end and a second end, wherein the first end striker plate is connected to the second end of the body via a first connection.

In an embodiment, the shaft has a first end, a second end and a second length, wherein the second end of the striker plate is connected to the first end of the shaft via a second connection.

In an embodiment, the puller/installer plate has a first end and a second end, wherein the second end of the shaft is connected to the first end of the puller/installer plate via a fourth connection. In an embodiment, the puller/installer plate has a means to engage a drilling mud screen. In an embodiment, the puller/installer plate has one or more extensions to fit an outlet of a first portion and/or an inlet of a second portion of the body of the drilling mud screen and to rotationally engage a shoulder inside the inlet of the second portion of the body of the drilling mud screen.

In an embodiment, the optional stop plate, grove or painted line on the shaft is offset from the first end of the body or the second end of the body. In an embodiment, the stop plate is connected to the shaft via a fifth connection.

In an embodiment, the movable sleeve has a first end, a second end and a third length, wherein the movable sleeve is disposed around a portion of the shaft.

In an embodiment, the handle is connected to the movable sleeve via a third connection.

In an embodiment, one or more of the first, second, third, fourth and fifth connections are welds.

In an embodiment, one or more of the body and the movable sleeve are constructed from AISI 4140 or equivalent, stainless steel or combinations thereof.

In an embodiment, one or more of the handle and the shaft are constructed from AISI 1018 or equivalent.

In an embodiment, one or more of the rounded end, the striker plate and the puller/installer plate are constructed from stainless steel.

In an embodiment, a method of installing a drilling mud screen system comprises a) providing a drilling mud screen system, b) stopping a drilling mud pump to fluidly connect the drilling mud screen to the drilling mud pump, c) fluidly connecting the drilling mud screen system in line with and immediately upstream or downstream of the drilling mud pump; and d) operating the drilling mud pump to produce flow of drilling mud through the drilling mud screen system.

In an embodiment, step c) comprises fluidly connecting a drilling mud inlet of the drilling mud screen system to a high-pressure outlet of the drilling mud pump and fluidly connecting a drilling mud outlet of the drilling mud screen system to a vibrator hose or a standpipe.

In an embodiment, step c) comprises fluidly connecting a drilling mud inlet of the drilling mud screen system to a high-pressure inlet of the drilling mud pump and fluidly connecting a drilling mud outlet of the drilling mud screen system to an inlet of a vibrator hose.

In an embodiment, step c) comprises fluidly connecting a drilling mud inlet of the drilling mud screen system to an outlet of a vibrator hose and a drilling mud outlet to an inlet of a standpipe.

In an embodiment, step c) comprises fluidly connecting a drilling mud inlet of the drilling mud screen system to an outlet of a first portion of a standpipe and a drilling mud outlet to an inlet of a second portion of the standpipe.

In an embodiment, step e) comprises filtering or screening debris from drilling mud.

In an embodiment, a method of installing and using a drilling mud screen system comprises a) providing the drilling mud screen system; b) stopping a drilling mud pump; c) fluidly connecting a first transducer subassembly, having a transducer, in line with and downstream of the drilling mud pump and fluidly connecting the drilling mud screen system in line with and immediately downstream of the first transducer subassembly; and d) operating the drilling mud pump to produce flow of drilling mud through the first transducer subassembly and the drilling mud screen system.

In an embodiment, the method further comprises step (f) monitoring the transducer of the first transducer subassembly for property information immediately upstream of the drilling mud screen system and step (g) using the property information to determine a status of the drilling mud screen system.

In an embodiment, step (c) comprises fluidly connecting a first transducer subassembly, having a transducer, in line with and downstream of the drilling mud pump and fluidly connecting the drilling mud screen system in line with and immediately downstream of the first transducer subassembly, and fluidly connecting a gate valve in line with and immediately downstream of the drilling mud screen system, fluidly connecting a second transducer subassembly, having a low torque plug valve, in line with and immediately downstream of the gate valve and wherein step (d) comprises operating the drilling mud pump to produce flow of drilling mud through the first transducer subassembly, the drilling mud screen system, the gate valve and the second transducer subassembly.

In an embodiment, the method further comprises step (e) stopping the drilling mud pump, step (f) closing the gate valve to isolate the drilling mud screen system, and step (g) pumping cement through the low torque plug valve of the second transducer subassembly, a vibrator hose, a stand pipe, a top drive and a case running tool (CRT).

In an embodiment, a method of removing and replacing a drilling mud screen comprises a) providing the drilling mud screen system; b) stopping a drilling mud pump connected to the drilling mud screen system; c) opening a drilling mud screen access port in the drilling mud screen system to remove and replace a drilling mud screen; d) accessing the interior of the drilling mud screen system to pull the plug from the drilling mud screen system; e) accessing the interior of the drilling mud screen system to pull the drilling mud screen from the drilling mud screen system and to install a replacement drilling mud screen into the drilling mud screen system; f) accessing the interior of the drilling mud screen system to reinstall the plug into the drilling mud screen system; g) closing the drilling mud screen access port in the drilling mud screen system; and h) operating the drilling mud pump to produce flow of drilling mud through the drilling mud screen system.

In an embodiment, step d) comprises using a puller/installer plate and/or a rounded end of a puller/installer tool to engage and pull the plug from the drilling mud screen system. In an embodiment, step d) comprises using a puller/installer plate and/or a rounded end of a puller/installer tool to engage and pull the plug from the drilling mud screen system and, optionally using a stop plate, groove or painted line of the puller/installer tool to determine when the replacement drilling mud screen is installed into the drilling mud screen system.

In an embodiment, step e) comprises using a puller/installer plate of a puller/installer tool to engage and pull the drilling mud screen from the drilling mud screen system. In an embodiment, step e) comprises using a puller/installer plate and/or a rounded end of a puller/installer tool to install the replacement drilling mud screen into the drilling mud screen system.

In an embodiment, step f) comprises using a puller/installer plate and/or a rounded end of a puller/installer tool to reinstall the plug into the drilling mud screen system.

In an embodiment, a valve-style drilling mud screen system comprises a first body, a first drilling mud inlet, a first drilling mud outlet, a rotating subassembly, a pivot subassembly and a drilling mud screen. In an embodiment, the first body has a first portion, a second portion and a third portion. In an embodiment, the first drilling mud inlet is at a first end of the first portion of the body. In an embodiment, the first drilling mud outlet is at a second end of the third portion of the body.

In an embodiment, the rotating subassembly is disposed within the second portion of the first body. In an embodiment, the rotating subassembly has a first end and a second end. In an embodiment, the first portion of the first body is fluidly connected to the first end of the rotating subassembly. In an embodiment, the second end of the rotating subassembly is fluidly connected to the third portion of the first body.

In an embodiment, the pivot subassembly is attached to the rotating subassembly through the second portion of the first body.

In an embodiment, the drilling mud screen is disposed within the rotating subassembly between the first drilling mud inlet and the first drilling mud outlet.

In an embodiment, the rotating subassembly comprises a second body, a third body and a fourth body. In an embodiment, the second body has a first end and a second end. In an embodiment, the third body has a first end and a second end. In an embodiment, the fourth body has a first end and a second end. In an embodiment, the first end of the second body is fluidly connected the second end of the first portion of the first body. In an embodiment, the second end of the second body is rotatably sealable against the first end of the third body. In an embodiment, the second end of the third body is rotatably sealable against the first end of the fourth body. In an embodiment, the second end of the fourth body is fluidly connected to a first end of the third portion of the first body.

In an embodiment, the pivot subassembly comprises a first shaft stud, a second shaft stud and a pivot shaft. In an embodiment, the first shaft stud and/or the second shaft stud are attached to the rotating subassembly through the second portion of the first body. In an embodiment, the pivot shaft is attached to first shaft stud or the second shaft stud.

In an embodiment, the pivot subassembly further comprises a pivot drive. In an embodiment, the pivot drive is attached to the pivot shaft.

In an embodiment, the drilling mud screen system further comprises a camming seal separator capable of separating a first seal and/or a second seal. In an embodiment, the camming seal separator comprises a face-roller camming mechanism or a push-rod camming mechanism.

In an embodiment, the camming seal separator comprises a first cam roller, a first cam bracket and a first cam track.

In an embodiment, the first roller bracket is attached to a first end of a second body of the rotating subassembly. In an embodiment, the first cam roller is attached to the first roller bracket.

In an embodiment, the first cam track is attached to a first end of a third body of the rotating subassembly. In an embodiment, the first cam track has a first recess portion to allow the second end of the second body of the rotating subassembly to close against the first end of the third body of the rotating subassembly.

In an embodiment, the camming seal separator further comprises a second cam roller, a second roller bracket and a second cam track.

In an embodiment, the second roller bracket is attached to the first end of a fourth body of the rotating subassembly. In an embodiment, the second cam roller is attached to the second roller bracket.

In an embodiment, the second cam track is attached to the second end of the third body of the rotating subassembly. In an embodiment, the second cam track has a second recessed portion to allow the second end of the third body of the rotating subassembly to close against the first end of the fourth body of the rotating subassembly.

In an embodiment, the camming seal separator comprises a first pivot pin, a first push rod, a first cam roller and a cam.

In an embodiment, the first pivot pin has a first end and a second end. In an embodiment, the first end of the first pivot pin is attached to the second body of the rotating subassembly through the first portion of the first body.

In an embodiment, the first push rod has a first end and a second end. In an embodiment, the first end of the first push rod is attached to the second end of the first pivot pin.

In an embodiment, the first cam roller is attached to the second end of the first push rod.

In an embodiment, the cam is attached to the pivot shaft. In an embodiment, the cam is sized and shaped such that the second end of the second body of the rotating subassembly closes against the first end of the third body of the rotating subassembly to form the first seal. In an embodiment, the cam is be sized and shaped such that the second end of the third body of the rotating subassembly closes against the first end of the fourth body of the rotating subassembly to form the second seal.

In an embodiment, the camming seal separator further comprises a second pivot pin, a second push rod, and a second cam roller.

In an embodiment, the second pivot pin has a first end and a second end. In an embodiment, the first end of the second pivot pin is attached to the third body of the rotating subassembly through the third portion of the first body.

In an embodiment, the second push rod has a first end and a second end. In an embodiment, the first end of the second push rod is attached to the second end of the second pivot pin.

In an embodiment, the second cam roller is attached to the second end of the second push rod.

In an embodiment, the camming seal separator further comprises a first guide block and a first spring.

In an embodiment, the first push rod is disposed through the first guide block.

In an embodiment, the first spring is disposed between the first push rod and the first guide block.

In an embodiment, the camming seal separator further comprises a second guide block and a second spring.

In an embodiment, the second push rod is disposed through the second guide block.

In an embodiment, the second spring is disposed between the second push rod and the second guide block.

In an embodiment, the first guide block and/or the second guide block are attached to the second portion of the first body.

In an embodiment, the drilling mud screen comprises a second body, a filter, a first end cap, a second drilling mud inlet and a second drilling mud outlet.

In an embodiment, the second body has a first end and a second end and a first centerline from the first end to the second end.

In an embodiment, the filter has a first end, a second end, and openings. In an embodiment, the first end of the filter is fluidly connected to the first end of the second body via a first connection and/or an optional first end retaining ring.

In an embodiment, the first end cap is fluidly connected at the second end of the filter via a second connection. In an embodiment, the filter has an optional retaining ring disposed between the first connection and the second connection.

In an embodiment, the second drilling mud inlet is at the first end of the second body.

In an embodiment, the second drilling mud outlet at the openings of the filter.

In an embodiment, one or more of the first body and the second body are constructed from AISI 4130/75k or equivalent material, AISI 4145 or equivalent, or combinations thereof. In an embodiment, one or more of the first body, and the second body are constructed from AISI 4130/75k or equivalent material, AISI 4145 or equivalent, or combinations thereof.

In an embodiment, the filter comprises a plurality of rods having a first end and a second end. In an embodiment, the rods are spaced a distance apart to form the openings in the filter. In an embodiment, the rods are tapered from the first end to the second end.

In an embodiment, the filter comprises a formed sheet having drilled holes or slots spaced a distance apart to form the openings in the filter. In an embodiment, the drilled holes or slots are drilled in offset rows or straight rows from the first end to the second end. In an embodiment, the filter is tapered from the second end to the first end.

In an embodiment, the first end cap is a flat plate or a flat plate with holes or slots.

In an embodiment, the first end cap is an inverted cone or an inverted cone with holes or slots.

In an embodiment, the first centerline of the second body and an outer surface of the first end cap forms a cap angle. In an embodiment, the cap angle is from about 30-degrees to about 90-degrees. In an embodiment, the cap angle is from about 35-degrees to about 45-degrees.

In an embodiment, the filter, the first end retaining ring and/or the retaining ring are constructed from AISI 4145 or equivalent, stainless steel or combinations thereof.

In an embodiment, the filter, the first end retaining ring and/or the retaining ring has a hardened coating. In an embodiment, one or more of the filter, the first end retaining ring and/or the retaining ring has a Carbide coating with about 6% Cobalt binder.

In an embodiment, the drilling mud screen system further comprises a transducer subassembly. In an embodiment, the transducer subassembly comprises a transducer body having a drilling mud inlet, a drilling mud outlet and a transducer access port, and a transducer.

In an embodiment, the transducer body has a first end, a second end and a first centerline from the first end to the second end.

In an embodiment, the drilling mud inlet is at the first end of the transducer body.

In an embodiment, the first drilling mud outlet is at the second end of the transducer body.

In an embodiment, the transducer access port has a second centerline forming a transducer angle with the first centerline and extending to the first centerline, wherein the transducer access port is offset from the first end of the transducer body. In an embodiment, the transducer angle is from about 20-degrees to about 120-degrees.

In an embodiment, the transducer is disposed within the transducer access port to close and seal the transducer access port.

In an embodiment, the drilling mud outlet of the transducer subassembly is fluidly connected to the first drilling mud inlet of the drilling mud screen system.

In an embodiment, the drilling mud outlet of the transducer subassembly is fluidly connected to the first drilling mud inlet of the drilling mud screen system via a cross-over connection.

In an embodiment, a trapdoor-style drilling mud screen system, comprises a first body having a first portion, a second portion and a third portion, a first drilling mud inlet at a first end of the first portion of the first body, a first drilling mud outlet at a second end of the third portion of the first body, a rotating trapdoor subassembly, wherein the rotating trapdoor subassembly is disposed within the second portion of the first body, wherein the first portion of the first body is fluidly connected to a first end of the rotating subassembly, and wherein a second end of the rotating subassembly is fluidly connected to the third portion of the first body, a pivot subassembly, wherein the pivot subassembly is disposed through the rotating trapdoor subassembly and through the second portion of the first body, and a drilling mud screen, wherein the drilling mud screen is disposed within the rotating trapdoor subassembly between the first drilling mud inlet and the first drilling mud outlet.

In an embodiment, the rotating trapdoor subassembly comprises a second body, wherein a first end of the second body is fluidly connected to a second end of the first portion of the first body and wherein a second end of the second body is fluidly connected to a first end of the third portion of the first body.

In an embodiment, the pivot subassembly comprises a pivot shaft, and a retaining ring, wherein the retaining ring retains the pivot shaft through the second portion of the first body.

In an embodiment, the first portion of the first body comprises a first piston.

In an embodiment, the drilling mud screen system further comprises a piston guide bar disposed through the first portion of the first body and into a portion of the first piston, wherein the piston guide bar guides a second end of the first piston to engage a first end of the rotating trapdoor subassembly when the rotating trapdoor subassembly is in a closed position.

In an embodiment, the drilling mud screen system further comprises a piston guide bar disposed through a first slot in the first portion of the first body or the second portion of the body, and into a second slot in the first piston, wherein the piston guide bar guides a second end of the first piston to engage a first end of the rotating trapdoor subassembly when the rotating trapdoor subassembly is in a closed position.

In an embodiment, the drilling mud screen system further comprises a piston guide bar disposed through the first portion of the first body of the second portion of the body, and into a portion of the first piston, wherein the piston guide bar locks a second end of the first piston to contact and seal a first end of the rotating trapdoor subassembly when the rotating trapdoor subassembly is in a closed position.

In an embodiment, the drilling mud screen system further comprises a piston guide bar disposed through a first slot in the first portion of the first body and into a second slot of the first piston, wherein the piston guide bar locks a second end of the first piston to contact and seal a first end of the rotating trapdoor subassembly when the rotating trapdoor subassembly is in a closed position.

In an embodiment, the drilling mud screen system further comprises a piston guide bar disposed through the first portion of the first body and into a portion of the first piston, wherein the piston guide bar guides a second end of the first piston to disengage from a first end of the rotating trapdoor subassembly when the rotating trapdoor subassembly is in an open position.

In an embodiment, the drilling mud screen system further comprises a piston guide bar disposed through the first portion of the first body and into a portion of the first piston, wherein the piston guide bar separates a second end of the first piston to disengage and create a gap from a first end of the rotating trapdoor subassembly when the rotating trapdoor subassembly is in the open position to avoid damage to a first seal face at the second end of the first piston and/or the second seal face at the first end of the rotating trapdoor subassembly In an embodiment, the piston guide bar further comprises a ball bearing for smooth operation.

In an embodiment, the drilling mud screen system further comprises a first spring, wherein the first spring is disposed between the first piston and a first subassembly, wherein the first subassembly comprises a second body having a first end and a second end, a second drilling mud inlet at the first end of the second body, and a second drilling mud outlet at the second end of the second body, wherein the second end of the second body is fluidly connected to the first end of the first portion of the first body.

In an embodiment, the second end of the first piston has a first seal face and wherein the first end of the rotating trapdoor subassembly has a second seal face.

In an embodiment, the third portion of the first body comprises a second piston.

In an embodiment, the drilling mud screen system of further comprises a second spring, wherein the second spring is disposed between the second piston and a second subassembly, wherein the second subassembly comprises a third body having a first end and a second end, a third drilling mud inlet at the first end of the third body, a third drilling mud outlet at the second end of the third body, wherein the second end of the third portion of the first body is fluidly connected to the first end of the third body.

In an embodiment, the second end of the rotating trapdoor subassembly has a third seal face and wherein the first end of the second piston has a fourth seal face.

In an embodiment, the drilling mud screen system further comprises a threaded lock ring, wherein the threaded lock ring is disposed around the first portion of the first body and the first end of the trapdoor subassembly.

In an embodiment, the drilling mud screen system further comprises a threaded lock ring, wherein the threaded lock ring is disposed around a first portion of the body and a first end of the rotating trapdoor subassembly to lock the trapdoor subassembly in a closed position.

In an embodiment, the threaded lock ring further comprises a handle.

In an embodiment, the drilling mud screen comprises a third body having a first end and a second end and a first centerline, a filter having a first end, a second end, and openings, wherein the first end of the filter is fluidly connected to the first end of the second body via a first connection and/or an optional first end retaining ring, an end cap fluidly connected at the second end of the filter via a second connection, wherein the filter has an optional retaining ring disposed between the first connection and the second connection, a second drilling mud inlet at the first end of the second body, and a second drilling mud outlet at the openings of the filter.

In an embodiment, the filter comprises a plurality of rods having a first end and a second end, wherein each of the plurality of rods are spaced a distance apart to form the openings in the filter. In an embodiment, each of the plurality of rods are tapered from the first end to the second end.

In an embodiment, the filter comprises a formed sheet having drilled holes or slots spaced a distance apart to form the openings in the filter. In an embodiment, the drilled holes or slots are drilled in offset rows or straight rows from the first end to the second end.

In an embodiment, the filter is tapered from the first end to the second end.

In an embodiment, the end cap is a flat plate or a flat plate with holes or slots.

In an embodiment, the end cap is an inverted cone or an inverted cone with holes or slots. In an embodiment, the first centerline of the second body and an outer surface of the end cap forms a cap angle, wherein the cap angle is from about 30-degrees to about 90-degrees. In an embodiment, the first centerline of the second body and an outer surface of the end cap forms a cap angle, wherein the cap angle is from about 35-degrees to about 45-degrees.

In an embodiment, the filter, the first end retaining ring and/or the retaining ring are constructed from AISI 4145 or equivalent, stainless steel or combinations thereof.

In an embodiment, the filter, the first end retaining ring and/or the retaining ring has a hardened coating. In an embodiment, one or more of the filter, the first end retaining ring and/or the retaining ring has a Carbide coating with about 6% Cobalt binder.

In an embodiment, one or more of the first body, the second body and the third body are constructed from AISI 4130/75k or equivalent material, AISI 4145 or equivalent, or combinations thereof.

In an embodiment, the drilling mud screen comprises a third body having a first end and a second end and a first centerline, a filter having a first end and a second end, and openings, wherein the second end of the filter is fluidly connected to the first end of the second body via a first connection and/or an optional second end retaining ring, an end cap fluidly connected at the first end of the filter via a second connection, wherein the filter has an optional retaining ring disposed between the first connection and the second connection, a second drilling mud inlet at the openings of the filter, and a second drilling mud outlet at the second end of the second body.

In an embodiment, the filter comprises a plurality of rods having a first end and a second end, wherein each of the plurality of rods are spaced a distance apart to form the openings in the filter. In an embodiment, each of the plurality of rods are tapered from the first end to the second end.

In an embodiment, the filter comprises a formed sheet having drilled holes or slots spaced a distance apart to form the openings in the filter. In an embodiment, the drilled holes or slots are drilled in offset rows or straight rows from the first end to the second end.

In an embodiment, the filter is tapered from the second end to the first end.

In an embodiment, the end cap is a flat plate or a flat plate with holes or slots.

In an embodiment, the end cap is a cone or a cone with holes or slots. In an embodiment, the first centerline of the second body and an outer surface of the end cap forms a cap angle, wherein the cap angle is from about 30-degrees to about 90-degrees. In an embodiment, the first centerline of the second body and an outer surface of the end cap forms a cap angle, wherein the cap angle is from about 35-degrees to about 45-degrees.

In an embodiment, the filter, the first end retaining ring and/or the retaining ring are constructed from AISI 4145 or equivalent, stainless steel or combinations thereof.

In an embodiment, the filter, the first end retaining ring and/or the retaining ring has a hardened coating. In an embodiment, one or more of the filter, the first end retaining ring and/or the retaining ring has a Carbide coating with about 6% Cobalt binder.

In an embodiment, one or more of the first body, the second body and the third body are constructed from AISI 4130/75k or equivalent material, AISI 4145 or equivalent, or combinations thereof.

In an embodiment, a method of installing a drilling mud screen system comprises (a) stopping a drilling mud pump to fluidly connect the valve-style drilling mud screen system as disclosed herein to the drilling mud pump, (b) fluidly connecting the drilling mud screen system in line with and immediately upstream or downstream of the drilling mud pump, and (c) operating the drilling mud pump to produce flow of drilling mud through the drilling mud screen system.

In an embodiment, step b) comprises fluidly connecting a drilling mud inlet of the drilling mud screen system to a high-pressure outlet of the drilling mud pump and fluidly connecting a drilling mud outlet of the drilling mud screen system to a vibrator hose or a standpipe.

In an embodiment, step b) comprises fluidly connecting a drilling mud inlet of the drilling mud screen system to a high-pressure inlet of the drilling mud pump and fluidly connecting a drilling mud outlet of the drilling mud screen system to an inlet of a vibrator hose.

In an embodiment, step b) comprises fluidly connecting a drilling mud inlet of the drilling mud screen system to an outlet of a vibrator hose and a drilling mud outlet to an inlet of a standpipe.

In an embodiment, step b) comprises fluidly connecting a drilling mud inlet of the drilling mud screen system to an outlet of a first portion of a standpipe and a drilling mud outlet of the drilling mud screen system to an inlet of a second portion of the standpipe.

In an embodiment, the method further comprises step d) filtering or screening debris from drilling mud.

In an embodiment, a method of removing and replacing a drilling mud screen comprises (a) stopping a drilling mud pump connected to the valve-style drilling mud screen system as disclosed herein, (b) rotating a rotating subassembly to open the drilling mud screen system, (c) installing a replacement drilling mud screen, (d) rotating the rotating subassembly to close and seal the drilling mud screen system, and (e) operating the drilling mud pump to produce flow of drilling mud through the drilling mud screen system.

In an embodiment, a method of installing a drilling mud screen system comprises (a) stopping a drilling mud pump, (b) fluidly connecting a first transducer subassembly, having a first transducer, in line with and downstream of the drilling mud pump and fluidly connecting the valve-style drilling mud screen system as disclosed herein in line with and immediately downstream of the first transducer subassembly and (c) operating the drilling mud pump to produce flow of drilling mud through the first transducer subassembly and the drilling mud screen system.

In an embodiment, the method further comprises step (d) monitoring the first transducer of the first transducer subassembly for property information immediately upstream of the drilling mud screen system. In an embodiment, the method further comprises step (e) using the property information to determine a status of the drilling mud screen system.

In an embodiment, step (b) comprises (b-1) fluidly connecting the first transducer subassembly, having the first transducer, in line with and downstream of the drilling mud pump and fluidly connecting the valve-style drilling mud screen system as disclosed herein in line with and immediately downstream of the first transducer subassembly, (b-2) fluidly connecting a gate valve in line with and immediately downstream of the drilling mud screen system, and (b-3)

fluidly connecting a second transducer subassembly, having a low torque plug valve, in line with and immediately downstream of the gate valve.

In an embodiment, step (c) comprises operating the drilling mud pump to produce flow of drilling mud through the first transducer subassembly, the drilling mud screen system, the gate valve and the second transducer subassembly.

In an embodiment, the method further comprises step (d) stopping the drilling mud pump, step (e) closing the gate valve to isolate the drilling mud screen system, and step (f) pumping cement through the low torque plug valve of the second transducer subassembly, a vibrator hose, a stand pipe, a top drive and a case running tool (CRT).

In an embodiment, a method of installing a trapdoor-style drilling mud screen system comprises a) stopping a drilling mud pump to fluidly connect the drilling mud screen system as disclosed herein to the drilling mud pump, b) fluidly connecting the drilling mud screen system in line with and immediately upstream or downstream of the drilling mud pump; and c) operating the drilling mud pump to produce flow of drilling mud through the drilling mud screen system.

In an embodiment, step b) comprises fluidly connecting a drilling mud inlet of the drilling mud screen system to a high-pressure outlet of the drilling mud pump and fluidly connecting a drilling mud outlet of the drilling mud screen system to a vibrator hose or a standpipe.

In an embodiment, step b) comprises fluidly connecting a drilling mud inlet of the drilling mud screen system to a high-pressure inlet of the drilling mud pump and fluidly connecting a drilling mud outlet of the drilling mud screen system to an inlet of a vibrator hose.

In an embodiment, step b) comprises fluidly connecting a drilling mud inlet of the drilling mud screen system to an outlet of a vibrator hose and a drilling mud outlet to an inlet of a standpipe.

In an embodiment, step b) comprises fluidly connecting a drilling mud inlet of the drilling mud screen system to an outlet of a first portion of a standpipe and a drilling mud outlet of the drilling mud screen system to an inlet of a second portion of the standpipe.

In an embodiment, the method further comprises step d) filtering or screening debris from drilling mud.

In an embodiment, a method of removing and replacing a drilling mud screen comprises a) stopping a drilling mud pump connected to the drilling mud screen system as disclosed herein, b) rotating a rotating trapdoor subassembly to open the drilling mud screen system, c) installing a replacement drilling mud screen, d) rotating the rotating trapdoor subassembly to close and seal the drilling mud screen system; and e) operating the drilling mud pump to produce flow of drilling mud through the drilling mud screen system.

In an embodiment, step b) comprises step b-1) removing a piston guide bar and/or a threaded lock ring and step b-2) rotating the rotating trapdoor subassembly to open the drilling mud screen system.

In an embodiment, step d) comprises step d-1) rotating the trapdoor subassembly to close the drilling mud screen system and step d-2) installing a piston guide bar and/or a threaded lock ring to seal the drilling mud screen system.

In an embodiment, step b) comprises step b-1) removing a piston guide bar and/or a threaded lock ring and step b-2) rotating the rotating trapdoor subassembly to open the drilling mud screen system, and step d) comprises step d-1) rotating the trapdoor subassembly to close the drilling mud screen system and step d-2) installing a piston guide bar and/or a threaded lock ring to seal the drilling mud screen system.

These and other objects, features and advantages will become apparent as reference is made to the following detailed description, preferred embodiments, and examples, given for the purpose of disclosure, and taken in conjunction with the accompanying drawings and appended claims.

BRIEF DESCRIPTION OF THE DRAWINGS

For a further understanding of the nature and objects of the present invention, reference should be made to the following detailed disclosure, taken in conjunction with the accompanying drawings, in which like parts are given like reference numerals, and wherein:

FIG. 38A illustrates a cross-sectional view of an exemplary trapdoor-style drilling mud screen system having a reversed drilling mud screen, showing the trapdoor-style drilling mud screen system in a closed position;

FIG. 38B illustrates a cross-sectional view of the exemplary trapdoor-style drilling mud screen system of FIG. 38A, showing the trapdoor-style drilling mud screen system in an open position

DETAILED DESCRIPTION OF EMBODIMENTS OF THE INVENTION

The following detailed description of various embodiments of the present invention references the accompanying drawings, which illustrate specific embodiments in which the invention can be practiced. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains. Therefore, the scope of the present invention is defined only by the appended claims, along with the full scope of equivalents to which such claims are entitled.

Exemplary Drilling Mud Screen System

Figure 1:
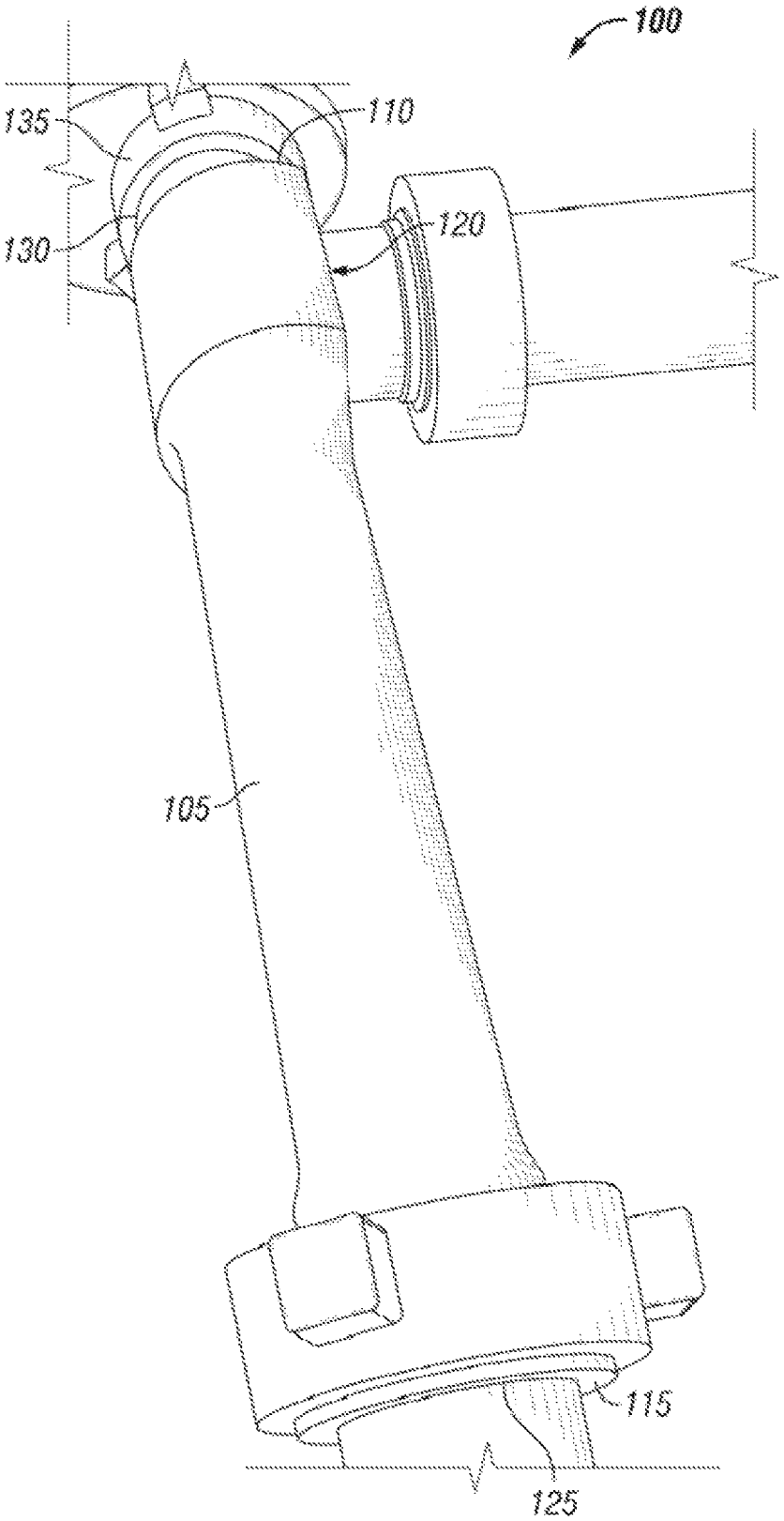
FIG. 1 illustrates a photograph of an exemplary drilling mud screen system according to an embodiment of the present invention, showing the system installed at an outlet of a drilling mud pump upstream of a drilling rig standpipe assembly.

FIG. 1 illustrates a photograph of an exemplary drilling mud screen system according to an embodiment of the present invention, showing the system installed at an outlet of a drilling mud pump upstream of a drilling rig standpipe assembly. As shown in FIG. 1, the drilling mud screen system 100 has a body 105 having a first end 110 and a second end 115, a drilling mud inlet 120 and a drilling mud outlet 125, and a drilling mud screen access port 130. In an embodiment, the drilling mud screen access port 130 may be closed with an end cap 135.

In an embodiment, a drilling mud inlet 120 of the drilling mud screen system 100 may be fluidly connected to a high-pressure outlet of a drilling mud pump via a connection. In an embodiment, a drilling mud outlet 125 of the drilling mud screen system 100 may be fluidly connected to an inlet of a vibrator hose to a standpipe via a connection.

Alternatively, the drilling mud screen system 100 may be installed between an outlet of the vibrator hose and an inlet of the standpipe, or at any point in the standpipe via a connection.

In an embodiment, the drilling mud inlet 120 may be fluidly connected to, for example, an outlet to a drilling mud pump via a connection; and the drilling mud outlet 125 may be fluidly connected to, for example, an inlet to a vibrator hose via a connection. Any suitable connection may be used for the drilling mud inlet and the drilling mud outlet. For example, suitable connections include, but are not limited to, pipe fittings and welds. Connections are well known in the art. In an embodiment, the drilling mud inlet 120 may be fluidly connected to, for example, an outlet to a drilling mud pump via a weld; and the drilling mud outlet 125 may be fluidly connected to, for example, an inlet to a vibrator hose via a weld.

Single-Piece Body

Figure 2:
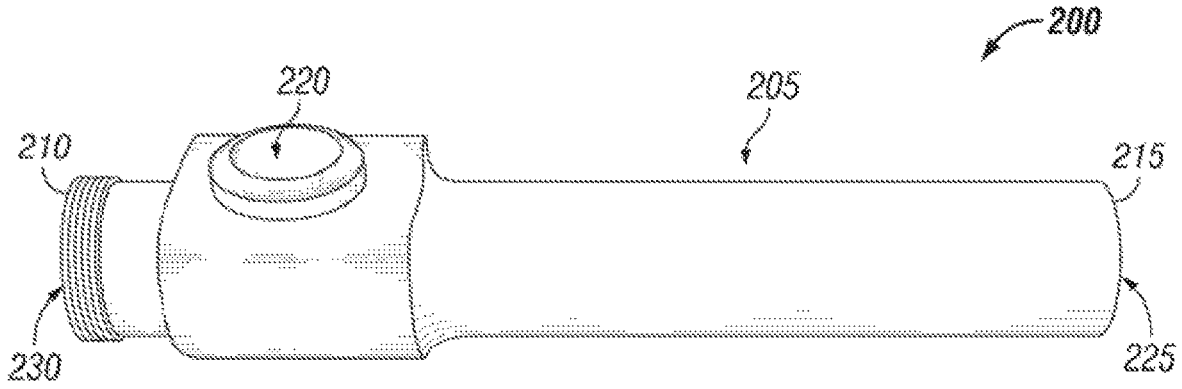
FIG. 2 illustrates a photograph of a single-piece body for the exemplary drilling mud screen system of FIG. 1, showing an unassembled view of a drilling mud inlet, a drilling mud outlet and a drilling mud screen access port.

FIG. 2 illustrates a photograph of a single-piece body for the exemplary drilling mud screen system of FIG. 1, showing an unassembled view of a drilling mud inlet 220, a drilling mud outlet 225, and a drilling mud screen access port 230. As shown in FIG. 2, the drilling mud screen system 200 has a body 205 having a first end 210 and a second end 215, an inlet 220 and an outlet 225, and a mud screen access port 230.

In an embodiment, the drilling mud inlet 220 may be fluidly connected to, for example, an outlet of a drilling mud pump via a connection; and the drilling mud outlet 225 may be fluidly connected to, for example, an inlet of a vibrator hose via a connection. Any suitable connection may be used for the drilling mud inlet 220 and the drilling mud outlet 225. For example, suitable connections include, but are not limited to, pipe fittings and welds. Connections are well known in the art. In an embodiment, the drilling mud inlet 220 may be fluidly connected to, for example, an outlet of a drilling mud pump via a weld; and the drilling mud outlet 225 may be fluidly connected to, for example, an inlet of a vibrator hose via a weld.

Figure 3A:
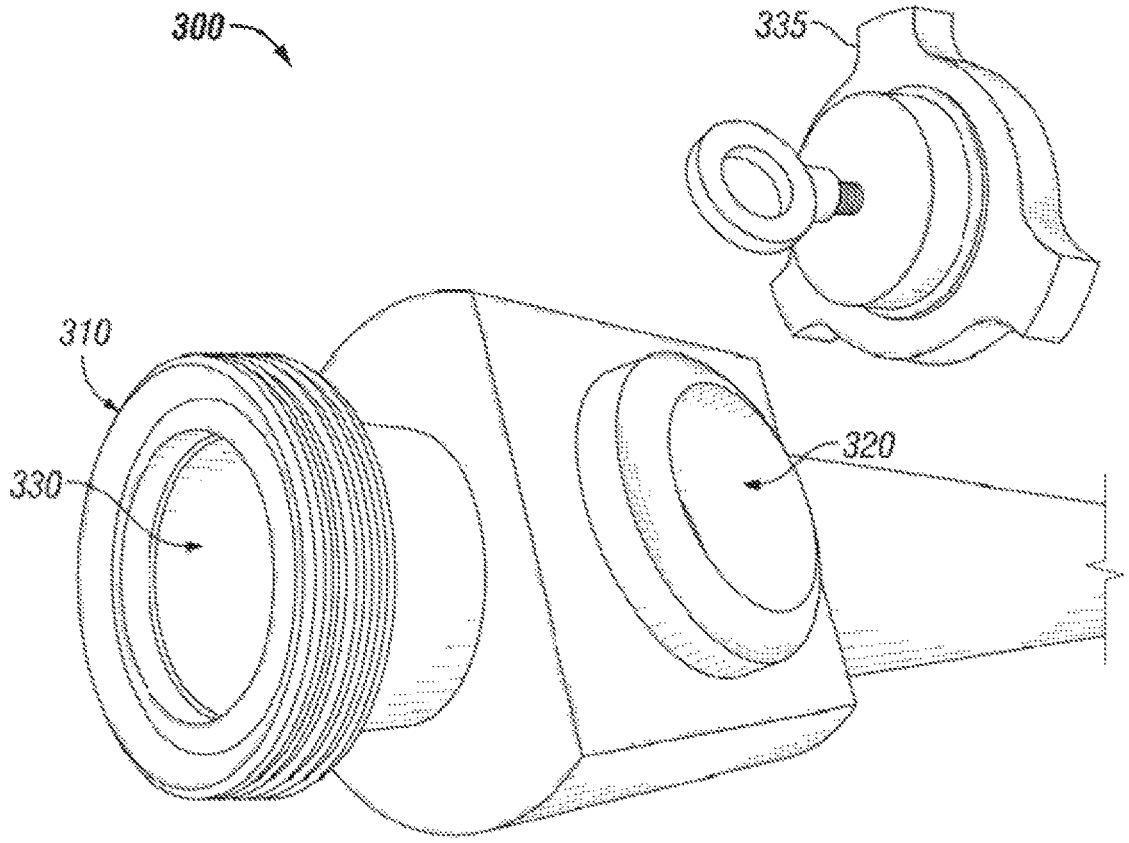
FIG. 3A illustrates a photograph of a single-piece body for the exemplary drilling mud screen system of FIG. 2, showing a detailed view of a drilling mud inlet and a drilling mud screen access port.

FIG. 3A illustrates a photograph of a single-piece body for the exemplary drilling mud screen system of FIG. 2, showing a detailed view of a drilling mud inlet 320 and a drilling mud screen access port 330. As shown in FIG. 3A, the drilling mud screen system 300 has a body 305 having a first end 310, an inlet 320, a drilling mud screen access port 330, and an end cap 335.

Figure 3B:
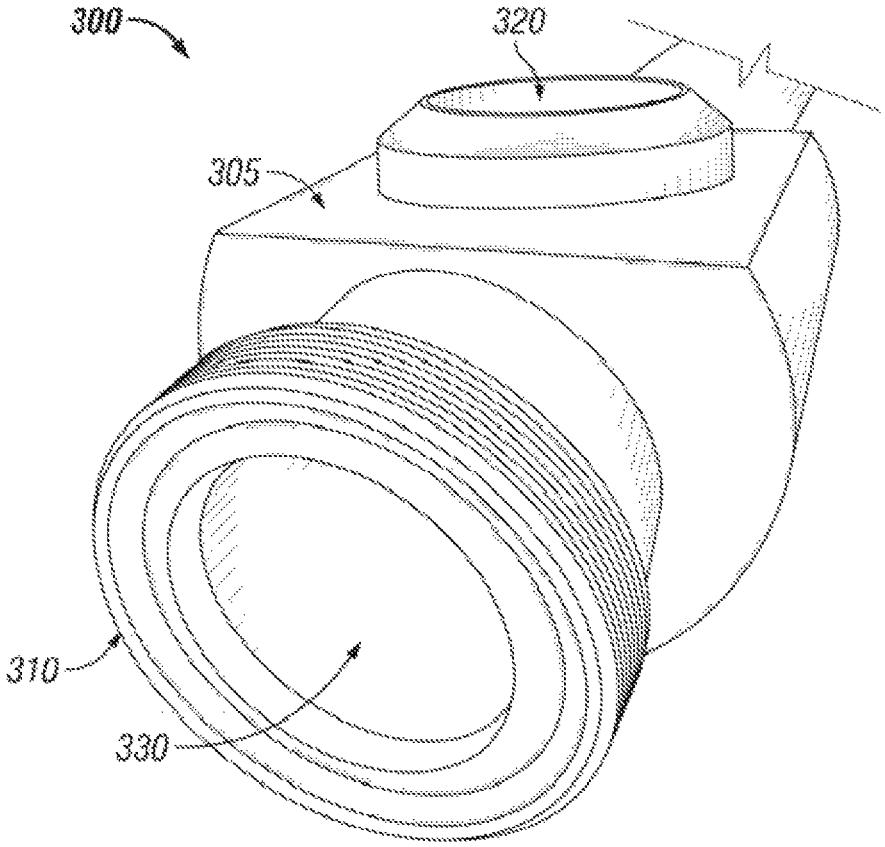
FIG. 3B illustrates a photograph of a single-piece body for the exemplary drilling mud screen system of FIG. 3A, showing a detailed view of the drilling mud screen access port.

FIG. 3B illustrates a photograph of the single-piece body of FIG. 3A, showing a detailed view of the drilling mud screen access port 330. As shown in FIG. 3B, the drilling mud screen system 300 has a body 305 having a first end 310, an inlet 320, and a drilling mud screen access port 330.

Figure 3C:
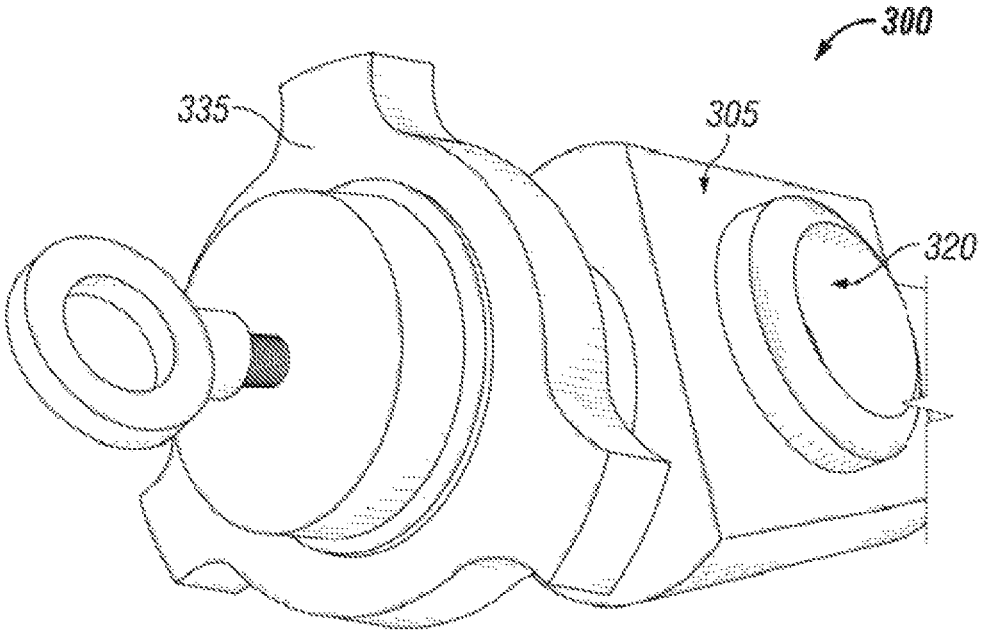
FIG. 3C illustrates a photograph of the single-piece body for the exemplary drilling mud screen system of FIG. 3A, showing an end cap installed in the drilling mud screen access port.

FIG. 3C illustrates a photograph of the single-piece body of FIG. 3A, showing an end cap 335 installed in a drilling mud screen access port 330. As shown in FIG. 3C, the drilling mud screen access port 330 of the drilling mud screen system 300 may be closed with an end cap 335 via a fitting. Any suitable fitting may be used. For example, suitable fittings include, but are not limited to, pipe fittings. Fittings are well known in the art.

In an embodiment, the drilling mud screen access port 330 of the drilling mud screen system 300 may be sealed with an end cap 335 via an O-ring. Any suitable O-ring may be used. For example, suitable O-rings include, but are not limited to, 300 Series O-rings. O-rings are well known in the art.

In an embodiment, the end cap 335 of the drilling mud screen system 300 may comprise a cap, an O-ring and a pipe collar. In an embodiment, the end cap 335 may be a five-inch 1002 WECO cap with an O-ring.

Figure 3D:
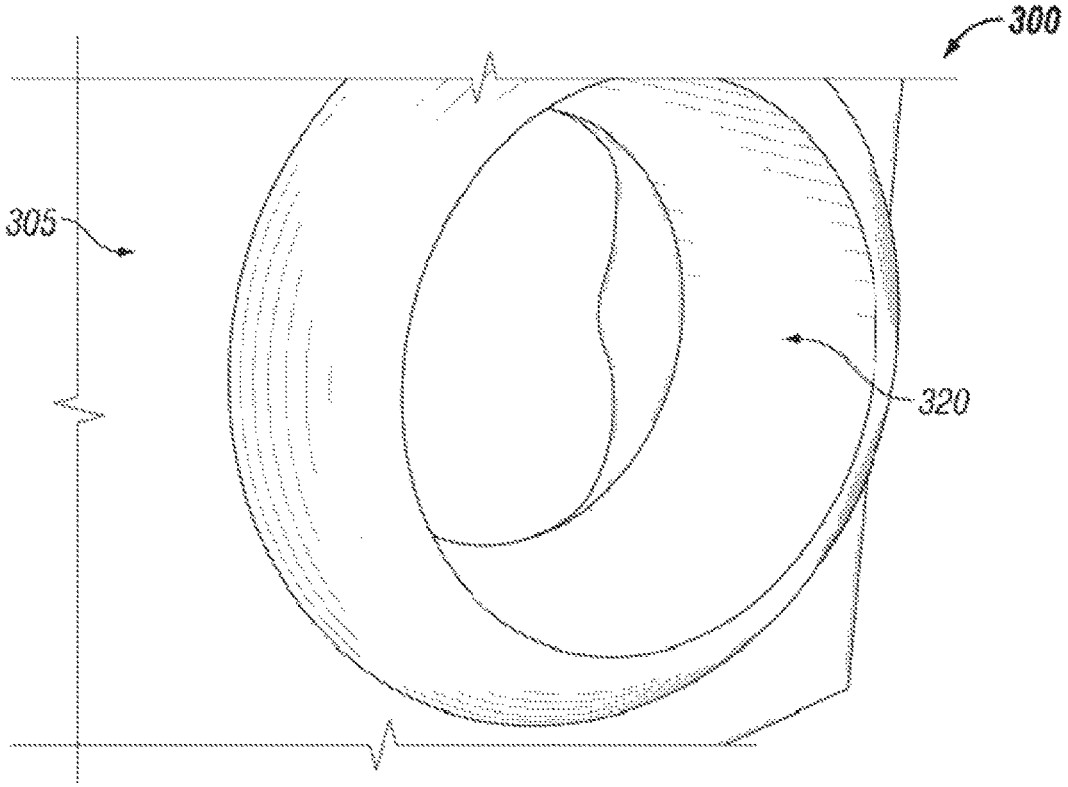
FIG. 3D illustrates a photograph of a single-piece body for the exemplary drilling mud screen system of FIGS. 3A-3C, showing a detailed view of the drilling mud inlet.
Figure 3E:
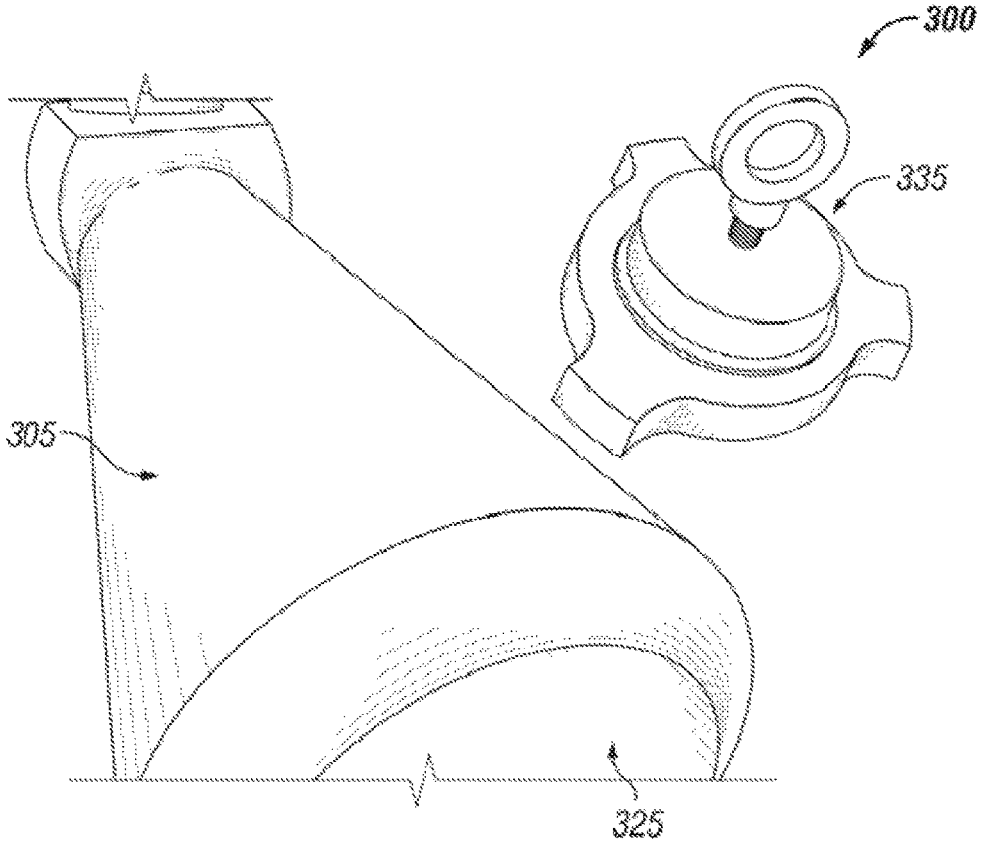
FIG. 3E illustrates a photograph of a single piece body of the exemplary drilling mud screen system of FIGS. 3A-3C, showing a detailed view of the drilling mud outlet.

FIG. 3D illustrates a photograph of a single-piece body of the exemplary drilling mud screen system of FIGS. 3A-3C, showing a detailed view of the drilling mud inlet 320; and FIG. 3E illustrates a photograph of a single-piece body of the exemplary drilling mud screen system of FIGS. 3A-3C, showing a detailed view of the drilling mud outlet 325.

In an embodiment, the drilling mud inlet 320 may be fluidly connected to, for example, an outlet of a drilling mud pump via a connection; and the drilling mud outlet 325 may be fluidly connected to an inlet of a vibrator hose via a connection. Any suitable connection may be used for the drilling mud inlet 320 and the drilling mud outlet 325. For example, suitable connections include, but are not limited to, pipe fittings and welds. Connections are well known in the art. In an embodiment, the drilling mud inlet 320 may be fluidly connected to, for example, an outlet of a drilling mud pump via a weld; and the drilling mud outlet 325 may be fluidly connected to an inlet of a vibrator hose via a weld.

Figure 4A:
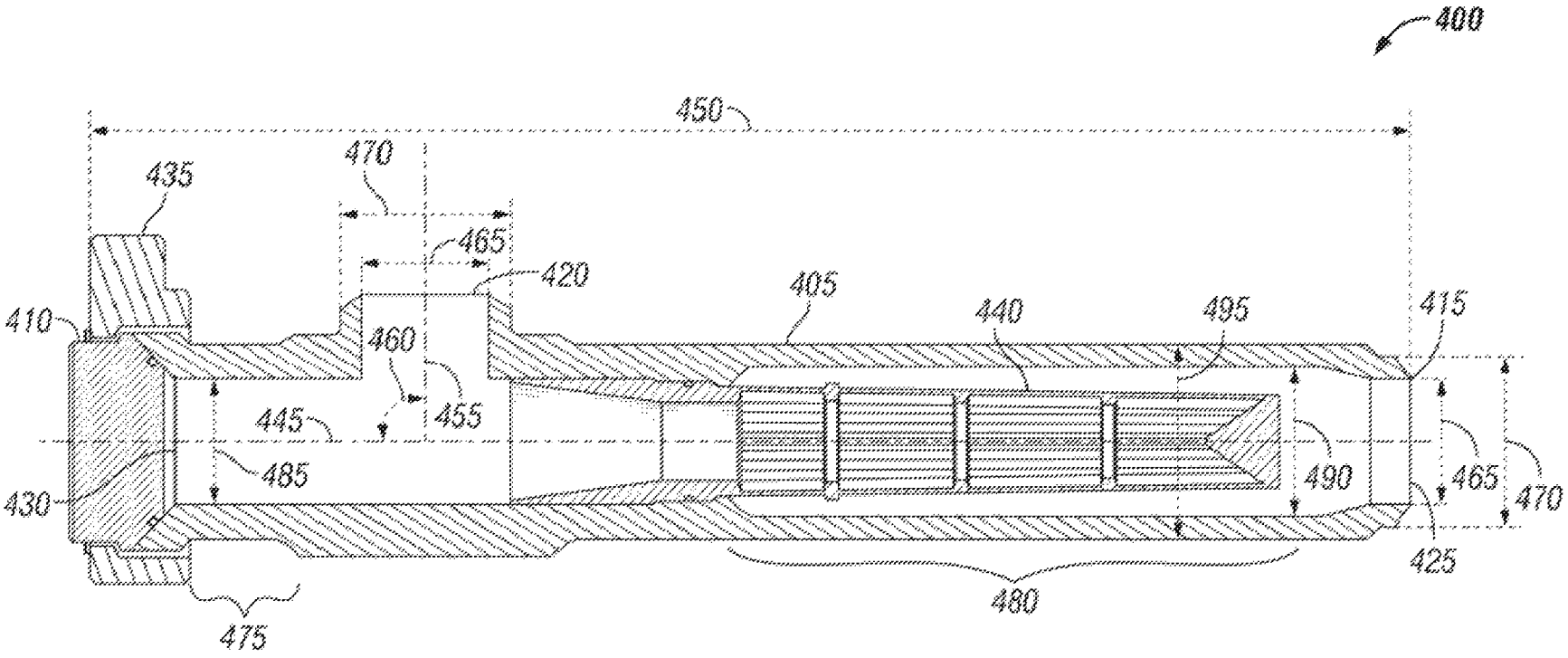
FIG. 4A illustrates an upper, cross-sectional view of an exemplary drilling mud screen system according to an embodiment of the present invention, showing a drilling mud screen.

FIG. 4A illustrates an upper, cross-sectional view of an exemplary drilling mud screen system according to an embodiment of the present invention, showing a drilling mud screen. As shown in FIG. 4A, the drilling mud screen system 400 has a body 405 having a first end 410 and a second end 415, a drilling mud inlet 420 and a drilling mud outlet 425, a drilling mud screen access port 430, an end cap 435 and a drilling mud screen 440.

Any suitable connection may be used for the drilling mud inlet 420 and the drilling mud outlet 425. For example, suitable connections include, but are not limited to, pipe fittings and welds. Connections are well known in the art.

In an embodiment, the body 405 of the drilling mud screen system 400 may be constructed of any suitable material. For example, suitable materials include, but are not limited to, any alloy steel suitable for a drilling mud application. In an embodiment, the body 405 may be constructed of an American Iron and Steel Industry (AISI) **4130/75*k* yield or equivalent material. See e.g., FIG. 2. In an embodiment, the inner surface of the body 405 may be unpainted. See e.g., FIGS. 1 & 3A-3E. In an embodiment, the outer surface of the body 405** may be painted. Id.

In an embodiment, the body 405 has a first centerline 445 and a length 450. In an embodiment, the first centerline 445 extends through the center of the drilling mud screen access port 430 to the drilling mud outlet 425. The length 450 of the body 405 may be any suitable length. In an embodiment, the length 450 of the body 405 may be from about 30-inches to about 50-inches, and any range or value there between. In an embodiment, the length 450 may be about 40-inches.

In an embodiment, the body 405 has a second centerline 455. In an embodiment, the second centerline 455 extends through the center of the drilling mud inlet 420 to the first centerline 445.

In an embodiment, the first centerline 445 and the second centerline 455 form a first angle 460. In an embodiment, the first angle 460 may be from about 30-degrees to about 120-degrees, and any range or value there between. In an embodiment, the first angle 460 may be about 45-degrees. In an embodiment, the first angle 460 may be about 90-degrees.

In an embodiment, the first drilling mud inlet 420 may be offset from a first end 410 of the body 405. The first drilling mud inlet 420 may be offset from a first end 410 of the body 405 at any suitable distance. In an embodiment, the second centerline 455 may be offset from the first end 410 of the body 405 from about 9-inches to about 13-inches, and any range or value there between. In an embodiment, the second centerline 455 may be offset from the first end 410 of the body 405 about 11-inches.

In an embodiment, the drilling mud inlet 420 may have any suitable inner diameter 465; and the drilling mud inlet 420 may have any suitable outer diameter 470. In an embodiment, the inner diameter 465 of the drilling mud inlet 420 may be from about 3-inches to about 5-inches, and any range or value there between. In an embodiment, the inner diameter 465 of the drilling mud inlet 420 may be about 4-inches.

In an embodiment, the outer diameter 470 of the drilling mud inlet 420 may be from about 4.5-inches to about 6.5-inches, and any range or value there between. In an embodiment, the outer diameter 470 of the drilling mud inlet 420 may be about 5.5-inches.

In an embodiment, the body 405 has a first portion 475 and a second portion 480. In an embodiment, the first portion 475 of the body 405 may have a first inner diameter 485 and an outer diameter 495; and the second portion 480 of the body 405 may have a second inner diameter 490 and an outer diameter 495.

In an embodiment, the first inner diameter 485 of the body 405 may be from about 3-inches to about 5-inches, and any range or value there between. In an embodiment, the first inner diameter 485 of the body 405 may be about 4-inches.

In an embodiment, the second inner diameter 490 of the body 405 may be from about 3-inches to about 5-inches, and any range or value there between. In an embodiment, the second inner diameter 490 of the body 405 may be about 4-inches.

In an embodiment, a second portion 480 of the body 405 may have a second inner diameter 490 to provide a high flow rate of drilling mud through the drilling mud screen 440. In an embodiment, the second inner diameter 490 of the body 405 may be from about 3.5-inches to about 5.5-inches, and any range or value there between. In an embodiment, the second inner diameter 490 of the body 405 may be from about 4.5-inches to about 5.5-inches, and any range or value there between.

In an embodiment, the outer diameter 495 of the first portion 475 and/or the second portion 480 of the body 405 may be from about 5.5-inches to about 7.5-inches, and any range or value there between. In an embodiment, the outer diameter 495 of the first portion 475 and/or the second portion 480 of the body 405 may be about 6.5-inches.

In an embodiment, the drilling mud outlet 425 may have any suitable inner diameter 465; and the drilling mud outlet 425 may have any suitable outer diameter 470. In an embodiment, the inner diameter 465 of the drilling mud outlet 425 may be from about 3-inches to about 5-inches, and any range or value there between. In an embodiment, the inner diameter 465 of the drilling mud outlet 425 may be about 4-inches.

In an embodiment, the outer diameter 470 of the drilling mud outlet 425 may be from about 4.5-inches to about 6.5-inches, and any range or value there between. In an embodiment, the outer diameter 470 of the drilling mud outlet 425 may be about 5.5-inches.

Figure 4B:
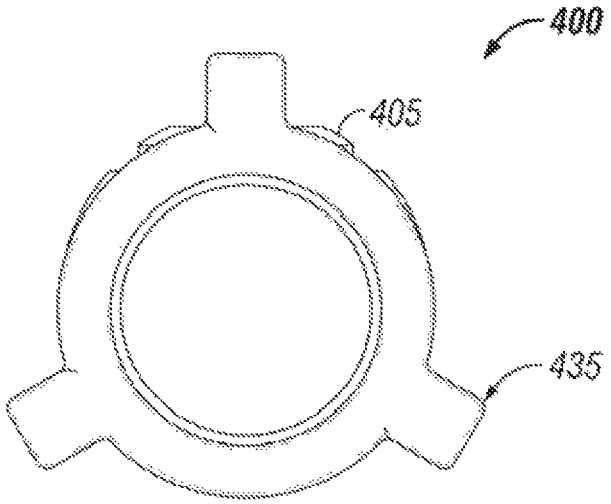
FIG. 4B illustrates a detailed view of A-A of FIG. 4A, showing an end cap installed.
Figure 4C:
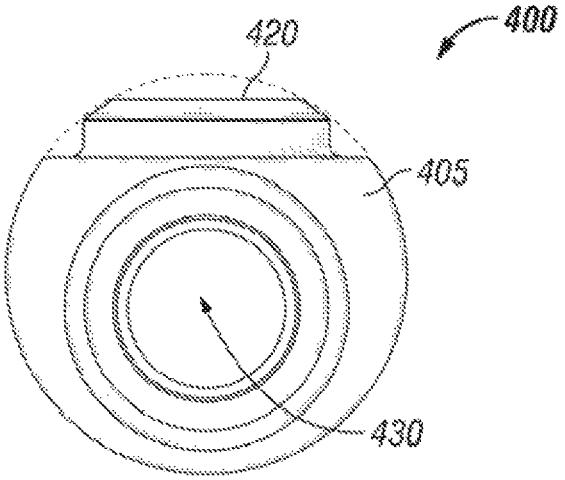
FIG. 4C illustrates a detailed view of A-A of FIGS. 4A-4B, showing the end cap removed.

FIG. 4B illustrates a detailed view of A-A of FIG. 4A, showing an end cap 435 installed; and FIG. 4C illustrates a detailed view of A-A of FIGS. 4A-4B, showing the end cap 435 removed.

Drilling Mud Screen

The drilling mud screen 500 may be any suitable filter or screen capable of filtering or screening debris from drilling muds. For example, suitable drilling mud screens include, but are not limited to, drill screens and rod screens.

Figure 5A:
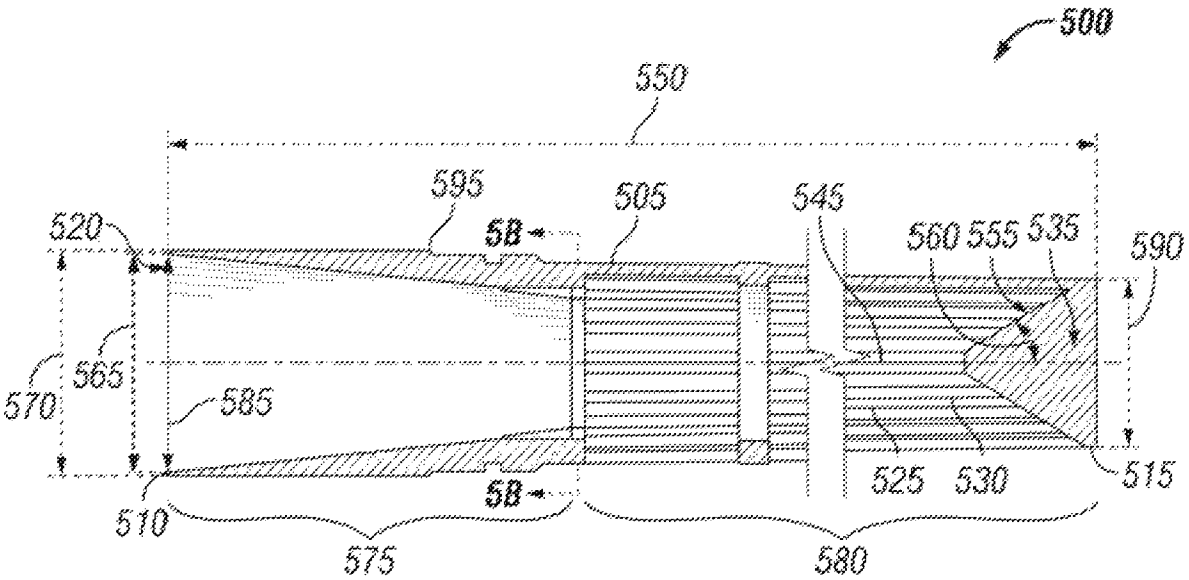
FIG. 5A illustrates an upper, cross-sectional view of a drilling mud screen according to an embodiment of the present invention, showing a filter and an end cap.

FIG. 5A illustrates an upper, cross-sectional view of a drilling mud screen 500 according to an embodiment of the present invention, showing a filter 530 and an end cap 535. As shown in FIG. 5A, the drilling mud screen 500 has a body 505 having a first end 510 and a second end 515, a drilling mud inlet 520, a drilling mud outlet 525, a filter 530 and an end cap 535.

In an embodiment, the drilling mud inlet 520 may be fluidly connected to, for example, an outlet of a drilling mud pump via a connection; and the drilling mud outlet 525 may be fluidly connected to an inlet of a vibrator hose via a connection. Any suitable connection may be used for the drilling mud inlet 520 and the drilling mud outlet 525. For example, suitable connections include, but are not limited to, pipe fittings and welds. Connections are well known in the art. In an embodiment, the drilling mud inlet 520 may be fluidly connected to, for example, an outlet of a drilling mud pump via a weld; and the drilling mud outlet 525 may be fluidly connected to an inlet of a vibrator hose via a weld.

In an embodiment, the body 505 of the drilling mud screen 500 may be constructed of any suitable material. For example, suitable materials include, but are not limited to, any alloy steel or tool steel. In an embodiment, the body 505 may be constructed of an AISI 4145 or equivalent material. See e.g., FIGS. 5A-5E. In an embodiment, the body 505 may be constructed of tool steel or equivalent material.

In an embodiment, the body 505 of the drilling mud screen 500 may have a hardened coating to reduce washing (i.e., erosion) of the screen 500. For example, suitable hardened coatings include, but are not limited to, any Carbide coating or equivalent. In an embodiment, the body 505 may have a Carbide coating with about 6% Cobalt binder or equivalent material.

In an embodiment, the body 505 of the drilling mud screen 500 has a centerline 545 and a length 550. In an embodiment, the centerline 545 extends through the center of the drilling mud screen inlet 520 to the end cap 535. The length 550 of the body 505 may be any suitable length. In an embodiment, the length 550 of the body 505 may be from about 20-inches to about 30-inches, and any range or value there between. In an embodiment, the length 550 may be about 25-inches.

In an embodiment, the drilling mud inlet 520 of the drilling mud screen 500 may have any suitable inner diameter 565; and the drilling mud inlet 520 may have any suitable outer diameter 570. In an embodiment, the inner diameter 565 of the drilling mud inlet 520 may be from about 3-inches to about 5-inches, and any range or value there between. In an embodiment, the inner diameter 565 of the drilling mud inlet 520 may be about 3.9-inches.

In an embodiment, the outer diameter 570 of the drilling mud inlet 520 may be from about 4-inches to about 6-inches, and any range or value there between. In an embodiment, the outer diameter 570 of the drilling mud inlet 520 may be about 4-inches.

In an embodiment, the body 505 of the drilling mud screen 500 has a first portion 575 and a second portion 580. In an embodiment, the first portion 575 of the body 505 has a first length; and the second portion 580 of the body 505 has a second length. The first portion 575 and the second portion 580 may be any suitable length. In an embodiment, the first portion 575 may have a first length from about 6-inches to about 10-inches; and the second portion 580 may have a second length from about 14-inches to about 20-inches, and any range or value there between. In an embodiment, the first portion 575 may have a first length of about 7.5-inches; and the second portion 580 may have a second length of about 17.5-inches.

In an embodiment, a second portion 580 of the body 505 of the drilling mud screen 500 may have a filter 530. In an embodiment, the filter 530 may comprise a plurality of rods spaced a distance apart to form a filter. In an embodiment, the distance may be less than a particle size (e.g., diameter) desired to be filtered from the drilling mud. Particle filtration is well known in the art.

In an embodiment, the filter 530 may comprise a formed sheet having drilled holes spaced a distance apart to form a filter. In an embodiment, the size of the holes (e.g., diameter) may be less than a particle size (e.g., diameter) desired to be filtered. Particle filtration is well known in the art.

In an embodiment, a second portion 580 of the body 505 of the drilling mud screen 500 may have a drilling mud outlet 525. In an embodiment, the drilling mud outlet 525 may comprise a plurality of spaces (i.e., flow passages) between a plurality of rods. In an embodiment, the drilling mud outlet 525 may comprise a plurality of holes (i.e., flow passages) drilled in a formed sheet.

In an embodiment, a first end 510 of a first portion 575 of the body 505 of the drilling mud screen 500 may have a first inner diameter 585; and a second end 515 of a second portion 580 of the body 505 may have a second inner diameter 590.

In an embodiment, the first end 510 of the first portion 575 may be shaped to accept a puller/installer plate 975 of a drilling mud screen puller/installer tool 800, 900, as discussed below. See e.g., FIGS. 5A, 8A & 9A.

In an embodiment, the body 505 and/or a filter 530 of the drilling mud screen 500 may have a tapered drilling mud flow path from a larger inner diameter (ID) to a smaller ID to reduce washing (i.e., erosion) of the screen 500.

In an embodiment, the first inner diameter 585 of the first end 510 of the body 505 of the drilling mud screen 500 may be from about 3-inches to about 5-inches, and any range or value there between. In an embodiment, the first inner diameter 585 of the first end 510 of the body 505 may be about 3.9-inches.

Figure 5B:
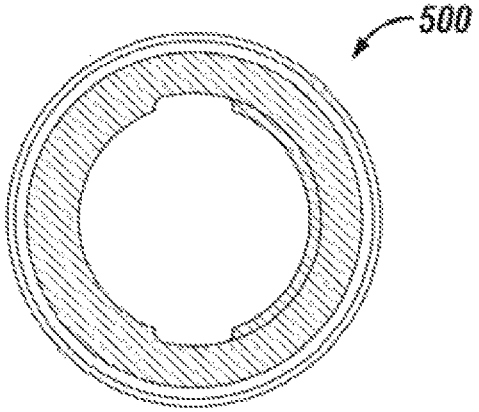
FIG. 5B illustrates a detailed view of A-A of FIG. 5A, showing an inlet of a second portion of a body and an outlet of the first portion of the body.

FIG. 5B illustrates a detailed view of A-A of FIG. 5A, showing an outlet of a first portion 575 of the body 505 and an inlet of the second portion 580 of the body 505. In an embodiment, an inner diameter of an outlet of the first portion 575 and an inlet of the second portion 590 of the body 505 may be from about 2-inches to about 3-inches, and any range or value there between. In an embodiment, the inner diameter of the outlet of the first portion 575 of the body 505 and the inlet of the second portion 590 of the body 505 may be about 2.5-inches.

Figure 12A:
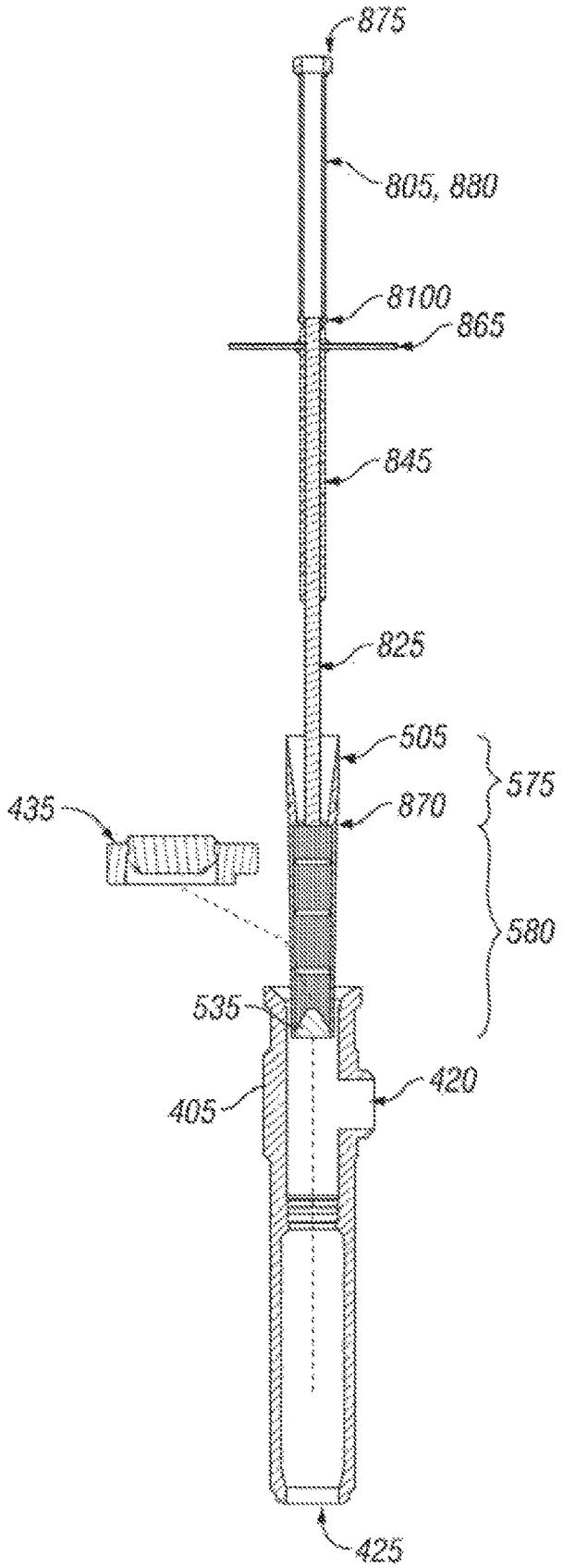
FIG. 12A illustrates a cross-sectional view of the exemplary drilling mud tool of FIG. 8A pulling the drilling mud screen of FIG. 5 from the exemplary drilling mud screen system of FIG. 4.
Figure 12B:
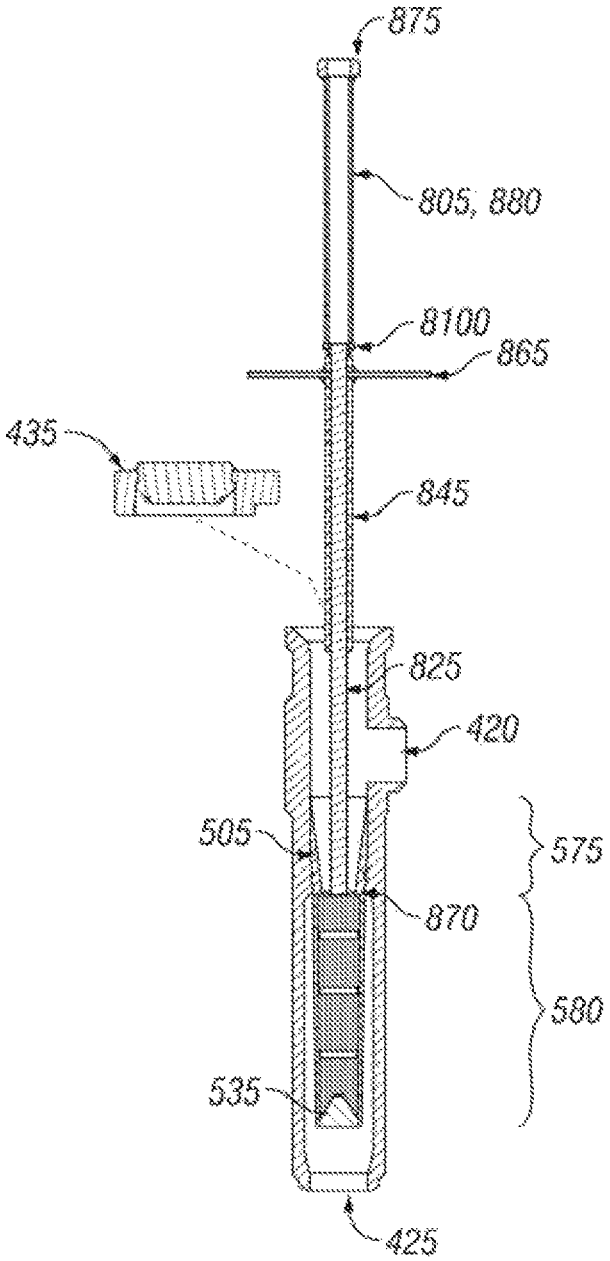
FIG. 12B illustrates a cross-sectional view of the exemplary drilling mud tool of FIG. 8A installing the drilling mud screen of FIG. 5 into the exemplary drilling mud screen system of FIG. 4.
Figure 13A:
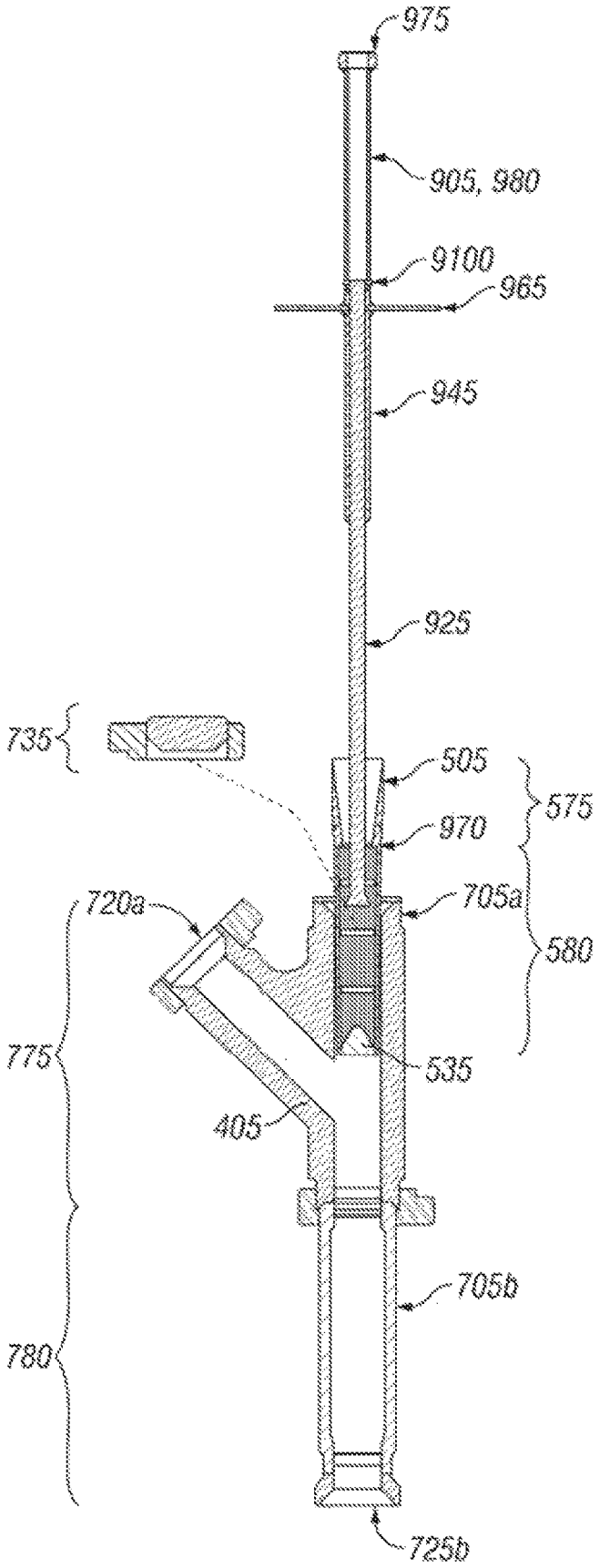
FIG. 13A illustrates a cross-sectional view of the exemplary drilling mud tool of FIG. 9A pulling the drilling mud screen of FIG. 5 from the exemplary drilling mud screen system of FIG. 7A.
Figure 13B:
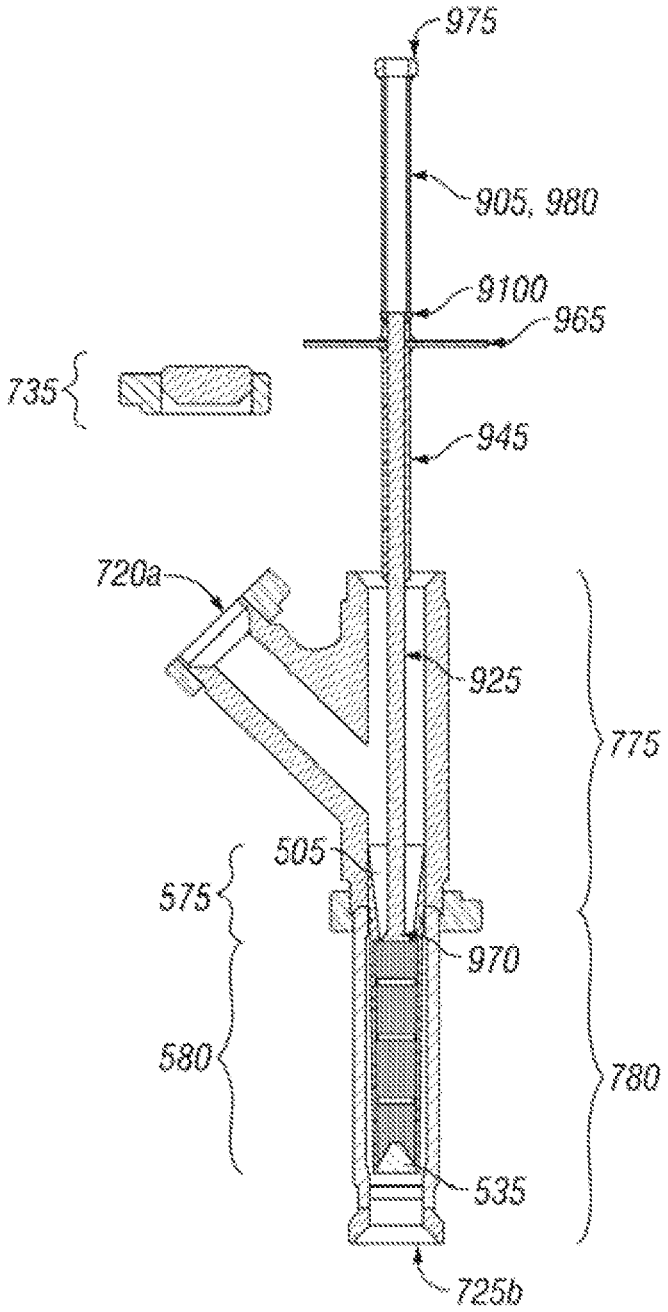
FIG. 13B illustrates a cross-sectional view of the exemplary drilling mud tool of FIG. 9A installing the drilling mud screen of FIG. 5 into the exemplary drilling mud screen system of FIG. 7A.

In an embodiment, the outlet of the first portion 575 and/or the inlet of the second portion 590 of the body 505 may be shaped to accept a rounded end 875, 975 of a drilling mud screen puller/installer tool 800, 900. See e.g., FIGS. 5B, 8B & 9B. See also FIGS. 12B & 13B. In an embodiment, the inlet of the second portion 590 of the body 505 may have an inner shoulder to provide a pushing surface for the rounded end 875, 975 of the drilling mud screen puller/installer tool 800, 900. Id.

In an embodiment, the outlet of the first portion 575 and/or the inlet of the second portion 580 of the body 505 may have a means to engage 540 a drilling mud screen puller/installer tool 800, 900, as discussed below. See e.g., FIGS. 5A, 8A & 9A. The means to engage 540 may be any suitable means to accept, and provide a pulling surface for, the drilling mud screen puller/installer tool 800, 900. For example, a suitable means to engage 540 includes, but is not limited to, a "key" opening to rotationally engage an inner shoulder. In an embodiment, the outlet of the first portion 575 and/or the inlet of the second portion 590 of the body 505 may be shaped to accept a puller/installer plate 870, 970 of a drilling mud screen puller/installer tool 800, 900. See e.g., FIGS. 5B, 8B & 9B. See also FIGS. 12A, 13A & 29. In an embodiment, the inlet of the second portion 590 of the body 505 may have an inner shoulder to provide a pulling surface for the puller/installer plate 870, 970 of the drilling mud screen puller/installer tool 800, 900. Id.

In an embodiment, the second inner diameter 590 of the second end 515 of the body 505 of the drilling mud screen 500 may be from about 2-inches to about 3-inches, and any range or value there between. In an embodiment, the second inner diameter 590 of the second end 515 of the body 505 may be about 2.3-inches.

In an embodiment, the outer surface 595 of the first portion 575 of the body 505 of the drilling mud screen 500 may be adapted to engage one or more shoulders in an inner surface of the body 505. In an embodiment, a first shoulder and a second shoulder of the body 505 may be offset from a first end 510 of the body 505. Cf. FIGS. 4A & 5A. The first and second shoulders may be offset from the first end 510 of the body 505 at any suitable distance. In an embodiment, the first shoulder may be offset from the first end 510 of the body 505 from about 4-inches to about 8-inches; and the second shoulder may be offset from the first end 510 of the body 505 from about 5-inches to about 9-inches, and any range or value there between. In an embodiment, the first shoulder may be offset from the first end 510 of the body 505 about 4.8-inches; and the second shoulder may be offset from the first end 510 of the body 505 about 6.8-inches.

In an embodiment, the outer surface 595 of the body 505 of the drilling mud screen 500 may be sealed against an inner surface of the body 505 via an O-ring. Cf. FIGS. 4A & 5A. Any suitable O-ring may be used. For example, suitable O-rings include, but are not limited to, 300 Series O-rings. O-rings are well known in the art.

Figure 5C:
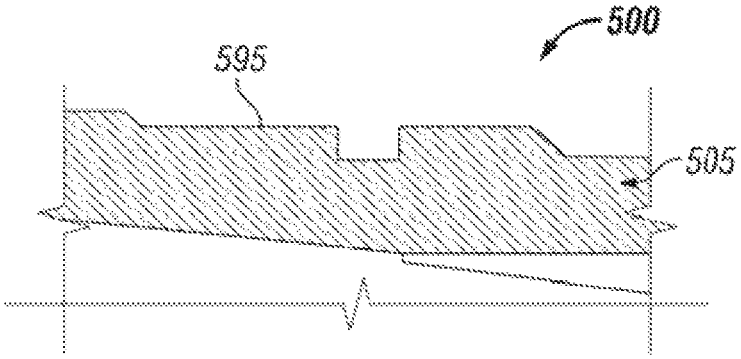
FIG. 5C illustrates a detailed view of B of FIG. 5A, showing a detailed view of a groove for an O-ring.
Figure 5D:
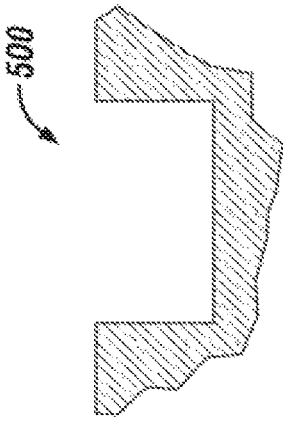
FIG. 5D illustrates a detailed view of C of FIG. 5A, showing an enlarged detailed view of the groove for an O-ring.

FIG. 5C illustrates a detailed view of B of FIG. 5A; and FIG. 5D illustrates a detailed view of C of FIG. 5A, both showing detailed views of a groove for an O-ring. In an embodiment, a groove for an O-ring may be offset from a first end 510 of the body 505 of the drilling mud screen 500. The groove for the O-ring may be offset from the first end 510 of the body 505 at any suitable distance. In an embodiment, the groove for the O-ring may be offset from the first end 510 of the body 505 from about 4-inches to about 8-inches, and any range or value there between. In an embodiment, the groove for the O-ring may be offset from the first end 510 of the body 505 about 5.7-inches.

In an embodiment, the filter 530 may have a plurality of rods spaced a distance apart to form a filter, or, alternatively, a formed sheet having drilled holes spaced a distance apart to form a filter. In an embodiment, the plurality of rods may be tapered from a larger outer diameter (OD) to a smaller OD to encourage drilling mud flow to exit in straight lines through the drilling mud outlet 525 (i.e., through flow passages between the plurality rods) to reduce washing (i.e., erosion) of the screen 500. In an embodiment, the filter 530 may have a plurality of straight rows of holes drilled in a formed sheet to encourage drilling mud flow to exit in straight rows of strings through the drilling mud outlet 525 (i.e., through straight flow passages of the drilled holes) to reduce washing (i.e., erosion) of the screen 500.

In an embodiment, a first end of a filter 530 may be connected to a second end 515 of the body 505 via a connection; and a second end of a filter 530 may be connected to a first end of the end cap 535 via a connection. Any suitable connection may be used for the drilling mud inlet 530. For example, suitable connections include, but are not limited to, welds. Connections are well known in the art. In an embodiment, the first end of the filter 530 may be connected to the second end 515 of the body 505 via a weld; and the second end of the filter 530 may be connected to the first end of the end cap 535 via a weld.

In an embodiment, the first end of the filter 530 may fit into a first recess in the second end 515 of the body 505; and the second end of the filter may fit into a second recess in the first end of the end cap 535. In an embodiment, the first recess and the second recess may be a plurality of recessed holes or a recessed groove. In an embodiment, the first recess and the second recess may be a plurality of recessed holes.

In an embodiment, the filter 530 may be held together with a retaining ring. In an embodiment, the retaining ring may have a plurality of holes to hold the plurality of rods to form the filter 530. In an embodiment, the plurality of rods may be connected to the plurality of holes in the retainer ring via a connection. Any suitable connection may be used for the drilling mud inlet 530. For example, suitable connections include, but are not limited to, welds. Connections are well known in the art. In an embodiment, the plurality of rods may be connected to the plurality of holes in the retainer ring via a weld.

In an embodiment, the filter 530, including any retaining rings, of the drilling mud screen 500 may be constructed of any suitable material. For example, suitable materials include, but are not limited to, any alloy steel. In an embodiment, the filter 530 may be constructed of 304 stainless steel material. See e.g., FIGS. 5A & 5E. In an embodiment, the filter 530 may have a hardened coating to reduce washing (i.e., erosion) of the screen 500.

In an embodiment, the end cap 535 of the drilling mud screen 500 has an inner surface 555. In an embodiment, the inner surface 555 of the end cap 535 of the drilling mud screen 500 may redirect the flow to reduce washing (i.e., erosion) of the screen 500. In an embodiment, the inner surface 555 of the end cap 535 of the drilling mud screen 500 forms an inverted cone relative to the second end 515 of the body 505 of the drilling mud screen 500 to redirect the flow. In an embodiment, the tip of the inverted cone may have a rounded or squared shape.

In an embodiment, the body 505 of the drilling mud screen 500 has a centerline 545 and a length 550. In an embodiment, the centerline 545 extends through the center of the drilling mud screen inlet 520 to the end cap 535. In an embodiment, the centerline 545 of the body 505 of the drilling mud screen 500 and the inner surface 555 of the end cap 535 form an angle 560. In an embodiment, the angle 560 may be from about 30-degrees to about 60-degrees, and any range or value there between. In an embodiment, the first angle 560 may be from about 35-degrees to about 45-degrees, and any range or value there between.

In an embodiment, the end cap 535 of the drilling mud screen 500 may be constructed of any suitable material. For example, suitable materials include, but are not limited to, any alloy steel. In an embodiment, the end cap 535 may be constructed of 304 stainless steel material. See e.g., FIGS. 5A & 5E. In an embodiment, the end cap 535 of the drilling mud screen 500 may have a hardened coating to reduce washing (i.e., erosion) of the screen 500. For example, suitable hardened coatings include, but are not limited to, any Carbide coating or equivalent. In an embodiment, the end cap 535 may have a Carbide coating with about 6% Cobalt binder or equivalent material.

Figure 5E:
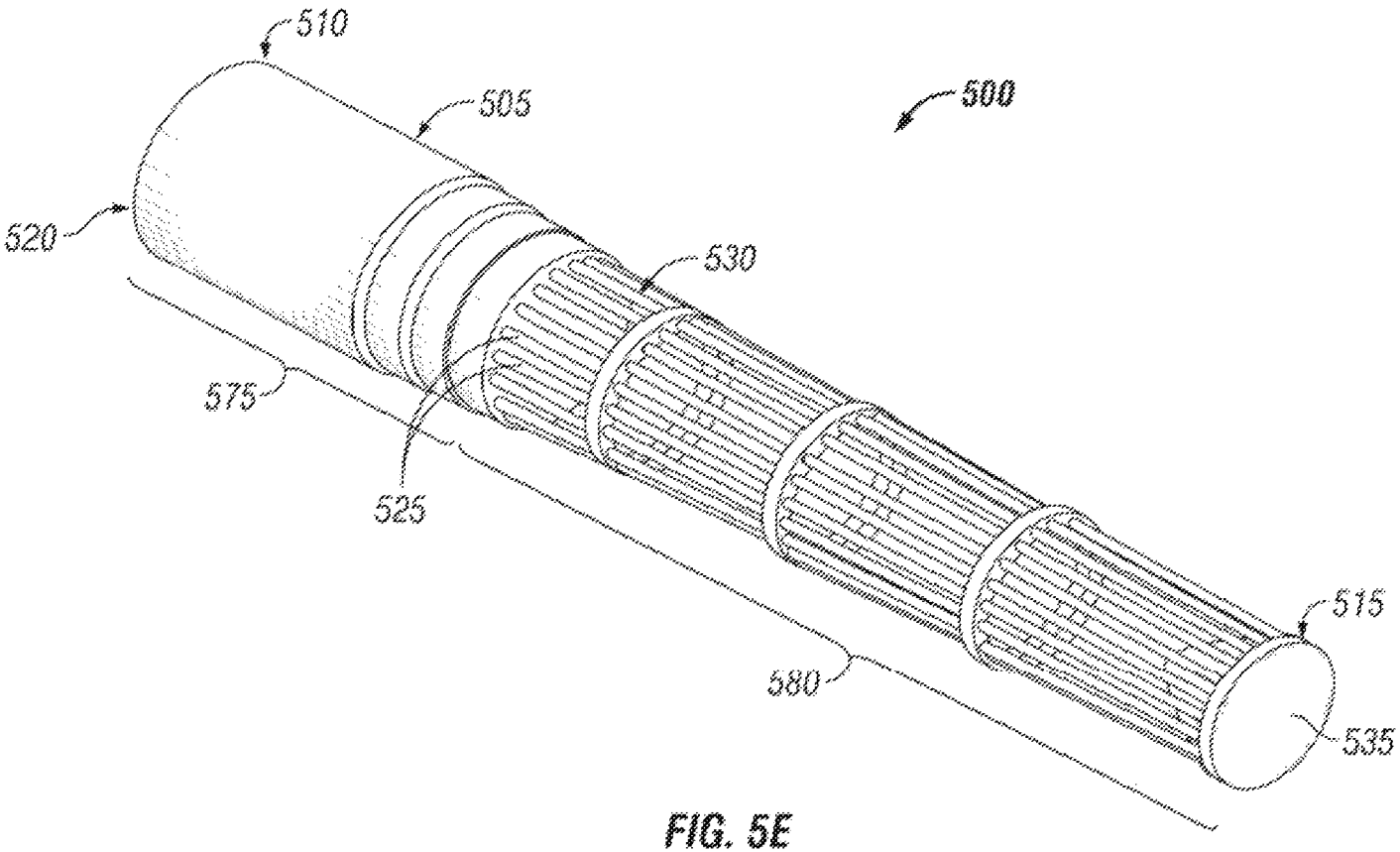
FIG. 5E illustrates an upper, right perspective view of the drilling mud screen of FIG. 5A.

FIG. 5E illustrates an upper, right side perspective view of the drilling mud screen 500 of FIG. 5A. As shown in FIG. 5E, the drilling mud screen 500 has a body 505 having a first end 510 and a second end 515, a drilling mud inlet 520, a drilling mud outlet 525, a filter 530 and an end cap 535. In an embodiment, the body 505 of the drilling mud screen 500 has a first portion 575 and a second portion 580.

Optional Plug for One-Piece Body

As discussed above, the one-piece body 405 for the exemplary drilling mud screen system of FIGS. 1-4 has a drilling mud flow passage from the drilling mud inlet 420 (through the drilling mud inlet 520 of the drilling mud screen 440, through the drilling mud outlet 525 of the drilling mud screen 440) and to the drilling mud outlet 425. See FIGS. 4A & 5.

The one-piece body 405, however, also has a drilling mud flow passage into a void between the drilling mud inlet 420 the mud screen access port 430. Id.

Figure 14:
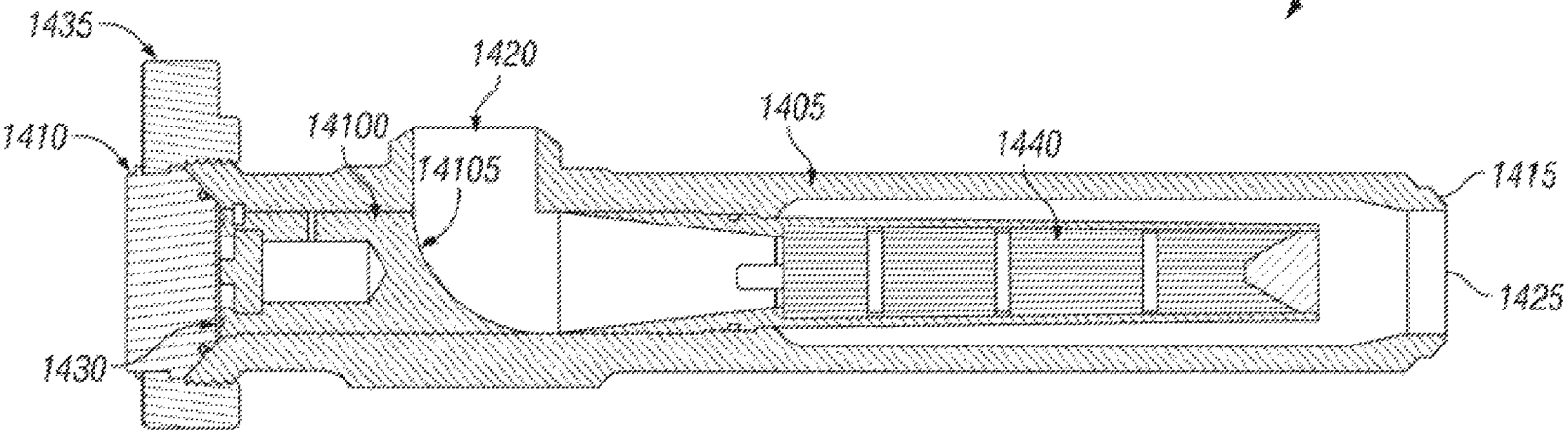
FIG. 14 illustrates a cross-sectional view of the exemplary drilling mud screen of FIG. 4, showing an optional plug installed in the drilling mud screen system.

FIG. 14 illustrates a cross-sectional view of the exemplary drilling mud screen of FIG. 4, showing an optional plug installed in the drilling mud screen system. As shown in FIGS. 4 and 14, the drilling mud screen system 400, 1400 has a body 405, 1405 having a first end 410, 1410 and a second end 415, 1415, a drilling mud inlet 420, 1420 and a drilling mud outlet 425, 1425, a drilling mud screen access port 430, 1430, an end cap 435, 1435, a drilling mud screen 440, 1440 and a plug 14100. In an embodiment, the optional plug 14100 has a flow surface 14105.

In an embodiment, the optional plug 14100 fills the void between the drilling mud inlet 420, 1420 and the mud screen access port 430, 1430; and the flow surface 14105 of the optional plug 14000 directs the drilling mud from the drilling mud inlet 420, 1420 of the drilling mud screen system 400, 1400 to the drilling mud inlet 520 of the drilling mud screen 440, 1440, resulting in increased flow efficiency and decreased erosion.

In an embodiment, the plug 14100 may be constructed of any suitable material. For example, suitable materials include, but are not limited to, any alloy steel suitable for a drilling mud application. In an embodiment, the plug 14100 may be constructed of an American Iron and Steel Industry (AISI) 4130/75*k* yield or equivalent material.

In an embodiment, the plug 14100 may have any suitable outer diameter to fit within the body 405, 1405. In an embodiment, the outer diameter of the plug 14100 may be from about 3-inches to about 5-inches, and any range or value there between. In an embodiment, the outer diameter of the plug 14100 may be about 3.9-inches.

In an embodiment, the optional plug 14100 has a flow surface 14105 to direct the drilling mud from the drilling mud inlet 420, 1420 of the drilling mud screen system 400, 1400 to the drilling mud inlet 520 of the drilling mud screen 440, 1440. See e.g., FIGS. 4A & 5. In an embodiment, the flow surface 14105 may have any suitable shape to direct the drilling mud from the drilling mud inlet of the drilling mud screen system to the drilling mud inlet of the drilling mud screen. Suitable shapes include, but are not limited to, a backward "J" shape, a curved shape, an "L" shape and any combination or variation thereof, as discussed further below.

Figure 15A:
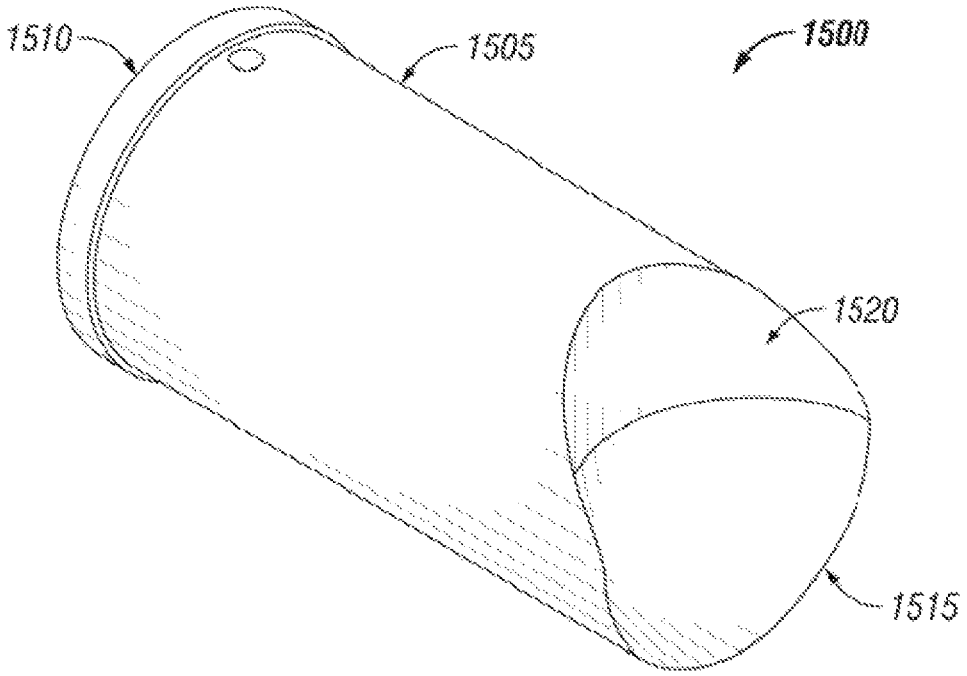
FIG. 15A illustrates an upper, right perspective view of an optional plug with a backward "J" shaped flow surface according to an embodiment of the present invention.
Figure 15B:
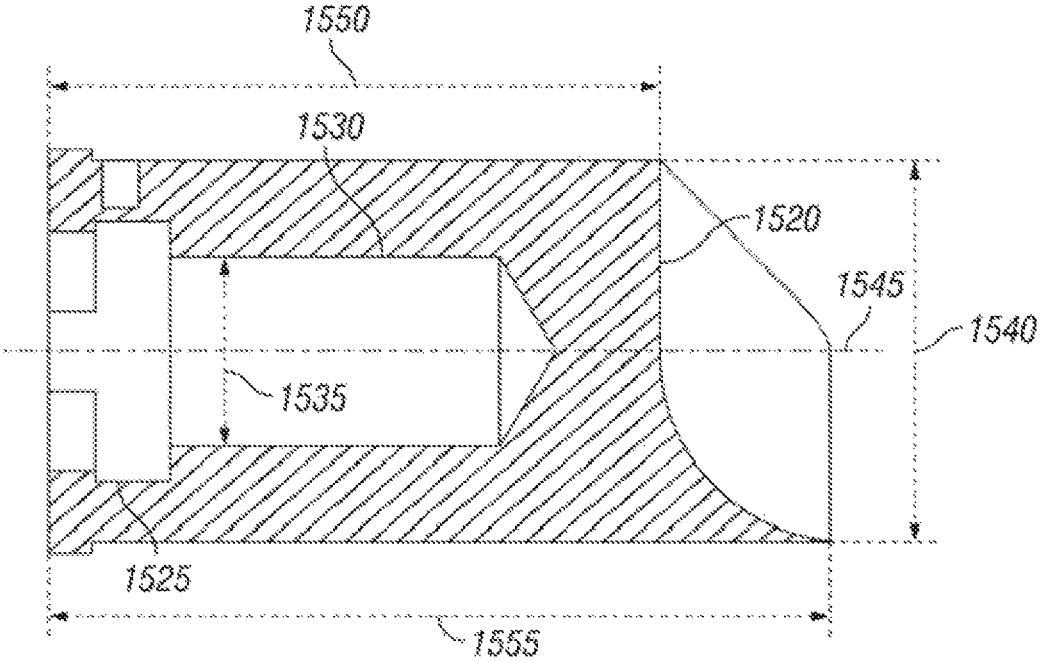
FIG. 15B illustrates a cross-sectional view of the optional plug with the backward "J" shaped flow surface of FIG. 15A.

FIG. 15A illustrates an upper, right perspective view of an optional plug with a backward "J" shaped flow surface according to an embodiment of the present invention; and FIG. 15B illustrates a cross-sectional view of the optional plug with the backward "J" shaped flow surface of FIG. 15A. As shown in FIGS. 15A and 15B, the optional plug 1500 has a body 1505 having a first end 1510 and a second end 1515, a flow surface 1520, an optional cavity 1530 and an optional port 1560.

In an embodiment, the first end 1510 of the body 1505 may have a means to engage 1525 a drilling mud screen puller/installer tool 800. See e.g., FIGS. 8A, 15A-15B & 18A-18B. The means to engage 1525 may be any suitable means to accept, and provide a pulling surface for, the drilling mud screen puller/installer tool 800. For example, a suitable means to engage 1525 includes, but is not limited to, a "key" opening to rotationally engage an inner shoulder.

In an embodiment, the first end 1510 of the plug 1500 may have an optional cavity 1530 extending towards, but not through, the flow surface 1520 of the plug 1500.

In an embodiment, the first end 1510 of the plug 1500 may have an optional port 1560 extending from an outer surface of the plug 1500 into the optional cavity 1530.

In an embodiment, the first end 1510 of the plug 1500 may have any suitable inner diameter 1535 of the optional cavity 1530. In an embodiment, the inner diameter 1535 of the optional cavity 1530 may be from about 1-inch to about 3-inches, and any range or value there between. In an embodiment, the inner diameter 1535 of the optional cavity 1530 may be about 2-inches.

In an embodiment, the plug 1500 may have any suitable outer diameter 1540. In an embodiment, the outer diameter 1540 of the plug 1500 may be from about 3-inches to about 5-inches, and any range or value there between. In an embodiment, the outer diameter 1540 of the plug 1500 may be about 3.9-inches.

In an embodiment, the body 1505 has a centerline 1545, a first length 1550 and a second length 1555. In an embodiment, the first length 1550 of the body 1505 may be any suitable length. In an embodiment, the first length 1550 of the body 1505 may be from about 6-inches to about 10-inches, and any range or value there between. In an embodiment, the length 1550 may be about 8-inches.

In an embodiment, the second length 1555 of the body 1505 may be any suitable length. In an embodiment, the second length 1555 may be from about 8-inches to about 14-inches, and any range or value there between. In an embodiment, the second length 1555 may be about 11.5-inches.

In an embodiment, the second end 1515 of the plug 1500 may have a flow surface 1520. In an embodiment, the flow surface 1520 may have any suitable shape to direct the drilling mud from the drilling mud inlet of the drilling mud screen system to the drilling mud inlet of the drilling mud screen. Suitable shapes include, but are not limited to, a backward "J" shape, a curved shape, an "L" shape and any combination or variation thereof, as discussed further below. In an embodiment, the flow surface 1520 may have a backward "J" shape. See FIG. 15B.

Figure 16A:
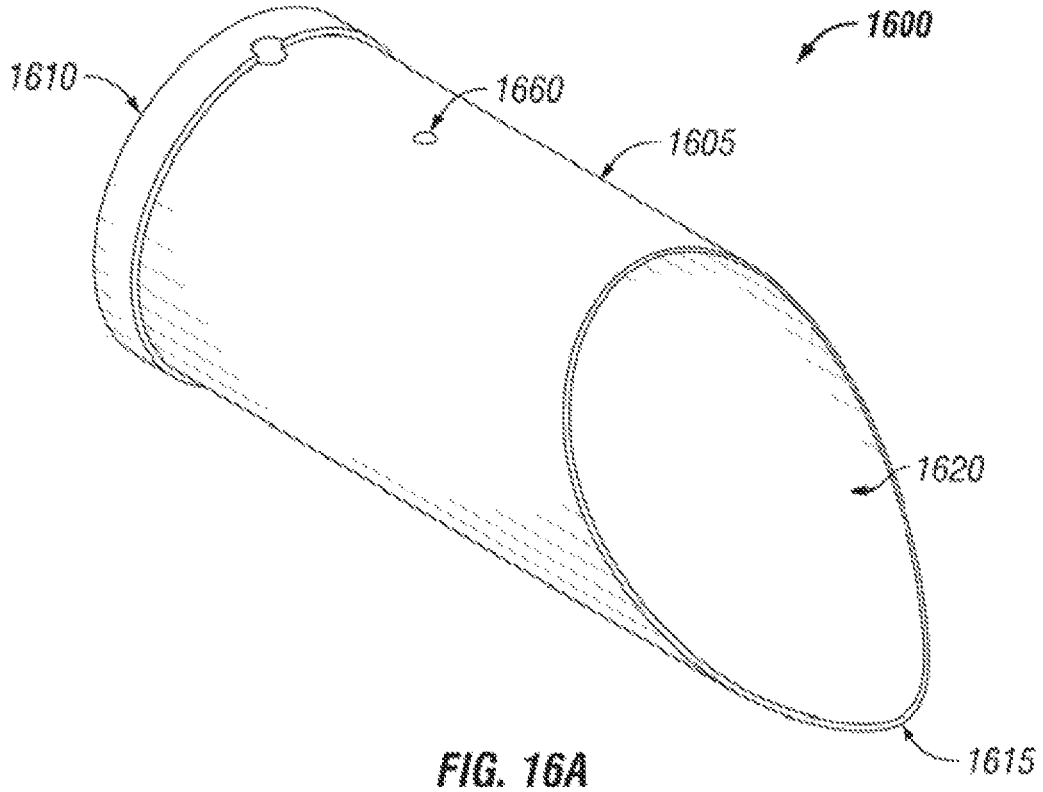
FIG. 16A illustrates an upper, right perspective view of an optional plug with a curved shaped flow surface according to an embodiment of the present invention.
Figure 16B:
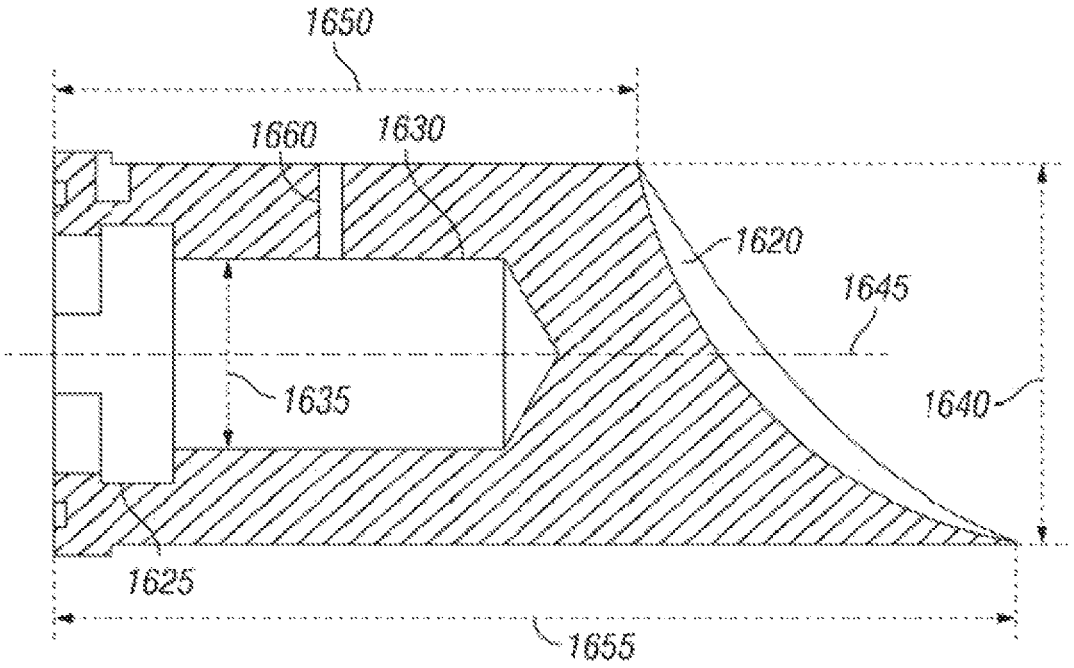
FIG. 16B illustrates a cross-sectional view of the optional plug with the curved shaped flow surface of FIG. 16A.

FIG. 16A illustrates an upper, right perspective view of an optional plug with a curved flow surface according to an embodiment of the present invention; and FIG. 16B illustrates a cross-sectional view of the optional plug with the curved flow surface of FIG. 16A. As shown in in FIGS. 16A and 16B, the optional plug 1600 has a body 1605 having a first end 1610 and a second end 1615, a flow surface 1620, an optional cavity 1630 and an optional port 1660.

In an embodiment, the first end 1610 of the body 1605 may have a means to engage 1625 a drilling mud screen puller/installer tool 800. See e.g., FIGS. 8A, 16A-16B, 18A-18B & 29. The means to engage 1625 may be any suitable means to accept, and provide a pulling surface for, the drilling mud screen puller/installer tool 800. For example, a suitable means to engage 1625 includes, but is not limited to, a "key" opening to rotationally engage an inner shoulder.

In an embodiment, the first end 1610 of the plug 1600 may have an optional cavity 1630 extending towards, but not through, the flow surface 1620 of the plug 1600.

In an embodiment, the first end 1610 of the plug 1600 may have an optional port 1660 extending from an outer surface of the plug 1600 into the optional cavity 1630.

In an embodiment, the first end 1610 of the plug 1600 may have any suitable inner diameter 1635 of the optional cavity 1630. In an embodiment, the inner diameter 1635 of the optional cavity 1630 may be from about 1-inch to about 3-inches, and any range or value there between. In an embodiment, the inner diameter 1635 of the optional cavity 1630 may be about 2-inches.

In an embodiment, the plug 1600 may have any suitable outer diameter 1640. In an embodiment, the outer diameter 1640 of the plug 1600 may be from about 3-inches to about 5-inches, and any range or value there between. In an embodiment, the outer diameter 1640 of the plug 1600 may be about 3.9-inches.

In an embodiment, the body 1605 has a centerline 1645, a first length 1650 and a second length 1655. In an embodiment, the first length 1650 of the body 1605 may be any suitable length. In an embodiment, the first length 1650 of the body 1605 may be from about 6-inches to about 10-inches, and any range or value there between. In an embodiment, the length 1650 may be about 8-inches.

In an embodiment, the second length 1655 of the body 1605 may be any suitable length. In an embodiment, the second length 1655 may be from about 8-inches to about 15-inches, and any range or value there between. In an embodiment, the second length 1655 may be about 12-inches.

In an embodiment, the second end 1615 of the plug 1600 may have a flow surface 1620. In an embodiment, the flow surface 1620 may have any suitable shape to direct the drilling mud from the drilling mud inlet of the drilling mud screen system to the drilling mud inlet of the drilling mud screen. Suitable shapes include, but are not limited to, a backward "J" shape, a curved shape, an "L" shape and any combination or variation thereof, as discussed further below. In an embodiment, the flow surface 1620 may have a curved shape. See FIG. 16B.

Figure 17A:
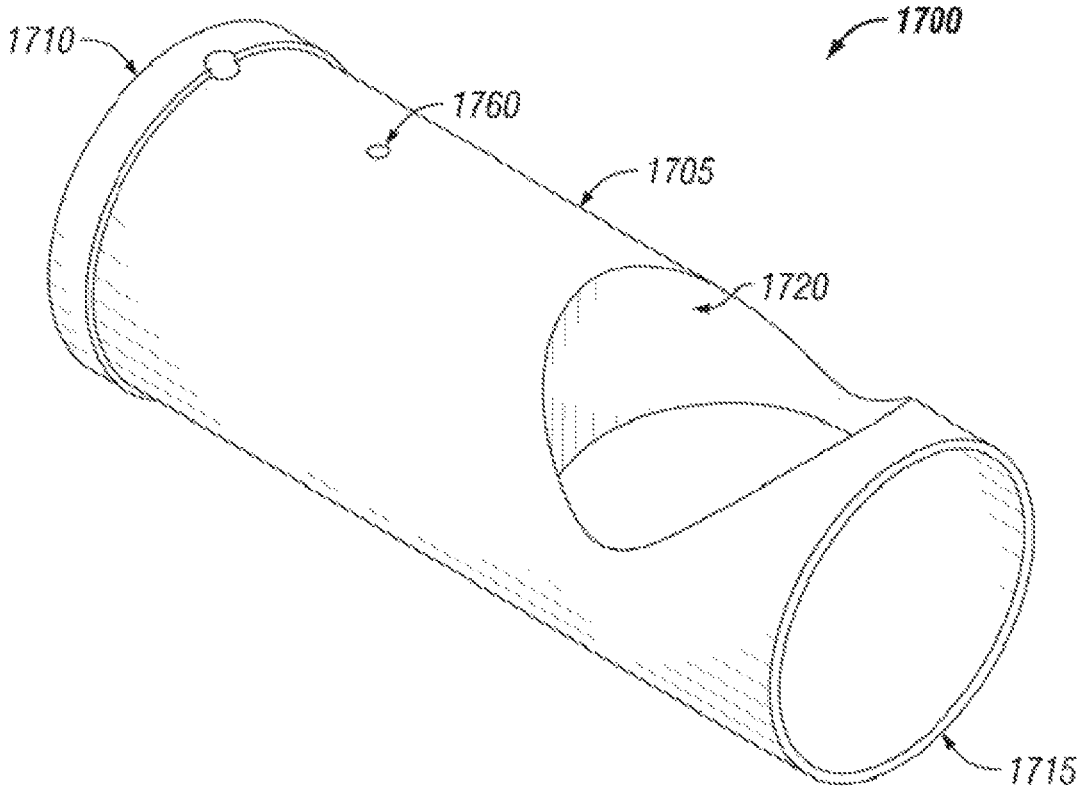
FIG. 17A illustrates an upper, right side perspective view of an optional plug with an "L" shaped flow surface according to an embodiment of the present invention.
Figure 17B:
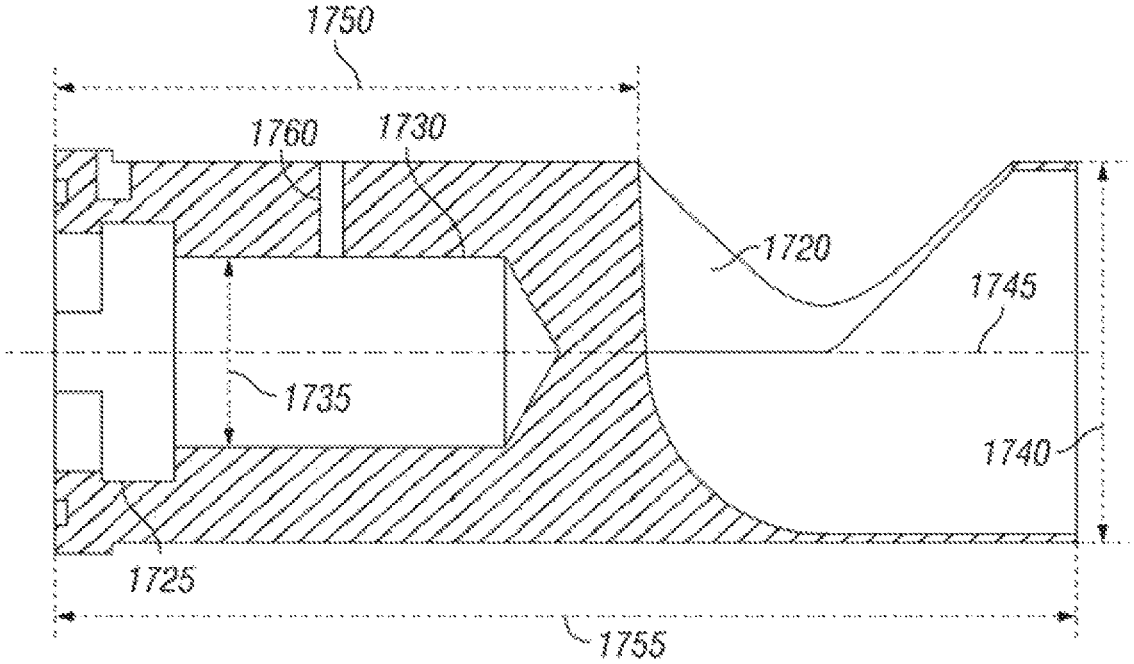
FIG. 17B illustrates a cross-sectional view of an optional plug with an "L" shaped flow surface of FIG. 17A.

FIG. 17A illustrates an upper, right perspective view of an optional plug with an "L" flow surface according to an embodiment of the present invention; and FIG. 17B illustrates a cross-sectional view of an optional plug with an "L" flow surface of FIG. 17A. As shown in FIGS. 17A and 17B, the optional plug 1700 has a body 1705 having a first end 1710 and a second end 1715, a flow surface 1720, an optional cavity 1730 and an optional port 1760.

In an embodiment, the first end 1710 of the body 1705 may have a means to engage 1725 a drilling mud screen puller/installer tool 800. See e.g., FIGS. 8A, 17A-17B, 18A-18B & 29. The means to engage 1725 may be any suitable means to accept, and provide a pulling surface for, the drilling mud screen puller/installer tool 800. For example, a suitable means to engage 1725 includes, but is not limited to, a "key" opening to rotationally engage an inner shoulder.

In an embodiment, the first end 1710 of the plug 1700 may have an optional cavity 1730 extending towards, but not through, the flow surface 1720 of the plug 1700.

In an embodiment, the first end 1710 of the plug 1700 may have an optional port 1760 extending from an outer surface of the plug 1700 into the optional cavity 1730.

In an embodiment, the first end 1710 of the plug 1700 may have any suitable inner diameter 1735 of the optional cavity 1730. In an embodiment, the inner diameter 1735 of the optional cavity 1730 may be from about 1-inch to about 3-inches, and any range or value there between. In an embodiment, the inner diameter 1735 of the optional cavity 1730 may be about 2-inches.

In an embodiment, the plug 1700 may have any suitable outer diameter 1740. In an embodiment, the outer diameter 1740 of the plug 1700 may be from about 3-inches to about 5-inches, and any range or value there between. In an embodiment, the outer diameter 1740 of the plug 1700 may be about 3.9-inches.

In an embodiment, the body 1705 has a centerline 1745, a first length 1750 and a second length 1755. In an embodiment, the first length 1750 of the body 1705 may be any suitable length. In an embodiment, the first length 1750 of the body 1705 may be from about 6-inches to about 10-inches, and any range or value there between. In an embodiment, the length 1750 may be about 8-inches.

In an embodiment, the second length 1755 of the body 1705 may be any suitable length. In an embodiment, the second length 1755 may be from about 8-inches to about 15-inches, and any range or value there between. In an embodiment, the second length 1755 may be about 12-inches.

In an embodiment, the second end 1715 of the plug 1700 may have a flow surface 1720. In an embodiment, the flow surface 1720 may have any suitable shape to direct the drilling mud from the drilling mud inlet of the drilling mud screen system to the drilling mud inlet of the drilling mud screen. Suitable shapes include, but are not limited to, a backward "J" shape, a curved shape, an "L" shape and any combination or variation thereof, as discussed further below. In an embodiment, the flow surface 1720 may have an "L" shape. See FIG. 17B.

Two-Piece Body

Figure 6A:
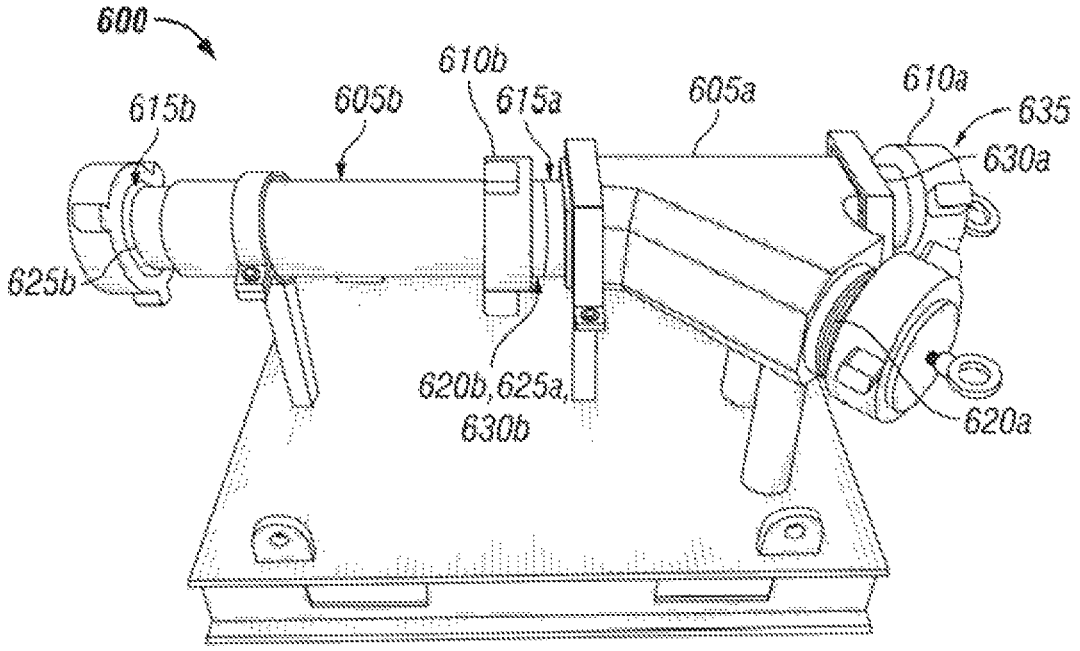
FIG. 6A illustrates a photograph of a mud screen system according to an embodiment of the present invention, showing a two-piece body for the system.

FIG. 6A illustrates a photograph of a drilling mud screen system according to an embodiment of the present invention, showing a two-piece body for the system. As shown in FIG. 6A, the drilling mud screen system 600 has a first body 605*a* having a first end 610*a* and a second end 615*a*, a first drilling mud inlet 620*a*, a first drilling mud outlet 625*a*, a first drilling mud screen access port 630*a*, and an end cap 635. The drilling mud screen system 600 has a second body 605*b* having a first end 610*b* and a second end 615*b*, a second drilling mud inlet 620*b* and a second drilling mud outlet 625*b*, and a second drilling mud screen access port 630*b*.

In an embodiment, the first drilling mud inlet 620*a* may be fluidly connected to, for example, an outlet of a drilling mud pump via a connection; and the second drilling mud outlet 625*b* may be fluidly connected to an inlet of a vibrator hose via a connection. Any suitable connection may be used for the first drilling mud inlet 620*a* and second drilling mud outlet 625*b*. For example, suitable connections include, but are not limited to, pipe fittings and welds. Connections are well known in the art. In an embodiment, the first drilling mud inlet 620*a* may be fluidly connected to, for example, an outlet of a drilling mud pump via a weld; and the second drilling mud outlet 625*b* may be fluidly connected to an inlet of a vibrator hose via a weld.

As shown in FIG. 6A, the drilling mud screen access port 630 of the drilling mud screen system 600 may be closed with an end cap 635 via a connection. Any suitable connection may be used. For example, suitable connections include, but are not limited to, pipe fittings. Connections are well known in the art.

In an embodiment, the drilling mud screen access port 630 of the drilling mud screen system 600 may be sealed with an end cap 635 via an O-ring. Any suitable O-ring may be used. For example, suitable O-rings include, but are not limited to, 300 Series O-rings. O-rings are well known in the art.

In an embodiment, the end cap 635 of the drilling mud screen system 600 may comprise a cap, an O-ring and a pipe collar. In an embodiment, the end cap may be a five-inch 1002 WECO cap with an O-ring.

Figure 6B:
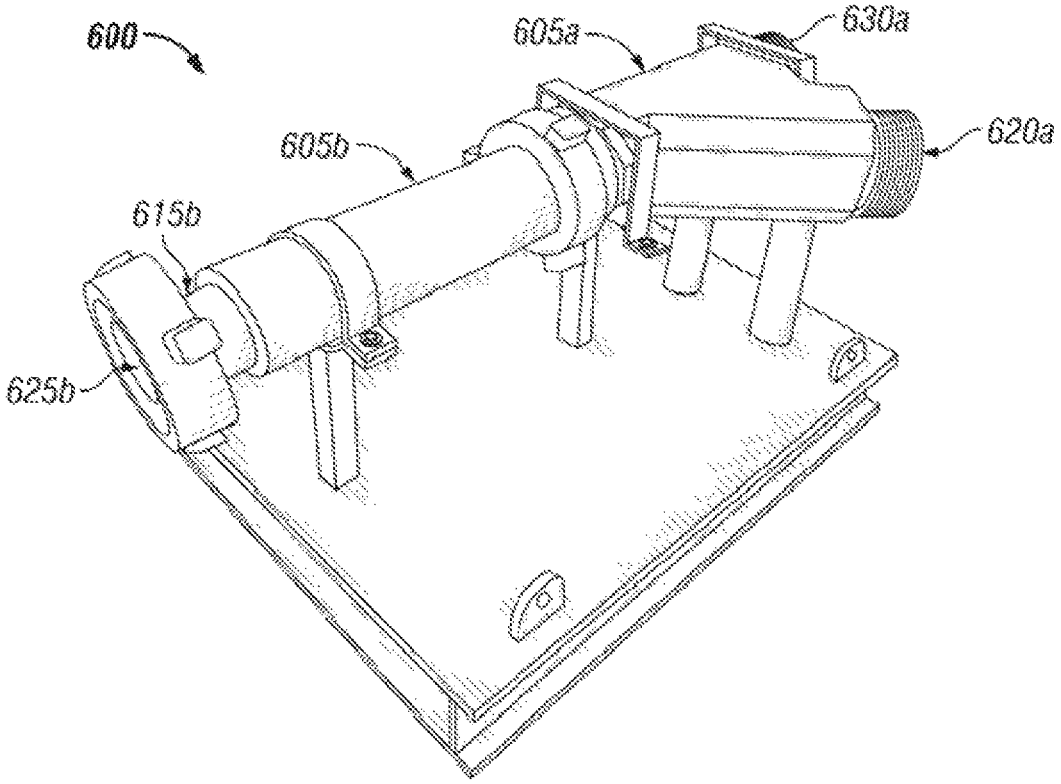
FIG. 6B illustrates a photograph of the exemplary drilling mud screen system of FIG. 6A, showing a drilling mud outlet.

FIG. 6B illustrates a photograph of the exemplary drilling mud screen system of FIG. 6A, showing a second drilling mud outlet 625*b*.

Figure 6C:
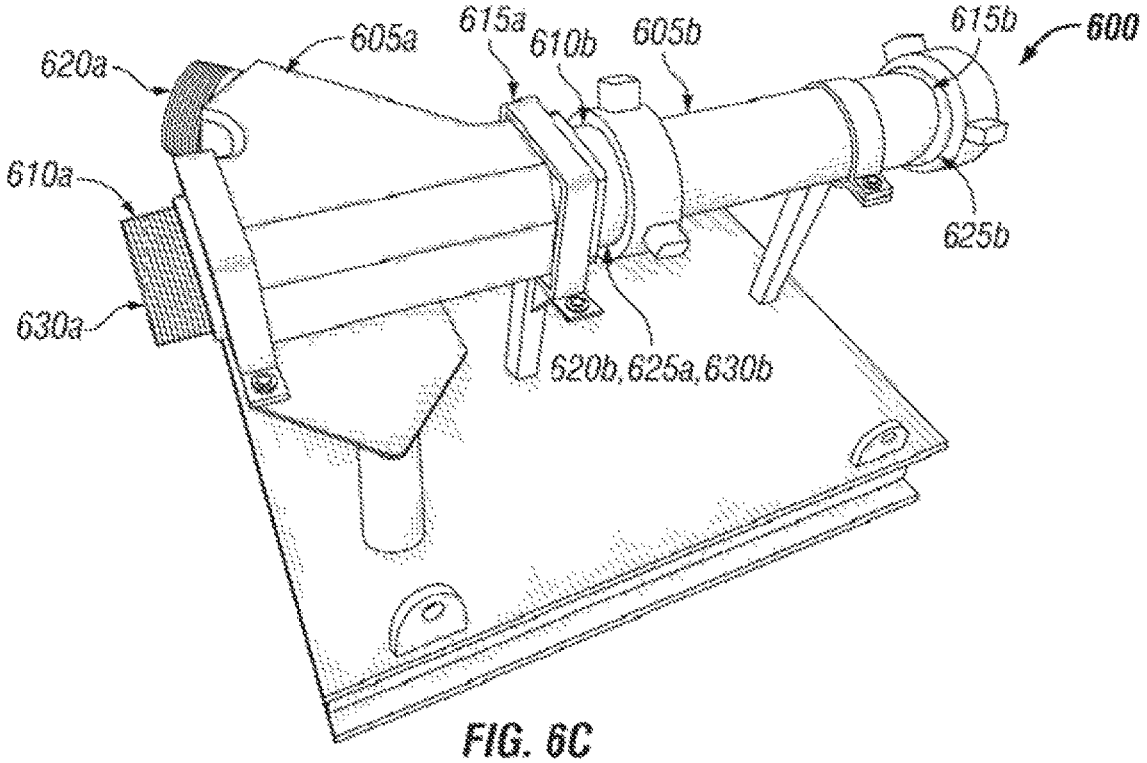
FIG. 6C illustrates a photograph of the exemplary drilling mud screen system of FIGS. 6A-6B.

FIG. 6C illustrates a photograph of the exemplary drilling mud screen system of FIGS. 6A-6B.

Figure 6D:
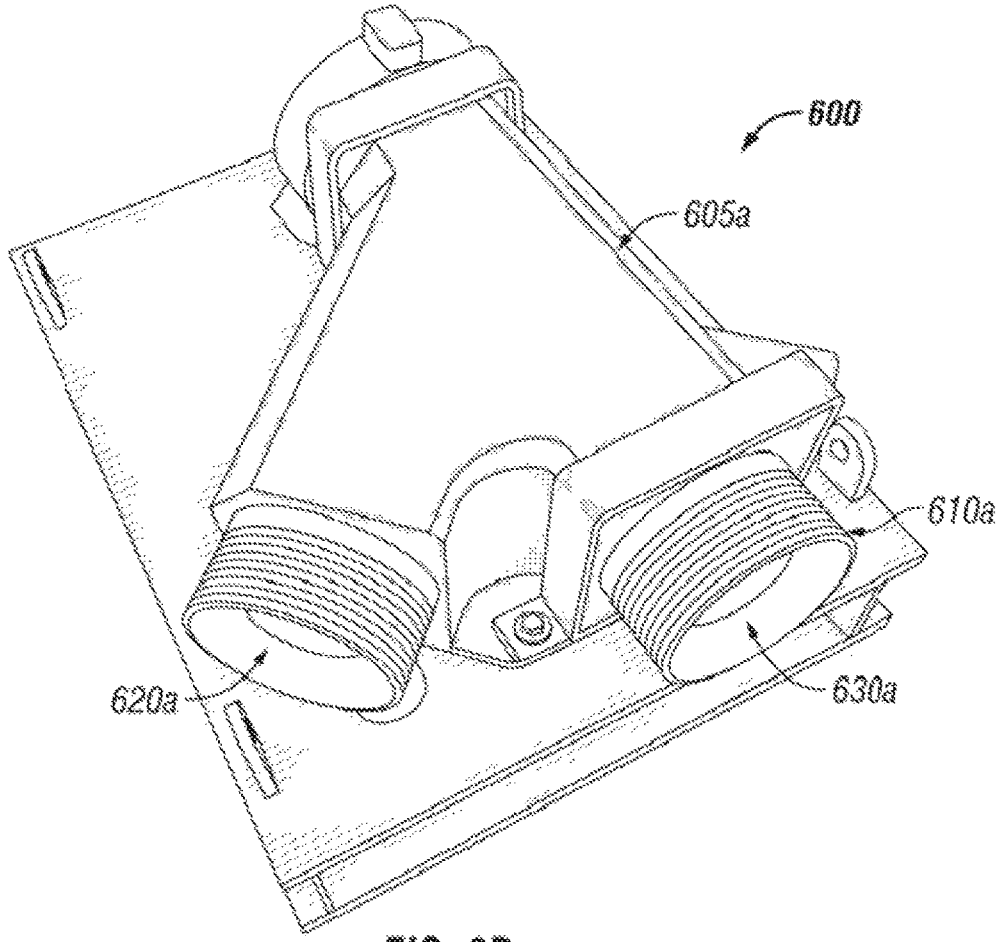
FIG. 6D illustrates a photograph of the exemplary drilling mud screen system of FIGS. 6A-6C, showing a drilling mud inlet and a drilling mud screen access port.

FIG. 6D illustrates a photograph of the exemplary drilling mud screen system of FIGS. 6A-6C, showing a detailed view of a first body 605*a* of the drilling mud screen system 600. In an embodiment, the first body 605*a* may be a five-inch 1002 WECO Y-housing.

Standard Single Inlet and Optional Reduced Angle Inlet Version

Figure 7A:
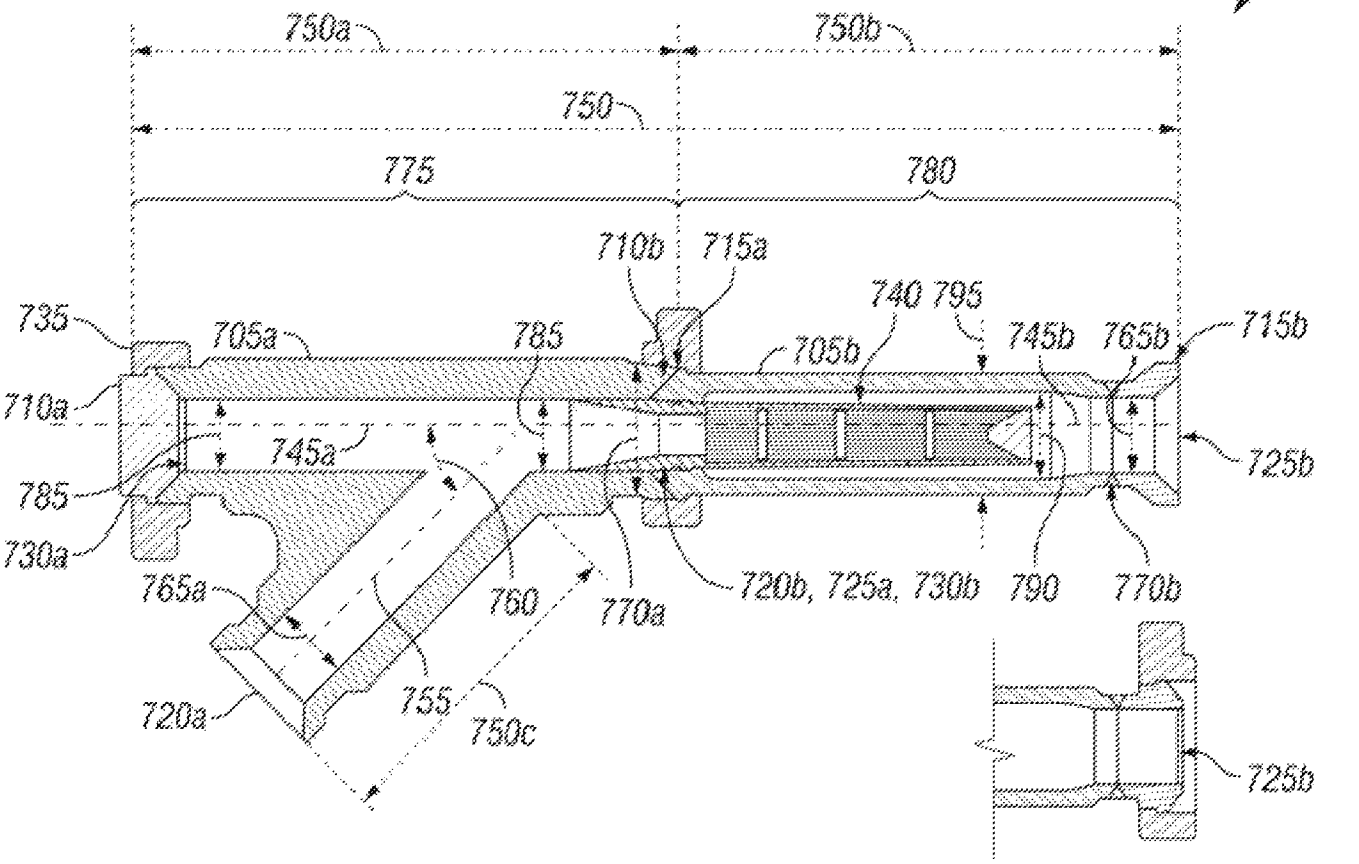
FIG. 7A illustrates an upper, cross-sectional view of a drilling mud screen system according to an embodiment of the present invention, showing a single-inlet drilling mud system.

FIG. 7A illustrates an upper, cross-sectional view of a drilling mud screen system 700 according to an embodiment of the present invention, showing a standard single-inlet drilling mud system.

Figure 19:
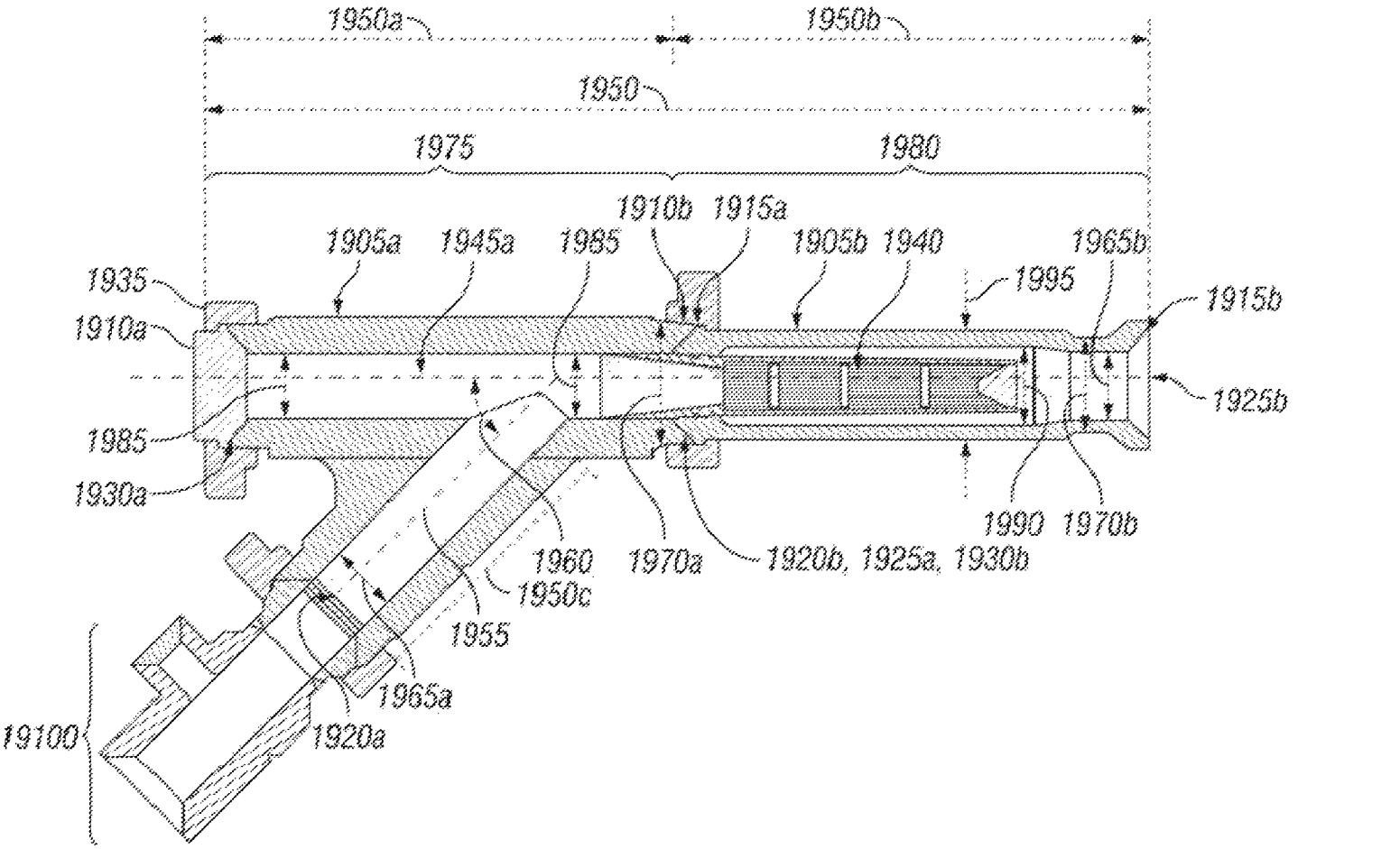
FIG. 19 illustrates a cross-sectional view of the drilling mud screen system in a monitoring configuration according to an embodiment of the present invention, showing an optional transducer subassembly.

FIG. 19 illustrates a cross-sectional view of the drilling mud screen system in a monitoring configuration 1900 according to an embodiment of the present invention, showing an optional transducer subassembly 19100.

Figure 21A:
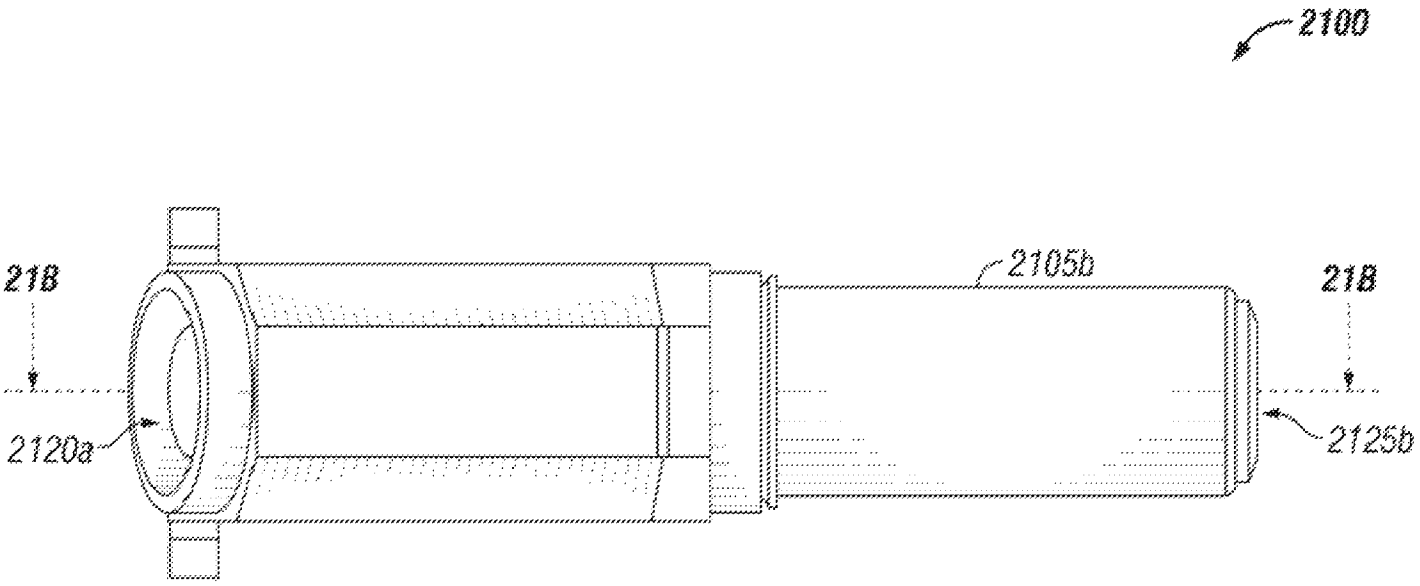
FIG. 21A illustrates an upper view of a mud screen system according to an embodiment of the present invention, showing an optional two-piece body for the system.
Figure 21B:
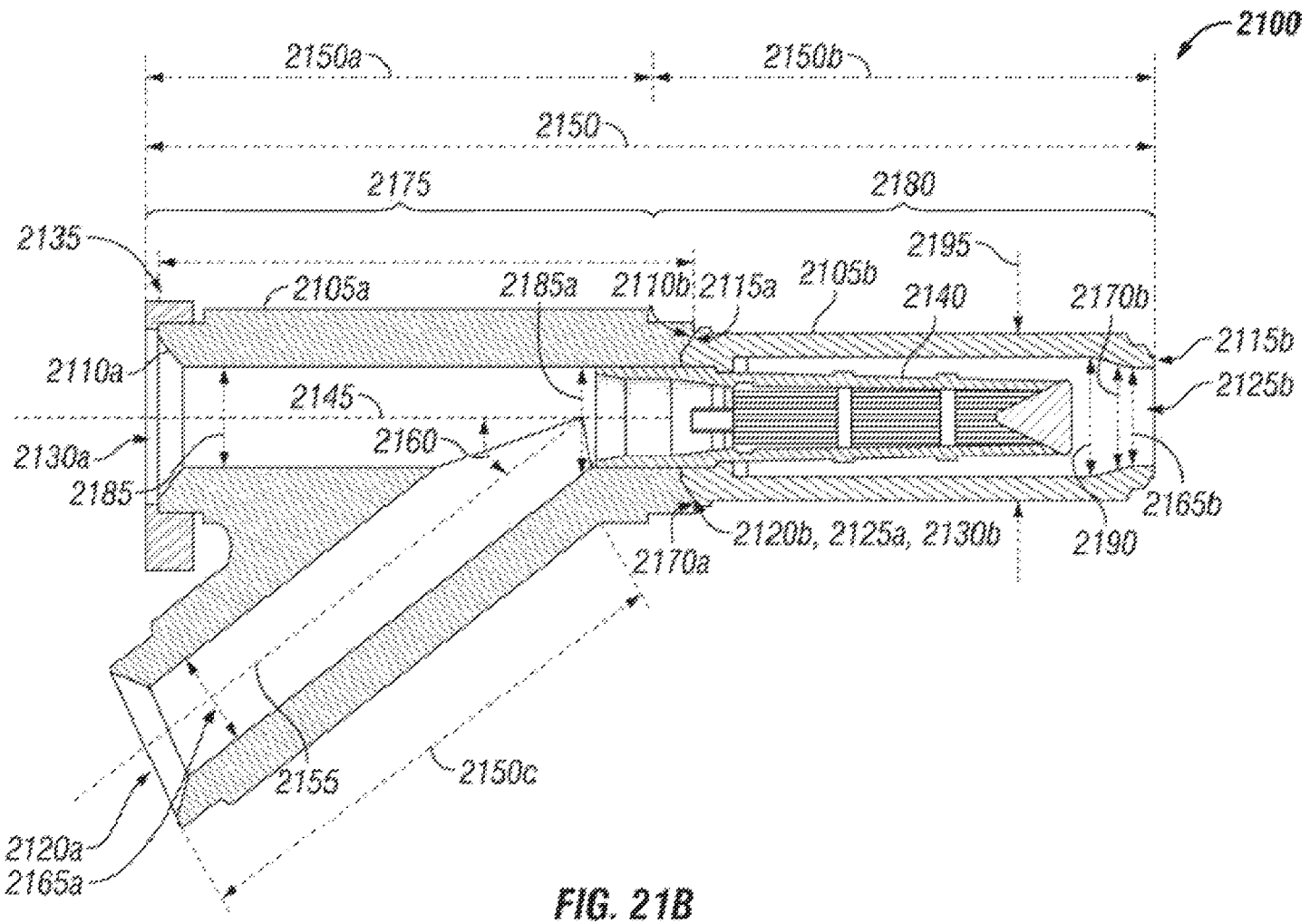
FIG. 21B illustrates a detailed, cross-sectional view of A-A of FIG. 21A, showing an entry angle of about 30 degrees.

FIG. 21A illustrates an upper view of a mud screen system 2100 according to an embodiment of the present invention, showing an optional two-piece body for the system; and FIG. 21B illustrates a detailed, cross-sectional view of A-A of FIG. 21A, showing an entry angle of about 30 degrees.

Figure 23:
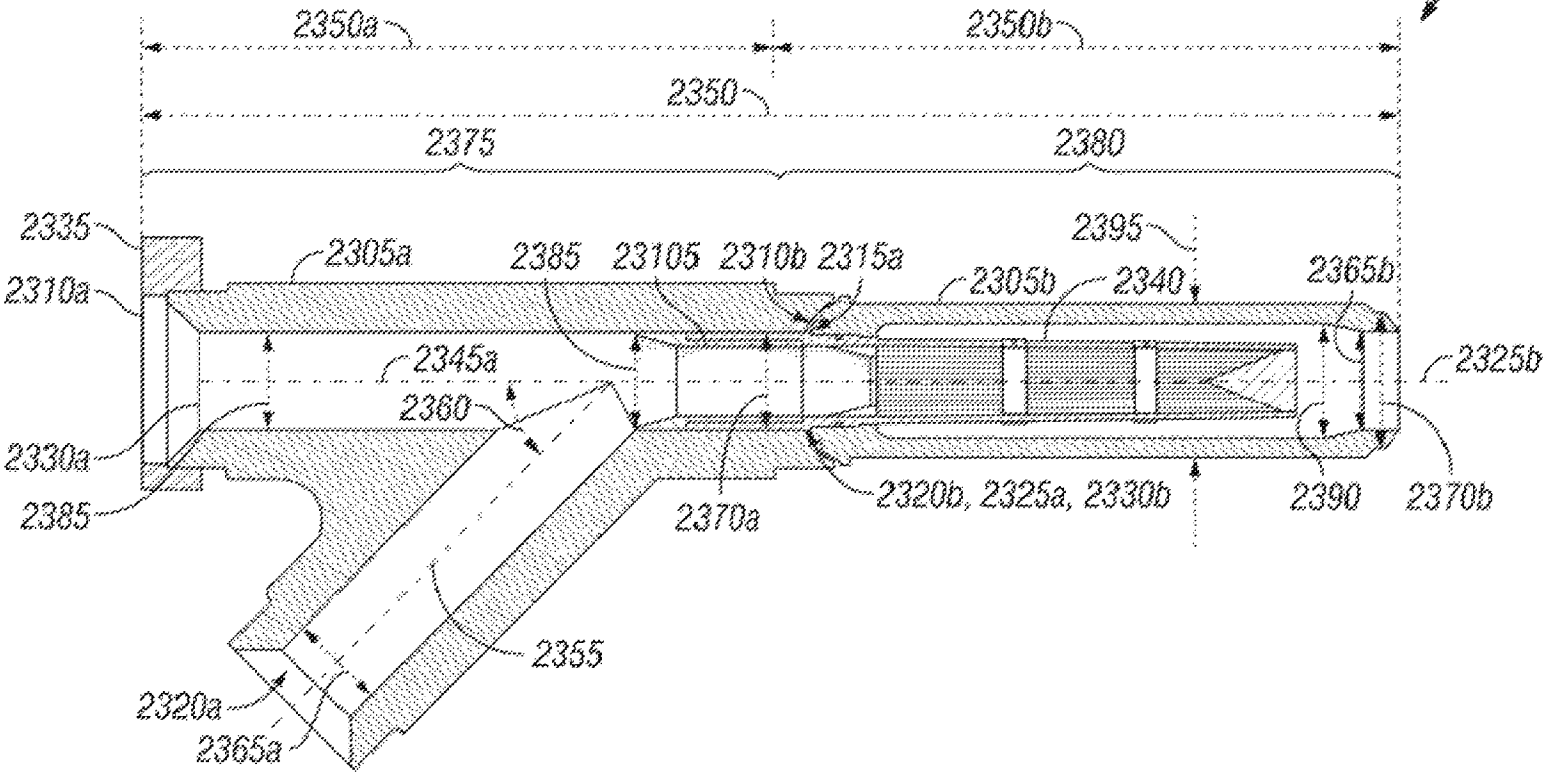
FIG. 23 illustrates a cross-sectional view of a mud screen system according to an embodiment of the present invention, showing an optional drilling mud screen insert inserted into a drilling mud screen.

FIG. 23 illustrates a cross-sectional view of a mud screen system 2300 according to an embodiment of the present invention, showing an optional drilling mud screen insert 23105 inserted into a drilling mud screen 2340.

As shown in FIGS. 7A, 19 and 23, the drilling mud screen system 700, 1900, 2100, 2300 has a first body 705*a*, 1905*a*, 2105*a*, 2305*a* having a first end 710*a*, 1910*a*, 2110*a*, 2310*a* and a second end 715*a*, 1915*a*, 2115*a*, 2315*a*, a first drilling mud inlet 720*a*, 1920*a*, 2120*a*, 2320*a* and a first drilling mud outlet 725*a*, 1925*a*, 2125*a*, 2325*a*, an end cap 735, 1935, 2135, 2335, and a first drilling mud screen access port 730*a*, 1930*a*, 2130*a*, 2330*a*. The drilling mud screen system 700, 1900, 2100, 2300 has a second body 705*b*, 1905*b*, 2105*b*, 2305*b* having a first end 710*b*, 1910*b*, 2110*b*, 2310*b* and a second end 715*b*, 1915*b*, 2115*b*, 2315*b*, a second drilling mud inlet 720*b*, 1920*b*, 2120*b*, 2320*b*, a second drilling mud outlet 725*b*, 1925*b*, 2125*b*, 2325*b*, and a second drilling mud screen access port 730*b*, 1930*b*, 2130*b*, 2330*b*.

In an embodiment, the first drilling mud inlet 720*a*, 1930*a*, 2130*a*, 2330*a* may be fluidly connected to, for example, an outlet of a drilling mud pump via a connection; and the second drilling mud outlet 725*b*, 1925*b*, 2125*b*, 2325*b* may be fluidly connected to an inlet of a vibrator hose via a connection. Any suitable connection may be used for the first drilling mud inlet 720*a*, 1920*a*, 2130*a*, 2320*a* and second drilling mud outlet 725*b*, 1925*b*, 2125*b*, 2325*b*. For example, suitable connections include, but are not limited to, pipe fittings and welds. Connections are well known in the art. In an embodiment, the first drilling mud inlet 720*a*, 1920*a*, 2120*a*, 2320*a* may be fluidly connected to, for example, an outlet of a drilling mud pump via a weld; and the second drilling mud outlet 725*b*, 1925*b*, 2125*b*, 2325*b* may be fluidly connected to an inlet of a vibrator hose via a weld.

In an embodiment, the first body 705*a*, 1905*a*, 2105*a*, 2305*a* and the second body 705*b*, 1905*b*, 2105*b*, 2305*b* may be fluidly connected by a connection. Any suitable connection may be used for the first body 705*a*, 1905*a*, 2105*a*, 2305*a* and the second body 705*b*, 1905*b*, 2105*b*, 2305*b*. For example, suitable connections include, but are not limited to, pipe fittings. Connections are well known in the art. In an embodiment, the first body 705*a*, 1905*a*, 2105*a*, 2305*a* and the second body 705*b*, 1905*b*, 2105*b*, 2305*b* may be fluidly connected by a union. In an embodiment, the union may be a five-inch 1002 WECO union.

In an embodiment, the first body 705*a*, 1905*a*, 2105*a*, 2305*a* and the second body 705*b*, 1905*b*, 2105*b*, 2305*b* of the drilling mud screen system 700, 1900, 2100, 2300 may be constructed of any suitable material. For example, suitable materials include, but are not limited to, any alloy steel suitable for a drilling mud application. In an embodiment, the first body 705*a*, 1905*a*, 2105*a*, 2305*a* and the second body 705*b*, 1905*b*, 2105*b*, 2305*b* may be constructed of an AISI 4130/75k yield or equivalent material. See e.g., FIGS. 6A-6D. In an embodiment, the inner surface of the first body 705*a*, 1905*a*, 2105*a*, 2305*a* and the second body 705*b*, 1905*b*, 2105*b*, 2305*b* may be unpainted. See e.g., FIG. 6D. In an embodiment, the outer surface of the first body 705*a*, 1905*a*, 2105*a*, 2305*a* and the second body 705*b*, 1905*b*, 2105*b*, 2305*b* may be painted. See e.g., FIGS. 6A-6D.

In an embodiment, the drilling mud screen system has a length 750, 1950, 2150, 2350. The length 750, 1950, 2150, 2350 may be any suitable length. In an embodiment, the length 750, 1950, 2150, 2350 may be from about 40-inches to about 80-inches, and any range or value there between. In an embodiment, the length 750, 1950, 2150, 2350 may be about 56-inches.

In an embodiment, the first body 705*a*, 1905*a*, 2105*a*, 2305*a* has a first centerline 745*a*, 1945*a*, 2145*a*, 2345*a* and a first length 750*a*, 1950*a*, 2150*a*, 2350*a*. In an embodiment, the first centerline 745*a*, 1945*a*, 2145*a*, 2345*a* extends through the center of the first drilling mud screen access port 730*a*, 1930*a*, 2130*a*, 2330*a* to the first drilling mud outlet 725*a*, 1925*a*, 2125*a*, 2325*a*. The first length 750*a*, 1950*a*, 2150*a*, 2350*a* of the first body 705*a*, 1905*a*, 2105*a*, 2305*a* may be any suitable length. In an embodiment, the first length 750*a*, 1950*a*, 2150*a*, 2350*a* of the first body 705*a*, 1905*a*, 2105*a*, 2305*a* may be from about 20-inches to about 40-inches, and any range or value there between. In an embodiment, the first length 750*a*, 1950*a*, 2150*a*, 2350*a* may be about 27-inches or 30-inches.

In an embodiment, the first body 705*a*, 1905*a*, 2105*a*, 2305*a* has a second centerline 755, 1955, 2155, 2355 and a third length 750*c*, 1950*c*, 2150*c*, 2350*c*. In an embodiment, the second centerline 755, 1955, 2155, 2355 extends through the center of the first drilling mud inlet 720*a*, 1920*a*, 2120*a*, 2320*a* to the first centerline 745*a*, 1945*a*, 2145*a*, 2345*a* of the first body 705*a*, 1905*a*, 2105*a*, 2305*a*. The third length 750*c*, 1950*c*, 2150*c*, 2350*c* of the first body 705*a*, 1905*a*, 2105*a*, 2305*a* may be any suitable length.

In an embodiment, the third length 750*c*, 1950*c*, 2350*c* of the first body 705*a*, 1905*a*, 2305*a* may be from about 10-inches to about 20-inches, and any range or value there between. In an embodiment, the third length 750*c*, 1950*c*, 2350*c* may be about 14-inches or 16-inches.

In an embodiment, the third length 2150*c* of the first body 2105*a* may be from about 20-inches to about 40-inches, and any range or value there between. In an embodiment, the third length 2150*c* may be about 25-inches or 30-inches.

In an embodiment, the first centerline 745*a*, 1945*a*, 2145*a*, 2345*a* and the second centerline 755, 1955, 2155, 2355 of the first body 705*a*, 1905*a*, 2105*a*, 2305*a* form a first angle 760, 1960, 2160, 2360.

In an embodiment, the first angle 760, 1960, 2360 may be from about 30-degrees to about 120-degrees, and any range or value there between. In an embodiment, the first angle 760, 1960, 2360 may be from about 45-degrees to about 60-degrees. In an embodiment, the first angle 760, 1960, 2360 may be about 90-degrees.

In an embodiment, the first body 2105*a* may be modified to reduce the entry angle 2160 of the first drilling mud inlet 2120, resulting in increased flow efficiency and decreased erosion. In an embodiment, the first angle 2160 may be from about 20-degrees to about 120-degrees, and any range or value there between. In an embodiment, the first angle 2160 may be about 30-degrees.

In an embodiment, the first drilling mud inlet 720*a*, 1920*a*, 2120*a*, 2320*a* may be offset from a first end 710*a*, 1910*a*, 2110*a*, 2310*a* of the first body 705*a*, 1905*a*, 2105*a*, 2305*a*. The first drilling mud inlet 720*a*, 1920*a*, 2120*a*, 2320*a* may be offset from a first end 710*a*, 1910*a*, 2110*a*, 2310*a* of the first body 705*a*, 1905*a*, 2105*a*, 2305*a* at any suitable distance. In an embodiment, the second centerline 755, 1955, 2155, 2355 may be offset from the first end 710*a*, 1910*a*, 2310*a* of the first body 705*a*, 1905*a*, 2105*a*, 2305*a* from about 15-inches to about 20-inches, and any range or value there between. In an embodiment, the second centerline 755, 1955, 2155, 2355 may be offset from the first end 710*a*, 1910*a*, 2110*a*, 2310*a* of the first body 705*a*, 1905*a*, 2105*a*, 2305*a* about 18-inches.

In an embodiment, the first drilling mud inlet 720*a*, 1920*a*, 2120*a*, 2320*a* may have any suitable first inner diameter 765*a*, 1965*a*, 2165*a*, 2365*a*; and the first drilling mud inlet 720*a*, 1920*a*, 2120*a*, 2320*a* may have any suitable first outer diameter 770*a*, 1970*a*, 2170*a*, 2370*a*. In an embodiment, the first inner diameter 765*a*, 1965*a*, 2165*a*, 2365*a* of the first drilling mud inlet 720*a*, 1920*a*, 2120*a*, 2320*a* may be from about 3-inches to about 5-inches, and any range or value there between. In an embodiment, the first inner diameter 765*a*, 1965*a*, 2165*a*, 2365*a* of the first drilling mud inlet 720*a*, 1920*a*, 2120*a*, 2320*a* may be about 4-inches.

In an embodiment, the first outer diameter 770*a*, 1970*a*, 2170*a*, 2370*a* of the first drilling mud inlet 720*a*, 1920*a*, 2120*a*, 2320*a* may be from about 4.5-inches to about 6.5-inches, and any range or value there between. In an embodiment, the first outer diameter 770*a*, 1970*a*, 2170*a*, 2370*a* of the first drilling mud inlet 720*a*, 1920*a*, 2120*a*, 2320*a* may be about 5.5-inches.

In an embodiment, the second body 705*b*, 1905*b*, 2105*b*, 2305*b* has a second centerline 745*b*, 1945*b*, 2135*b*, 2345*b* and a second length 750*b*, 1950*b*, 2150*b*, 2350*b*. In an embodiment, the second centerline 745*b*, 1945*b*, 2145*b*, 2345*b* extends through the center of the second drilling mud screen access port 730*b*, 1930*b*, 2130*b*, 2330*b* (and the second drilling mud inlet 720*b*, 1920*b*, 2120*b*, 2320*b*) to the second drilling mud outlet 725*b*, 1925*b*, 2125*b*, 2325*b*. The second length 750*b*, 1950*b*, 2150*b*, 2350*b* of the second body 705*b*, 1905*b*, 2105*b*, 2305*b* may be any suitable length. In an embodiment, the second length 750*b*, 1950*b*, 2150*b*, 2350*b* of the second body 705*b*, 1905*b*, 2105*b*, 2305*b* may be from about 20-inches to about 40-inches, and any range or value there between. In an embodiment, the second length 750*b*, 1950*b*, 2150*b*, 2350*b* may be about 25-inches.

In an embodiment, the second drilling mud inlet 720*b*, 1920*b*, 2120*b*, 2320*b* may have any suitable second inner diameter 765*b*, 1965*b*, 2165*b*, 2365*b*; and the second drilling mud inlet 720*b*, 1920*b*, 2120*b*, 2320*b* may have any suitable second outer diameter 770*b*, 1970*b*, 2170*b*, 2370*b*. In an embodiment, the second inner diameter 765*b*, 1965*b*, 2165*b*, 2365*b* of the second drilling mud inlet 720*b*, 1920*b*, 2120*b*, 2320*b* may be from about 3-inches to about 5-inches, and any range or value there between. In an embodiment, the second inner diameter 765*b*, 1965*b*, 2165*b*, 2365*b* of the second drilling mud inlet 720*b*, 1920*b*, 2120*b*, 2320*b* may be about 4-inches.

In an embodiment, the second outer diameter 770*b*, 1970*b*, 2170*b*, 2370*b* of the second drilling mud inlet 720*b*, 1920*b*, 2120*b*, 2320*b* may be from about 4.5-inches to about 6.5-inches, and any range or value there between. In an embodiment, the second outer diameter 770*b*, 1970*b*, 2170*b*, 2370*b* of the second drilling mud inlet 720*b*, 1920*b*, 2120*b*, 2320*b* may be about 5.5-inches.

In an embodiment, the first body 705*a*, 1905*a*, 2105*a*, 2305*a* has a first portion 775, 1975, 2175, 2375 and the second body 705*b*, 1905*b*, 2105*b*, 2305*b* has a second portion 780, 1980, 2180, 2380. In an embodiment, the first portion 775, 1975, 2175, 2375 of the first body 705*a*, 1905*a*, 2105*a*, 2305*a* may have a first inner diameter 785, 1985, 2185, 2385 and an outer diameter 795, 1995, 2195, 2395; and the second portion 780, 1980, 2180, 2380 of the second body 705*b*, 1905*b*, 2105*b*, 2305*b* may have a second inner diameter 790, 1990, 2190, 2390 and an outer diameter 795, 1995, 2195, 2395.

In an embodiment, the first inner diameter 785, 1985, 2185, 2385 of the first body 705*a*, 1905*a*, 2105*a*, 2305*a* may be from about 3-inches to about 5-inches, and any range or value there between. In an embodiment, the first inner diameter 785, 1985, 2185, 2385 of the first body 705*a*, 1905*a*, 2105*a*, 2305*a* may be about 4-inches.

In an embodiment, the first drilling mud outlet 725*a*, 1925*a*, 2125*a*, 2325*a* may have any suitable first inner diameter 765*a*, 1965*a*, 2165*a*, 2365*a*; and the first drilling mud outlet 725*a*, 1925*a*, 2135*a*, 2325*a* may have any suitable first outer diameter 770*a*, 1970*a*, 2170*a*, 2370*a*. In an embodiment, the first inner diameter 765*a*, 1965*a*, 2165*a*, 2365*a* of the first drilling mud outlet 725*a*, 1925*a*, 2125*a*, 2325*a* may be from about 3-inches to about 5-inches, and any range or value there between. In an embodiment, the first inner diameter 765*a*, 1965*a*, 2165*a*, 2365*a* of the first drilling mud outlet 725*a*, 1925*a*, 2125*a*, 2325*a* may be about 4-inches.

In an embodiment, the first outer diameter 770*a*, 1970*a*, 2170*a*, 2370*a* of the first drilling mud outlet 725*a*, 1925*a*, 2125*a*, 2325*a* may be from about 4.5-inches to about 6.5-inches, and any range or value there between. In an embodiment, the first outer diameter 770*a*, 1970*a*, 2170*a*, 2370*a* of the first drilling mud outlet 725*a*, 1925*a*, 2125*a*, 2325*a* may be about 5-inches.

In an embodiment, the second inner diameter 790, 1990, 2190, 2390 of the second body 705*b*, 1905*b*, 2105*b*, 2305*b* may be from about 3-inches to about 5-inches, and any range or value there between. In an embodiment, the second inner diameter 790, 1990, 2190, 2390 of the second body 705*b*, 1905*b*, 2105*b*, 2305*b* may be about 4-inches.

In an embodiment, a second portion 780, 1980, 2180, 2380 of the second body 705*b*, 1905*b*, 2105*b*, 2305*b* may have a second inner diameter 790, 1990, 2190, 2390 to provide a high flow rate of drilling mud through the drilling mud screen 740, 1940, 2140, 2340. In an embodiment, the second inner diameter 790, 1990, 2190, 2390 of the second body 705*b*, 1905*b*, 2105*b*, 2305*b* may be from about 3.5-inches to about 5.5-inches, and any range or value there between. In an embodiment, the second inner diameter 790, 1990, 2190, 2390 of the second body 705*b*, 1905*b*, 2105*b*, 2305*b* may be from about 4.5-inches to about 5.5-inches, and any range or value there between.

In an embodiment, the first outer diameter 795, 1995, 2195, 2395 of the first portion 775, 1975, 2175, 2375 of the first body 705*a*, 1905*a*, 2105*a*, 2305*a* and/or the second portion 780, 1980, 2180, 2380 of the second body 705*b*, 1905*b*, 2105*b*, 2305*b* may be from about 5.5-inches to about 7.5-inches, and any range or value there between. In an embodiment, the first outer diameter 795, 1995, 2195, 2395 of the first portion 775, 1975, 2175, 2375 of the first body 705*a*, 1905*a*, 2105*a*, 2305*a* and/or the second portion 780, 1980, 2180, 2380 of the second body 705*b*, 1905*b*, 2105*b*, 2305*b* may be about 6.5-inches.

In an embodiment, the second drilling mud outlet 725*b*, 1925*b*, 2125*b*, 2325*b* may have any suitable second inner diameter 765*b*, 1965*b*, 2165*b*, 2365*b*; and the second drilling mud outlet 725*b*, 1925*b*, 2125*b*, 2325*b* may have any suitable second outer diameter 770*b*, 1970*b*, 2170*b*, 2370*b*. In an embodiment, the second inner diameter 765*b*, 1965*b*, 2165*b*, 2365*b* of the second drilling mud outlet 725*b*, 1925*b*, 2125*b*, 2325*b* may be from about 3-inches to about 5-inches, and any range or value there between. In an embodiment, the second inner diameter 765*b*, 1965*b*, 2165*b*, 2365*b* of the second drilling mud outlet 725*b*, 1925*b*, 2125*b*, 2325*b* may be about 4-inches.

In an embodiment, the second outer diameter 770*b*, 1970*b*, 2170*b*, 2370*b* of the second drilling mud outlet 725*b*, 1925*b*, 2125*b*, 2325*b* may be from about 4.5-inches to about 6.5-inches, and any range or value there between. In an embodiment, the second outer diameter 770*b*, 1970*b*, 2170*b*, 2370*b* of the second drilling mud outlet 725*b*, 1925*b*, 2125*b*, 2325*b* may be about 5.5-inches.

Optional Double Inlet

Figure 7B:
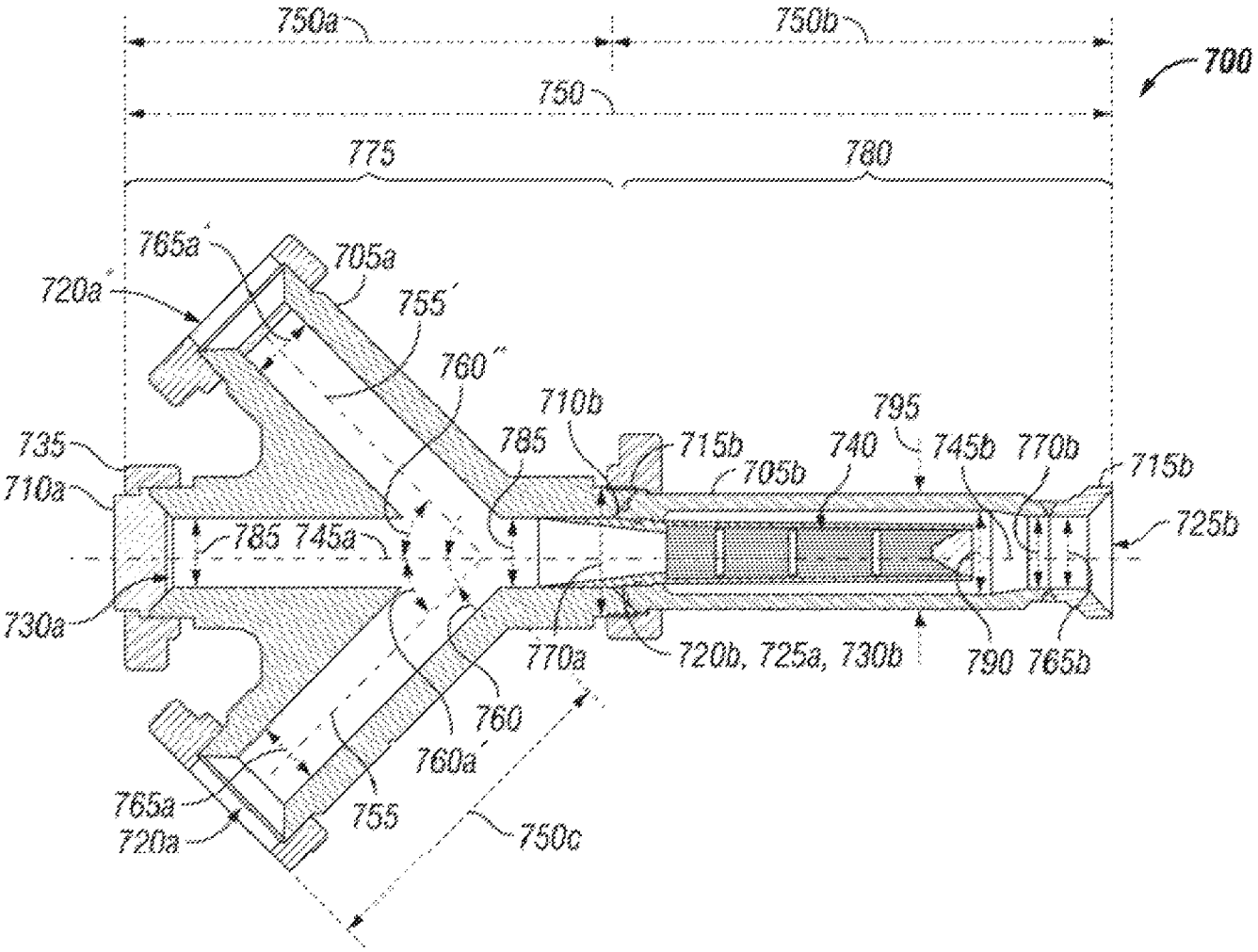
FIG. 7B illustrates an upper, cross-sectional view of a drilling mud screen system according to an embodiment of the present invention, showing a double-inlet drilling mud system.

FIG. 7B illustrates an upper, cross-sectional view of a drilling mud screen system according to an embodiment of the present invention, showing an optional double-inlet drilling mud system.

As shown in FIG. 7B, the drilling mud screen system 700 has a first body 705*a* having a first end 710*a* and a second end 715*a*, a first drilling mud inlet 720*a*, an optional first drilling mud inlet 720*a*' and a first drilling mud outlet 725*a*, an end cap 735, and a first drilling mud screen access port 730*a*. The drilling mud screen system 700 has a second body 705*b* having a first end 710*b* and a second end 715*b*, a second drilling mud inlet 720*b*, a second drilling mud outlet 725*b*, and a second drilling mud screen access port 730*b*.

In an embodiment, the first drilling mud inlet 720*a* and the optional first drilling mud inlet 720*a*' may be fluidly connected to, for example, an outlet of a drilling mud pump via a connection; and the second drilling mud outlet 725*b* may be fluidly connected to an inlet of a vibrator hose via a connection. Any suitable connection may be used for the first drilling mud inlet 720*a*, the optional first drilling mud inlet 720*a*' and the second drilling mud outlet 725*b*. For example, suitable connections include, but are not limited to, pipe fittings and welds. Connections are well known in the art. In an embodiment, the first drilling mud inlet 720*a* and the optional first drilling mud inlet 720*a*' may be fluidly connected to, for example, an outlet of a drilling mud pump via a weld; and the second drilling mud outlet 725*b* may be fluidly connected to an inlet of a vibrator hose via a weld.

In an embodiment, the first body 705*a* and the second body 705*b* may be fluidly connected by a connection. Any suitable connection may be used for the first body 705*a* and the second body 705*b*. For example, suitable connections include, but are not limited to, pipe fittings. Connections are well known in the art. In an embodiment, the first body 705*a* and the second body 705*b* may be fluidly connected by a union. In an embodiment, the union may be a five-inch 1002 WECO union.

In an embodiment, the first body 705*a* and the second body 705*b* of the drilling mud screen system 700 may be constructed of any suitable material. For example, suitable materials include, but are not limited to, any alloy steel suitable for a drilling mud application. In an embodiment, the first body 705*a* and the second body 705*b* may be constructed of an AISI 4130/75k yield or equivalent material. See e.g., FIGS. 6A-6D. In an embodiment, the inner surface of the first body 705*a* and the second body 705*b* may be unpainted. See e.g., FIG. 6D. In an embodiment, the outer surface of the first body 705*a* and the second body 705*b* may be painted. See e.g., FIGS. 6A-6D.

In an embodiment, the drilling mud screen system has a length 750. The length 750 may be any suitable length. In an embodiment, the length 750 may be from about 40-inches to about 80-inches, and any range or value there between. In an embodiment, the length 750 may be about 56-inches.

In an embodiment, the first body 705*a* has a first centerline 745*a* and a first length 750*a*. In an embodiment, the first centerline 745*a* extends through the center of the first drilling mud screen access port 730*a* to the first drilling mud outlet 725*a*. The first length 750*a* of the first body 705*a* may be any suitable length. In an embodiment, the first length 750*a* of the first body 705*a* may be from about 20-inches to about 40-inches, and any range or value there between. In an embodiment, the first length 750*a* may be about 30-inches.

In an embodiment, the first body 705*a* has a second centerline 755 and a third length 750*c*. In an embodiment, the second centerline 755 extends through the center of the first drilling mud inlet 720*a* to the first centerline 745*a* of the first body 705*a*. The third length 750*c* of the first body 705*a* may be any suitable length. In an embodiment, the third length 750*c* of the first body 705*a* may be from about 10-inches to about 20-inches, and any range or value there between. In an embodiment, the third length 750*c* may be about 14-inches or 16-inches.

In an embodiment, the first body 705*a* has a second centerline 755 and a third length 750*c*, and an optional second centerline 755' and an optional third length 750*c*'. In an embodiment, the second centerline 755 extends through the center of the first drilling mud inlet 720*a* to the first centerline 745*a* of the first body 705*a*. In an embodiment, the optional second centerline 755' extends through the center of the optional first drilling mud inlet 720*a*' to the first centerline 745*a* of the first body 705*a*. The third length 750*c* of the first body 705*a* may be any suitable length; and the optional third length 750*c*' of the first body 705*a* may be any suitable length.

In an embodiment, the third length 750*c* of the first body 705*a* may be from about 10-inches to about 20-inches, and any range or value there between. In an embodiment, the third length 750*c* may be about 14-inches or 16-inches.

In an embodiment, the optional third length 750*c*' of the first body 705*a* may be from about 10-inches to about 20-inches, and any range or value there between. In an embodiment, the optional third length 750*c*' may be about 14-inches or 16-inches.

In an embodiment, the third length 750*c* may be the same as the optional third length 750*c*'. In an embodiment, the third length 750*c* may be different from the optional third length 750*c*'.

In an embodiment, the first centerline 745*a* and the second centerline 755 of the first body 705*a* form a first angle 760. In an embodiment, the first angle 760 may be from about 30-degrees to about 120-degrees, and any range or value there between. In an embodiment, the first angle 760 may be from about 45-degrees to about 60-degrees. In an embodiment, the first angle 760 may be about 90-degrees.

In an embodiment, the first drilling mud inlet 720*a* may be offset from a first end 710*a* of the first body 705*a*. The first drilling mud inlet 720*a* may be offset from a first end 710*a* of the first body 705*a* at any suitable distance. In an embodiment, the second centerline 755 may be offset from the first end 710*a* of the first body 705*a* from about 15-inches to about 20-inches, and any range or value there between. In an embodiment, the second centerline 755 may be offset from the first end 710*a* of the first body 705*a* about 18-inches.

In an embodiment, the first drilling mud inlet 720*a* may have any suitable first inner diameter 765*a*; and the first drilling mud inlet 720*a* may have any suitable first outer diameter 770*a*. In an embodiment, the first inner diameter 765*a* of the first drilling mud inlet 720*a*' may be from about 3-inches to about 5-inches, and any range or value there between. In an embodiment, the first inner diameter 765*a* of the first drilling mud inlet 720*a* may be about 4-inches.

In an embodiment, the first centerline 745*a* and the optional second centerline 755' of the first body 705*a* form an optional first angle 760'. In an embodiment, the optional first angle 760' may be from about 30-degrees to about 120-degrees, and any range or value there between. In an embodiment, the optional first angle 760' may be from about 45-degrees to about 60-degrees. In an embodiment, the optional first angle 760' may be about 90-degrees.

In an embodiment, the first angle 760 may be the same as the optional first angle 760'. In an embodiment, the first angle 760 may be different from the optional first angle 760'.

In an embodiment, the optional first drilling mud inlet 720*a*' may be offset from a first end 710*a* of the first body 705*a*. The optional first drilling mud inlet 720*a*' may be offset from a first end 710*a* of the first body 705*a* at any suitable distance. In an embodiment, the optional first centerline 755' may be offset from the first end 710*a* of the first body 705*a* from about 15-inches to about 20-inches, and any range or value there between. In an embodiment, the optional first centerline 755' may be offset from the first end 710*a* of the first body 705*a* about 18-inches.

In an embodiment, the optional second centerline 755' of the optional first drilling mud inlet 720*a*' may be offset from the second centerline 755 of the first drilling mud inlet 720*a* radially about the first centerline 745*a* of the first body 705*a* to form an optional second angle 760". In an embodiment, the optional second angle 760" may be from about 30 degrees to about 120 degrees, and any range or value there between. In an embodiment, the optional second angle 760" may be from about 45-degrees to about 120-degrees. In an embodiment, the optional second angle 760" may be from about 90-degrees to about 120-degrees. In an embodiment, the optional second angle 760" may be about 120-degrees. See FIG. 7B.

In an embodiment, the optional first drilling mud inlet 720*a*' may have any suitable optional first inner diameter 765*a*'; and the optional first drilling mud inlet 720*a*' may have any suitable optional first outer diameter 770*a*'. In an embodiment, the optional first inner diameter 765*a*' of the optional first drilling mud inlet 720*a*' may be from about 3-inches to about 5-inches, and any range or value there between. In an embodiment, the optional first inner diameter 765*a*' of the optional first drilling mud inlet 720*a*' may be about 4-inches.

In an embodiment, the first outer diameter 770*a* of the first drilling mud inlet 720*a* may be from about 4.5-inches to about 6.5-inches, and any range or value there between. In an embodiment, the first outer diameter 770*a* of the first drilling mud inlet 720*a* may be about 5.5-inches.

In an embodiment, the optional first outer diameter 770*a*' of the optional first drilling mud inlet 720*a*' may be from about 4.5-inches to about 6.5-inches, and any range or value there between. In an embodiment, the optional first outer diameter 770*a*' of the optional first drilling mud inlet 720*a*' may be about 5.5-inches.

In an embodiment, the second body 705*b* has a second centerline 745*b* and a second length 750*b*. In an embodiment, the second centerline 745*b* extends through the center of the second drilling mud screen access port 730*b* (and the second drilling mud inlet 720*b*) to the second drilling mud outlet 725*b*. The second length 750*b* of the second body 705*b* may be any suitable length. In an embodiment, the second length 750*b* of the second body 705*b* may be from about 20-inches to about 40-inches, and any range or value there between. In an embodiment, the second length 750*b* may be about 25-inches.

In an embodiment, the second drilling mud inlet 720*b* may have any suitable second inner diameter 765*b*; and the second drilling mud inlet 720*b* may have any suitable second outer diameter 770*b*. In an embodiment, the second inner diameter 765*b* of the second drilling mud inlet 720*b* may be from about 3-inches to about 5-inches, and any range or value there between. In an embodiment, the second inner diameter 765*b* of the second drilling mud inlet 720*b* may be about 4-inches.

In an embodiment, the second outer diameter 770*b* of the second drilling mud inlet 720*b* may be from about 4.5-inches to about 6.5-inches, and any range or value there between. In an embodiment, the second outer diameter 770*b* of the second drilling mud inlet 720*b* may be about 5.5-inches.

In an embodiment, the first body 705*a* has a first portion 775 and the second body 705*b* has a second portion 780. In an embodiment, the first portion 775 of the first body 705*a* may have a first inner diameter 785 and an outer diameter 795; and the second portion 780 of the second body 705*b* may have a second inner diameter 790 and an outer diameter 795.

In an embodiment, the first inner diameter 785 of the first body 705*a* may be from about 3-inches to about 5-inches, and any range or value there between. In an embodiment, the first inner diameter 785 of the first body 705*a* may be about 4-inches.

In an embodiment, the first drilling mud outlet 725*a* may have any suitable first inner diameter 765*a*; and the first drilling mud outlet 725*a* may have any suitable first outer diameter 770*a*. In an embodiment, the first inner diameter 765*a* of the first drilling mud outlet 725*a* may be from about 3-inches to about 5-inches, and any range or value there between. In an embodiment, the first inner diameter 765*a* of the first drilling mud outlet 725*a* may be about 4-inches.

In an embodiment, the first outer diameter 770*a* of the first drilling mud outlet 725*a* may be from about 4.5-inches to about 6.5-inches, and any range or value there between. In an embodiment, the first outer diameter 770*a* of the first drilling mud outlet 725*a* may be about 5-inches.

In an embodiment, the second inner diameter 790 of the second body 705*b* may be from about 3-inches to about 5-inches, and any range or value there between. In an embodiment, the second inner diameter 790 of the second body 705*b* may be about 4-inches.

In an embodiment, a second portion 780 of the second body 705*b* may have a second inner diameter 790 to provide a high flow rate of drilling mud through the drilling mud screen 740. In an embodiment, the second inner diameter 790 of the second body 705*b* may be from about 3.5-inches to about 5.5-inches, and any range or value there between. In an embodiment, the second inner diameter 790 of the second body 705*b* may be from about 4.5-inches to about 5.5-inches, and any range or value there between.

In an embodiment, the first outer diameter 795 of the first portion 775 of the first body 705*a* and/or the second portion 780 of the second body 705*b* may be from about 5.5-inches to about 7.5-inches, and any range or value there between. In an embodiment, the first outer diameter 795 of the first portion 775 of the first body 705*a* and/or the second portion 780 of the second body 705*b* may be about 6.5-inches.

In an embodiment, the second drilling mud outlet 725*b* may have any suitable second inner diameter 765*b*; and the second drilling mud outlet 725*b* may have any suitable second outer diameter 770*b*. In an embodiment, the second inner diameter 765*b* of the second drilling mud outlet 725*b* may be from about 3-inches to about 5-inches, and any range or value there between. In an embodiment, the second inner diameter 765*b* of the second drilling mud outlet 725*b* may be about 4-inches.

In an embodiment, the second outer diameter 770*b* of the second drilling mud outlet 725*b* may be from about 4.5-inches to about 6.5-inches, and any range or value there between. In an embodiment, the second outer diameter 770*b* of the second drilling mud outlet 725*b* may be about 5.5-inches.

Optional Transducer Subassembly for Two-Piece Body

FIG. 19 illustrates a cross-sectional view of the drilling mud screen system in a monitoring configuration 1900 according to an embodiment of the present invention, showing an optional transducer subassembly 19100. As shown in FIG. 19, the drilling mud screen system 19200 has a first body 1905*a* having a first end 1910*a* and a second end 1915*a*, a first drilling mud inlet 1920*a* and a first drilling mud outlet 1925*a*, an end cap 1935, a first drilling mud screen access port 1930*a*, and an optional transducer subassembly 19100.

Figure 28:
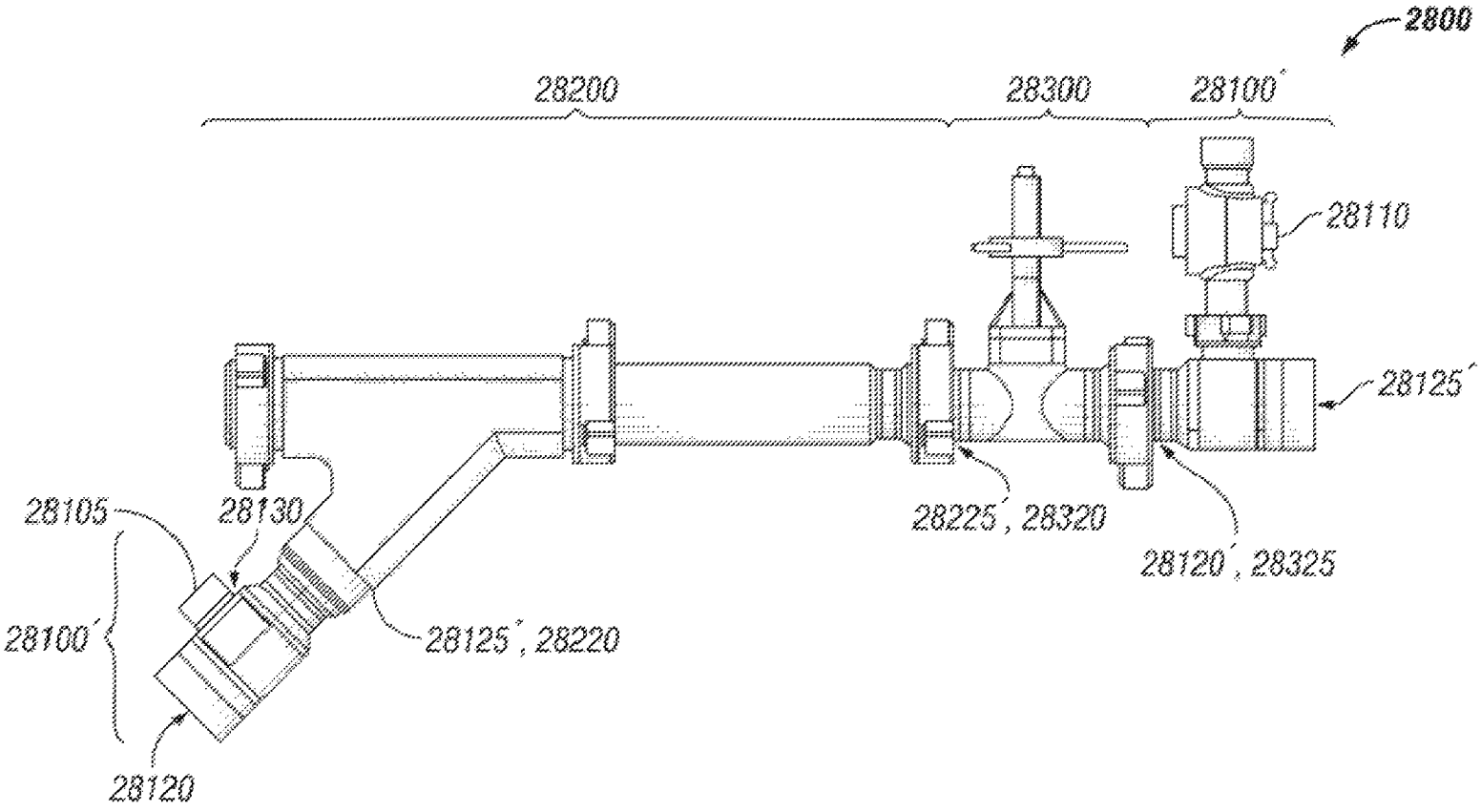
FIG. 28 illustrates a cross-sectional view of a drilling mud screen system in a cementing configuration according to an embodiment of the present invention, showing an optional first transducer subassembly having an optional transducer, a drilling mud screen system, an optional gate valve and an optional second transducer subassembly having an optional low torque plug valve.

As shown in FIGS. 19 and 28, the drilling mud inlet 1920 of the drilling mud screen system 19200, 28200 may be fluidly connected to a drilling mud outlet 28125 of the transducer subassembly 19110, 28100 via a connection. Any suitable connection may be used for the drilling mud inlet 1920 and the drilling mud outlet 28125. For example, suitable connections include, but are not limited to, pipe fittings and welds. Connections are well known in the art. In an embodiment, the drilling mud inlet 1920 of the drilling mud screen system 19200, 28200 may be fluidly connected to a drilling mud outlet 28125 of a transducer subassembly 19100 via a weld.

Figure 20A:
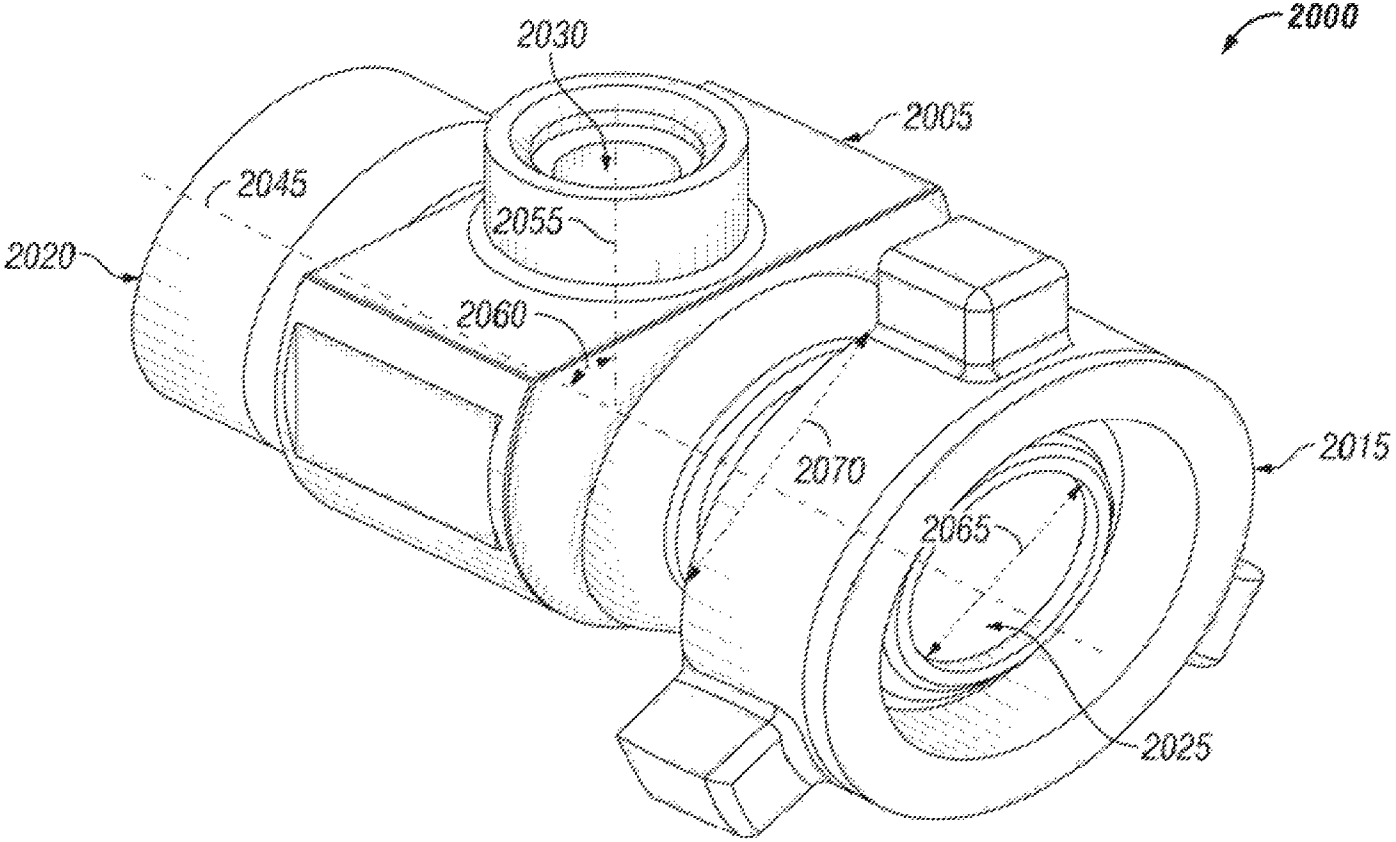
FIG. 20A illustrates an upper, right side perspective view of an optional transducer subassembly according to an embodiment of the present invention.
Figure 20B:
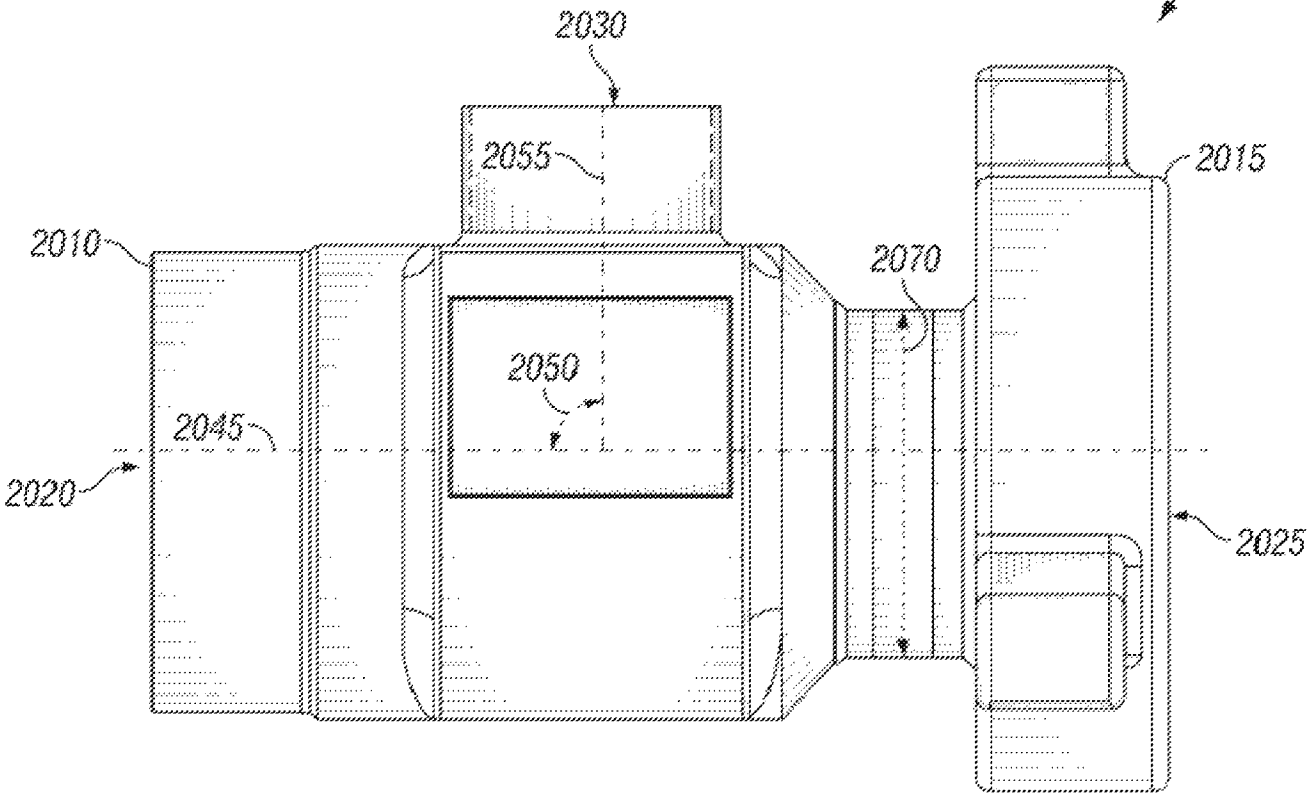
FIG. 20B illustrates a side perspective view of the optional transducer subassembly of FIG. 20A.

FIG. 20A illustrates an upper, right side perspective view of an optional transducer subassembly 2000 according to an embodiment of the present invention; and FIG. 20B illustrates a side perspective view of the optional transducer subassembly of FIG. 20A. As shown in FIGS. 20A and 20B, the optional transducer subassembly 2000 has a body 2005 having a first end 2010 and a second end 2015, an inlet 2020 and an outlet 2025, a transducer port 2030, and a transducer 28105. See e.g., FIG. 28.

In an embodiment, the drilling mud inlet 2020 of the optional transducer subassembly 2000 may be fluidly connected to, for example, an outlet of a drilling mud pump via a connection; and the drilling mud outlet 2025 may be fluidly connected to, for example, an inlet of a drilling mud screen system via a connection. Any suitable connection may be used for the drilling mud inlet 2020 and the drilling mud outlet 2025. For example, suitable connections include, but are not limited to, pipe fittings and welds. Connections are well known in the art. In an embodiment, the drilling mud inlet 2020 of the optional transducer subassembly 2000 may be fluidly connected to, for example, an outlet of a drilling mud pump via a weld; and the drilling mud outlet 2025 of the optional transducer subassembly 2000 may be fluidly connected to, for example, an inlet of a drilling mud screen system via a weld.

In an embodiment, the transducer access port 2030 of the optional transducer subassembly 2000 may be closed with a transducer via a fitting. Any suitable type of transducer may be used. For example, suitable types of transducers include, but are not limited to, displacement transducers, flow rate transducers, pressure transducers, temperature transducers and any combination thereof. Any suitable fitting may be used. For example, suitable fittings include, but are not limited to, pipe fittings. Fittings are well known in the art. In an embodiment, the transducer access port 2030 of the optional transducer subassembly 2000 may be closed with a pressure transducer via a 2-inch 1502 WECO union.

In an embodiment, a computing device (such as a rig computer) may include a bus that directly or indirectly couples the following devices: memory, one or more processors, one or more presentation components, one or more input/output (I/O) ports, I/O components, a user interface and a power supply. The computing device may include a variety of computer-readable media. The memory may include computer-storage media in the form of volatile and/or nonvolatile memory. The presentation component(s) present data indications to a user or other device. The user interface allows the user to input/output information to/from the computing device. The one or more I/O ports may allow the computing device to be logically coupled to other devices including a transducer 28105, and other I/O components, some of which may be built in. See e.g., FIG. 28. Examples of other I/O components include a printer, scanner, wireless device, and the like.

In an embodiment, the transducer access port 2030 of the optional transducer subassembly 2000 may be sealed with an end cap via an O-ring. Any suitable O-ring may be used. For example, suitable O-rings include, but are not limited to, 300 Series O-rings. O-rings are well known in the art.

In an embodiment, the body 2005 of the optional transducer subassembly 2000 may be constructed of any suitable material. For example, suitable materials include, but are not limited to, any alloy steel suitable for a drilling mud application. In an embodiment, the body 2005 may be constructed of an American Iron and Steel Industry (AISI) 4130/75*k* yield or equivalent material. See e.g., FIG. 2. In an embodiment, the inner surface of the body 2005 may be unpainted. In an embodiment, the outer surface of the body 2005 may be painted.

In an embodiment, the body 2005 has a first centerline 2045 and a length 2050. In an embodiment, the first centerline 2045 extends through the center of the drilling mud inlet 2020 to the drilling mud outlet 2025. The length 2050 of the body 2005 may be any suitable length. In an embodiment, the length 2050 of the body 2005 may be from about 10-inches to about 30-inches, and any range or value there between. In an embodiment, the length 2050 may be about 12-inches.

In an embodiment, the body 2005 has a second centerline 2055. In an embodiment, the second centerline 2055 extends through the center of the transducer access port 2030 to the first centerline 2045.

In an embodiment, the first centerline 2045 and the second centerline 2055 form a first angle 2060. In an embodiment, the first angle 2060 may be from about 20-degrees to about 120-degrees, and any range or value there between. In an embodiment, the first angle 2060 may be about 45-degrees. In an embodiment, the first angle 2060 may be about 90-degrees.

In an embodiment, the transducer access port 2030 may be offset from a first end 2010 of the body 2005. The transducer access port 2030 may be offset from a first end 2010 of the body 2005 at any suitable distance. In an embodiment, the second centerline 2055 may be offset from the first end 2010 of the body 2005 from about 6-inches to about 15-inches, and any range or value there between. In an embodiment, the second centerline 2055 may be offset from the first end 2010 of the body 2005 about 7-inches.

In an embodiment, the transducer access port 2030 may have any suitable inner diameter. In an embodiment, the inner diameter of the transducer access port 2030 may be from about 1-inches to about 3-inches, and any range or value there between. In an embodiment, the inner diameter of the transducer access port 2030 may be about 2-inches.

In an embodiment, the outer diameter of the transducer access port 2030 may be from about 1.5-inches to about 3.5-inches, and any range or value there between. In an embodiment, the outer diameter of the transducer access port 2030 may be about 2.5-inches.

In an embodiment, the drilling mud inlet 2020 may have any suitable inner diameter 2065; and the drilling mud inlet 2020 may have any suitable outer diameter 2070. In an embodiment, the inner diameter 2065 of the drilling mud inlet 2020 may be from about 3-inches to about 5-inches, and any range or value there between. In an embodiment, the inner diameter 2065 of the drilling mud inlet 2020 may be about 4-inches.

In an embodiment, the outer diameter 2070 of the drilling mud inlet 2020 may be from about 4.5-inches to about 6.5-inches, and any range or value there between. In an embodiment, the outer diameter 2070 of the drilling mud inlet 2020 may be about 5.5-inches.

In an embodiment, the drilling mud outlet 2025 may have any suitable inner diameter 2065; and the drilling mud outlet 2025 may have any suitable outer diameter 2070. In an embodiment, the inner diameter 2065 of the drilling mud outlet 2025 may be from about 3-inches to about 5-inches, and any range or value there between. In an embodiment, the inner diameter 2065 of the drilling mud outlet 2025 may be about 4-inches.

In an embodiment, the outer diameter 2070 of the drilling mud outlet 2025 may be from about 4.5-inches to about 6.5-inches, and any range or value there between. In an embodiment, the outer diameter 2070 of the drilling mud outlet 2025 may be about 5.5-inches.

Drilling Mud Screen

FIG. 5A illustrates an upper, cross-sectional view of a drilling mud screen 500 according to an embodiment of the present invention, as discussed above. FIG. 5B illustrates a detailed view of A-A of FIG. 5A; FIG. 5C illustrates a detailed view of B of FIG. 5A; and FIG. 5D illustrates a detailed view of C of FIG. 5A. FIG. 5E illustrates an upper, right side perspective view of the drilling mud screen 500 of FIG. 5A.

Optional Drilling Mud Screen

Figure 22A:
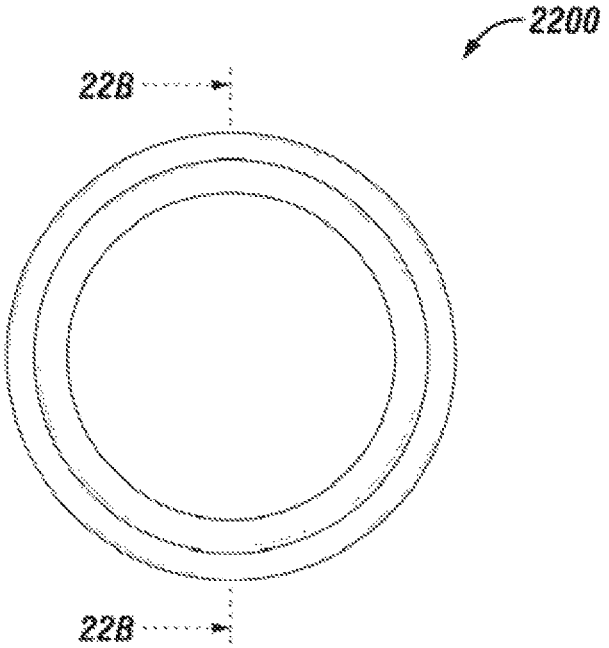
FIG. 22A illustrates an end view of an optional drilling mud screen according to an embodiment of the present invention.
Figure 22B:
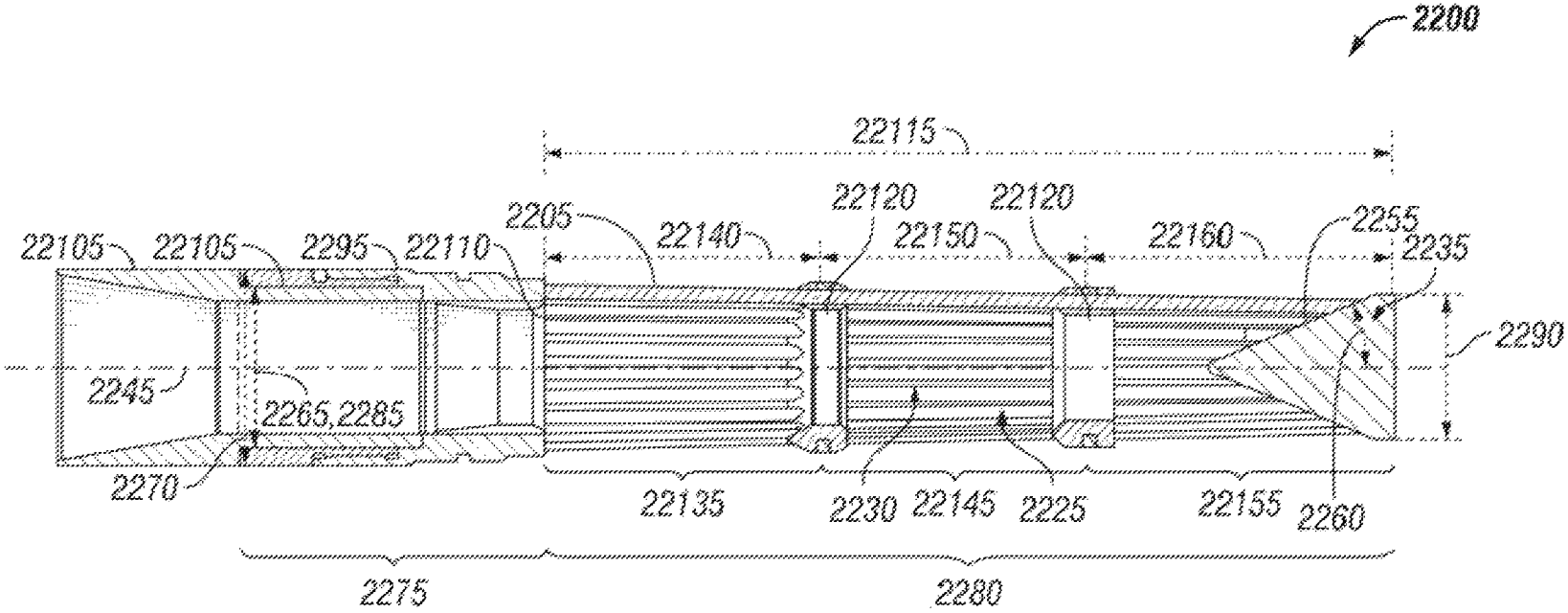
FIG. 22B illustrates a detailed, cross-sectional view of A-A of FIG. 22A, showing an optional drilling mud screen insert, and optional first end retaining ring, an optional filter length, and an optional filter retaining ring.
Figure 22C:
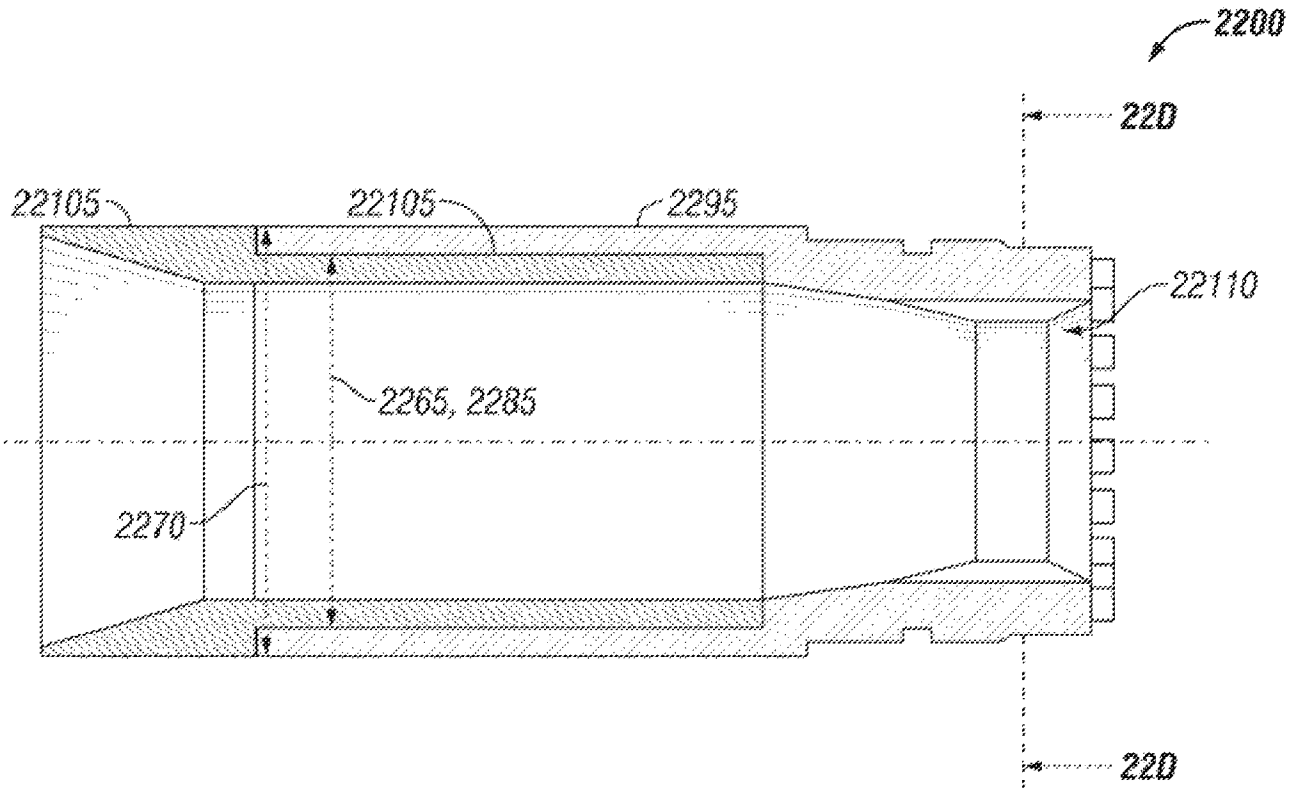
FIG. 22C illustrates a detailed view of B of FIG. 22B.
Figure 22D:
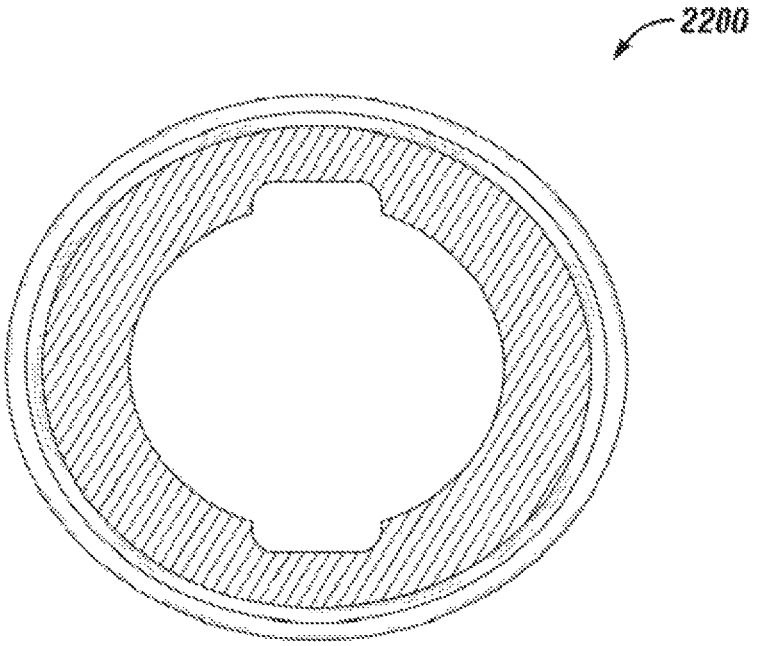
FIG. 22D illustrates a detailed, cross-sectional view of C-C of FIG. 22C.
Figure 22E:
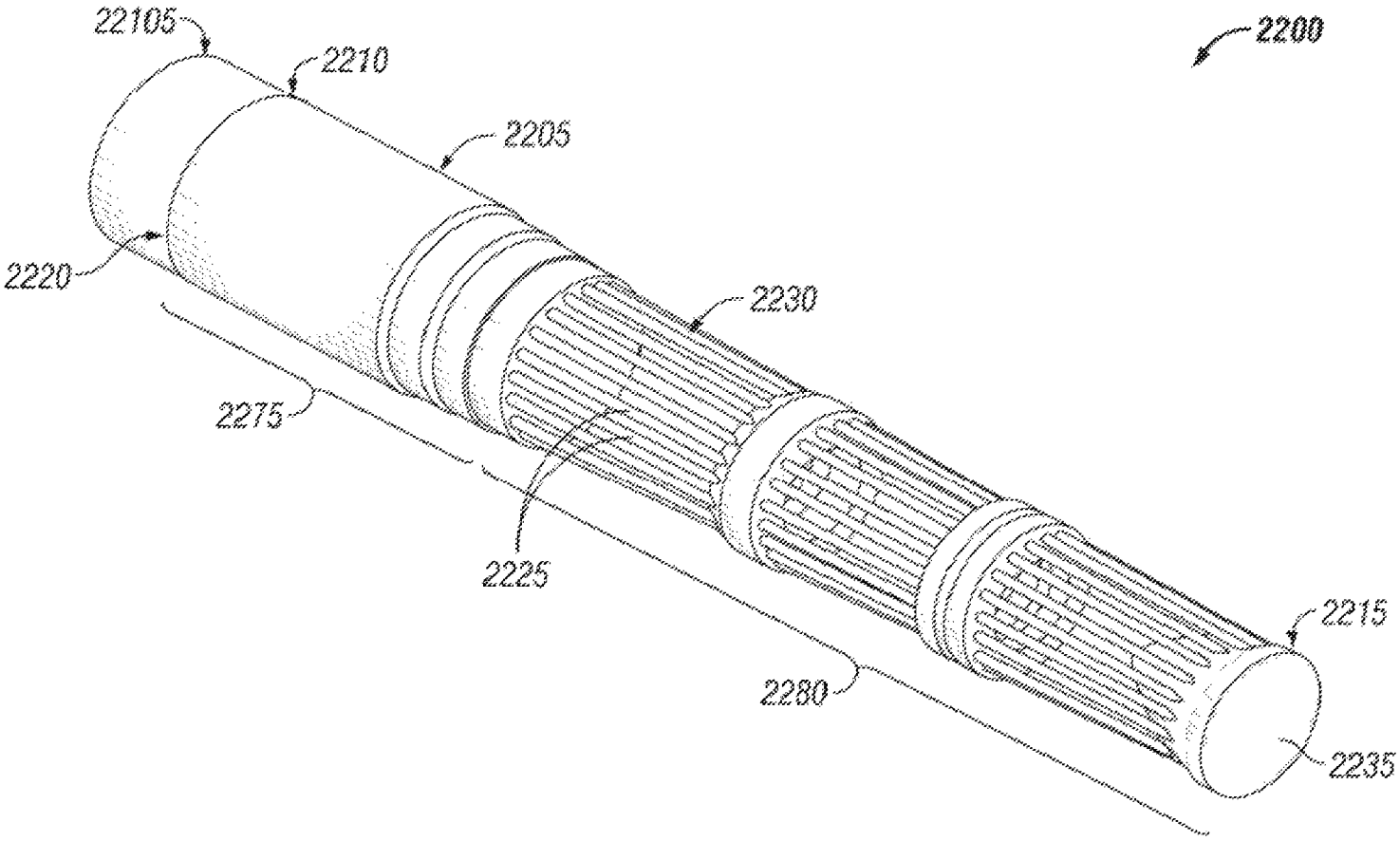
FIG. 22E illustrates an upper, right perspective view of the drilling mud screen of FIGS. 22A-22B.

FIG. 22A illustrates an end view of an optional drilling mud screen 2200 according to an embodiment of the present invention; FIG. 22B illustrates a detailed, cross-sectional view of A-A of FIG. 22A, showing an optional drilling mud screen insert 22105, and optional first end retaining ring 22110, an optional filter length 22115, and an optional retaining ring 22120; FIG. 22C illustrates a detailed view of B of FIG. 22B; FIG. 22D illustrates a detailed, cross-sectional view of C-C of FIG. 22C; and FIG. 22E illustrates an upper, right perspective view of the drilling mud screen 2200 of FIGS. 22A-22B.

As shown in FIG. 22B, the drilling mud screen 2200 has a body 2205 having a first end 2210 and a second end 2215, a drilling mud inlet 2220, a drilling mud outlet 2225, a filter 2230 and an end cap 2235.

In an embodiment, the drilling mud inlet 2220 may be fluidly connected to, for example, an outlet of a drilling mud pump via a connection; and the drilling mud outlet 2225 may be fluidly connected to an inlet of a vibrator hose via a connection. Any suitable connection may be used for the drilling mud inlet 2220 and the drilling mud outlet 2225. For example, suitable connections include, but are not limited to, pipe fittings and welds. Connections are well known in the art. In an embodiment, the drilling mud inlet 2220 may be fluidly connected to, for example, an outlet of a drilling mud pump via a weld; and the drilling mud outlet 2225 may be fluidly connected to an inlet of a vibrator hose via a weld.

In an embodiment, the body 2205 of the drilling mud screen 2200 may be constructed of any suitable material. For example, suitable materials include, but are not limited to, any alloy steel or tool steel. In an embodiment, the body 2205 may be constructed of an AISI 4145 or equivalent material. See e.g., FIGS. 5A-5E. In an embodiment, the body 2205 may be constructed of tool steel or equivalent material.

In an embodiment, the body 2205 of the drilling mud screen 2200 may have a hardened coating to reduce washing (i.e., erosion) of the screen 2200. For example, suitable hardened coatings include, but are not limited to, any Carbide coating or equivalent. In an embodiment, the body 2205 may have a Carbide coating with about 6% Cobalt binder or equivalent material.

In an embodiment, the body 2205 of the drilling mud screen 2200 has a centerline 2245 and a length 2250. In an embodiment, the centerline 2245 extends through the center of the drilling mud screen inlet 2220 to the end cap 2235. The length 2250 of the body 2205 may be any suitable length. In an embodiment, the length 2250 of the body 2205 may be from about 20-inches to about 30-inches, and any range or value there between. In an embodiment, the length 2250 may be about 25-inches.

In an embodiment, the drilling mud inlet 2220 of the drilling mud screen 2200 may have any suitable inner diameter 2265; and the drilling mud inlet 2220 may have any suitable outer diameter 2270. In an embodiment, the inner diameter 2265 of the drilling mud inlet 2220 may be from about 3-inches to about 5-inches, and any range or value there between. In an embodiment, the inner diameter 2265 of the drilling mud inlet 2220 may be about 3.9-inches.

In an embodiment, the outer diameter 2270 of the drilling mud inlet 2220 may be from about 4-inches to about 6-inches, and any range or value there between. In an embodiment, the outer diameter 2270 of the drilling mud inlet 2220 may be about 4-inches.

In an embodiment, the body 2205 of the drilling mud screen 2200 has a first portion 2275 and a second portion 2280. In an embodiment, the first portion 2275 of the body 2205 has a first length 22125; and the second portion 2280 of the body 2205 has a second length 22130. The first portion 2275 and the second portion 2280 may be any suitable length. In an embodiment, the first portion 2275 may have a first length 22125 from about 6-inches to about 10-inches, and any range or value there between; and the second portion 2280 may have a second length 22130 from about 14-inches to about 20-inches, and any range or value there between. In an embodiment, the first portion 2275 may have a first length 22125 of about 7.5-inches; and the second portion 2280 may have a second length 22130 of about 17.5-inches.

In an embodiment, the second portion 2280 of the body 2205 has a first section 22135, a second section 22145 and a third section 22155. In an embodiment, the first section 22135 has a third length 22140, the second section 22145 has a fourth length 22150 and the third section 22155 has a fifth length 22160. The first section 22135, the second section 22145 and the third section 22155 may be any suitable length. In an embodiment, the first section 22135 may be up to about 20-25% longer than the second section 22145 and/or the third section 22155, resulting in increased flow efficiency and decreased erosion.

In an embodiment, the first section 22135 may have a third length 22140 from about 4-inches to about 8-inches, and any range or value there between. In an embodiment, the first section 22135 may have a third length 22140 of about 6-inches.

In an embodiment, the second section 22145 may have a fourth length 22150 from about 4-inches to about 8-inches, and any range or value there between. In an embodiment, the second section 22145 may have a fourth length 22150 of about 5-inches.

In an embodiment, the third section 22155 may have a fifth length 22160 from about 4-inches to about 8-inches, and any range or value there between. In an embodiment, the third section 22155 may have a fifth length 22160 of about 5-inches.

In an embodiment, a second portion 2280 of the body 2205 of the drilling mud screen 2200 may have a filter 2230. In an embodiment, the filter 2230 may comprise a plurality of rods spaced a distance apart to form a filter. In an embodiment, the distance may be less than a particle size (e.g., diameter) desired to be filtered from the drilling mud. Particle filtration is well known in the art.

In an embodiment, the filter 2230 may comprise a formed sheet having drilled holes spaced a distance apart to form a filter. In an embodiment, the size of the holes (e.g., diameter) may be less than a particle size (e.g., diameter) desired to be filtered. Particle filtration is well known in the art.

In an embodiment, a second portion 2280 of the body 2205 of the drilling mud screen 2200 may have a drilling mud outlet 2225. In an embodiment, the drilling mud outlet 2225 may comprise a plurality of spaces (i.e., flow passages) between a plurality of rods. In an embodiment, the drilling mud outlet 2225 may comprise a plurality of holes (i.e., flow passages) drilled in a formed sheet.

In an embodiment, a first end 2210 of a first portion 2275 of the body 2205 of the drilling mud screen 2200 may have a first inner diameter 2285; and a second end 2215 of a second portion 2280 of the body 2205 may have a second inner diameter 2290.

In an embodiment, the first end 2210 of the first portion 2275 may be shaped to accept a puller/installer plate 975 of a drilling mud screen puller/installer tool 800, 900, as discussed below. See e.g., FIGS. 5A, 8A & 9A.

In an embodiment, the body 2205 and/or a filter 2230 of the drilling mud screen 2200 may have a tapered drilling mud flow path from a larger inner diameter (ID) to a smaller ID to reduce washing (i.e., erosion) of the screen 2200.

In an embodiment, the first inner diameter 2285 of the first end 2210 of the body 2205 of the drilling mud screen 2200 may be from about 3-inches to about 5-inches, and any range or value there between. In an embodiment, the first inner diameter 2285 of the first end 2210 of the body 2205 may be about 3.9-inches.

FIG. 22D illustrates a detailed view of C-C of FIG. 22C, showing an outlet of a first portion 2275 of the body 2205 and an inlet of the second portion 2280 of the body 2205. In an embodiment, an inner diameter of an outlet of the first portion 2275 and an inlet of the second portion 2290 of the body 2205 may be from about 2-inches to about 3-inches, and any range or value there between. In an embodiment, the inner diameter of the outlet of the first portion 2275 of the body 2205 and the inlet of the second portion 2290 of the body 2205 may be about 2.5-inches.

In an embodiment, the outlet of the first portion 2275 and/or the inlet of the second portion 2290 of the body 2205 may be shaped to accept a rounded end 875, 975 of a drilling mud screen puller/installer tool 800, 900. See e.g., FIGS. 5B, 8B & 9B. See also FIGS. 12B, 13B & 29. In an embodiment, the inlet of the second portion 2290 of the body 2205 may have an inner shoulder to provide a pushing surface for the rounded end 875, 975 of the drilling mud screen puller/installer tool 800, 900. Id.

In an embodiment, the outlet of the first portion 2275 and/or the inlet of the second portion 2280 of the body 2205 may have a means to engage 2240 a drilling mud screen puller/installer tool 800, 900, as discussed below. See e.g., FIGS. 5A, 8A & 9A. The means to engage 2240 may be any suitable means to accept, and provide a pulling surface for, the drilling mud screen puller/installer tool 800, 900. For example, a suitable means to engage 2240 includes, but is not limited to, a "key" opening to rotationally engage an inner shoulder. In an embodiment, the outlet of the first portion 2275 and/or the inlet of the second portion 2290 of the body 2205 may be shaped to accept a puller/installer plate 870, 970 of a drilling mud screen puller/installer tool 800, 900. See e.g., FIGS. 5B, 8B & 9B. See also FIGS. 12A, 13A & 29. In an embodiment, the inlet of the second portion 2290 of the body 2205 may have an inner shoulder to provide a pulling surface for the puller/installer plate 870, 970 of the drilling mud screen puller/installer tool 800, 900. Id.

In an embodiment, the second inner diameter 2290 of the second end 2215 of the body 2205 of the drilling mud screen 2200 may be from about 2-inches to about 3-inches, and any range or value there between. In an embodiment, the second inner diameter 2290 of the second end 2215 of the body 2205 may be about 2.3-inches.

In an embodiment, the outer surface 2295 of the first portion 2275 of the body 2205 of the drilling mud screen 2200 may be adapted to engage one or more shoulders in an inner surface of the body 2205. In an embodiment, a first shoulder and a second shoulder of the body 2205 may be offset from a first end 2210 of the body 2205. Cf. FIGS. 4A & 5A. The first and second shoulders may be offset from the first end 2210 of the body 2205 at any suitable distance. In an embodiment, the first shoulder may be offset from the first end 2210 of the body 2205 from about 4-inches to about 8-inches, and any range or value there between; and the second shoulder may be offset from the first end 2210 of the body 2205 from about 5-inches to about 9-inches, and any range or value there between. In an embodiment, the first shoulder may be offset from the first end 2210 of the body 2205 about 4.8-inches; and the second shoulder may be offset from the first end 2210 of the body 2205 about 6.8-inches.

In an embodiment, the outer surface 2295 of the body 2205 of the drilling mud screen 2200 may be sealed against an inner surface of the body 2205 via an O-ring. Cf. FIGS. 4A & 5A. Any suitable O-ring may be used. For example, suitable O-rings include, but are not limited to, 300 Series O-rings. O-rings are well known in the art.

FIG. 22C illustrates a detailed view of B of FIG. 22B, showing a detailed view of a groove for an O-ring. In an embodiment, a groove for an O-ring may be offset from a first end 2210 of the body 2205 of the drilling mud screen 2200. The groove for the O-ring may be offset from the first end 2210 of the body 2205 at any suitable distance. In an embodiment, the groove for the O-ring may be offset from the first end 2210 of the body 2205 from about 4-inches to about 8-inches, and any range or value there between. In an embodiment, the groove for the O-ring may be offset from the first end 2210 of the body 2205 about 5.7-inches.

In an embodiment, the filter 2230 may have a plurality of rods spaced a distance apart to form a filter, or, alternatively, a formed sheet having drilled holes spaced a distance apart to form a filter. In an embodiment, the plurality of rods may be tapered from a larger outer diameter (OD) to a smaller OD to encourage drilling mud flow to exit in straight lines through the drilling mud outlet 2225 (i.e., through flow passages between the plurality rods) to reduce washing (i.e., erosion) of the screen 2200. In an embodiment, the filter 2230 may have a plurality of straight rows of holes drilled in a formed sheet to encourage drilling mud flow to exit in straight rows of strings through the drilling mud outlet 2225 (i.e., through straight flow passages of the drilled holes) to reduce washing (i.e., erosion) of the screen 2200.

In an embodiment, a first end of a filter 2230 may be connected to a second end 2215 of the body 2205 via a connection; and a second end of a filter 2230 may be connected to a first end of the end cap 2235 via a connection. Any suitable connection may be used for the drilling mud inlet 2230. For example, suitable connections include, but are not limited to, welds. Connections are well known in the art. In an embodiment, the first end of the filter 2230 may be connected to the second end 2215 of the body 2205 via a weld; and the second end of the filter 2230 may be connected to the first end of the end cap 2235 via a weld.

In an embodiment, the first end of the filter 2230 may fit into a first recess in the second end 2215 of the body 2205; and the second end of the filter may fit into a second recess in the first end of the end cap 2235. In an embodiment, the first recess and the second recess may be a plurality of recessed holes or a recessed groove. In an embodiment, the first recess and the second recess may be a plurality of recessed holes.

In an embodiment, the filter 2230 may be held together with a retaining ring. In an embodiment, the retaining ring may have a plurality of holes to hold the plurality of rods to form the filter 2230. In an embodiment, the plurality of rods may be connected to the plurality of holes in the retainer ring via a connection. Any suitable connection may be used for the drilling mud inlet 2230. For example, suitable connections include, but are not limited to, welds. Connections are well known in the art. In an embodiment, the plurality of rods may be connected to the plurality of holes in the retainer ring via a weld.

In an embodiment, the filter 2230, including any retaining rings, of the drilling mud screen 2200 may be constructed of any suitable material. For example, suitable materials include, but are not limited to, any alloy steel or tool steel. In an embodiment, the filter 2230 may be constructed of 304 stainless steel material. See e.g., FIGS. 5A & 5E. In an embodiment, the filter 2230 may be constructed of AISI 4145 or equivalent material. In an embodiment, the filter 2230 may be constructed of D2 tool steel or equivalent material.

In an embodiment, the filter 2230 may have a hardened coating to reduce washing (i.e., erosion) of the screen 2200. For example, suitable hardened coatings include, but are not limited to, any Carbide coating or equivalent. In an embodiment, the filter 2230 may have a Carbide coating with about 6% Cobalt binder or equivalent material.

In an embodiment, the end cap 2235 of the drilling mud screen 2200 has an inner surface 2255. In an embodiment, the inner surface 2255 of the end cap 2235 of the drilling mud screen 200 may redirect the flow to reduce washing (i.e., erosion) of the screen 2200. In an embodiment, the inner surface 2255 of the end cap 2235 of the drilling mud screen 2200 forms an inverted cone relative to the second end 2215 of the body 2205 of the drilling mud screen 2200 to redirect the flow. In an embodiment, the tip of the inverted cone may have a rounded or squared shape.

In an embodiment, the body 2205 of the drilling mud screen 2200 has a centerline 2245 and a length 2250. In an embodiment, the centerline 2245 extends through the center of the drilling mud screen inlet 2220 to the end cap 2235. In an embodiment, the centerline 2245 of the body 2205 of the drilling mud screen 2200 and the inner surface 2255 of the end cap 2235 form an angle 2260. In an embodiment, the angle 2260 may be from about 30-degrees to about 60-degrees, and any range or value there between. In an embodiment, the angle 2260 may be from about 35-degrees to about 45-degrees.

In an embodiment, the end cap 2235 of the drilling mud screen 2200 may be constructed of any suitable material. For example, suitable materials include, but are not limited to, any alloy steel or tool steel. In an embodiment, the end cap 2235 may be constructed of 304 stainless steel material or equivalent material. See e.g., FIGS. 5A & 5E. In an embodiment, the end cap 2235 may be constructed of AISI 4155 or equivalent material. In an embodiment, the end cap 2235 may be constructed of tool steel or equivalent material.

In an embodiment, the end cap 2235 of the drilling mud screen 2200 may have a hardened coating to reduce washing (i.e., erosion) of the screen 2200. For example, suitable hardened coatings include, but are not limited to, any Carbide coating or equivalent. In an embodiment, the end cap 2235 may have a Carbide coating with about 6% Cobalt binder or equivalent material.

FIG. 22E illustrates an upper, right side perspective view of the drilling mud screen 2200 of FIGS. 22A-22B. As shown in FIG. 33E, the drilling mud screen 2200 has a body 2205 having a first end 2210 and a second end 2215, a drilling mud inlet 2220, a drilling mud outlet 2225, a filter 2230 and an end cap 2235. In an embodiment, the body 2205 of the drilling mud screen 2200 has a first portion 2275 and a second portion 2280.

Optional Drilling Mud Screen Insert

FIG. 23 illustrates a cross-sectional view of a mud screen system according to an embodiment of the present invention, showing an optional drilling mud screen insert 23105 inserted into a drilling mud screen 2340. As shown in FIG. 23, the drilling mud screen system 700, 1900, 2100 has an optional drilling mud screen insert 23105 inserted into a drilling mud screen 2340 to reduce the washing (i.e., erosion) of the drilling mud screen 2340. In an embodiment, the optional drilling mud screen insert 23105 may be inserted into a first end 510, 2210 of the drilling mud screen 2340. See e.g., FIGS. 5 & 22. In an embodiment, the optional drilling mud screen insert 23105 may be brazed or welded to the drilling mud screen 2340.

Figure 24A:
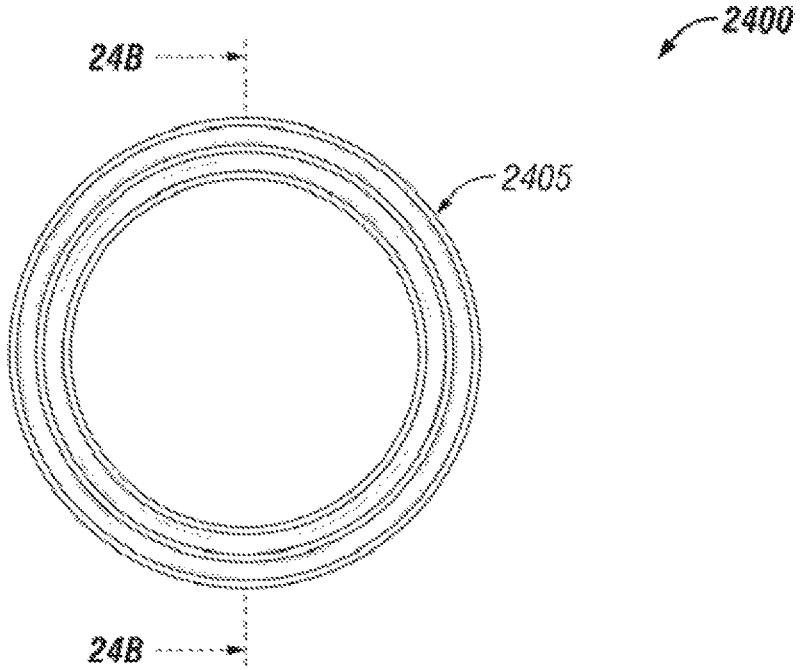
FIG. 24A illustrates an end view of an optional drilling mud screen insert according to an embodiment of the present invention.
Figure 24B:
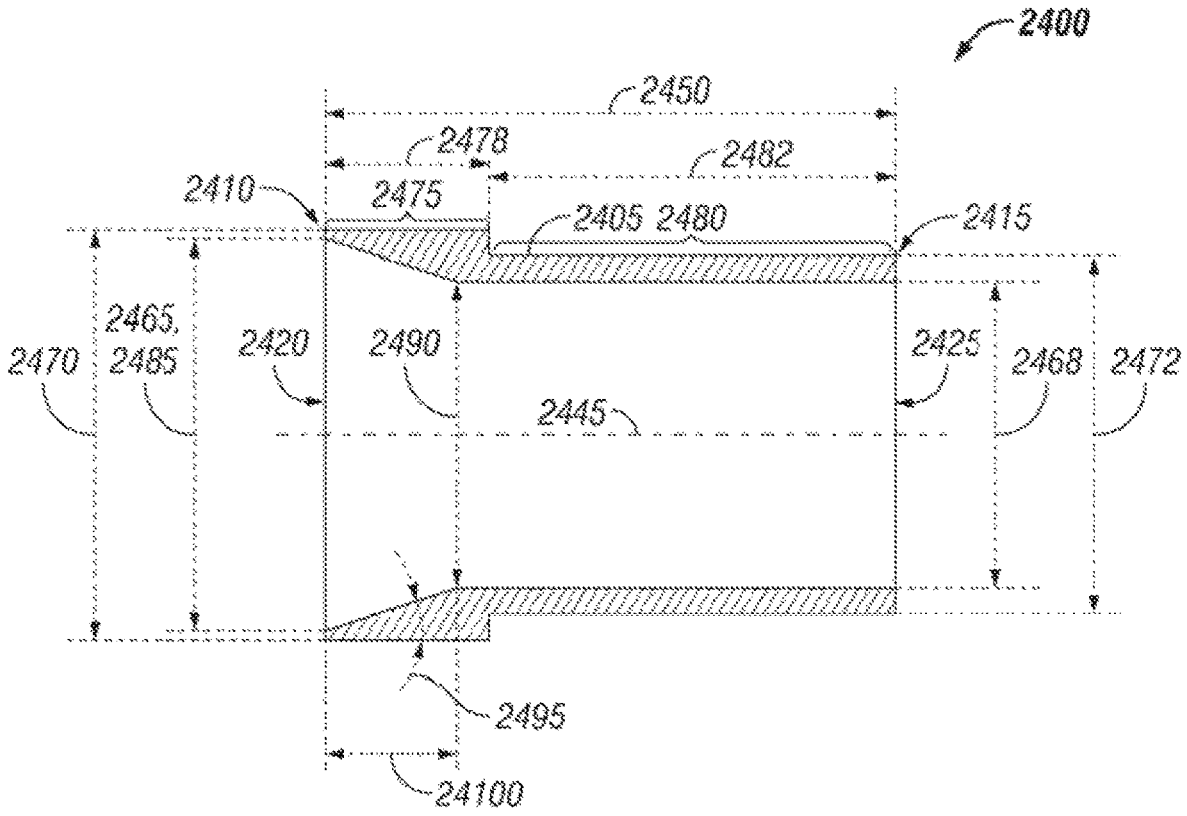
FIG. 24B illustrates a detailed, cross-sectional view of A-A of FIG. 24A, showing an inlet of the drilling mud screen insert and an outlet of the drilling mud screen insert.
Figure 24C:
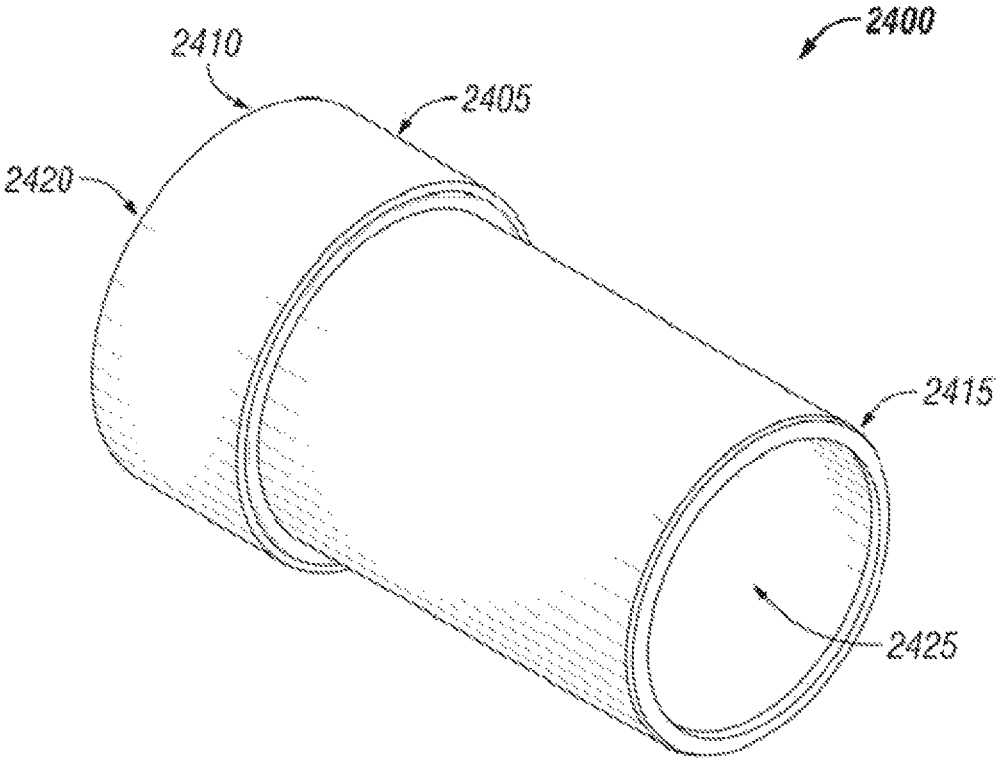
FIG. 24C illustrates an upper, right perspective view of the optional drilling mud screen insert of FIGS. 24A-24B.

FIG. 24A illustrates an end view of an optional drilling mud screen insert according to an embodiment of the present invention; FIG. 24B illustrates a detailed, cross-sectional view of A-A of FIG. 24A, showing an inlet of the drilling mud screen insert and an outlet of the drilling mud screen insert; and FIG. 24C illustrates an upper, right perspective view of the optional drilling mud screen insert of FIGS. 24A-24B. As shown in FIG. 24B, the optional drilling mud screen insert 2400 has a body 2405 having a first end 2410 and a second end 2415, a drilling mud inlet 2420 and a drilling mud outlet 2425.

In an embodiment, the body 2405 of the optional drilling mud screen insert 2400 may be constructed of any suitable material. For example, suitable materials include, but are not limited to, any alloy steel or tool steel. In an embodiment, the body 2405 may be constructed of an AISI 4145 or equivalent material. See e.g., FIGS. 5A-5E. In an embodiment, the body 2405 may be constructed of tool steel or equivalent material.

In an embodiment, the body 2405 of the optional drilling mud screen insert 2400 may have a hardened coating to reduce washing (i.e., erosion) of the insert 2400. For example, suitable hardened coatings include, but are not limited to, any Carbide coating or equivalent. In an embodiment, the body 2405 may have a Carbide coating with about 6% Cobalt binder or equivalent material.

In an embodiment, the body 2405 of the optional drilling mud screen insert 2400 has a centerline 2445 and a length 2450. In an embodiment, the centerline 2445 extends through the center of the drilling mud inlet 2420 to the drilling mud outlet 2425. The length 2450 of the body 2405 may be any suitable length. In an embodiment, the length 2450 of the body 2405 may be from about 5-inches to about 10-inches, and any range or value there between. In an embodiment, the length 2450 may be about 6.9-inches.

In an embodiment, the drilling mud inlet 2420 of the optional drilling mud screen insert 2400 may have any suitable inner diameter 2465; and the drilling mud inlet 2420 may have any suitable outer diameter 2470. In an embodiment, the inner diameter 2465 of the drilling mud inlet 2450 may be from about 3-inches to about 5-inches, and any range or value there between. In an embodiment, the inner diameter 2465 of the drilling mud inlet 2420 may be about 3.9-inches.

In an embodiment, the outer diameter 2470 of the drilling mud inlet 2420 may be from about 4-inches to about 6-inches, and any range or value there between. In an embodiment, the outer diameter 2470 of the drilling mud inlet 2420 may be about 4-inches.

In an embodiment, the drilling mud outlet 2425 of the optional drilling mud screen insert 2400 may have any suitable inner diameter 2468; and the drilling mud outlet 2425 may have any suitable outer diameter 2472. In an embodiment, the inner diameter 2468 of the drilling mud outlet 2425 may be from about 2-inches to about 5-inches, and any range or value there between. In an embodiment, the inner diameter 2468 of the drilling mud outlet 2425 may be about 3-inches.

In an embodiment, the outer diameter 2472 of the drilling mud outlet 2425 may be from about 3.5-inches to about 6-inches, and any range or value there between. In an embodiment, the outer diameter 2472 of the drilling mud outlet 2425 may be about 3.5-inches.

In an embodiment, the body 2405 of the optional drilling mud screen insert 2400 has a first portion 2475 and a second portion 2480. In an embodiment, the first portion 2475 of the body 2405 has a first length 2478; and the second portion 2480 of the body 2405 has a second length 2482. The first portion 2475 and the second portion 2480 may be any suitable length. In an embodiment, the first portion 2475 may have a first length 2478 from about 1-inch to about 3-inches, and any range or value there between; and the second portion 2480 may have a second length 2482 from about 3-inches to about 7-inches, and any range or value there between. In an embodiment, the first portion 2475 may have a first length 2478 of about 2-inches; and the second portion 2480 may have a second length 2482 of about 4.9-inches.

In an embodiment, the first portion 2475 of the body 2405 may have a first inner diameter 2485 and a second inner diameter 2490.

In an embodiment, the first inner diameter 2485 of the first portion 2475 may have any suitable diameter. In an embodiment, the first inner diameter 2485 of the first portion 2475 may be from about 3-inches to about 5-inches, and any range or value there between. In an embodiment, the first inner diameter 2485 of the first portion 2475 may be about 3.9-inches.

In an embodiment, the second inner diameter 2490 of the first portion 2475 may have any suitable diameter. In an embodiment, the second inner diameter 2490 of the first portion 2475 may be from about 2-inches to about 5-inches, and any range or value there between. In an embodiment, the second inner diameter 2490 of the first portion 2475 may be about 3-inches.

In an embodiment, an outer surface of the first portion 2475 and an inner surface of the first portion 2475 form an angle 2495 over a third length 24125. In an embodiment, the angle may be from about 10-degrees to about 20-degrees, and any range or value there between. In an embodiment, the angle 2495 may be about 15-degrees.

In an embodiment, the third length 24125 may be from about 1-inch to about 2-inches, and any range or value there between. In an embodiment, the third length 24125 may be about 1.5-inches.

Optional First End Retaining Ring

Figure 25:
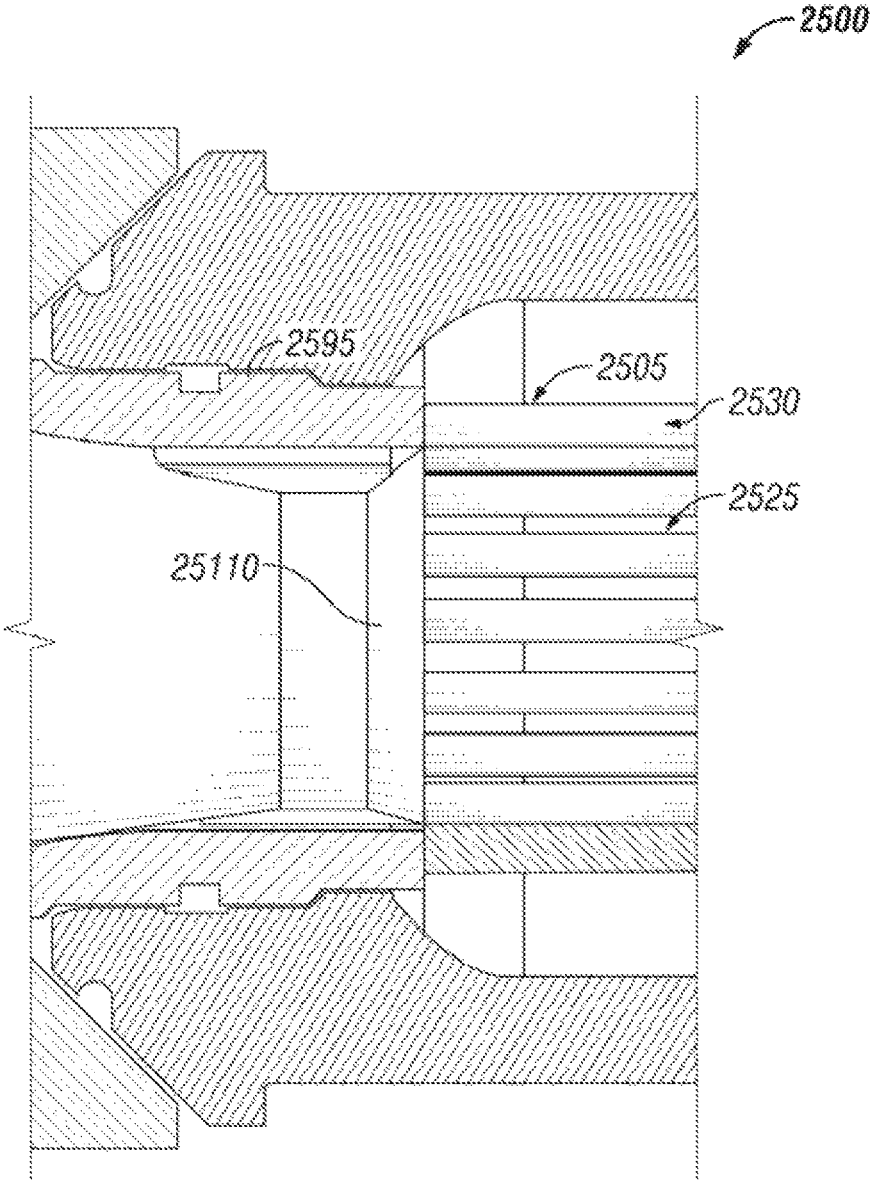
FIG. 25 illustrates a detailed, cross-sectional view of the optional drilling mud screen, showing an optional first end retaining ring.

FIG. 25 illustrates a detailed, cross-sectional view of the optional drilling mud screen 2500, showing an optional first end retaining ring 25110. As shown in FIG. 25, the optional drilling mud screen 2500 has a body 2505, a drilling mud outlet 2525, a filter 2530, an outer surface of body 2595 and an optional first end retaining ring 25110.

As shown in FIGS. 22B and 25, the filter 2230 may be held together with an optional first end retaining ring 25110. In an embodiment, the optional filter retaining ring 25110 may have a plurality of holes to hold the plurality of rods to form the filter 2230. In an embodiment, the plurality of rods may be connected to the plurality of holes in the optional filter retainer ring via a connection. Any suitable connection may be used for the drilling mud inlet 2230. For example, suitable connections include, but are not limited to, welds. Connections are well known in the art. In an embodiment, the plurality of rods may be connected to the plurality of holes in the retainer ring via a weld.

In an embodiment, the optional first end retaining ring 25110 of the optional drilling mud screen 2500 may be constructed of any suitable material. For example, suitable materials include, but are not limited to, any alloy steel or tool steel. In an embodiment, the optional first end retaining ring 25110 may be constructed of an AISI 4145 or equivalent material. See e.g., FIGS. 5A-5E. In an embodiment, the optional first end retaining ring 25110 may be constructed of D2 tool steel or equivalent material.

In an embodiment, the optional first end retaining ring 25110 of the optional drilling mud screen 2500 may have a hardened coating to reduce washing (i.e., erosion) of the retaining ring 25110. For example, suitable hardened coatings include, but are not limited to, any Carbide coating or equivalent. In an embodiment, the optional first end retaining ring 25110 may have a Carbide coating with about 6% Cobalt binder or equivalent material.

In an embodiment, the optional first end retaining ring 25110 may be modified to reduce an inside surface exit angle between the first portion 2575 and the second portion 2580 of the drilling mud screen 2500, resulting in increased flow efficiency and decreased erosion. In an embodiment, the exit angle may be about 10-degrees to about 90-degrees, and any range or value there between. In an embodiment, the exit angle may be from about 10-degrees to about 50-degrees. In an embodiment, the exit angle may be about 30-degrees.

Optional Filter Retaining Ring

Figure 26A:
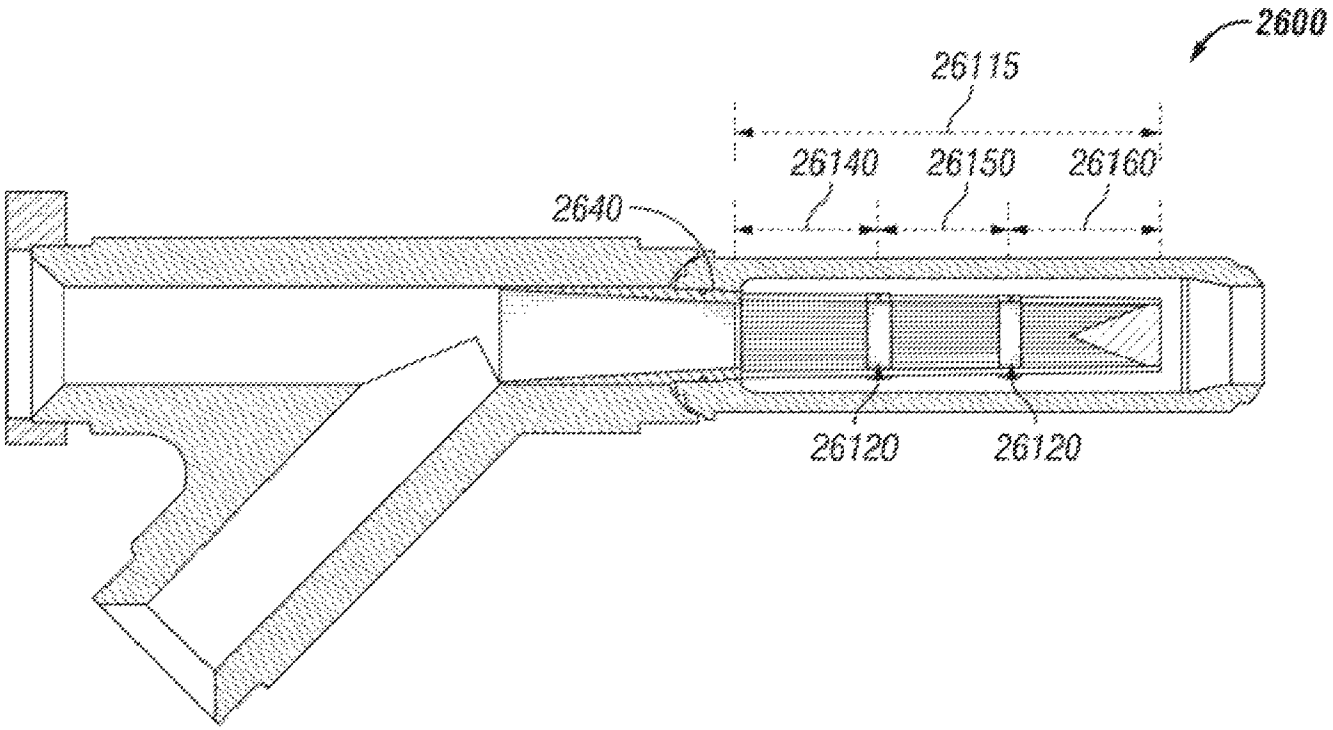
FIG. 26A illustrates a side view of an optional drilling mud screen according to an embodiment of the present invention, showing an optional filter length, and an optional filter retaining ring.
Figure 26B:
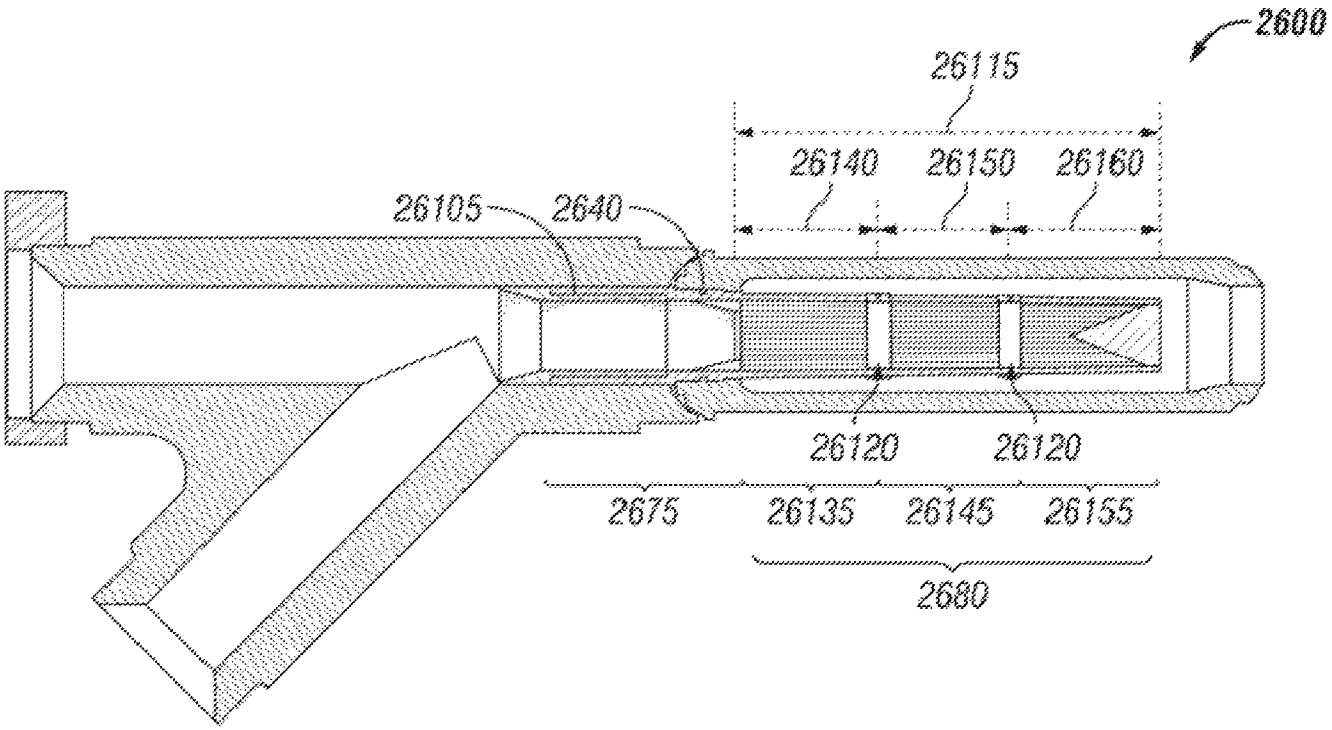
FIG. 26B illustrates a detailed, cross-sectional view of the optional drilling mud screen of FIG. 26A, showing an optional drilling mud screen insert, an optional filter length, and an optional filter retaining ring.

FIG. 26A illustrates a side view of an optional drilling mud screen system 2600 according to an embodiment of the present invention, showing an optional filter length 26115, and an optional filter retaining ring 26120; and FIG. 26B illustrates a detailed, cross-sectional view of the optional drilling mud screen system 2600 of FIG. 26A, showing an optional drilling mud screen insert 26105, an optional filter length 26115, and an optional filter retaining ring 26120. As shown in FIGS. 26A and 26B, the optional drilling mud screen system 2600 has an optional drilling mud screen insert 26105, an optional filter length 26115, and an optional retaining ring 26120.

In an embodiment, the optional filter retaining ring 26120 of the optional drilling mud screen 2640 may be constructed of any suitable material. For example, suitable materials include, but are not limited to, any alloy steel or tool steel. In an embodiment, the optional filter retaining ring 26120 may be constructed of an AISI 4145 or equivalent material. See e.g., FIGS. 5A-5E. In an embodiment, the optional filter retaining ring 26120 may be constructed of D2 tool steel or equivalent material.

In an embodiment, the optional filter retaining ring 26120 of the optional drilling mud screen 2640 may have a hardened coating to reduce washing (i.e., erosion) of the optional filter retaining ring 26120. For example, suitable hardened coatings include, but are not limited to, any Carbide coating or equivalent. In an embodiment, the optional filter retaining ring 26120 may have a Carbide coating with about 6% Cobalt binder or equivalent material.

In an embodiment, the optional filter retaining ring 26120 of the optional drilling mud screen 2640 may be modified to reduce inside surface entry and exit angles of the drilling mud screen 2640, resulting in increased flow efficiency and decreased erosion. In an embodiment, the exit and entry angles may be from about 10-degrees to about 90-degrees, and any range or value there between. In an embodiment, the entry and exit angles may be from about 10-degrees to about 50-degrees. In an embodiment, the entry and exit angles may be about 30-degrees.

Figure 27A:
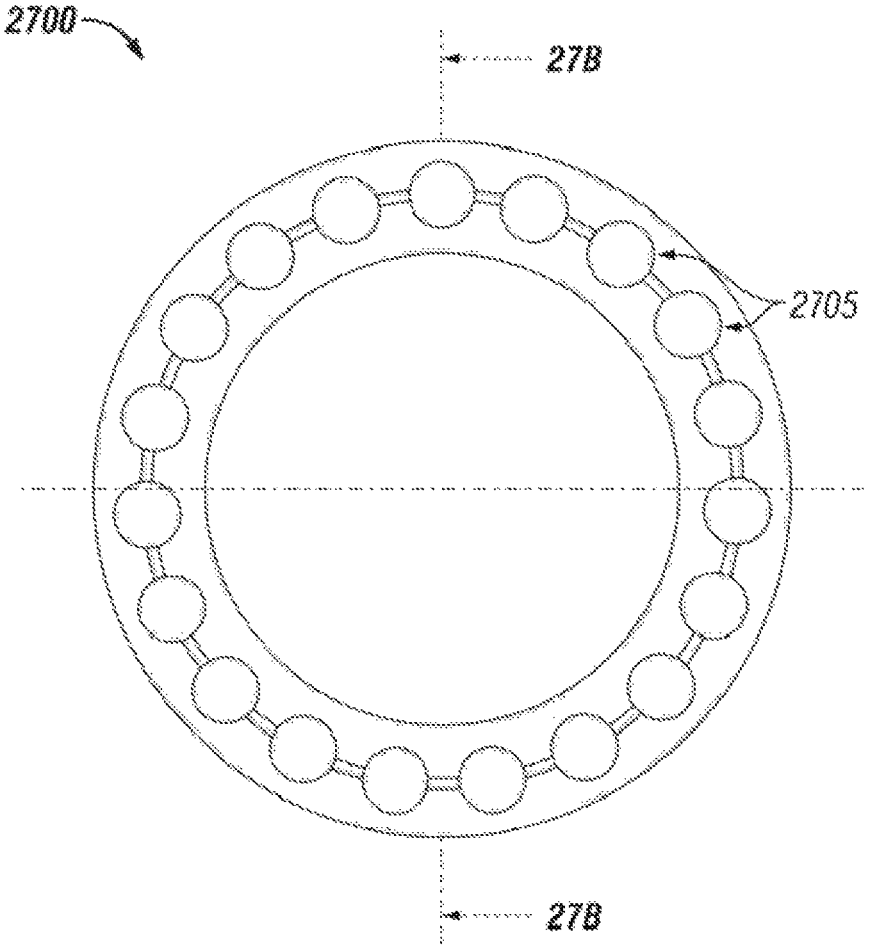
FIG. 27A illustrates an end view of an optional filter retaining ring according to an embodiment of the present invention.
Figure 27B:
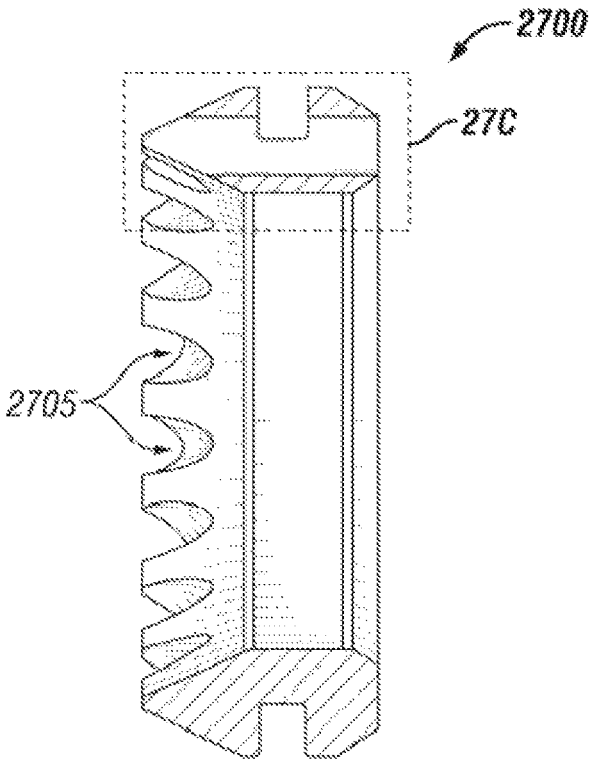
FIG. 27B illustrates a detailed, cross-sectional view of A-A of FIG. 27A.
Figure 27C:
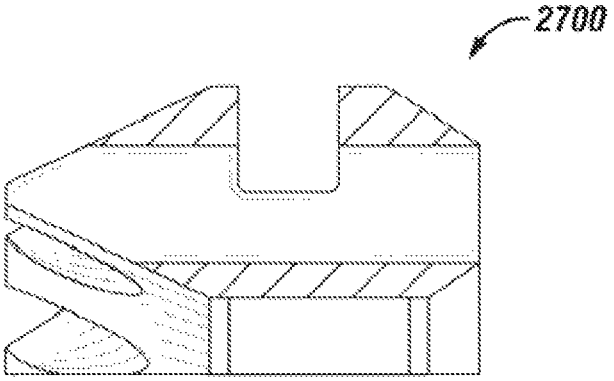
FIG. 27C illustrates a detailed, cross-sectional view of B of FIG. 27B.

FIG. 27A illustrates an end view of an optional filter retaining ring 2700 according to an embodiment of the present invention; FIG. 27B illustrates a detailed, cross-sectional view of A-A of FIG. 27A; and FIG. 27C illustrates a detailed, cross-sectional view of B of FIG. 27B.

As shown in FIGS. 22B and 27A, the filter 2230 may be held together with an optional filter retaining ring 2700. In an embodiment, the optional filter retaining ring 2700 may have a plurality of holes 2705 to hold the plurality of rods to form the filter 2230. In an embodiment, the plurality of rods may be connected to the plurality of holes in the optional filter retainer ring via a connection. Any suitable connection may be used for the drilling mud inlet 2230. For example, suitable connections include, but are not limited to, welds. Connections are well known in the art. In an embodiment, the plurality of rods may be connected to the plurality of holes in the retainer ring via a weld.

In an embodiment, the optional filter retaining rings 2700 of the optional drilling mud screen 2200 may be constructed of any suitable material. For example, suitable materials include, but are not limited to, any alloy steel or tool steel. In an embodiment, the optional filter retaining rings 2700 may be constructed of 304 stainless steel material. See e.g., FIGS. 5A & 5E. In an embodiment, the optional filter retaining rings 2700 may be constructed of AISI 4145 or equivalent material. In an embodiment, the optional filter retaining rings 2700 may be constructed of D2 tool steel or equivalent material.

In an embodiment, the optional filter retaining ring 2700 of the optional drilling mud screen 2220 may have a hardened coating to reduce washing (i.e., erosion) of the screen 2200. For example, suitable hardened coatings include, but are not limited to, any Carbide coating or equivalent. In an embodiment, the optional filter retaining rings 2700 may have a Carbide coating with about 6% Cobalt binder or equivalent material.

In an embodiment, the optional filter retaining ring 2700 of the optional drilling mud screen 2200 may be modified to reduce inside surface entry and exit angles of the drilling mud screen 2200, resulting in increased flow efficiency and decreased erosion. In an embodiment, the entry and exit angles may be from about 10-degrees to about 50-degrees, and any range or value there between. In an embodiment, the entry and exit angles may be about 25-degrees or about 30-degrees.

Optional Filter Length

FIG. 26A illustrates a side view of an optional drilling mud screen system 2600 according to an embodiment of the present invention, showing an optional filter length 26115, and an optional filter retaining ring 26120; and FIG. 26B illustrates a detailed, cross-sectional view of the optional drilling mud screen system 2600 of FIG. 26A, showing an optional drilling mud screen insert 26105, an optional filter length 26115, and an optional filter retaining ring 26120. As shown in FIGS. 26A and 26B, the optional drilling mud screen system 2600 has an optional drilling mud screen insert 26105, an optional filter length 26115, and an optional retaining ring 26120.

As shown in FIG. 26B, the optional drilling mud screen 2640 has a first portion 2675 and a second portion 2680. In an embodiment, the first portion 2675 of the optional drilling mud screen 2640 has a first length 26125; and the second portion 2680 of the optional drilling mud screen 2640 has a second length 26130. The first portion 2675 and the second portion 2680 may be any suitable length. In an embodiment, the first portion 2675 may have a first length 26125 from about 6-inches to about 10-inches, and any range or value there between; and the second portion 2680 may have a second length 26130 from about 14-inches to about 20-inches, and any range or value there between. In an embodiment, the first portion 2275 may have a first length 26125 of about 7.5-inches; and the second portion 2680 may have a second length 26130 of about 17.5-inches.

In an embodiment, the second portion 2680 of the optional drilling mud screen 2640 has a first section 26135, a second section 26145 and a third section 26155. In an embodiment, the first section 26135 has a third length 26140, the second section 26145 has a fourth length 26150 and the third section 26155 has a fifth length 26160. The first section 26135, the second section 26145 and the third section 26155 may be any suitable length. In an embodiment, the first section 26135 of the optional drilling mud screen 2640 may be up to about 20-25% longer than the second section 26145 and/or the third section 26155, resulting in increased flow efficiency and decreased erosion.

In an embodiment, the first section 26135 may have a third length 26140 from about 4-inches to about 8-inches, and any range or value there between. In an embodiment, the first section 26135 may have a third length 26140 of about 6-inches.

In an embodiment, the second section 26145 may have a fourth length 26150 from about 4-inches to about 8-inches, and any range or value there between. In an embodiment, the second section 26145 may have a fourth length 26150 of about 5-inches.

In an embodiment, the third section 26155 may have a fifth length 26160 from about 4-inches to about 8-inches, and any range or value there between. In an embodiment, the third section 26155 may have a fifth length 26160 of about 5-inches.

Optional Cementing Configuration

FIG. 28 illustrates a cross-sectional view of a drilling mud screen system in a cementing configuration 2800 according to an embodiment of the present invention, showing an optional first transducer subassembly 28100' having an optional transducer 28105, an optional gate valve 28205 and an optional second transducer subassembly 28100" having an optional low torque plug valve 28110. As shown in FIG. 28, the drilling mud screen system in a cementing configuration 2800 comprises an optional first transducer subassembly 28100' having an optional transducer 28105, a drilling mud screen system 28200, an optional gate valve 28300 and an optional second transducer subassembly 28100" having an optional low torque plug valve 28110.

In an embodiment, a first drilling mud inlet 28120' of the optional first transducer subassembly 28100' may be fluidly connected to, for example, an outlet of a drilling mud pump via a connection; and a first drilling mud outlet 28125' of the optional first transducer subassembly 28100' may be fluidly connected to, for example, a drilling mud inlet 28120 of a drilling mud screen system 28200 via a connection. Any suitable connection may be used for the first drilling mud inlet 28120' and the first drilling mud outlet 28125'. For example, suitable connections include, but are not limited to, pipe fittings and welds. Connections are well known in the art. In an embodiment, the first drilling mud inlet 28120' of the optional first transducer subassembly 28100' may be fluidly connected to, for example, an outlet of a drilling mud pump via a weld; and the first drilling mud outlet 28125' of the optional first transducer subassembly 28100' may be fluidly connected to a drilling mud inlet 28220 of a drilling mud screen system 28200 via a weld.

The inlet pressure to the first drilling mud inlet 28120' of the optional first transducer subassembly 28100' may be any suitable pressure. In an embodiment, the inlet pressure may be from about 7500 psi to about 10,000 psi, and any range or value there between.

In an embodiment, the transducer access port 28130 of the optional first transducer subassembly 28100' may be closed with an optional transducer 28105 via a fitting. Any suitable type of transducer 28105 may be used. For example, suitable types of transducers include, but are not limited to, displacement transducers, flow rate transducers, pressure transducers, temperature transducers and any combination thereof. Any suitable fitting may be used. For example, suitable fittings include, but are not limited to, pipe fittings. Fittings are well known in the art. In an embodiment, the transducer access port 2030 of the optional transducer subassembly 2000 may be closed with, for example, a pressure transducer 28105 via a 2-inch 1502 WECO union.

In an embodiment, a computing device (such as a rig computer) may include a bus that directly or indirectly couples the following devices: memory, one or more processors, one or more presentation components, one or more input/output (I/O) ports, I/O components, a user interface and a power supply. The computing device may include a variety of computer-readable media. The memory may include computer-storage media in the form of volatile and/or nonvolatile memory. The presentation component(s) present data indications to a user or other device. The user interface allows the user to input/output information to/from the computing device. The one or more I/O ports may allow the computing device to be logically coupled to other devices including a transducer 28105, and other I/O components, some of which may be built in. See e.g., FIG. 28. Examples of other I/O components include a printer, scanner, wireless device, and the like.

In an embodiment, pressure information from, for example, a pressure transducer 28105 will allow a driller to know when a drilling mud screen (not shown) in a drilling mud screen system 28200 is "packing off" For example, the pressure information from the pressure transducer 28105 at the drilling mud inlet 28220 of the drilling mud screen system 28200 may be compared to, for example, pressure information from a pressure transducer on a pressure transducer for a stand pipe. If the pressure decreases at the stand pipe and the pressure increases at the drilling mud inlet 28220 of the drilling mud screen system 28200, the drilling mud screen (not shown) is likely "packing off" If the pressure decreases or increases at both the stand pipe and the drilling mud screen system, then the problem is likely down hole and not at the drilling mud screen system 28200. If the problem is at the drilling mud screen system 28200, the drilling mud screen may be cleaned, repaired or replaced.

In an embodiment, a drilling mud inlet 28220 of the drilling mud screen system 28200 may be fluidly connected to, for example, a first drilling mud outlet 28125' of the optional first transducer subassembly 28100' via a connection; and a drilling mud outlet 28225 of the drilling mud screen system 28200 may be fluidly connected to, for example, a drilling mud inlet 28320 of an optional gate valve 28300 via a connection. Any suitable connection may be used for the drilling mud inlet 2820 and the drilling mud outlet 2825. For example, suitable connections include, but are not limited to, pipe fittings and welds. Connections are well known in the art. In an embodiment, the drilling mud inlet 28200 of the drilling mud screen system 28200 may be fluidly connected to, for example, a first drilling mud outlet 28120' of the optional first transducer subassembly 28100' via a weld; and the drilling mud outlet 28225 of the drilling mud screen system 28200 may be fluidly connected to, for example, a drilling mud inlet 28320 of the optional gate valve 28300 via a weld.

The inlet pressure to the drilling mud inlet 28220 of the drilling mud screen system 28200 may be any suitable pressure. In an embodiment, the inlet pressure may be from about 7500 psi to about 10,000 psi, and any range or value there between.

In an embodiment, a drilling mud inlet 28320 of the optional gate valve 28300 may be fluidly connected to, for example, a drilling mud outlet 28220 of the drilling mud screen system 28200 via a connection; and a drilling mud outlet 28325 of the optional gate valve 28300 may be fluidly connected to, for example, a second drilling mud inlet 28120" of the optional second transducer subassembly 28100" via a connection. Any suitable connection may be used for the drilling mud inlet 28320 and the drilling mud outlet 28325. For example, suitable connections include, but are not limited to, pipe fittings and welds. Connections are well known in the art. In an embodiment, the drilling mud inlet 28320 of the optional gate valve 28300 may be fluidly connected to, for example, a drilling mud outlet 28220 of a drilling mud screen system 28200 via a weld; and the drilling mud outlet 28225 of the optional gate valve 28300 may be fluidly connected to, for example, a second drilling mud inlet 28125" of the optional second transducer subassembly 28100" via a weld.

In an embodiment, a second drilling mud inlet 28120" of the optional second transducer subassembly 28100" may be fluidly connected to, for example, a drilling mud outlet 28325 of the optional gate valve 28300 via a connection; and a second drilling mud outlet 28125" of the optional second transducer subassembly 28100" may be fluidly connected to, for example, an inlet of a vibrator hose via a connection. Any suitable connection may be used for the second drilling mud inlet 28120" and the second drilling mud outlet 28125". For example, suitable connections include, but are not limited to, pipe fittings and welds. Connections are well known in the art. In an embodiment, a second drilling mud inlet 28120" of the optional second transducer subassembly 28100" may be fluidly connected to, for example, a drilling mud outlet 28325 of the optional gate valve 28300 via a weld; and a second drilling mud outlet 28125" of the optional second transducer subassembly 28100" may be fluidly connected to, for example, an inlet of a vibrator hose via a weld.

In an embodiment, an operator may close an optional gate valve 28300 to isolate a drilling mud screen system 28200 (and an upstream drilling mud pump) from cement for a cementing application. The operator may pump cement through an optional low torque plug valve 28110 in an optional second transducer subassembly 28100", through a vibrator hose, through a stand pipe, through a top drive and through a casing running tool (CRT).

Drilling Mud Screen Puller/Installer Tool

FIGS. 8A-8B and 9A-9B illustrate a drilling mud screen puller/installer tool according to an embodiment of the present invention. The tool permits use of a deep bore in a single-piece body of the drilling mud screen system, and removal of the drilling mud screen from the two-piece body without disassembly of the two-piece body. Further, the tool provides additional force to remove "stuck" drilling mud screens from debris entrapment in the system.

Single-Piece Body

Figure 8A:
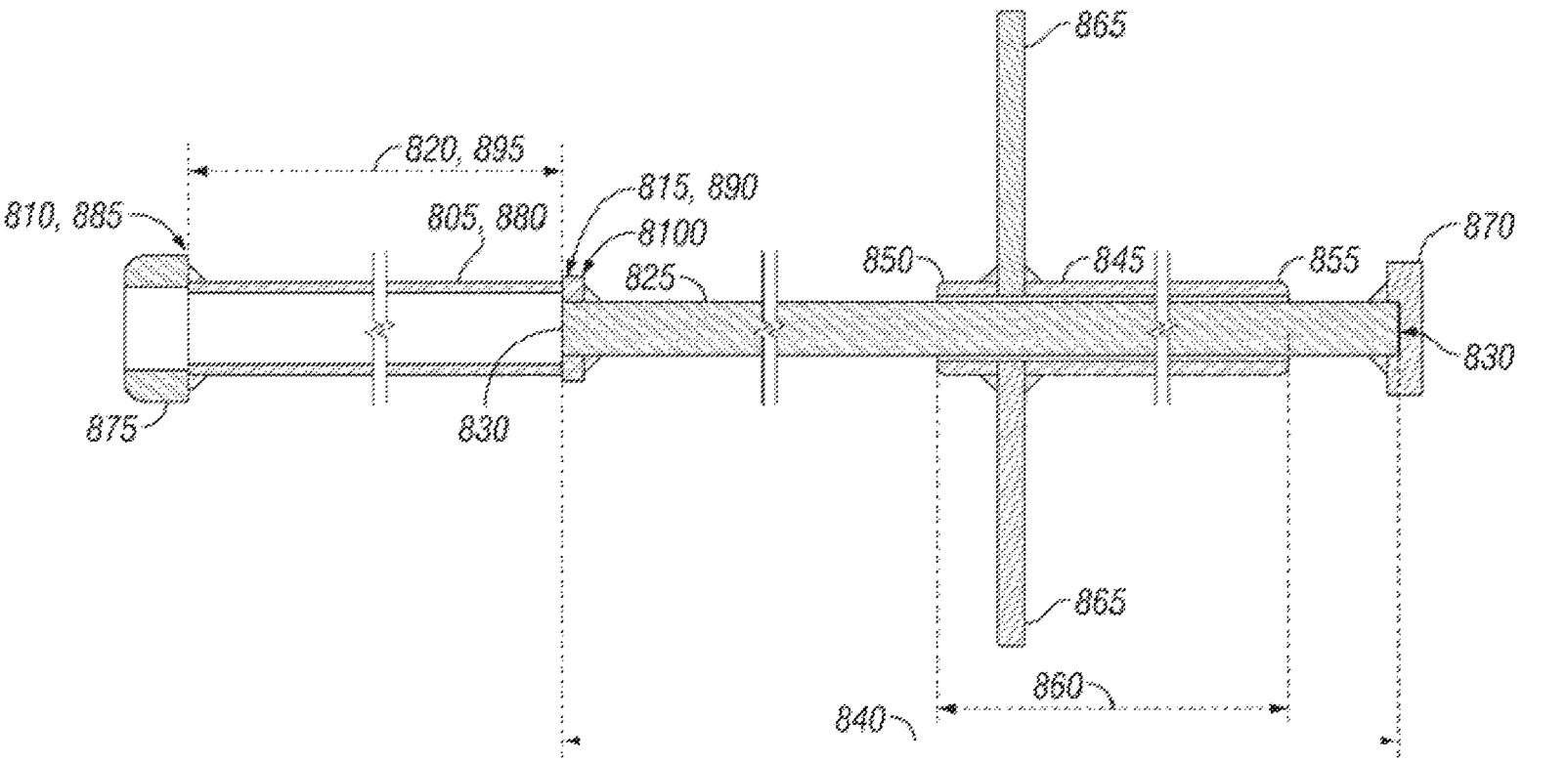
FIG. 8A illustrates an upper cross-sectional view of an exemplary drilling mud screen puller/installer tool for the exemplary drilling mud screen system of FIGS. 4A-4C.
Figure 18A:
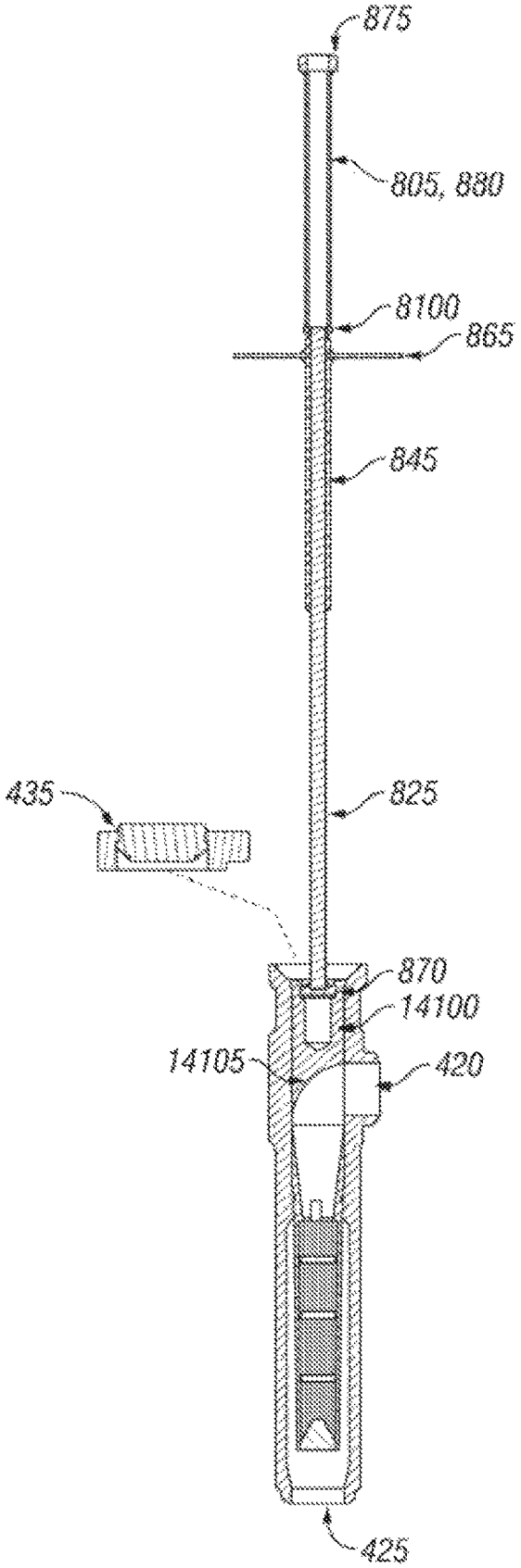
FIG. 18A illustrates an upper cross-sectional view of the exemplary drilling mud tool of FIG. 8A for the exemplary drilling mud system of FIGS. 4A-4C and 14.
Figure 18B:
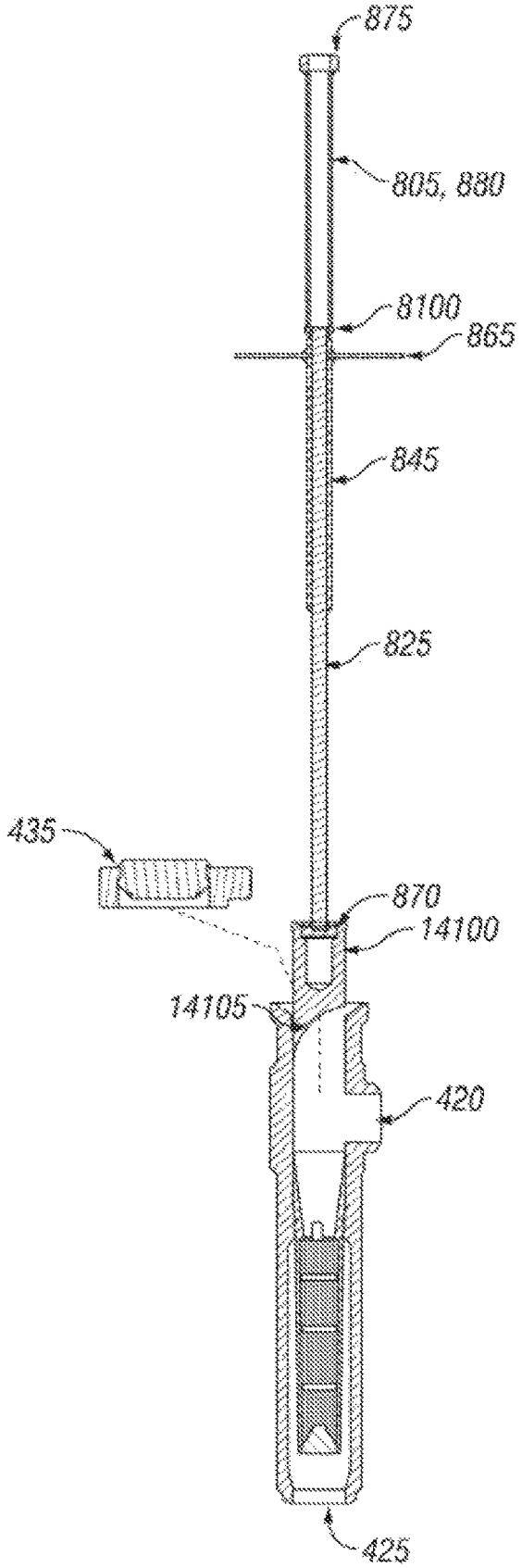
FIG. 18B illustrates another upper cross-sectional view of the exemplary drilling mud tool of FIG. 8A for the exemplary drilling mud system of FIGS. 4A-4C and 14.

FIG. 8A illustrates an upper cross-sectional view of a drilling mud screen puller/installer tool for the exemplary drilling mud screen system of FIGS. 4A-4C; and FIGS. 18A-18B illustrate an upper cross-sectional view of the drilling mud screen puller/installer tool of FIG. 8A for the exemplary drilling mud system of FIGS. 4A-4C and 14.

As shown in FIG. 8A, the drilling mud screen puller/installer tool 800 has a body 805 having a first end 810 and a second end 815 and a first length 820, a shaft 825 having a first end 830 and a second end 835 and a second length 840, a movable sleeve 845 having a first end 850 and a second end 855 and a third length 860, a handle 865, and a puller/installer plate 870.

The first length 820 of the body 805 may be any suitable length. In an embodiment, the first length 820 of the body 805 may be from about 10-inches to about 30-inches, and any range or value there between. In an embodiment, the first length 820 of the body 805 may be from about 18-inches to about 22-inches.

The inner diameter (ID) of the body 805 may be any suitable diameter. In an embodiment, the ID of the body 805 may be from about 1-inch to about 2-inches, and any range or value there between. In an embodiment, the ID of the body 805 may be about 1.5-inches.

The outer diameter (OD) of the body 805 may be any suitable diameter. In an embodiment, the OD of the body 805 may be from about 1.5-inches to about 2.5-inches, and any range or value there between. In an embodiment, the OD of the body 805 may be about 1.9-inches.

In an embodiment, the body 805 of the drilling mud screen puller/installer tool 800 may be constructed of any suitable material. For example, suitable materials include, but are not limited to, any alloy steel. In an embodiment, the body 805 may be constructed of an American Iron and Steel Industry (AISI) 4140 or equivalent material, stainless steel and combinations thereof. See e.g., FIG. 8A. In an embodiment, the surface of the body 805 may be painted.

In an embodiment, the body 805 may have a first striker plate 8100.

The striker plate 8100 may be any suitable length. In an embodiment, the length of the striker plate 8100 may be from about 0.3-inches to about 0.6-inches, and any range or value there between. In an embodiment, the length of the striker plate 8100 may be about 0.5-inches.

In an embodiment, the inner diameter (ID) of the striker plate 8100 may be any suitable diameter. In an embodiment, the ID of the striker plate 8100 may be from about 1-inch to about 1.25-inches, and any range or value there between. In an embodiment, the ID of the striker plate 8100 may be about 1.13-inches.

In an embodiment, the outer diameter (OD) of the striker plate 8100 may be any suitable diameter. In an embodiment, the OD of the striker plate 8100 may be from about 2-inches to about 2.25-inches, and any range or value there between. In an embodiment, the OD of the striker plate 8100 may be about 2.130-inches.

In an embodiment, the striker plate 8100 of the drilling mud screen puller/installer tool 800 may be constructed of any suitable material. For example, suitable materials include, but are not limited to, any alloy steel. In an embodiment, the striker plate 8100 may be constructed of stainless steel. See e.g., FIG. 8A. In an embodiment, the surface of the striker plate 8100 may be painted.

In an embodiment, the striker plate 8100 may be attached to the second end 815 of the body 805 via a connection. Any suitable connection may be used for the striker plate 8100. For example, suitable connections include, but are not limited to, pipe fittings and welds. Connections are well known in the art. In an embodiment, the striker plate 8100 may be attached to the second end 815 of the body 805 via a weld.

In an embodiment, the second length 840 of the shaft 825 may be any suitable length. In an embodiment, the second length 840 of the shaft 825 may be from about 30-inches to about 50-inches, and any range or value there between. In an embodiment, the second length 840 of the shaft 825 may be from about 40-inches to about 42-inches.

The diameter of the shaft 825 may be any suitable diameter. In an embodiment, the diameter of the shaft 825 may be from about 0.75-inches to about 1.5-inches, and any range or value there between. In an embodiment, the diameter of the shaft 825 may be about 1.1-inches.

In an embodiment, the shaft 825 of the drilling mud screen puller/installer tool 800 may be constructed of any suitable material. For example, suitable materials include, but are not limited to, any alloy steel. In an embodiment, the shaft 825 may be constructed of an American Iron and Steel Industry (AISI) 1018 or equivalent material. See e.g., FIG. 8A. In an embodiment, the surface of the shaft 825 may be painted.

In an embodiment, the third length 860 of the movable sleeve 845 may be any suitable length. In an embodiment, the third length 860 of the movable sleeve 845 may be from about 10-inches to about 30-inches, and any range or value there between. In an embodiment, the third length 860 of the movable sleeve 845 may be from about 20-inches to about 22-inches.

The inner diameter (ID) of the movable sleeve 845 may be any suitable diameter. In an embodiment, the ID of the movable sleeve 845 may be from about 1-inch to about 2-inches, and any range or value there between. In an embodiment, the ID of the movable sleeve 845 may be about 1.4-inches.

The outer diameter (OD) of the movable sleeve 845 may be any suitable diameter. In an embodiment, the OD of the movable sleeve 845 may be from about 1.5-inches to about 2.5-inches, and any range or value there between. In an embodiment, the OD of the movable sleeve 845 may be about 1.9-inches.

In an embodiment, the movable sleeve 845 of the drilling mud screen puller/installer tool 800 may be constructed of any suitable material. For example, suitable materials include, but are not limited to, any alloy steel. In an embodiment, the movable sleeve 845 may be constructed of an American Iron and Steel Industry (AISI) 4140 or equivalent material. See e.g., FIG. 8A. In an embodiment, the surface of the movable sleeve 845 may be painted.

In an embodiment, the first end 810 of the body 805 may have a rounded end 875 having a first end and a second end; the second end 815 of the body 805 may have a striker plate 8100.

The length of the rounded end 875 may be any suitable length. In an embodiment, the length of the rounded end 875 may be from about 1-inch to about 2-inches, and any range or value there between. In an embodiment, the length of the rounded end 875 may be about 1.3-inches.

The inner diameter (ID) of the rounded end 875 may be any suitable diameter. In an embodiment, the ID of the rounded end 875 may be from about 1.5-inches to about 2-inches, and any range or value there between. In an embodiment, the ID of the rounded end 875 may be about 1.7-inches.

The outer diameter (OD) of the rounded end 875 may be any suitable diameter. In an embodiment, the OD of the rounded end 875 may be from about 2.5-inches to about 3.5-inches, and any range or value there between. In an embodiment, the OD of the rounded end 875 may be about 3-inches.

In an embodiment, the first end of the rounded end 875 may have a rounded edge. See e.g., FIG. 8. The radius of the rounded edge may be any suitable radius. In an embodiment, the radius may be from about 0.35-inches to about 0.4-inches, and any range or value there between. In an embodiment, the radius may be about 0.375-inches.

In an embodiment, the rounded end 875 of the drilling mud screen puller/installer tool 800 may be constructed of any suitable material. For example, suitable materials include, but are not limited to, any alloy steel. In an embodiment, the rounded end 875 may be painted.

In an embodiment, the second end of the rounded end 875 may be attached to the first end 810 of the body 805 via a connection. Any suitable connection may be used for the second end of the rounded end 875. For example, suitable connections include, but are not limited to, pipe fittings and welds. Connections are well known in the art. In an embodiment, the second end of the rounded end 875 may be attached to the first end 810 of the body 805 via a weld.

In an embodiment, the body 805 may have a sleeve body 880 having a first end 885 and a second end 890 and a fourth length 895, and a first striker plate 8100.

The fourth length 895 of the sleeve body 880 may be any suitable length. In an embodiment, the fourth length 895 of the sleeve body 880 may be from about 10-inches to about 40-inches, and any range or value there between. In an embodiment, the fourth length 895 of the sleeve body 880 may be from about 20-inches to about 22-inches.

The inner diameter (ID) of the sleeve body 880 may be any suitable diameter. In an embodiment, the ID of the sleeve body 880 may be from about 1-inch to about 2-inches, and any range or value there between. In an embodiment, the ID of the sleeve body 880 may be about 1.4-inches.

The outer diameter (OD) of the sleeve body 880 may be any suitable diameter. In an embodiment, the OD of the sleeve body 880 may be from about 1.5-inches to about 2.5-inches, and any range or value there between. In an embodiment, the OD of the sleeve body 880 may be about 1.9-inches.

In an embodiment, the sleeve body 880 of the drilling mud screen puller/installer tool 800 may be constructed of any suitable material. For example, suitable materials include, but are not limited to, any alloy steel. In an embodiment, the sleeve body 880 may be constructed of an American Iron and Steel Industry (AISI) 4140 or equivalent material, stainless steel and combinations thereof. See e.g., FIG. 8A. In an embodiment, the surface of the sleeve body 880 may be painted.

In an embodiment, the rounded end 875 may be attached to the first end 885 of the sleeve body 880 via a connection. Any suitable connection may be used for the rounded end 875. For example, suitable connections include, but are not limited to, pipe fittings and welds. Connections are well known in the art. In an embodiment, the rounded end 875 may be attached to the first end 885 of the sleeve body 880 via a weld.

In an embodiment, the striker plate 8100 may be attached to the second end 890 of the sleeve body 880 via a connection. Any suitable connection may be used for the striker plate 8100. For example, suitable connections include, but are not limited to, pipe fittings and welds. Connections are well known in the art. In an embodiment, the striker plate 8100 may be attached to the second end 890 of the sleeve body 880 via a weld.

In an embodiment, the second end 815 of the body 805 may be attached to the first end 830 of the shaft 825 via a connection. Any suitable connection may be used for the second end 815 of the body 805. For example, suitable connections include, but are not limited to, pipe fittings and welds. Connections are well known in the art. In an embodiment, the second end 815 of the body 805 may be attached to the first end 830 of the shaft 825 via a weld.

In an embodiment, the movable sleeve 845 may be disposed around the shaft 825.

In an embodiment, a handle 865 may be attached to the movable sleeve 845 via a connection. Any suitable connection may be used for the handle 865. For example, suitable connections include, but are not limited to, pipe fittings and welds. Connections are well known in the art. In an embodiment, the handle 865 may be attached to the movable sleeve 845 via a weld.

The handle 865 may be any suitable handle to move the moveable sleeve 845 back and forth. Suitable handles 865 include, but are not limited to, one or more hand holds extending from the movable sleeve 845, a hand ring or hand wheel surrounding the movable sleeve 845, and combinations thereof.

The diameter of the one or more hand holds of the handle 865 may be any suitable diameter. In an embodiment, the diameter of the one or more hand holds of the handle 865 may be from 0.3-inch to about 1.0-inch, and any range or value there between. In an embodiment, the diameter of the one or more hand holds of the handle 865 may be about 0.5-inch.

In an embodiment, the handle 865 of the drilling mud screen puller/installer tool 800 may be constructed of any suitable material. For example, suitable materials include, but are not limited to, any alloy steel. In an embodiment, the handle 865 may be constructed of an American Iron and Steel Industry (AISI) 1018 or equivalent material. See e.g., FIG. 8A. In an embodiment, the surface of the handle 865 may be painted.

In an embodiment, the handle 865 may be attached to the movable sleeve 845 via a connection. Any suitable connection may be used for the handle 865. For example, suitable connections include, but are not limited to, pipe fittings and welds. Connections are well known in the art. In an embodiment, the handle 865 may be attached to the movable sleeve 845 via a weld.

In an embodiment, the puller/installer plate 870 may be attached to a second end 835 of the shaft 825 via a connection. Any suitable connection may be used for the puller/installer plate 870. For example, suitable connections include, but are not limited to, pipe fittings and welds. Connections are well known in the art. In an embodiment, the puller/installer plate 870 may be attached to the second end 835 of the shaft 825 via a weld.

The length of the puller/installer plate 870 may be any suitable length. In an embodiment, the length of the puller/installer plate 870 may be from about 0.5-inch to about 1-inch, and any range or value there between. In an embodiment, the length of the puller/installer plate 870 may be about 0.725-inch.

The diameter of the puller/installer plate 870 may be any suitable diameter. In an embodiment, the diameter of the puller/installer plate 870 may be from about 2-inches to about 2.5-inches, and any range or value there between. In an embodiment, the diameter of the puller/installer plate 870 may be about 2.3-inches.

In an embodiment, the puller/installer plate 870 of the drilling mud screen puller/installer tool 800 may be constructed of any suitable material. For example, suitable materials include, but are not limited to, any alloy steel. In an embodiment, the puller/installer plate 870 may be constructed of a stainless steel. See e.g., FIG. 8A. In an embodiment, the surface of the puller/installer plate 870 may be painted.

Figure 8B:
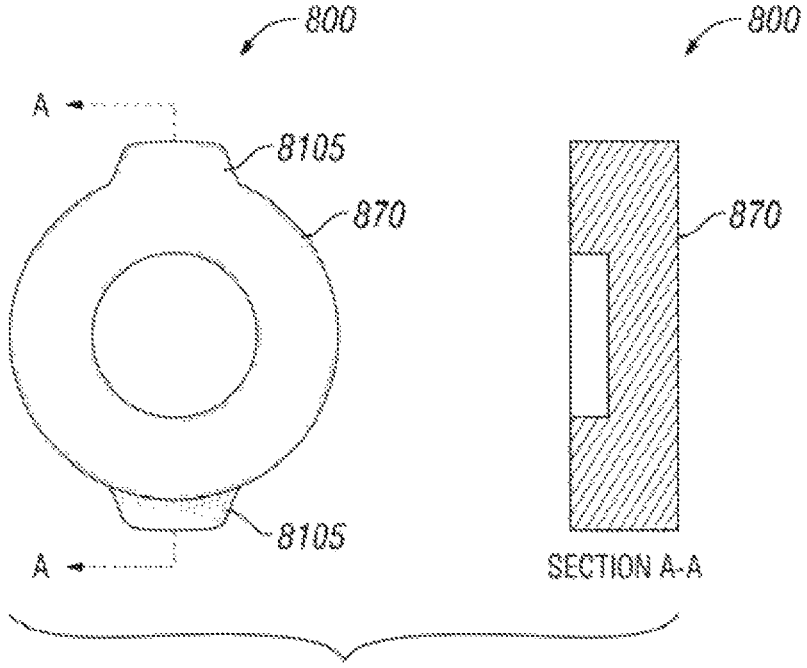
FIG. 8B illustrates a detailed view of A-A of FIG. 8A, showing a means to engage a drilling mud screen according to an embodiment of the present invention.

In an embodiment, the puller/installer plate 870 may have a means to engage 8105 a drilling mud screen 500 of the drilling mud screen system 400. The means to engage 875 may be any suitable means to engage 8105 the drilling mud screen 500. For example, a suitable means to engage 8105 includes, but is not limited to, one or more extensions to fit an outlet of the first portion 575 and/or an inlet of the second portion 580 of the body 505 of the drilling mud screen 500 and to engage a shoulder outside the inlet of the second portion 580 of the body 505 of the drilling mud screen 500 and/or to rotationally engage a shoulder inside the inlet of the second portion 580 of the body 505 of the drilling mud screen 500. Cf. FIGS. 5B & 8B. See also FIGS. 12A-12B. In an embodiment, the puller/installer plate 870 may have one or more extensions to fit an outlet of the first portion 575 and/or an inlet of the second portion 580 of the body 505 of the drilling mud screen 500 and to engage a shoulder outside the inlet of the second portion 580 of the body 505 of the drilling mud screen 500 and/or to rotationally engage a shoulder inside the inlet of the second portion 580 of the body 505 of the drilling mud screen 500. Id.

In an embodiment, the means to engage 8105 may be constructed of any suitable material. For example, suitable materials include, but are not limited to, any alloy steel. In an embodiment, the means to engage 8105 may be constructed of a stainless steel or equivalent material. See e.g., FIG. 8A. In an embodiment, the means to engage 8105 may be painted.

Two-Piece Body

Figure 9A:
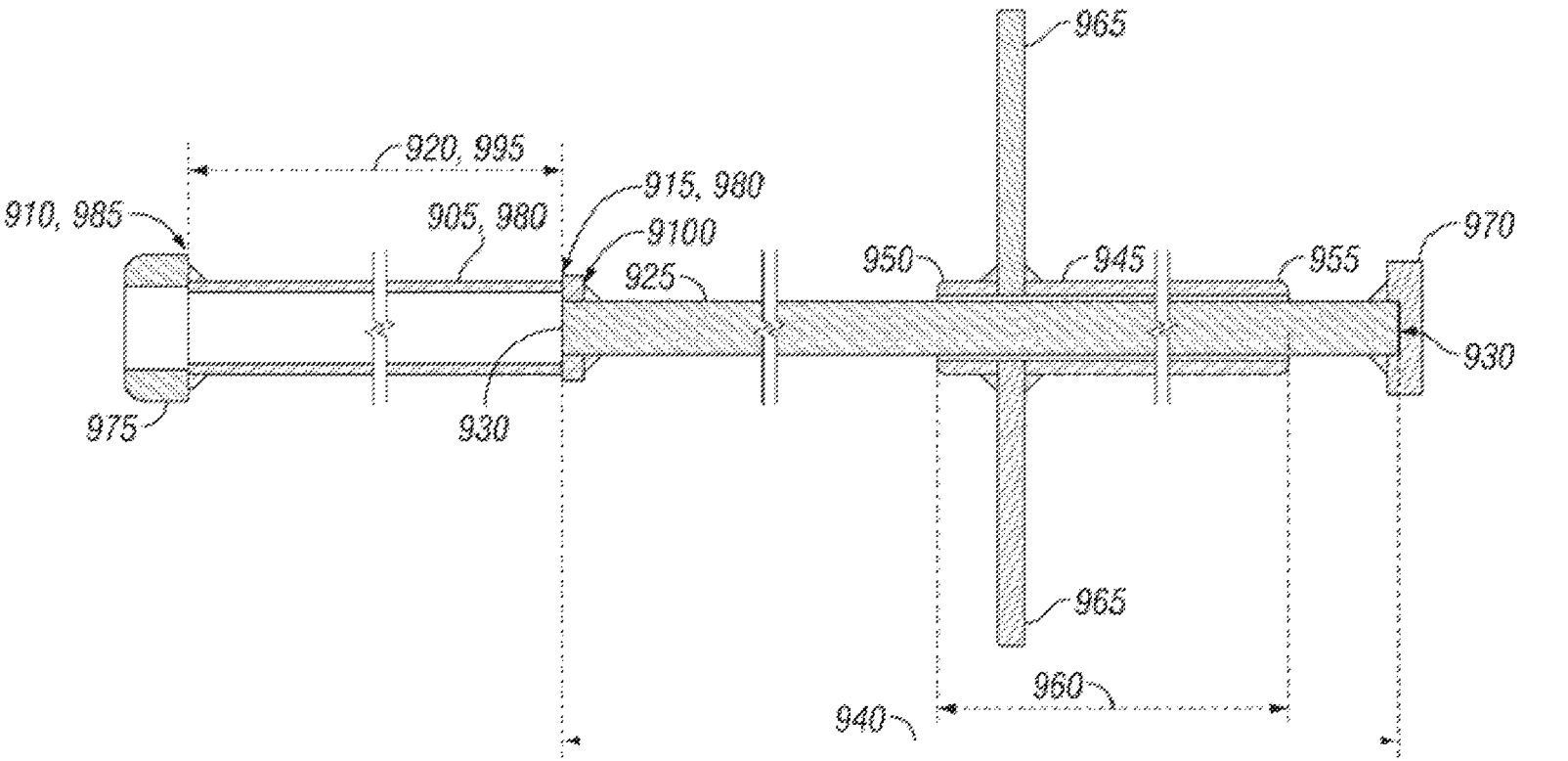
FIG. 9A illustrates a upper cross-sectional view of an exemplary drilling mud screen puller/installer tool for the exemplary drilling mud screen system of FIG. 7A.
Figure 9B:
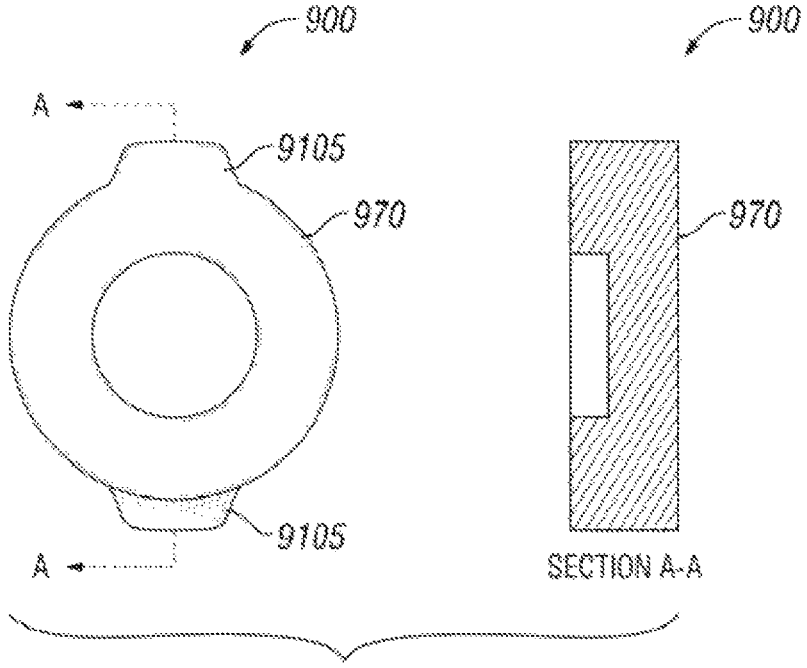
FIG. 9B illustrates a detailed view of A-A of FIG. 9A, showing a means to engage a drilling mud screen according to an embodiment of the present invention.

FIG. 9A illustrates an upper cross-sectional view of a drilling mud screen puller/installer tool for the exemplary drilling mud screen system of FIG. 7. As shown in FIG. 9, the drilling mud screen puller/installer tool 900 has a body 905 having a first end 910 and a second end 915 and a first length 920, a shaft 925 having a first end 930 and a second end 935 and a second length 940, a movable sleeve 945 having a first end 950 and a second end 955 and a third length 960, a handle 965, and a puller/installer plate 970.

The first length 920 of the body 905 may be any suitable length. In an embodiment, the first length 920 of the body 905 may be from about 10-inches to about 30-inches, and any range or value there between. In an embodiment, the first length 920 of the body 905 may be from about 18-inches to about 22-inches.

The inner diameter (ID) of the body 905 may be any suitable diameter. In an embodiment, the ID of the body 905 may be from about 1-inch to about 2-inches, and any range or value there between. In an embodiment, the ID of the body 905 may be about 1.5-inches.

The outer diameter (OD) of the body 905 may be any suitable diameter. In an embodiment, the OD of the body 905 may be from about 1.5-inches to about 2.5-inches, and any range or value there between. In an embodiment, the OD of the body 905 may be about 1.9-inches.

In an embodiment, the body 905 of the drilling mud screen puller/installer tool 900 may be constructed of any suitable material. For example, suitable materials include, but are not limited to, any alloy steel. In an embodiment, the body 905 may be constructed of an American Iron and Steel Industry (AISI) 4140 or equivalent material, stainless steel and combinations thereof. See e.g., FIG. 9A. In an embodiment, the surface of the body 905 may be painted.

In an embodiment, the body 905 may have a striker plate 9100.

The striker plate 9100 may be any suitable length. In an embodiment, the length of the striker plate 9100 may be from about 0.3-inch to about 0.6-inch, and any range or value there between. In an embodiment, the length of the striker plate 9100 may be about 0.5-inch.

In an embodiment, the inner diameter (ID) of the striker plate 9100 may be any suitable diameter. In an embodiment, the ID of the striker plate 9100 may be from about 1-inch to about 1.25-inches, and any range or value there between. In an embodiment, the ID of the striker plate 9100 may be about 1.13-inches.

In an embodiment, the outer diameter (OD) of the striker plate 9100 may be any suitable diameter. In an embodiment, the OD of the striker plate 9100 may be from about 2-inches to about 2.25-inches, and any range or value there between. In an embodiment, the OD of the striker plate 9100 may be about 2.130-inches.

In an embodiment, the striker plate 9100 of the drilling mud screen puller/installer tool 900 may be constructed of any suitable material. For example, suitable materials include, but are not limited to, any alloy steel. In an embodiment, the striker plate 9100 may be constructed of stainless steel. See e.g., FIG. 9A. In an embodiment, the surface of the striker plate 9100 may be painted.

In an embodiment, the striker plate 9100 may be attached to the second end 915 of the body 905 via a connection. Any suitable connection may be used for the striker plate 9100.

For example, suitable connections include, but are not limited to, pipe fittings and welds. Connections are well known in the art. In an embodiment, the striker plate 9100 may be attached to the second end 915 of the body 905 via a weld.

In an embodiment, the second length 940 of the shaft 925 may be any suitable length. In an embodiment, the second length 940 of the shaft 925 may be from about 40-inches to about 60-inches, and any range or value there between. In an embodiment, the second length 940 of the shaft 925 may be from about 50-inches to about 52-inches.

The diameter of the shaft 925 may be any suitable diameter. In an embodiment, the diameter of the shaft 925 may be from about 0.75-inch to about 1.5-inches, and any range or value there between. In an embodiment, the diameter of the shaft 925 may be about 1.1-inches.

In an embodiment, the shaft 925 of the drilling mud screen puller/installer tool 900 may be constructed of any suitable material. For example, suitable materials include, but are not limited to, any alloy steel. In an embodiment, the shaft 925 may be constructed of an American Iron and Steel Industry (AISI) 1018 or equivalent material. See e.g., FIG. 9A. In an embodiment, the surface of the shaft 925 may be painted.

In an embodiment, the third length 960 of the movable sleeve 945 may be any suitable length. In an embodiment, the third length 960 of the movable sleeve 945 may be from about 10-inches to about 30-inches, and any range or value there between. In an embodiment, the third length 960 of the movable sleeve 945 may be from about 20-inches to about 22-inches.

The inner diameter (ID) of the movable sleeve 945 may be any suitable diameter. In an embodiment, the ID of the movable sleeve 945 may be from about 1-inch to about 2-inches, and any range or value there between. In an embodiment, the ID of the movable sleeve 945 may be about 1.4-inches.

The outer diameter (OD) of the movable sleeve 945 may be any suitable diameter. In an embodiment, the OD of the movable sleeve 945 may be from about 1.5-inches to about 2.5-inches, and any range or value there between. In an embodiment, the OD of the movable sleeve 945 may be about 1.9-inches.

In an embodiment, the movable sleeve 945 of the drilling mud screen puller/installer tool 900 may be constructed of any suitable material. For example, suitable materials include, but are not limited to, any alloy steel. In an embodiment, the movable sleeve 945 may be constructed of an American Iron and Steel Industry (AISI) 4140 or equivalent material. See e.g., FIG. 9A. In an embodiment, the surface of the movable sleeve 945 may be painted.

In an embodiment, the first end 910 of the body 905 may have a rounded end 975 having a first end and a second end; the second end 915 of the body 905 may have a striker plate 9100.

The length of the rounded end 975 may be any suitable length. In an embodiment, the length of the rounded end 975 may be from about 1-inch to about 2-inches, and any range or value there between. In an embodiment, the length of the rounded end 975 may be about 1.3-inches.

The inner diameter (ID) of the rounded end 975 may be any suitable diameter. In an embodiment, the ID of the rounded end 975 may be from about 1.5-inches to about 2-inches, and any range or value there between. In an embodiment, the ID of the rounded end 975 may be about 1.7-inches.

The outer diameter (OD) of the rounded end 975 may be any suitable diameter. In an embodiment, the OD of the rounded end 975 may be from about 2.5-inches to about 3.5-inches, and any range or value there between. In an embodiment, the OD of the rounded end 975 may be about 3-inches.

In an embodiment, the first end of the rounded end 975 may have a rounded edge. See e.g., FIG. 9A. The radius of the rounded edge may be any suitable radius. In an embodiment, the radius may be from about 0.35-inch to about 0.4-inch, and any range or value there between. In an embodiment, the radius may be about 0.375-inch.

In an embodiment, the rounded end 975 of the drilling mud screen puller/installer tool 900 may be constructed of any suitable material. For example, suitable materials include, but are not limited to, any alloy steel. In an embodiment, the rounded end 975 may be painted.

In an embodiment, the second end of the rounded end 975 may be attached to the first end 910 of the body 905 via a connection. Any suitable connection may be used for the second end of the rounded end 975. For example, suitable connections include, but are not limited to, pipe fittings and welds. Connections are well known in the art. In an embodiment, the second end of the rounded end 975 may be attached to the first end 910 of the body 905 via a weld.

In an embodiment, the body 905 may have a sleeve body 980 having a first end 985 and a second end 990 and a fourth length 995, and a striker plate 9100.

The fourth length 995 of the sleeve body 980 may be any suitable length. In an embodiment, the fourth length 995 of the sleeve body 980 may be from about 10-inches to about 40-inches, and any range or value there between. In an embodiment, the fourth length 995 of the sleeve body 980 may be from about 18-inches to about 20-inches.

The inner diameter (ID) of the sleeve body 980 may be any suitable diameter. In an embodiment, the ID of the sleeve body 980 may be from about 1-inch to about 2-inches, and any range or value there between. In an embodiment, the ID of the sleeve body 980 may be about 1.4-inches.

The outer diameter (OD) of the sleeve body 980 may be any suitable diameter. In an embodiment, the OD of the sleeve body 980 may be from about 1.5-inches to about 2.5-inches, and any range or value there between. In an embodiment, the OD of the sleeve body 980 may be about 1.9-inches.

In an embodiment, the sleeve body 980 of the drilling mud screen puller/installer tool 900 may be constructed of any suitable material. For example, suitable materials include, but are not limited to, any alloy steel. In an embodiment, the sleeve body 980 may be constructed of an American Iron and Steel Industry (AISI) 4140 or equivalent material, stainless steel and combinations thereof. See e.g., FIG. 9A. In an embodiment, the surface of the sleeve body 980 may be painted.

In an embodiment, the rounded end 975 may be attached to the first end 985 of the sleeve body 880 via a connection. Any suitable connection may be used for the rounded end 975. For example, suitable connections include, but are not limited to, pipe fittings and welds. Connections are well known in the art. In an embodiment, the rounded end 975 may be attached to the first end 985 of the sleeve body 980 via a weld.

In an embodiment, the striker plate 9100 may be attached to the second end 990 of the sleeve body 980 via a connection. Any suitable connection may be used for the striker plate 9100. For example, suitable connections include, but are not limited to, pipe fittings and welds. Connections are well known in the art. In an embodiment, the striker plate 9100 may be attached to the second end 990 of the sleeve body 980 via a weld.

In an embodiment, the second end 915 of the body 905 may be attached to the first end 930 of the shaft 925 via a connection. Any suitable connection may be used for the second end 915 of the body 905. For example, suitable connections include, but are not limited to, pipe fittings and welds. Connections are well known in the art. In an embodiment, the second end 915 of the body 905 may be attached to the first end 930 of the shaft 925 via a weld.

In an embodiment, the movable sleeve 945 may be disposed around the shaft 925.

In an embodiment, a handle 965 may be attached to the movable sleeve 945 via a connection. Any suitable connection may be used for the handle 965. For example, suitable connections include, but are not limited to, pipe fittings and welds. Connections are well known in the art. In an embodiment, the handle 965 may be attached to the movable sleeve 945 via a weld.

The handle 965 may be any suitable handle to move the moveable sleeve 945 back and forth. For example, suitable handles 965 include, but are not limited to, one or more hand holds extending from the movable sleeve 945, a hand ring or hand wheel surrounding the movable sleeve 945, and combinations thereof.

The diameter of the one or more hand holds of the handle 965 may be any suitable diameter. In an embodiment, the diameter of the one or more hand holds of the handle 965 may be from 0.3-inch to about 1.0-inch, and any range or value there between. In an embodiment, the diameter of the one or more hand holds of the handle 965 may be about 0.5-inch.

In an embodiment, the handle 965 of the drilling mud screen puller/installer tool 900 may be constructed of any suitable material. For example, suitable materials include, but are not limited to, any alloy steel. In an embodiment, the handle 965 may be constructed of an American Iron and Steel Industry (AISI) 1018 or equivalent material. See e.g., FIG. 9A. In an embodiment, the surface of the handle 965 may be painted.

In an embodiment, the handle 965 may be attached to the movable sleeve 945 via a connection. Any suitable connection may be used for the handle 965. For example, suitable connections include, but are not limited to, pipe fittings and welds. Connections are well known in the art. In an embodiment, the handle 965 may be attached to the movable sleeve 945 via a weld.

In an embodiment, the puller/installer plate 970 may be attached to a second end 935 of the shaft 925 via a connection. Any suitable connection may be used for the puller/installer plate 970. For example, suitable connections include, but are not limited to, pipe fittings and welds. Connections are well known in the art. In an embodiment, the puller/installer plate 970 may be attached to the second end 935 of the shaft 925 via a weld.

The length of the puller/installer plate 970 may be any suitable length. In an embodiment, the length of the puller/installer plate 970 may be from about 0.5-inch to about 1-inch, and any range or value there between. In an embodiment, the length of the puller/installer plate 970 may be about 0.725-inch.

The diameter of the puller/installer plate 970 may be any suitable diameter. In an embodiment, the diameter of the puller/installer plate 970 may be from about 2-inches to about 2.5-inches, and any range or value there between. In an embodiment, the diameter of the puller/installer plate 970 may be about 2.3-inches.

In an embodiment, the puller/installer plate 970 of the drilling mud screen puller/installer tool 900 may be constructed of any suitable material. For example, suitable materials include, but are not limited to, any alloy steel. In an embodiment, the puller/installer plate 970 may be constructed of a stainless steel. See e.g., FIG. 9A. In an embodiment, the surface of the puller/installer plate 970 may be painted.

In an embodiment, the puller/installer plate 970 may have a means to engage 9105 a drilling mud screen 500 of the drilling mud screen system 400. The means to engage 975 may be any suitable means to engage 9105 the drilling mud screen 500. For example, a suitable means to engage 9105 includes, but is not limited to, one or more extensions to fit an outlet of the first portion 575 and/or an inlet of the second portion 580 of the body 505 of the drilling mud screen 500 and to engage a shoulder outside the inlet of the second portion 580 of the body 505 of the drilling mud screen 500 and/or to rotationally engage a shoulder inside the inlet of the second portion 580 of the body 505 of the drilling mud screen 500. Cf. FIGS. 5B & 8B. See also FIGS. 13A-13B. In an embodiment, the puller/installer plate 970 may have one or more extensions to fit an outlet of the first portion 575 and/or an inlet of the second portion 580 of the body 505 of the drilling mud screen 500 and to engage a shoulder outside the inlet of the second portion 580 of the body 505 of the drilling mud screen 500 and/or to rotationally engage a shoulder inside the inlet of the second portion 580 of the body 505 of the drilling mud screen 500. Id.

In an embodiment, the means to engage 9105 may be constructed of any suitable material. For example, suitable materials include, but are not limited to, any alloy steel. In an embodiment, the means to engage 9105 may be constructed of a stainless steel or equivalent material. See e.g., FIG. 9A. In an embodiment, the means to engage 9105 may be painted.

Optional Drilling Mud Screen Installer/Puller Tool

One-Piece Body

Figure 29:
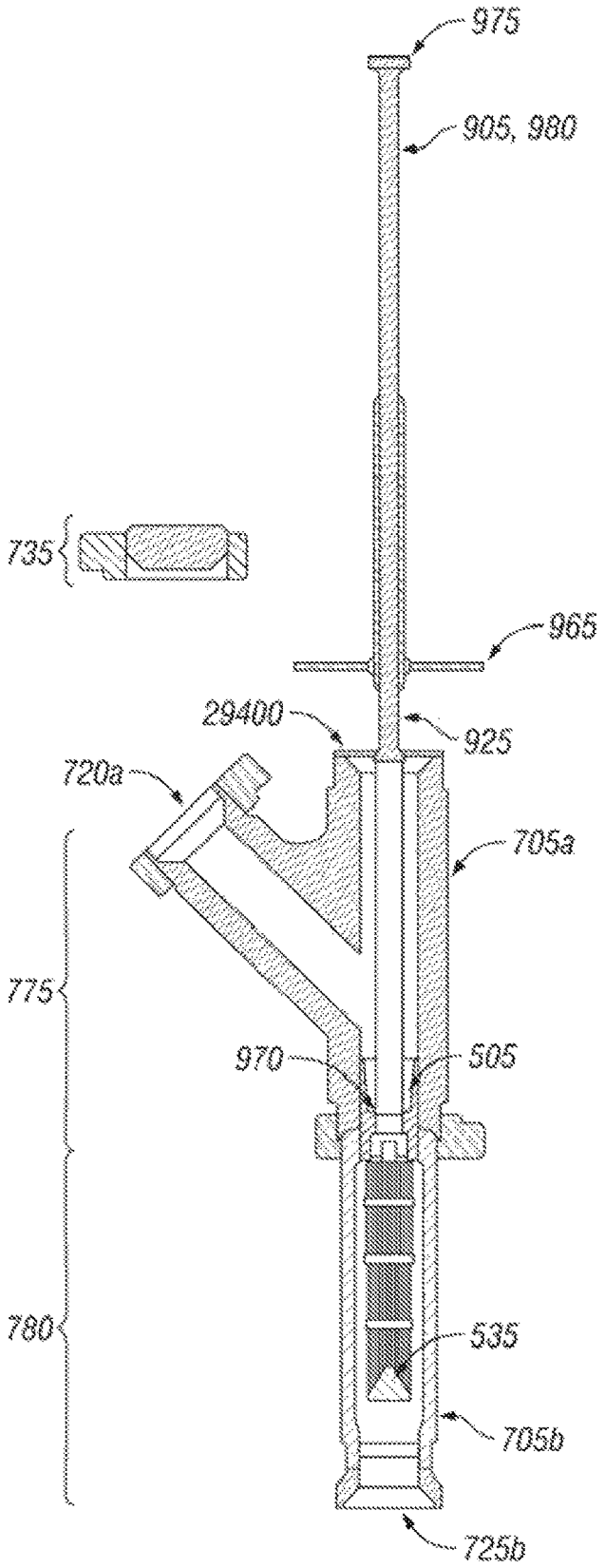
FIG. 29 illustrates a cross-sectional view of the exemplary drilling mud tool of FIG. 9A inserting the drilling mud screen of FIG. 5 or 22 into the exemplary drilling mud screen system of FIG. 7A or 21B, showing an optional stop plate.

In an embodiment, the drilling mud screen puller/installer tool 800 has a body 805 having a first end 810 and a second end 815 and a first length 820, a shaft 825 having a first end 830 and a second end 835 and a second length 840, a movable sleeve 845 having a first end 850 and a second end 855 and a third length 860, a handle 865, an optional stop plate (not shown) and a puller/installer plate 870. Cf. FIG. 29. In an embodiment, the optional stop plate (not shown) on the shaft 825 of the puller/installer tool 800 indicates that the puller/installer tool 800 (and, therefore, the drilling mud screen 500) is fully inserted into the drilling mud screen system 800 when the optional stop plate (not shown) contacts the first end 810 of the body 805 of the system 800.

In an embodiment, an optional groove or painted line may be used instead of the optional stop plate on the shaft 825 of the puller/installer tool 800. In an embodiment, the optional groove or painted line (not shown) on the shaft 825 of the puller/installer tool 800 indicates that the puller/installer tool 800 (and, therefore, the drilling mud screen 500) is fully inserted into the drilling mud screen system 800 when the optional groove or painted line (not shown) lines up with the first end 810 of the body 805 of the system 800.

Two-Piece Body

FIG. 29 illustrates a cross-sectional view of the exemplary drilling mud tool of FIG. 9A inserting the drilling mud screen of FIG. 5 or 22 into the exemplary drilling mud screen system of FIG. 7A or 21B, showing an optional stop plate. As shown in FIG. 29, the drilling mud screen puller/installer tool 900 has a body 905 having a first end 910 and a second end 915 and a first length 920, a shaft 925 having a first end 930 and a second end 935 and a second length 940, a movable sleeve 945 having a first end 950 and a second end 955 and a third length 960, a handle 965, an optional stop plate 29400 and a puller/installer plate 970. In an embodiment, the optional stop plate 29400 on the shaft 925 of the puller/installer tool 900 indicates that the puller/installer tool 900 (and, therefore, the drilling mud screen 500 or 2200) is fully inserted into the drilling mud screen system 700 or 2100 when the optional stop plate 29400 contacts the first end 710*a* or 2110*a* of the first body 705*a* or 2105*a* of the system 700 or 2100.

In an embodiment, an optional groove or painted line may be used instead of the optional stop plate 29400 on the shaft 925 of the puller/installer tool 900. In an embodiment, the optional groove or painted line (not shown) on the shaft 925 of the puller/installer tool 900 indicates that the puller/installer tool 900 (and, therefore, the drilling mud screen 500 or 2200) is fully inserted into the drilling mud screen system 700 or 2100 when the optional groove or painted line (not shown) lines up with the first end 710*a* or 2110*a* of the first body 705*a* or 2105*a* of the system 700 or 2100.

Method of Using Drilling Mud Screen System

Figure 10:
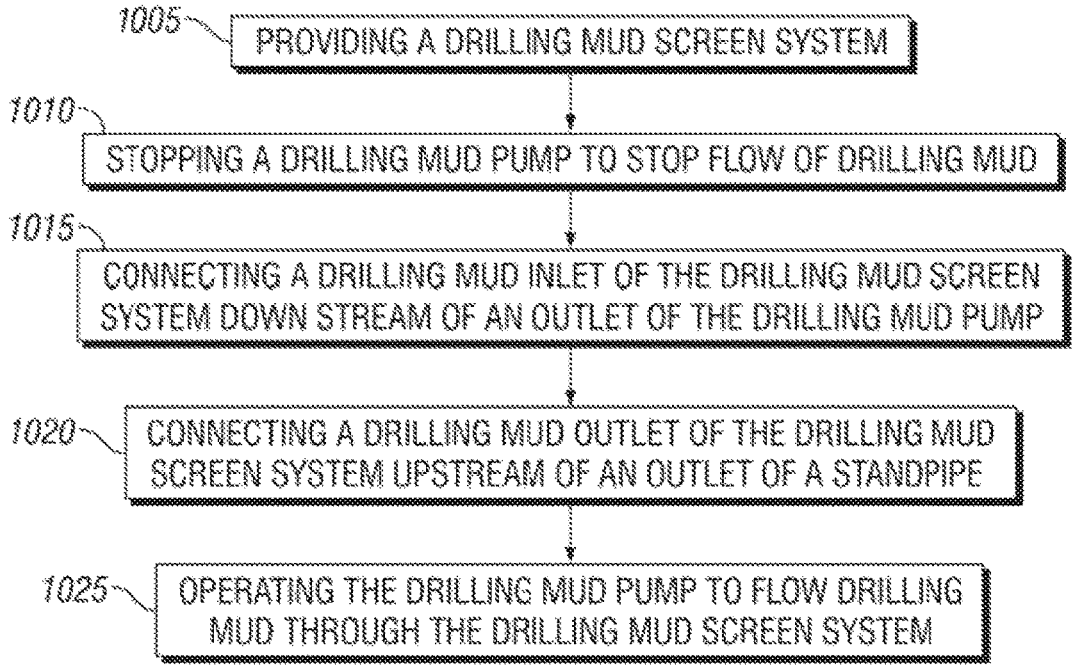
FIG. 10 illustrates a flow diagram for a method of using a drilling mud screen system.

FIG. 10 illustrates a flow diagram for a method of using a drilling mud screen system, as discussed above. As shown in FIG. 10, the method of using a drilling mud screen system 1000 comprises stopping a drilling mud pump to stop flow of drilling mud 1005, fluidly connecting a drilling mud inlet of a drilling mud screen system downstream of an outlet to the drilling mud pump 1010, fluidly connecting a drilling mud outlet of the drilling mud screen system upstream of an outlet of a stand pipe 1015, and starting the drilling mud pump to flow drilling mud through the drilling mud screen system 1020.

In an embodiment, the drilling mud inlet 120, 220, 320, 400, 620, 720 of the drilling mud screen system 100, 200, 300, 400, 600, 700 may be fluidly connected to a high pressure outlet of the drilling mud pump via a connection. See also FIGS. 14, 19, 21, 23 & 26. The inlet pressure to the drilling mud inlet 120, 220, 320, 400, 620, 720 of the drilling mud screen system 100, 200, 300, 400, 600, 700 may be any suitable pressure. In an embodiment, the inlet pressure may be from about 7500 psi to about 10,000 psi, and any range or value there between.

In an embodiment, the drilling mud outlet 125, 225, 325, 425, 625, 725 of the drilling mud screen system 100, 200, 300, 400, 600, 700 may be fluidly connected to an inlet of a vibrator hose to the standpipe via a connection.

In an embodiment, the drilling mud inlet 120, 220, 320, 400, 620, 720 of the drilling mud screen system 100, 200, 300, 400, 600, 700 may be fluidly connected to an outlet of a vibrator hose to a standpipe via a connection. In an embodiment, the drilling mud outlet 125, 225, 325, 425, 625, 725 of the drilling mud screen system 100, 200, 300, 400, 600, 700 may be fluidly connected to an inlet of the standpipe via a connection.

In an embodiment, the drilling mud screen system 100, 200, 300, 400, 600, 700 may be fluidly connected at any point in the standpipe via a connection.

Optional Monitoring Configuration

FIG. 10 illustrates a flow diagram for a method of using a drilling mud screen system, as discussed above. As shown in FIG. 10, the method of using a drilling mud screen system 1000 comprises stopping a drilling mud pump to stop flow of drilling mud 1005, fluidly connecting a drilling mud inlet of a drilling mud screen system downstream of an outlet to the drilling mud pump 1010, fluidly connecting a drilling mud outlet of the drilling mud screen system upstream of an outlet of a stand pipe 1015, and starting the drilling mud pump to flow drilling mud through the drilling mud screen system 1020.

In an embodiment, step 1010 comprises fluidly connecting a drilling mud inlet of a transducer subassembly downstream of an outlet to the drilling mud pump; and fluidly connecting a drilling mud inlet of a drilling mud screen system downstream of a drilling mud outlet to the transducer subassembly.

As shown in FIGS. 19 and 28, the drilling mud inlet 1920 of the drilling mud screen system 19200, 28200 may be fluidly connected to a drilling mud outlet 28125 of the transducer subassembly 19110, 28100 via a connection. Any suitable connection may be used for the drilling mud inlet 1920 and the drilling mud outlet 28125. For example, suitable connections include, but are not limited to, pipe fittings and welds. Connections are well known in the art. In an embodiment, the drilling mud inlet 1920 of the drilling mud screen system 19200, 28200 may be fluidly connected to a drilling mud outlet 28125 of a transducer subassembly 19100 via a weld.

In an embodiment, the method of using a drilling mud screen system 1000 further comprises monitoring a transducer of the transducer subassembly for property information (e.g., displacement, flow rate, pressure, and/or temperature) at the drilling mud screen system.

In an embodiment, a computing device (such as a rig computer) may include a bus that directly or indirectly couples the following devices: memory, one or more processors, one or more presentation components, one or more input/output (I/O) ports, I/O components, a user interface and a power supply. The computing device may include a variety of computer-readable media. The memory may include computer-storage media in the form of volatile and/or nonvolatile memory. The presentation component(s) present data indications to a user or other device. The user interface allows the user to input/output information to/from the computing device. The one or more I/O ports may allow the computing device to be logically coupled to other devices including a transducer 28105, and other I/O components, some of which may be built in. See e.g., FIG. 28. Examples of other I/O components include a printer, scanner, wireless device, and the like.

In an embodiment, the method of using a drilling mud screen system 1000 further comprises using the property information (e.g., displacement, flow rate, pressure, and/or temperature) from the transducer of the transducer subassembly to determine a status of the drilling mud screen system. In an embodiment, the method further comprises using the information to determine when to clean, repair or replace the drilling mud screen in the drilling mud screen system.

In an embodiment, pressure information from, for example, a pressure transducer 28105 will allow a driller to know when a drilling mud screen 1940 in a drilling mud screen system 19200, 28200 is "packing off." For example, the pressure information from the pressure transducer 28105 at the drilling mud inlet 1920 of the drilling mud screen system 19200, 28200 may be compared to, for example, pressure information from a pressure transducer on a pressure transducer for a stand pipe. If the pressure decreases at the stand pipe and the pressure increases at the drilling mud inlet 1920 of the drilling mud screen system 19200, 28200, the drilling mud screen 1940 is likely "packing off" If the pressure decreases or increases at both the stand pipe and the drilling mud screen system, then the problem is likely down hole and not at the drilling mud screen system 19200, 28200. If the problem is at the drilling mud screen system 19200, 28200, the drilling mud screen 1940 may be cleaned, repaired or replaced.

Optional Cementing Configuration

FIG. 10 illustrates a flow diagram for a method of using a drilling mud screen system, as discussed above. As shown in FIG. 10, the method of using a drilling mud screen system 1000 comprises stopping a drilling mud pump to stop flow of drilling mud 1005, fluidly connecting a drilling mud inlet of a drilling mud screen system downstream of an outlet to the drilling mud pump 1010, fluidly connecting a drilling mud outlet of the drilling mud screen system upstream of an outlet of a stand pipe 1015, and starting the drilling mud pump to flow drilling mud through the drilling mud screen system 1020.

In an embodiment, step 1010 comprises fluidly connecting a first drilling mud inlet of a first transducer subassembly downstream of an outlet to the drilling mud pump; and fluidly connecting a first drilling mud inlet of a drilling mud screen system downstream of an outlet to the first transducer subassembly.

In an embodiment, step 1015 comprises fluidly connecting a drilling mud outlet of the drilling mud screen system upstream of a drilling mud inlet of a gate valve, fluidly connecting a drilling mud outlet of the gate valve to a second drilling mud inlet to a second transducer subassembly, and fluidly connecting a second drilling mud outlet of the second transducer subassembly upstream of an outlet of a stand pipe.

As shown in FIG. 28, the first drilling mud inlet 28120' of the optional first transducer subassembly 28100' may be fluidly connected to, for example, an outlet of a drilling mud pump via a connection; and the first drilling mud outlet 28125' of the optional first transducer subassembly 28100' may be fluidly connected to, for example, the drilling mud inlet 28120 of the drilling mud screen system 28200 via a connection. Any suitable connection may be used for the first drilling mud inlet 28120' and the first drilling mud outlet 28125'. For example, suitable connections include, but are not limited to, pipe fittings and welds. Connections are well known in the art. In an embodiment, the first drilling mud inlet 28120' of the optional first transducer subassembly 28100' may be fluidly connected to, for example, an outlet of a drilling mud pump via a weld; and the first drilling mud outlet 28125' of the optional first transducer subassembly 28100' may be fluidly connected to the drilling mud inlet 28220 of the drilling mud screen system 28200 via a weld.

The inlet pressure to the first drilling mud inlet 28120' of the optional first transducer subassembly 28100' may be any suitable pressure. In an embodiment, the inlet pressure may be from about 7500 psi to about 10,000 psi, and any range or value there between.

In an embodiment, a computing device (such as a rig computer) may include a bus that directly or indirectly couples the following devices: memory, one or more processors, one or more presentation components, one or more input/output (I/O) ports, I/O components, a user interface and a power supply. The computing device may include a variety of computer-readable media. The memory may include computer-storage media in the form of volatile and/or nonvolatile memory. The presentation component(s) present data indications to a user or other device. The user interface allows the user to input/output information to/from the computing device. The one or more I/O ports may allow the computing device to be logically coupled to other devices including a transducer 28105, and other I/O components, some of which may be built in. See e.g., FIG. 28. Examples of other I/O components include a printer, scanner, wireless device, and the like.

In an embodiment, pressure information from, for example, a pressure transducer 28105 will allow a driller to know when a drilling mud screen 1940 in a drilling mud screen system 28200 is "packing off." For example, the pressure information from the pressure transducer 28105 at the drilling mud inlet 28220 of the drilling mud screen system 28200 may be compared to, for example, pressure information from a pressure transducer on a pressure transducer for a stand pipe. If the pressure decreases at the stand pipe and the pressure increases at the drilling mud inlet 28220 of the drilling mud screen system 28200, the drilling mud screen 1940 is likely "packing off." If the pressure decreases or increases at both the stand pipe and the drilling mud screen system, then the problem is likely down hole and not at the drilling mud screen system 28200. If the problem is at the drilling mud screen system 28200, the drilling mud screen 1940 may be cleaned, repaired or replaced.

In an embodiment, the drilling mud inlet 28220 of the drilling mud screen system 28200 may be fluidly connected to, for example, the first drilling mud outlet 28125' of the optional first transducer subassembly 28100' via a connection; and a drilling mud outlet 28225 of the drilling mud screen system 28200 may be fluidly connected to, for example, the drilling mud inlet 28320 of the optional gate valve 28300 via a connection. Any suitable connection may be used for the drilling mud inlet 2820 and the drilling mud outlet 2825. For example, suitable connections include, but are not limited to, pipe fittings and welds. Connections are well known in the art. In an embodiment, the drilling mud inlet 28200 of the drilling mud screen system 28200 may be fluidly connected to, for example, the first drilling mud outlet 28120' of the optional first transducer subassembly 28100' via a weld; and the drilling mud outlet 28225 of the drilling mud screen system 28200 may be fluidly connected to, for example, the drilling mud inlet 28320 of the optional gate valve 28300 via a weld.

The inlet pressure to the drilling mud inlet 28220 of the drilling mud screen system 28200 may be any suitable pressure. In an embodiment, the inlet pressure may be from about 7500 psi to about 10,000 psi, and any range or value there between.

In an embodiment, the drilling mud inlet 28320 of the optional gate valve 28300 may be fluidly connected to, for example, the drilling mud outlet 28220 of the drilling mud screen system 28200 via a connection; and a drilling mud outlet 28325 of the optional gate valve 28300 may be fluidly connected to, for example, the second drilling mud inlet 28120" of the optional second transducer subassembly 28100" via a connection. Any suitable connection may be used for the drilling mud inlet 28320 and the drilling mud outlet 28325. For example, suitable connections include, but are not limited to, pipe fittings and welds. Connections are well known in the art. In an embodiment, the drilling mud inlet 28320 of the optional gate valve 28300 may be fluidly connected to, for example, the drilling mud outlet 28220 of the drilling mud screen system 28200 via a weld; and the drilling mud outlet 28225 of the optional gate valve 28300 may be fluidly connected to, for example, a second drilling mud inlet 28125" of the optional second transducer subassembly 28100" via a weld.

In an embodiment, the second drilling mud inlet 28120" of the optional second transducer subassembly 28100" may be fluidly connected to, for example, the drilling mud outlet 28325 of the optional gate valve 28300 via a connection; and the second drilling mud outlet 28125" of the optional second transducer subassembly 28100" may be fluidly connected to, for example, an inlet of a vibrator hose via a connection. Any suitable connection may be used for the second drilling mud inlet 28120" and the second drilling mud outlet 28125". For example, suitable connections include, but are not limited to, pipe fittings and welds. Connections are well known in the art. In an embodiment, the second drilling mud inlet 28120" of the optional second transducer subassembly 28100" may be fluidly connected to, for example, the drilling mud outlet 28325 of the optional gate valve 28300 via a weld; and a second drilling mud outlet 28125" of the optional second transducer subassembly 28100" may be fluidly connected to, for example, an inlet of a vibrator hose via a weld.

In an embodiment, an operator may close an optional gate valve 28300 to isolate a drilling mud screen system 28200 (and an upstream drilling mud pump) from cement for a cementing application. The operator may pump cement through an optional low torque plug valve 28110 in an optional second transducer subassembly 28100", through a vibrator hose, through a stand pipe, through a top drive and through a casing running tool (CRT).

Method of Removing and Replacing Drilling Mud Screen

Figure 11:
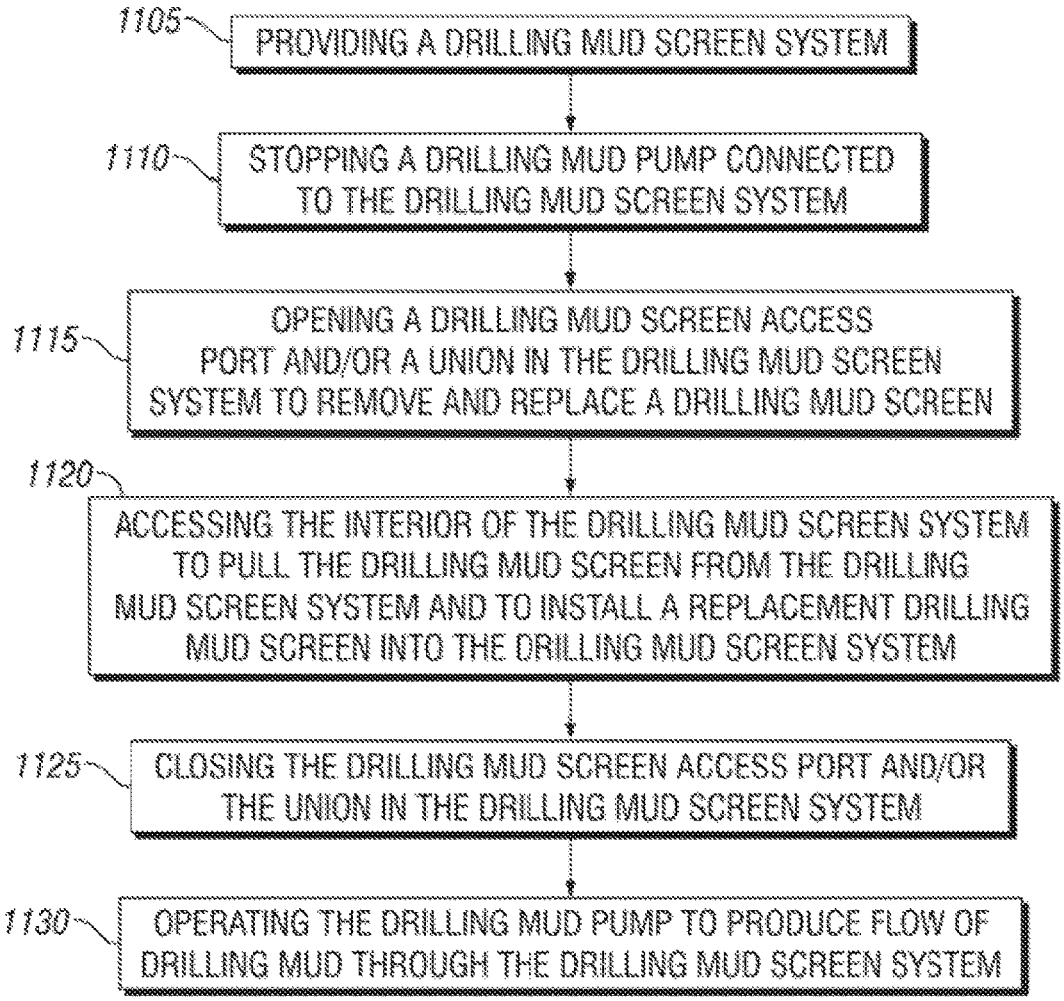
FIG. 11 illustrates a flow diagram for a method of using a drilling mud screen puller/installer.

FIG. 11 illustrates a method of removing and replacing a drilling mud screen in a drilling mud screen system, as discussed above. As shown in FIG. 11, the method of removing and replacing a drilling mud screen 1100 comprises providing a drilling mud screen system 1105, stopping a drilling mud pump connected to the drilling mud screen system 1110, opening a drilling mud screen access port and/or a union in the drilling mud screen system to remove and replace a drilling mud screen 1115, accessing the interior of the drilling mud screen system to pull the drilling mud screen from the drilling mud screen system and to install a replacement drilling mud screen into the drilling mud screen system 1120, closing the drilling mud screen access port and or the union in the drilling mud screen system 1125, and operating the drilling mud pump to produce flow of drilling mud through the drilling mud screen system 1130.

In an embodiment, step 1115 comprises opening a drilling mud screen access port 130, 230, 330, 430 in the body 105, 205, 305 405 of the single-piece drilling mud screen system 100, 200, 300 400. See also FIG. 14. In an embodiment, step 1115 comprises opening the drilling mud screen access port 630, 730 of the first body 605*a*, 705*a* and opening a union between the first body 605*a*, 705*a* and the second body 605*b*, 705*b* of the two-piece drilling mud screen system 600, 700 to remove and replace the drilling mud screen 500. See also FIGS. 19, 21, 23 & 26.

In an embodiment, step 1125 comprises closing the drilling mud screen access port 130, 230, 330, 430 in the body 105, 205, 305, 405 of the single piece drilling mud screen system 100, 200, 300, 400. In an embodiment, step 1125 comprises closing the drilling mud screen access port 130, 230, 330, 430 of the first body 605*a*, 705*a* and connecting the union between the first body 605*a*, 705*a* and the second body 650*b*, 705*b* of the two-piece drilling mud screen system 600, 700.

In an embodiment, step 1115 comprises opening the drilling mud screen access port 130, 230, 330, 430, 630, 730 of the drilling mud screen system 100, 200, 300, 400, 600, 700, and step 1120 comprises using a puller/installer plate 870, 970 of a puller/installer tool 800, 900 to engage and pull the drilling mud screen 500 from the drilling mud screen system 100, 200, 300, 400, 600, 700. In an embodiment, step 1115 comprises opening the drilling mud screen access port 130, 230, 330, 430, 630, 730 of the drilling mud screen system 100, 200, 300, 400, 600, 700, and step 1120 comprises using the puller/installer plate 875, 975 and/or a rounded end 875, 975 of the puller/installer tool 800, 900 to install the replacement drilling mud screen 500 into the drilling mud screen system 100, 200, 300, 400, 600, 700.

In an embodiment, step 1120 further comprises using a groove, painted line or stop plate 29110 on the shaft 825, 925 of the puller/installer tool 800, 900 to indicate when the puller/installer tool 800, 900 (and therefore, the drilling mud screen 500, 2200) is fully inserted in the system 100, 200, 300, 400, 600, 700, 2100.

Improved Exemplary Valve-Style Drilling Mud Screen System

Body with Face-Roller Camming Mechanism

Figure 30A:
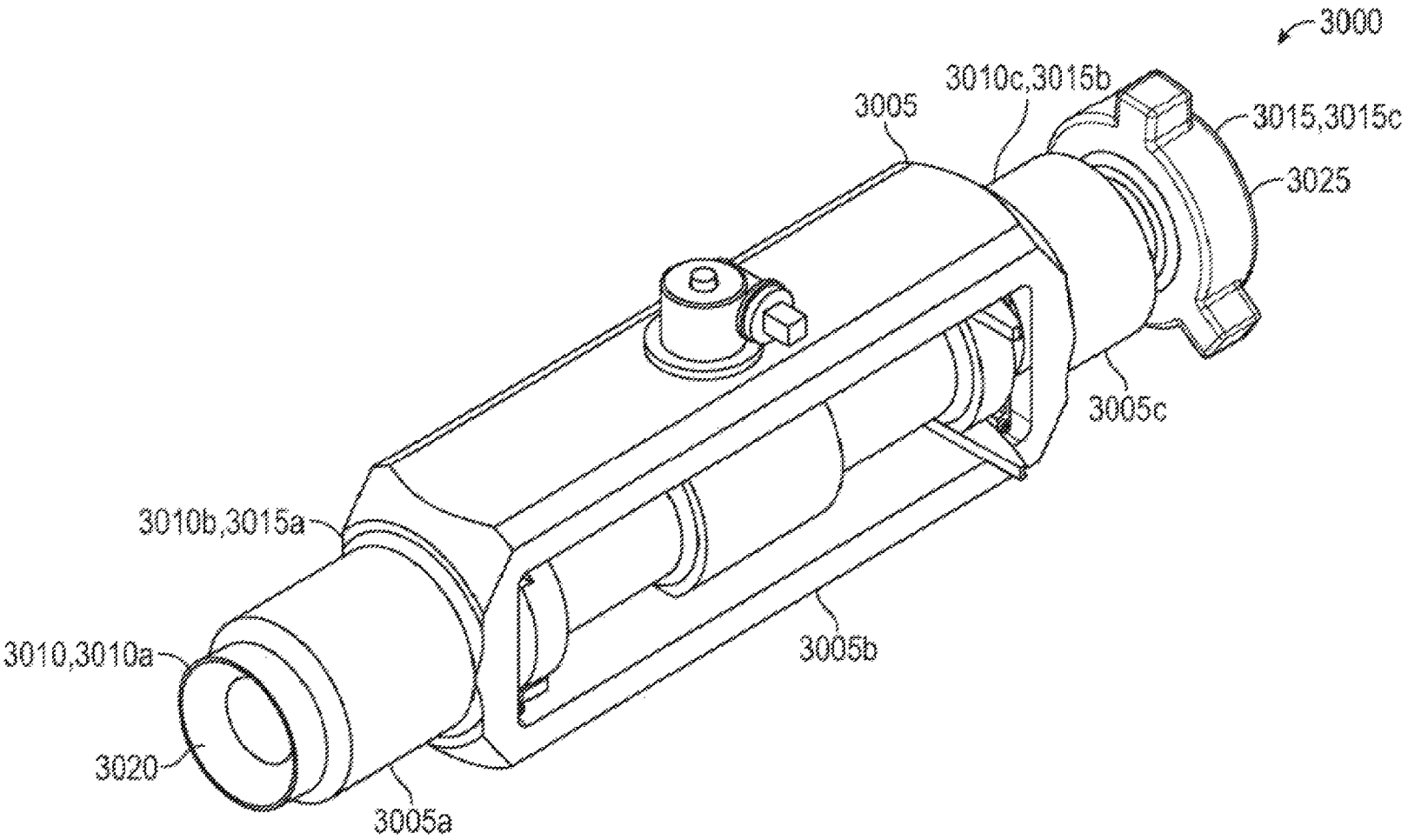
FIG. 30A illustrates an upper, left perspective view of an exemplary drilling mud screen system with a camming seal separator having a face-roller cam mechanism according to an embodiment of the present invention, showing a rotating subassembly in a closed position.

FIG. 30A illustrates an upper, left perspective view of an exemplary drilling mud screen system 3000 with a camming seal separator 30200 having a face-roller camming mechanism 30200*a* according to an embodiment of the present invention, showing a rotating subassembly 30400 in a closed position; FIG. 30C illustrates an upper, left perspective view of the drilling mud screen system 3000 of FIG. 30A, showing a rotating subassembly 30400 in the open position; FIG. 30D illustrates a detail view of a rotating subassembly 30400 of FIGS. 30A-30C; and FIG. 30E illustrates a cross-sectional view of the drilling mud screen system 3000 of FIG. 30A, showing the rotating subassembly 30400 in a closed position.

Figure 31A:
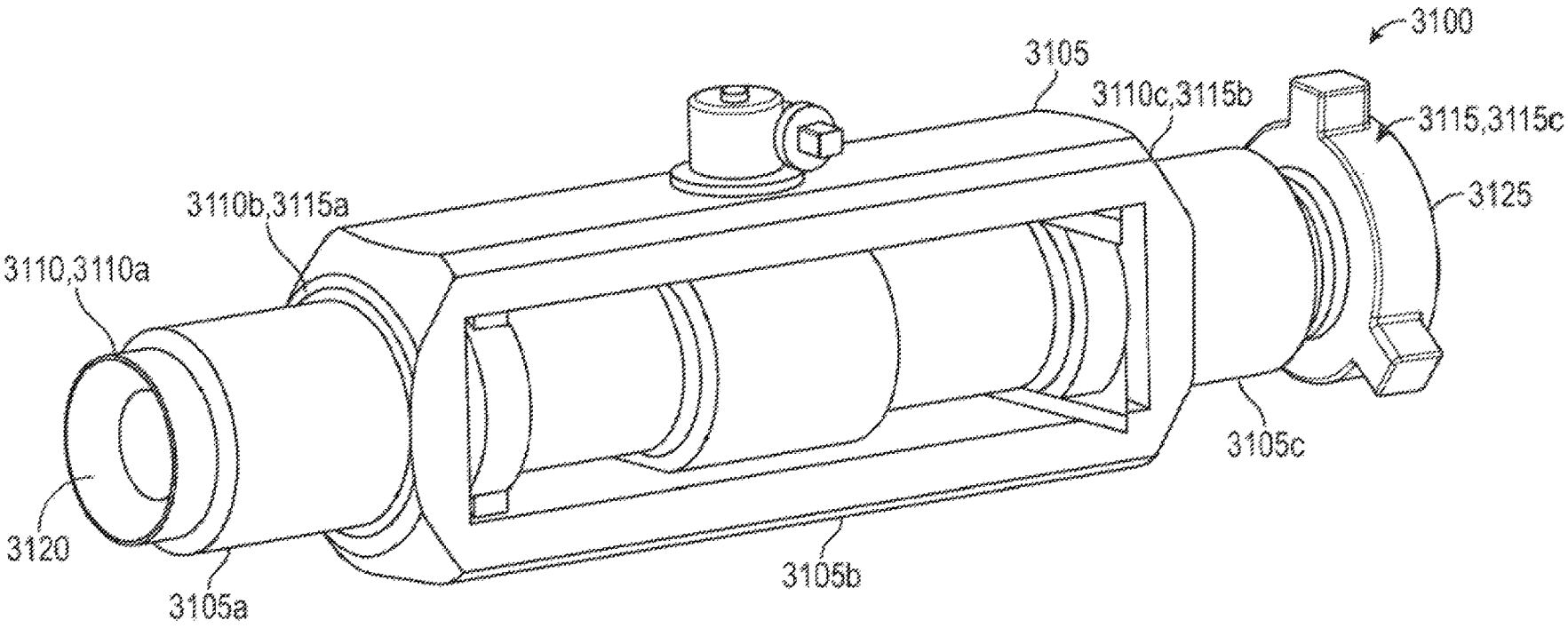
FIG. 31A illustrates left perspective view of an exemplary drilling mud screen system with a camming seal separator having a face-roller cam mechanism according to an embodiment of the present invention, showing a rotating subassembly in a closed position.

FIG. 31A illustrates left perspective view of an exemplary drilling mud screen system 3100 with a camming seal separator 31200 having a face-roller camming mechanism 31200*a* according to an embodiment of the present invention, showing a rotating subassembly 31400 in a closed position; FIG. 31C illustrates a left perspective view of the drilling mud screen system 3100 of FIG. 30A, showing a rotating subassembly 31400 in the open position; FIG. 31D illustrates a partial cross-sectional view of the drilling mud screen system 3100 of FIG. 31A, showing the rotating subassembly 31400 in the closed position; and FIG. 31E illustrates a partial cross-sectional view of the drilling mud screen system 3100 of FIGS. 31A and 31C-31D, showing the rotating subassembly 31400 in the open position.

Figure 30B:
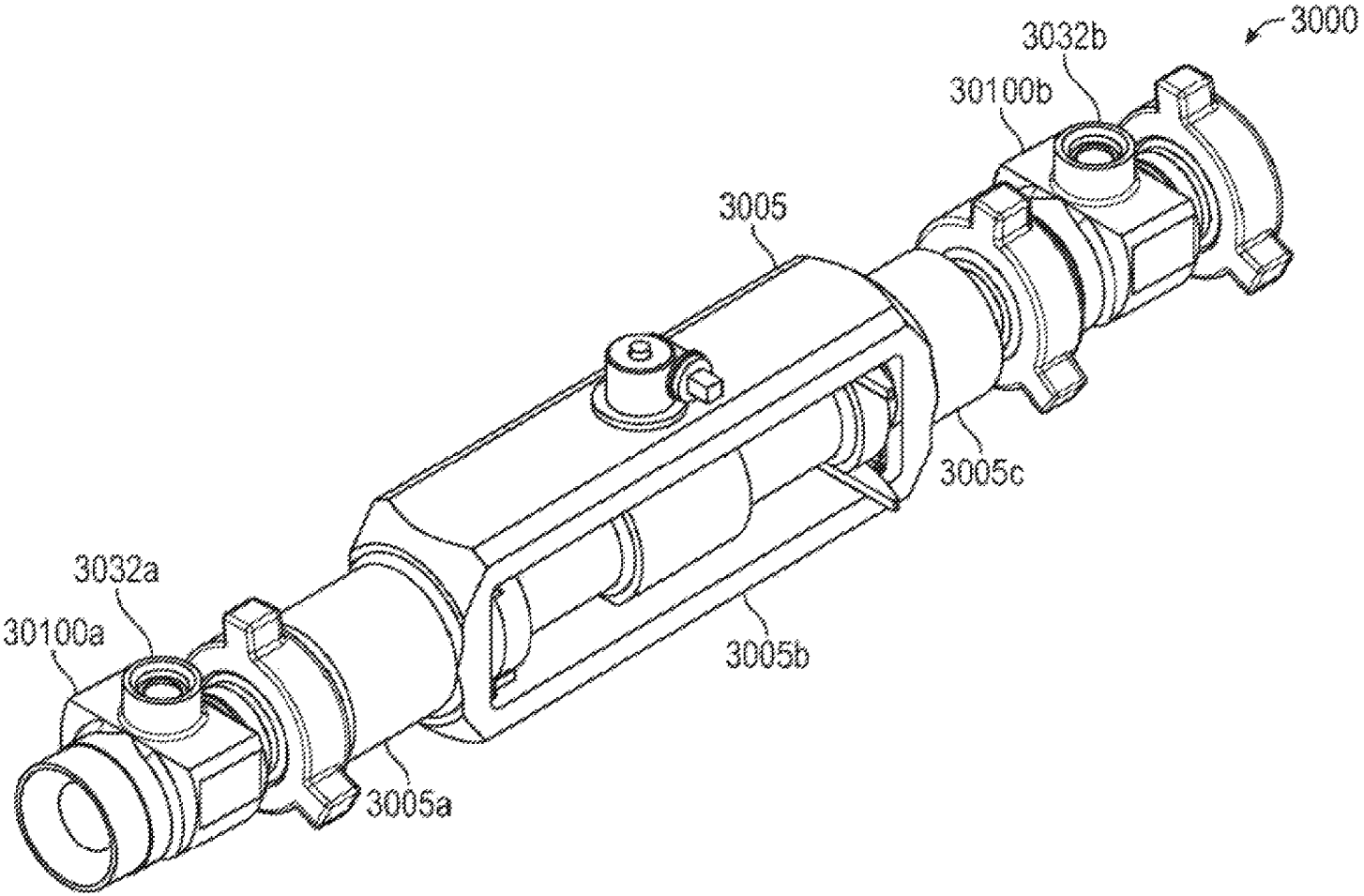
FIG. 30B illustrates the upper, left perspective view of the drilling mud screen system of FIG. 30A, showing an optional first transducer subassembly and an optional second transducer subassembly.
Figure 30C:
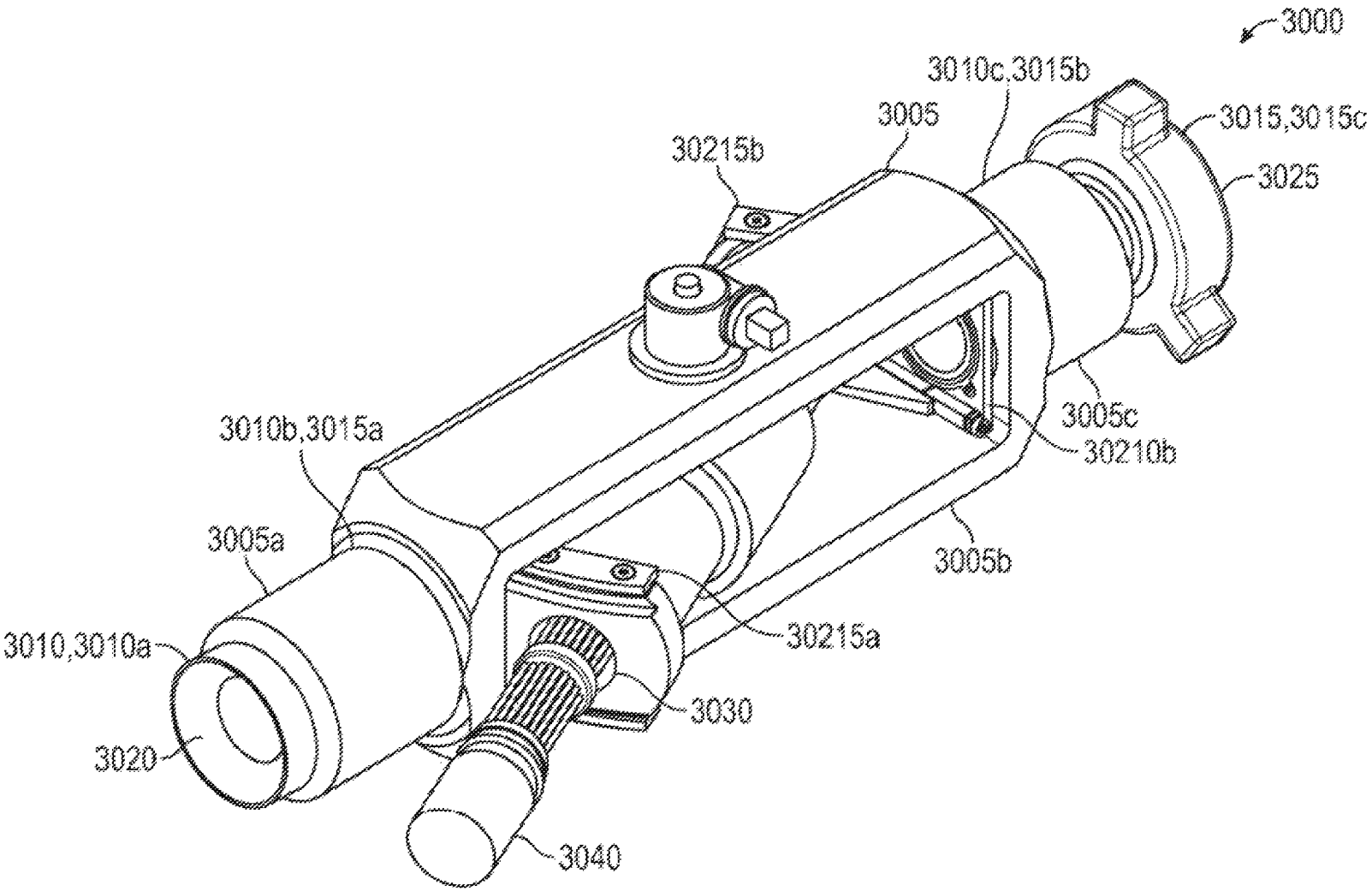
FIG. 30C illustrates an upper, left perspective view of the drilling mud screen system of FIG. 30A, showing a rotating subassembly in the open position.
Figure 30D:
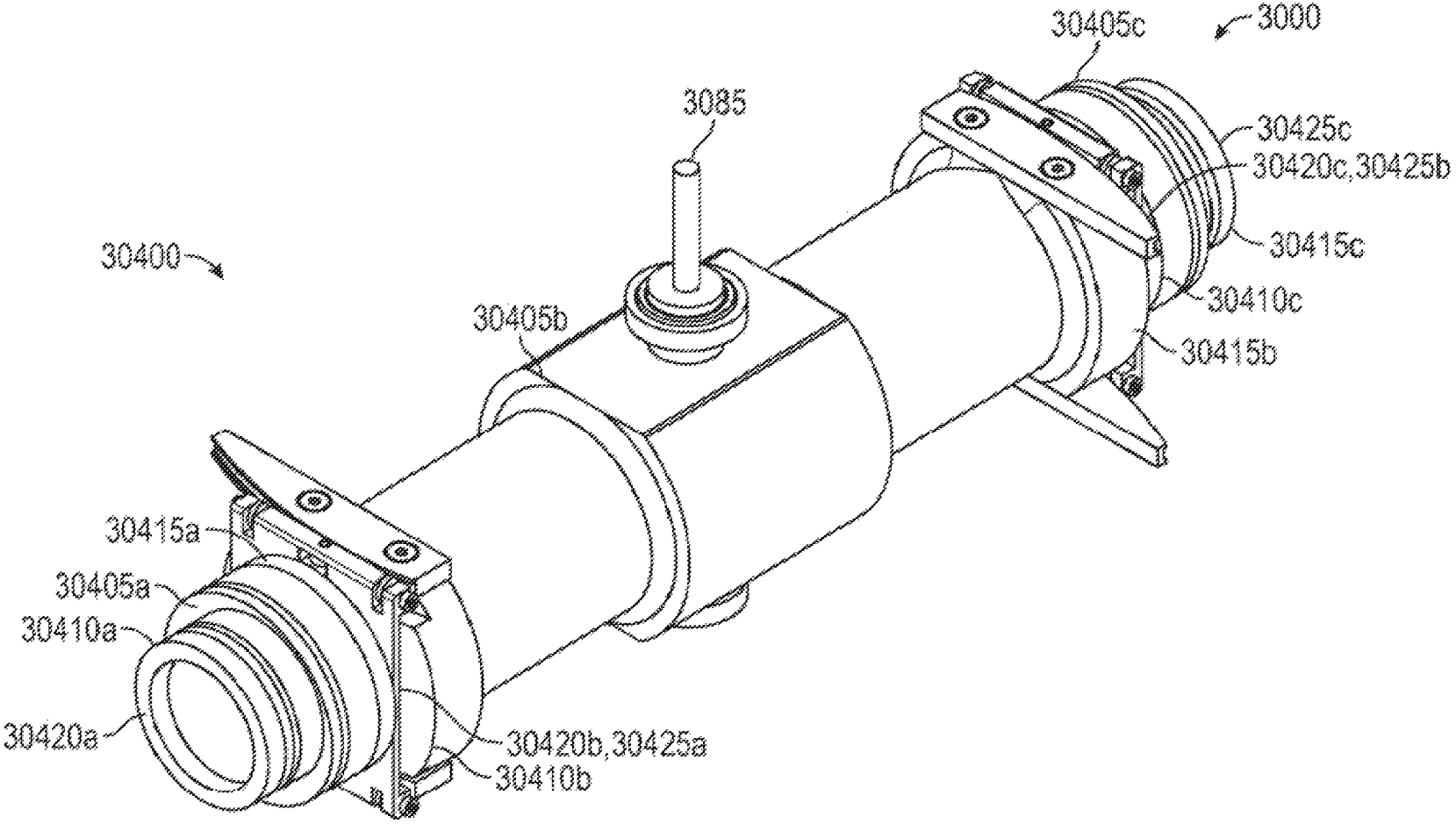
FIG. 30D illustrates a detail view of a rotating subassembly of FIGS. 30A-30C.
Figure 30E:
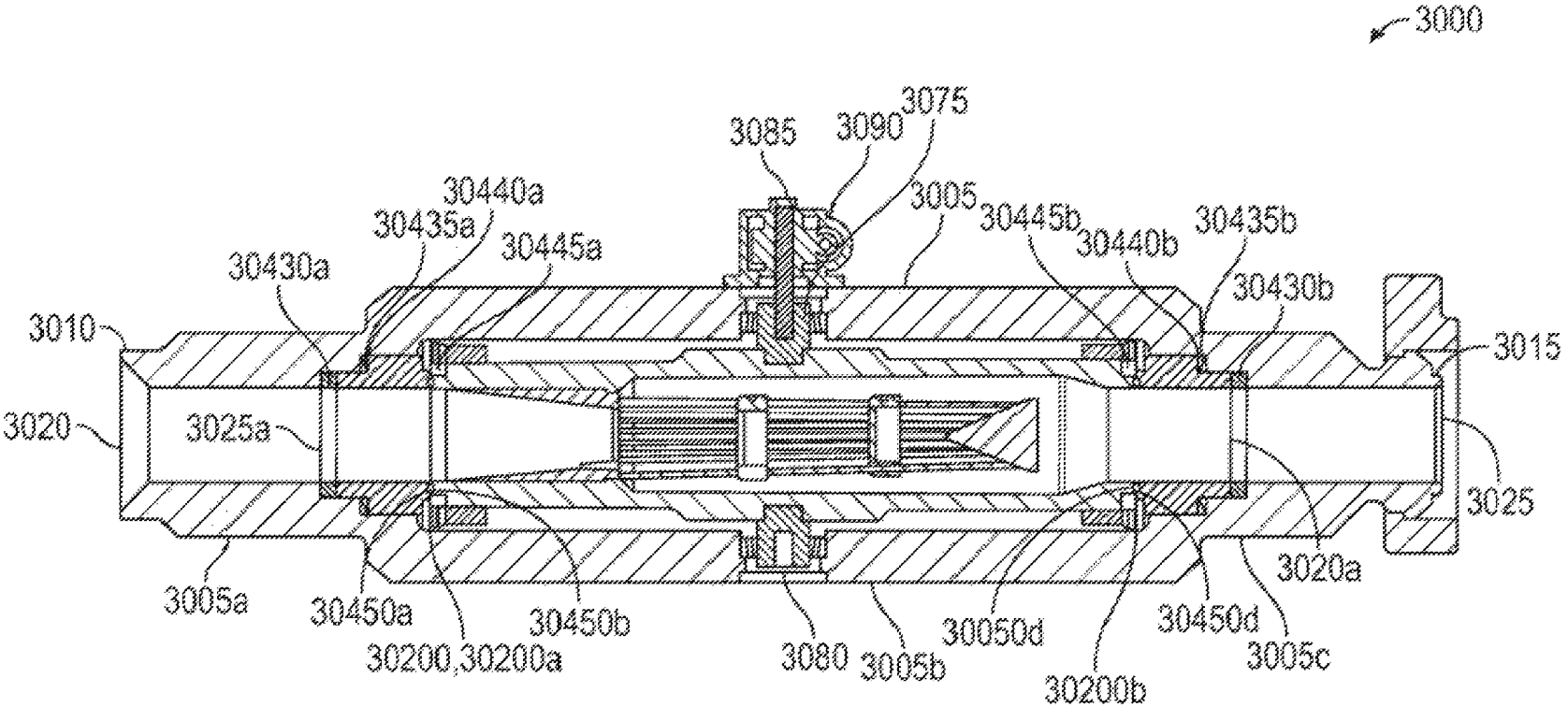
FIG. 30E illustrates a cross-sectional view of the drilling mud screen system of FIG. 30A, showing the rotating subassembly in a closed position.
Figure 31B:
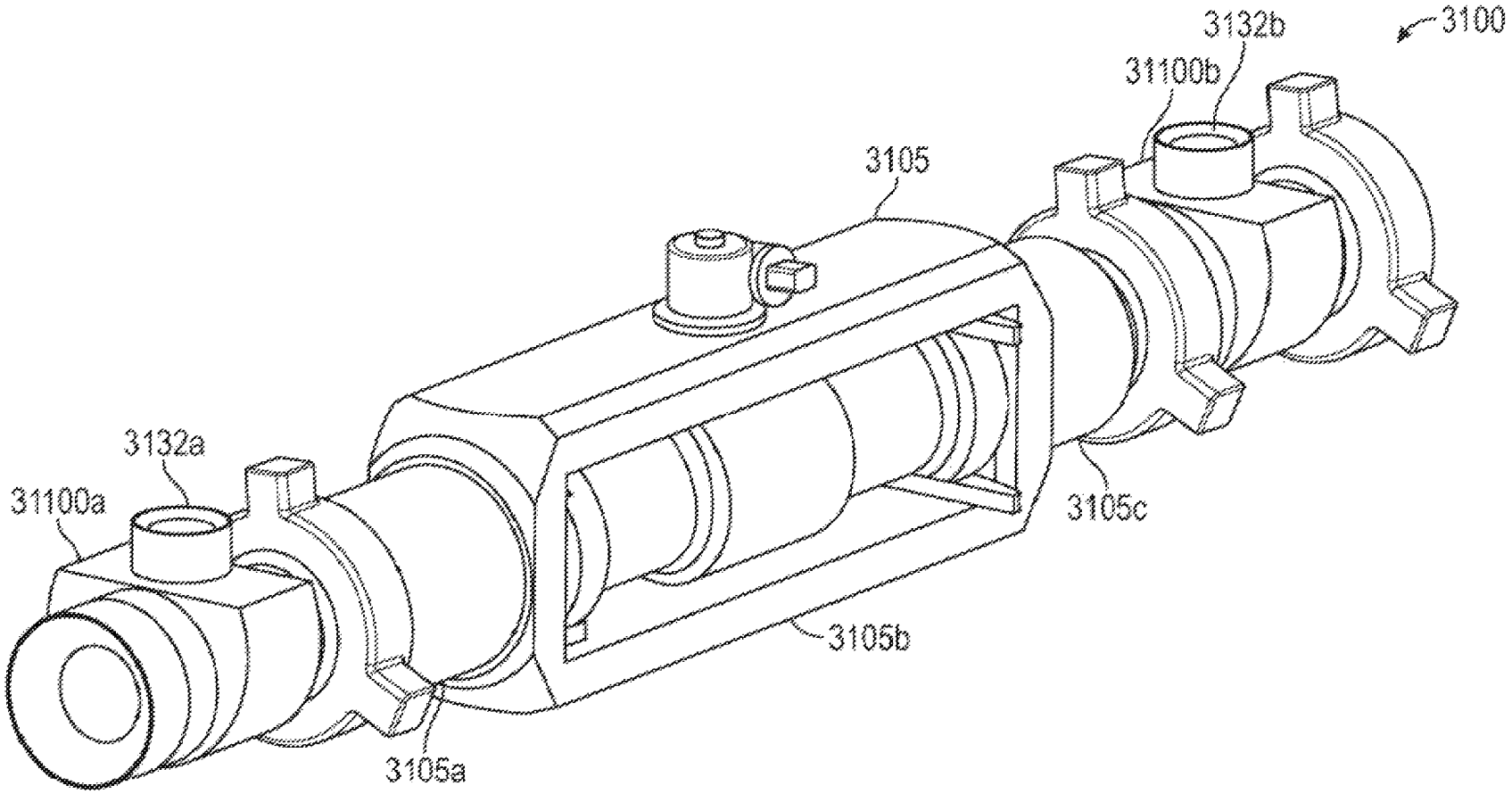
FIG. 31B illustrates the left perspective view of the drilling mud screen system of FIG. 31A, showing an optional first transducer subassembly and an optional second transducer subassembly.
Figure 31C:
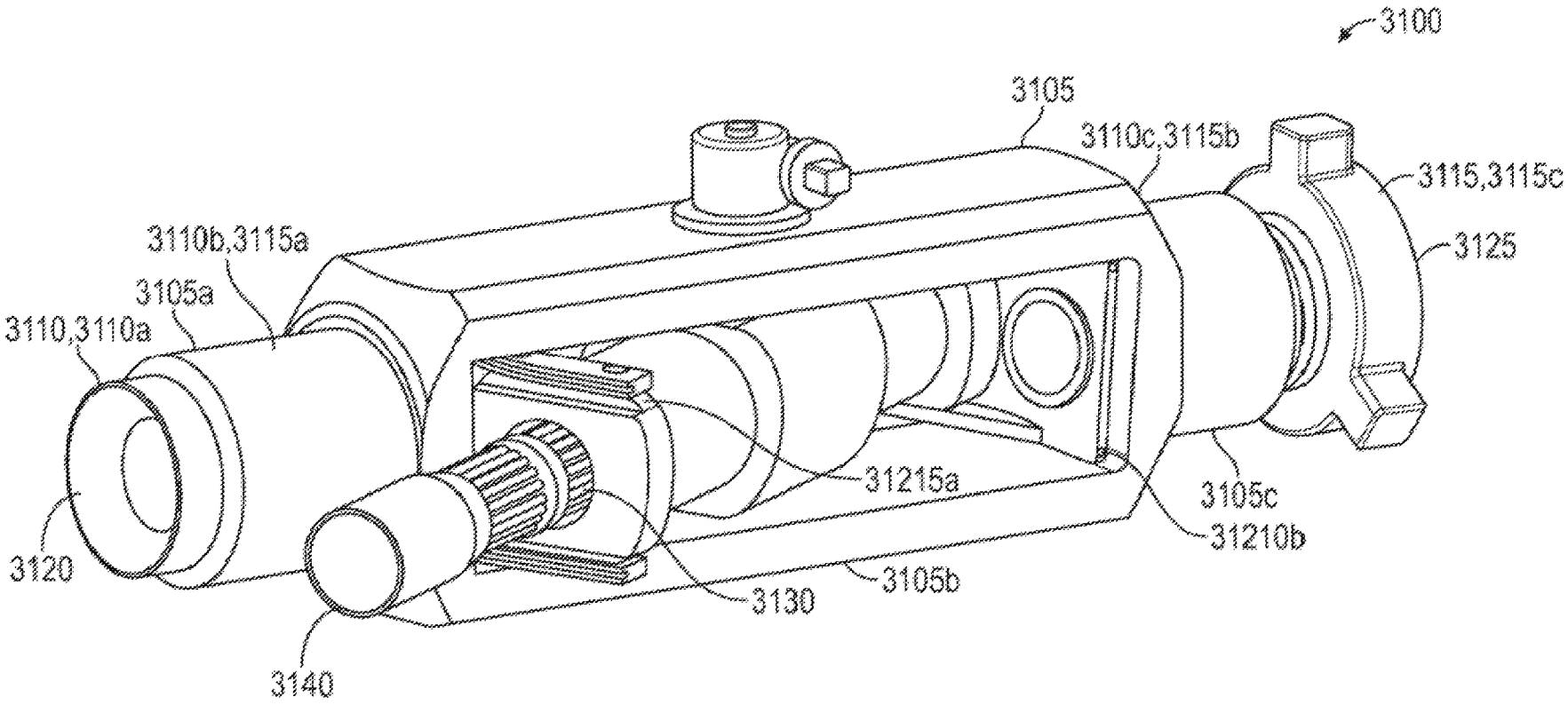
FIG. 31C illustrates a left perspective view of the drilling mud screen system of FIG. 30A, showing a rotating subassembly in the open position.
Figure 31D:
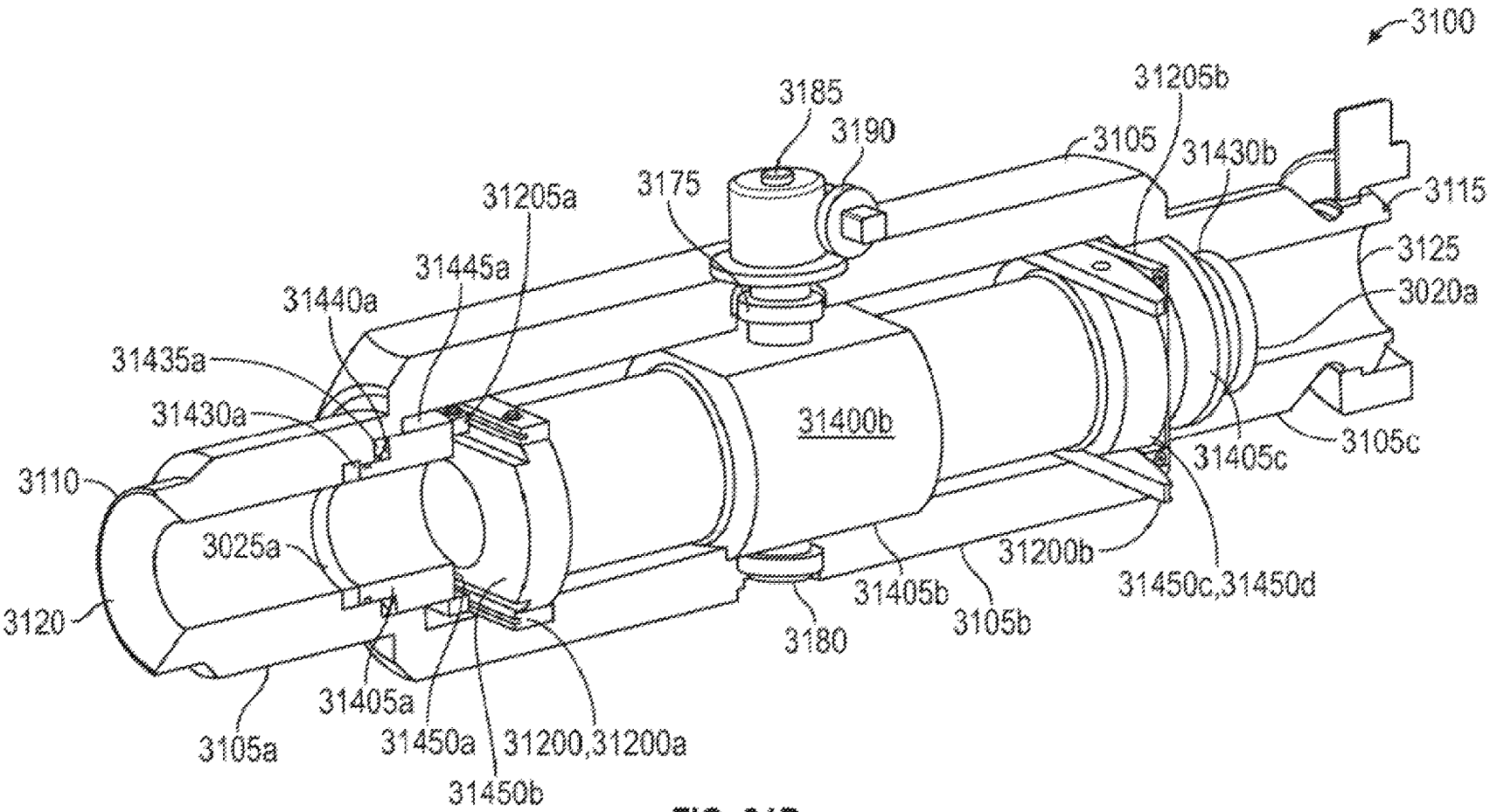
FIG. 31D illustrates a partial cross-sectional view of the drilling mud screen system of FIG. 31A, showing the rotating subassembly in the closed position.
Figure 31E:
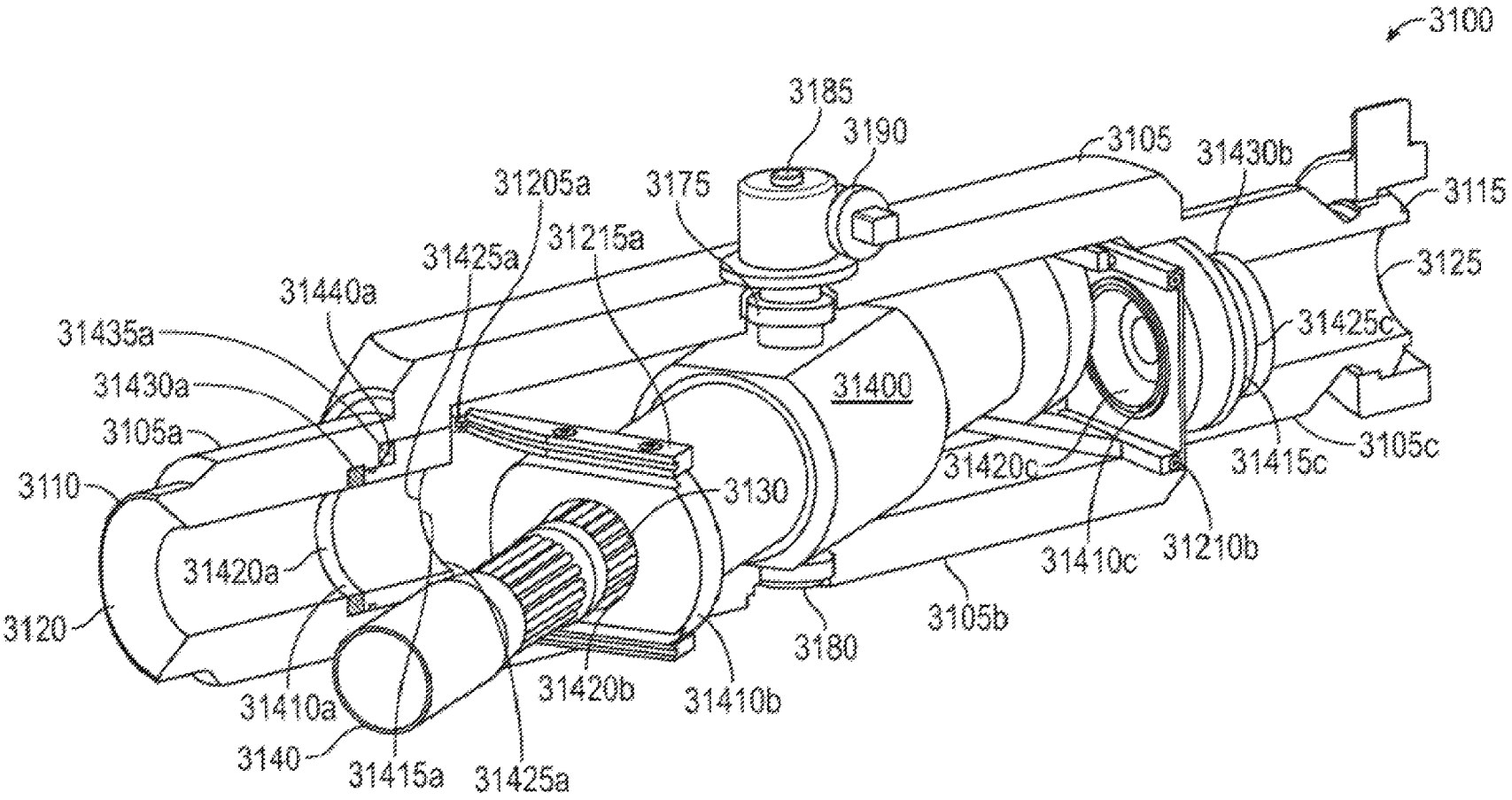
FIG. 31E illustrates a partial cross-sectional view of the drilling mud screen system of FIGS. 31A and 31C-31D, showing the rotating subassembly in the open position.

FIG. 30B illustrates the upper, left perspective view of the drilling mud screen system 3000 of FIG. 30A, showing an optional first transducer subassembly 30100*a* and an optional second transducer subassembly 30100*b*, as discussed below; and FIG. 31B illustrates the left perspective view of the drilling mud screen system 3100 of FIG. 31A, showing an optional first transducer subassembly 31100*a* and an optional second transducer subassembly 31100*b*.

As shown in FIGS. 30A-30E and 31A-31E, the drilling mud screen system 3000, 3100 has a body 3005, 3105 having a first end 3010, 3110 and a second end 3015, 3115, a drilling mud inlet 3020, 3120 and a drilling mud outlet 3025, 3125, and a drilling mud screen access port 3130.

In an embodiment, the drilling mud screen system 3000, 3100 has a drilling mud screen 3040, 3140 fluidly connected to and disposed between the first drilling mud inlet 3020, 3120 and the first drilling outlet 3025, 3125.

In an embodiment, the body 3005, 3105 has a first portion 3005*a*, 3105*a*, a second portion 3005*b*, 3105*b* and a third portion 3005*c*, 3105*c*. In an embodiment, the first portion 3005*a*, 3105*a* of the body 3005, 3105 is an inlet portion. In an embodiment, the second portion 3005*b*, 3105*b* of the body 3005, 3105 is a rotating subassembly/drilling mud screen portion. In an embodiment, the third portion 3005*c*, 3105*c* of the body 3005, 3105 is an outlet portion.

In an embodiment, the first portion 3005*a*, 3105*a* and the third portion 3005*c*, 3105*c* may be any suitable shape. For example, suitable shapes include, but are not limited to, a cone, a cylinder, a rectangular prism (e.g., cubic, cuboid), a pentagonal prism, a sphere, a spheroid, a triangular prism, and combinations and/or portions thereof. In an embodiment, the first portion 3005*a*, 3105*a* and the third portion 3005*c*, 3105*c* may be a cylinder or a combination of cylinders.

In an embodiment, the first portion 3005*a*, 3105*a* and the third portion 3005*c*, 3105*c* may have any suitable inner diameter or dimension. For example, a suitable inner diameter for the first portion 3005*a*, 3105*a* and the third portion 3005*c*, 3105*c* may be from about 2-inches to about 5-inches, and any range or value there between. In an embodiment, the inner diameter of the first portion 3005*a*, 3105*a* and the third portion 3005*c*, 3105*c* may be about 4.06-inches.

In an embodiment, the second portion 3005*b*, 3105*b* may be any suitable shape. For example, suitable shapes include, but are not limited to, a cone, a cylinder, a rectangular prism (e.g., cubic, cuboid), a pentagonal prism, a sphere, a spheroid, a triangular prism, and combinations and/or portions thereof. In an embodiment, the second portion 3005*b*, 3105*b* may be a rectangular prism with open opposing sides. See e.g., FIGS. 30A-30C & 31A-31C (open front and rear sides).

In an embodiment, the second portion 3005*b*, 3105*b* may have any suitable inner diameter or dimension. For example, a suitable inner diameter for the second portion 3005*b*, 3105*b* may be from about 6-inches to about 14-inches, and any range or value there between. In an embodiment, the inner diameter for the second portion 3005*b*, 3105*b* may be about 10-inches.

For example, a suitable inner dimension for the second portion 3005*b*, 3105*b* may be from about 6-inches to about 14-inches square, and any range or value there between. In an embodiment, the inner dimension for the second portion 3005*b*, 3105*b* may be about 10-inches square.

In an embodiment, a drilling mud inlet 3020, 3120 of the drilling mud screen system 3000, 3100 may be fluidly connected to a high-pressure outlet of a drilling mud pump via a connection. In an embodiment, a drilling mud outlet 3025, 3125 of the drilling mud screen system 3000, 3100 may be fluidly connected to an inlet of a vibrator hose to a standpipe via a connection.

Alternatively, the drilling mud screen system 3000, 3100 may be installed between an outlet of the vibrator hose and an inlet of the standpipe, or at any point in the standpipe via a connection.

In an embodiment, the drilling mud inlet 3020, 3120 may be fluidly connected to, for example, an outlet to a drilling mud pump via a connection; and the drilling mud outlet 3025, 3125 may be fluidly connected to, for example, an inlet to a vibrator hose via a connection. Any suitable connection may be used for the drilling mud inlet and the drilling mud outlet. For example, suitable connections include, but are not limited to, pipe fittings and welds. Connections are well known in the art. In an embodiment, the drilling mud inlet 3020, 3120 may be fluidly connected to, for example, an outlet to a drilling mud pump via a weld; and the drilling mud outlet 3025, 3125 may be fluidly connected to, for example, an inlet to a vibrator hose via a weld.

In an embodiment, the body 3005, 3105 of the drilling mud screen system 3000, 3100 may be constructed of any suitable material. For example, suitable materials include, but are not limited to, any alloy suitable for a drilling mud application. In an embodiment, the body 3005, 3105 may be constructed of a low alloy steel (e.g., 4140, 4145, 4330), a stainless steel (e.g., 17-4, 304, 316), a super alloy (e.g., Inconel), a titanium alloy (e.g., Ti-6Al-4V, Ti-6Al-6V-2Sn), a copper alloy (e.g., Beryllium Copper), a Cobalt alloy (e.g., Stellite), an Aluminum alloy (e.g., 2024, 6061, 7075) and combination thereof. In an embodiment, the body 3005, 3105 may be constructed of an American Iron and Steel Industry (AISI) 4130/75*k* yield or equivalent material. In an embodiment, the inner surface of the body 3005, 3105 may be unpainted. In an embodiment, the outer surface of the body 3005, 3105 may be painted.

Pivot Subassembly

As shown in FIGS. 30A-30E and 31A-31E, the second portion 3005*b*, 3105*b* of the body 3005, 3105 and/or the rotating subassembly 30400, 31400 has a first shaft stud 3075, 3175, a second shaft stud 3080, 3180, a pivot shaft 3085, 3185, and a pivot drive 3090, 3190.

In an embodiment, the rotating subassembly 30400, 31400 may be retained in the second portion 3005*b*, 3105*b* of the body 3005, 3105 via the first shaft stud 3075, 3175 and the second shaft stud 3080, 3180. See e.g., FIGS. 30E & 31D-31E. In an embodiment, the rotating subassembly 30400, 31400 may be retained in the second portion 3005*b*, 3105*b* of the body 3005, 3105 via the first shaft stud 3075, 3175 and the second shaft stud 3080, 3180 such that the rotating subassembly 30400, 31400 may rotate with respect to the second portion 3005*b*, 3105*b* of the body 3005, 3105.

In an embodiment, the first shaft stud 3075, 3175 or the second shaft stud 3080, 3180 may be attached to the pivot drive 3090, 3190 via the pivot shaft 3085, 3185.

In an embodiment, the pivot drive 3090, 3190 may be any suitable means of leverage to rotate the rotating subassembly. For example, suitable means of leverage include, but are not limited to a handle, a gear box, or other driving means. In an embodiment, the pivot drive 3090, 3190 has a handle. In an embodiment, the pivot drive 3090, 3190 has a gear box.

Rotating Subassembly

FIG. 30D illustrates a detail view of a rotating subassembly 30400 of FIGS. 30A-30C; and FIG. 30E illustrates a cross-sectional view of the drilling mud screen system 3000 of FIG. 30A, showing the rotating subassembly 30400 in a closed position.

FIG. 31D illustrates a partial cross-sectional view of the drilling mud screen system 3100 of FIG. 31A, showing the rotating subassembly 31400 in the closed position; and FIG. 31E illustrates a partial cross-sectional view of the drilling mud screen system 3100 of FIGS. 31A and 31C-31D, showing the rotating subassembly 31400 in the open position.

As shown in FIGS. 30D-30E and 31D-31E, the rotating subassembly 30400, 31400 has a first body 30405*a*, 31405*a* having a first end 30410*a*, 31410*a*, a second end 30415*a*, 31415*a*, a first drilling mud inlet 30420*a*, 31420*a* and a first drilling mud outlet 30425*a*, 31425*a*, a second body 30405*b*, 31405*b* having a first end 30410*b*, 31410*b*, a second end 30415*b*, 31415*b*, a second drilling mud inlet 30420*b*, 31420*b* and a second drilling mud outlet 30425*b*, 31425*b*, and a third body 30405*c*, 31405*c* having a first end 30410*c*, 31410*c*, a second end 30415*c*, 31415*c*, a third drilling mud inlet 30420*c*, 31420*c* and a third drilling mud outlet 30425*c*, 31425*c*.

In an embodiment, the rotating subassembly 30400, 31400 has a drilling mud screen 3040, 3140 fluidly connected to and disposed between the second drilling mud inlet 30420*b*, 31420*b* and the second drilling outlet 30425*b*, 31425*b*.

In an embodiment, the first body 30405*a*, 31405*a* is an inlet portion. In an embodiment, the second body 30405*b*, 31405*b* is a rotating subassembly/drilling mud screen portion. In an embodiment, the third body 30405*c*, 31405*c* is an outlet portion.

In an embodiment, the first body 30405*a*, 31405*a* and the third body 30405*c*, 31405*c* may be any suitable shape. For example, suitable shapes include, but are not limited to, a cone, a cylinder, a rectangular prism (e.g., cubic, cuboid), a pentagonal prism, a sphere, a spheroid, a triangular prism, and combinations and/or portions thereof. In an embodiment, the first body 30405*a*, 31405*a* and the third body 30405*c*, 31405*c* may be a cylinder or a combination of cylinders.

In an embodiment, the first body 30405*a*, 31405*a* and the third body 30405*c*, 31405*c* may have any suitable inner diameter or dimension. For example, a suitable inner diameter for the first body 30405*a*, 31405*a* and the third body 30405*c*, 31405*c* may be from about 2-inches to about 5-inches, and any range or value there between. In an embodiment, the inner diameter of the first body 30405*a*, 31405*a* and the third body 30405*c*, 31405*c* may be about 4.06-inches.

In an embodiment, the second body 30405*b*, 31405*b* may be any suitable shape. For example, suitable shapes include, but are not limited to, a cone, a cylinder, a rectangular prism (e.g., cubic, cuboid), a pentagonal prism, a sphere, a spheroid, a triangular prism, and combinations and/or portions thereof. In an embodiment, the second body 30405*b*, 31405*b* may be a combination of cylinders. See e.g., FIGS. 30D-30E & 31D-31E.

In an embodiment, the second body 30405*b*, 31405*b* may have any suitable inner diameter or dimension. For example, a suitable inner diameter for the second body 30405*b*, 31405*b* may be from about 4-inches to about 10-inches, and any range or value there between. In an embodiment, the inner diameter for the second body 30405*b*, 31405*b* may be about 6-inches.

In an embodiment, an internal drilling mud outlet 3025*a*, 3125*a* of the body 3005, 3105 of the drilling mud screen system 3000, 3100 may be fluidly connected to the first drilling mud inlet 30420*a*, 31420*a* of the first body 30405*a*, 31405*a* of the rotating subassembly 30400, 31400.

In an embodiment, the first drilling mud outlet 30425*a*, 31425*a* of the first body 30405*a*, 31405*a* of the rotating subassembly 30400, 31400 may be fluidly connected to the second drilling mud inlet 30420*b*, 31420*b* of the second body 30405*b*, 31405*b* of the rotating subassembly 30400, 31400.

In an embodiment, the second drilling mud outlet 30425*b*, 31425*b* of the second body 30405*b*, 31405*b* of the rotating subassembly 30400, 31400 may be fluidly connected to the third drilling mud inlet 30420*c*, 31420*c* of the third body 30405*c*, 31405*c* of the rotating subassembly 30400, 31400.

In an embodiment, the third drilling mud outlet 30425*c*, 31425*c* of the third body 30405*c*, 31405*c* of the rotating subassembly 30400, 31400 may be fluidly connected to an internal drilling mud inlet 3020*a*, 3120*a* of the body 3005, 3105 of the drilling mud screen system 3000, 3100.

In an embodiment, a first guard ring 30430*a*, 31430*a* may be disposed between the body 3005, 3105 of the drilling mud screen system 3000, 3100 and the first end 30410*a*, 31410*a* of the first body 30405*a*, 31405*a* of the rotating subassembly 30400, 31400. See e.g., FIGS. 30E & 31D-31E. In an embodiment, a first guard ring 30430*a*, 31430*a* may be disposed in a first piston cavity 30435*a*, 31435*a* between the body 3005, 3105 of the drilling mud screen system 3000, 3100 and the first end 30410*a*, 31410*a* of the first body 30405*a*, 31405*a* of the rotating subassembly 30400, 31400 to prevent buildup and compaction of debris in the first piston cavity 30435*a*, 31435*a*.

In an embodiment, a second guard ring 30430*b*, 31430*b* may be disposed between the second end 30415*c*, 31415*c* of the third body 30405*c*, 31405*c* of the rotating subassembly 30400, 31400 and the body 3005, 3105 of the drilling mud screen system 3000, 3100. See e.g., FIGS. 30E & 31D-31E. In an embodiment, a second guard ring 30430*b*, 31430*b* may be disposed in a second piston cavity 30435*b*, 31435*b* between the second end 30415*c*, 31415*c* of the third body 30405*c*, 31405*c* of the rotating subassembly 30400, 31400 and the body 3005, 3105 of the drilling mud screen system 3000, 3100 to prevent buildup and compaction of debris in the second piston cavity 30435*b*, 31435*b*.

In an embodiment, the first guard ring 30430*a*, 31430*a* and the second guard ring 30430*b*, 31430*b* may be constructed of any suitable compressible material to prevent buildup and compaction of debris in first piston cavity 30435*a*, 31435*a* and the second piston cavity 30435*b*, 31435*b*, respectively.

In an embodiment, a first spring 30440*a*, 31440*a* may be disposed between the body 3005, 3105 of the drilling mud screen system 3000, 3100 and the first body 30405*a*, 31405*a* of the rotating subassembly 30400, 31400. See e.g., FIGS. 30E & 31D-31E. In an embodiment, a first spring 30440*a*, 31440*a* may be disposed in a first seal piston cavity 30445*a*, 31445*a* between the body 3005, 3105 of the drilling mud screen system 3000, 3100 and the first body 30405*a*, 31405*a* of the rotating subassembly 30400, 31400 to engage and seal a second end 30415*a*, 31415*a* of the first body 30405*a*, 31405*a* with a first end 30410*b*, 31410*b* of a second body 30405*b*, 31405*b* of the rotating subassembly 30400, 31400.

In an embodiment, a second spring 30440*b*, 31440*b* may be disposed between the third body 30405*c*, 31504*c* of the rotating subassembly 30400, 31400 and the body 3005, 3105 of the drilling mud screen system 3000, 3100. See e.g., FIGS. 30E & 31D-31E. In an embodiment, a second spring 30440*b*, 31440*b* may be disposed in a second seal piston cavity 30445*b*, 31445*b* between the third body 30405*c* of the rotating subassembly 30400, 31400 and the body 3005, 3105 of the drilling mud screen system 3000, 3100 to engage and seal a second end 30415*b*, 31415*b* of the second body 30405*b*, 31405*b* with a first end 30410*c*, 31410*c* of the third body 30405*c*, 31405*c* of the rotating subassembly 30400, 31400.

In an embodiment, the body 3005, 3105 of the drilling mud screen system 3000, 3100 and the first body 30405*a*, 31405*a* of the rotating subassembly 30400, 31400 may be sealed via an O-ring. See e.g., FIGS. 30E & 31D-31E. Any suitable O-ring may be used. For example, suitable O-rings include, but are not limited to, 300 Series O-rings. O-rings are well known in the art.

In an embodiment, the third body 30405*c*, 31405*c* of the rotating subassembly 30400, 31400 and the body 3005, 3105 of the drilling mud screen system 3000, 3100 may be sealed with via an O-ring. See e.g., FIG. 30E. Any suitable O-ring may be used. For example, suitable O-rings include, but are not limited to, 300 Series O-rings. O-rings are well known in the art.

In an embodiment, the second end 30415*a*, 31415*a* of the first body 30405*a*, 31405*a* of the rotating subassembly 30400, 31400 has a first seal face 30450*a*, 31450*a*. See e.g., FIGS. 30E & 31E.

In an embodiment, the first end 30410*b*, 31410*b* of the second body 30405*b*, 31405*b* of the rotating subassembly 30400, 31400 has a second seal face 30450*b*, 31450*b*. See e.g., FIGS. 30E & 31C-31E.

In an embodiment, the first seal face 30450*a*, 31450*a* and the second seal face 30450*b*, 31450*b* may have any suitable shapes to form a seal. For example, suitable shapes may be mating concave and convex surfaces, mating concave and convex surfaces similar to a ball valve, and combinations and variations thereof. In an embodiment, the first seal face 30450*a*, 31450*a* may be concave; and the second seal face 30450*b*, 31450*b* may be convex.

In an embodiment, the second end 30415*b*, 31415*b* of the second body 30405*b*, 31405*b* of the rotating subassembly 3000, 3100 has a third seal face 30450*c*, 314050*c*. See e.g., FIGS. 30E & 31D 10077111*n* an embodiment, the first end 30410*c*, 314010*c* of the third body 30405*c*, 31405*c* of the rotating subassembly 30400, 31400 has a fourth seal face 30450*d*, 31450*d*. See e.g., FIGS. 30E & 31C-31E.

In an embodiment, the third seal face 30450*c*, 31450*c* and the fourth seal face 30450*d*, 31450*d* may have any suitable shapes to form a seal. For example, suitable shapes may be mating concave and convex surfaces, mating concave and convex surfaces similar to a ball valve, and combinations and variations thereof. In an embodiment, the third seal face 30450*c*, 31450*c* may be convex; and the fourth seal face 30450*d*, 31450*d* may be concave.

In an embodiment, the first body 30405*a*, 31405*a*, the second body 30405*b*, 31405*b* and the third body 30405*c*, 31405*c* of the rotating subassembly 30400, 31400 may be constructed of any suitable material. For example, suitable materials include, but are not limited to, any alloy suitable for a drilling mud application. In an embodiment, the first body 30405*a*, 31405*a*, the second body 30405*b*, 31405*b* and the third body 30405*c*, 31405*c* may be constructed of a low alloy steel (e.g., 4140, 4145, 4330), a stainless steel (e.g., 17-4, 304, 316), a super alloy (e.g., Inconel), a titanium alloy (e.g., Ti-6Al-4V, Ti-6Al-6V-2Sn), a copper alloy (e.g., Beryllium Copper), a Cobalt alloy (e.g., Stellite), an Aluminum alloy (e.g., 2024, 6061, 7075) and combination thereof. In an embodiment, the first body 30405*a*, 31405*a*, the second body 30405*b*, 31405*b* and the third body 30405*c*, 31405*c* may be constructed of an American Iron and Steel Industry (AISI) 4130/75*k* yield or equivalent material. In an embodiment, the inner surface of the first body 30405*a*, 31405*a*, the inner surface of the second body 30405*b*, 31405*b* and the inner surface of the third body 30405*c*, 31405*c* may be unpainted. In an embodiment, the outer surface of the first body 30405*a*, 31405*a*, the outer surface of the second body 30405*b*, 31405*b* and the outer surface of the third body 30405*c*, 31405*c* may be painted.

Camming Seal Separator

In an embodiment, a camming seal separator 30200, 31200 may be used to prevent unnecessary wear to the seal faces 30450*a*, 30450*b*, 30450*c*, 30450*d*, 31450*a*, 31450*b*, 31450*c*, 31450*d*, as discussed below.

In an embodiment, the camming seal separator 30200, 31200 may be any suitable seal separator. For example, a suitable camming seal separator includes, but is not limited to, a face-rolling camming mechanism, a push-rod camming mechanism, and combinations and variations thereof. In an embodiment, the camming seal separator 30200, 31200 has a face-roller camming mechanism. See e.g., FIGS. 30C-30D & 31C-31E.

Face-Rolling Camming Mechanism

FIG. 30C illustrates an upper, left perspective view of the drilling mud screen system 3000 of FIG. 30A, showing a rotating subassembly 30400 in the open position; and FIG. 30D illustrates a detail view of a rotating subassembly 30400 of FIGS. 30A-30C.

FIG. 31C illustrates a left perspective view of the drilling mud screen system 3100 of FIG. 30A, showing a rotating subassembly 31400 in the open position; FIG. 31D illustrates a partial cross-sectional view of the drilling mud screen system 3100 of FIG. 31A, showing the rotating subassembly 31400 in the closed position; and FIG. 31E illustrates a partial cross-sectional view of the drilling mud screen system 3100 of FIGS. 31A and 31C-31D, showing the rotating subassembly 31400 in the open position.

As shown in FIGS. 30C-30D and 31C-31E, the rotating subassembly 30400, 31400 has a first face-rolling camming mechanism 30200*a*, 31200*a* and a second face-rolling camming mechanism 30200*b*, 31200*b*.

In an embodiment, the first face-rolling camming mechanism 30200*a*, 31200*a* has a first cam roller 30205*a*, 31205*a*, a first roller bracket 30210*a*, 31210*a* and a first cam track 30215*a*, 31215*a*.

In an embodiment, the second face-rolling camming mechanism 30200*b*, 31200*b* has a second cam roller 30205*b*, 31205*b*, a second roller bracket 30210*b*, 31210*b*, and a second cam track 30215*b*, 31215*b*.

In an embodiment, the first cam roller 30205*a*, 31205*a* may be attached to a second end 30415*a*, 31415*a* of the first body 30405*a*, 31405*a* of the rotating subassembly 30400, 31400. In an embodiment, the first cam roller 30205*a*, 31205*a* may be attached to a second end 30415*a*, 31415*a* of the first body 30405*a*, 31405*a* of the rotating subassembly 3040, 31400 via fasteners. Any suitable fastener may be used for the first cam roller 30205*a*, 31205*a* and the first body 30405*a*, 31405*a* of the rotating subassembly 30400, 31400. For example, suitable fasteners include, but are not limited to, bolts, screws, pins, rivets, welds, and combinations thereof. Fasteners are well known in the art.

In an embodiment, the first roller bracket 30210*a*, 31210*a* may be attached to a second end 30415*b*, 31415*b* of the first body 30405*a*, 31405*a* of the rotating subassembly 30400, 31400. In an embodiment, the first roller bracket 30210*a*, 31210*a* may be attached to a second end 30415*b*, 31415*b* of the first body 30405*a*, 31405*a* of the rotating subassembly 30400, 31400 via fasteners. Any suitable fastener may be used for the first roller bracket 30210*a*, 31210*a* and the first body 30405*a*, 31405*a* of the rotating subassembly 30400, 31400. For example, suitable fasteners include, but are not limited to, bolts, screws, pins, rivets, welds, and combinations thereof. Fasteners are well known in the art.

In an embodiment, the first cam roller 30205*a*, 31205*a* may be attached to the first roller bracket 30210*a*, 31210*a*. In an embodiment, the first cam roller 30205*a*, 31205*a* may be attached to the first roller bracket 30210*a*, 31210*a* via fasteners. Any suitable fastener may be used for the first cam roller 30205*a*, 31205*a* and the first roller bracket 30210*a*, 31210*a*. For example, suitable fasteners include, but are not limited to, bolts, screws, pins, rivets, welds, and combinations thereof. Fasteners are well known in the art.

In an embodiment, the first cam track 30215*a*, 31215*a* may be attached to a first end 30410*b*, 31410*b* of the second body 30405*b*, 31405*b* of the rotating subassembly 30400, 31400. In an embodiment, the first cam track 30215*a*,

31215*a* may be attached to a first end 30410*b*, 31410*b* of the second body 30405*b*, 31405*b* of the rotating subassembly 30400, 31400 via fasteners. Any suitable fasteners may be used for the first cam track 30215*a*, 31215*a* and the second body 30405*b*, 31405*b* of the rotating subassembly 30400, 31400. For example, suitable fasteners include, but are not limited to, bolts, screws, pins, rivets, welds, and combinations thereof. Fasteners are well known in the art.

In a closed position for the rotating subassembly 30400, 31400, the first cam roller 30205*a*, 31205*a* may be disposed in a first recessed portion of the first cam track 30215*a*, 31215*a* allowing the second end 30415*a*, 31415*a* of the first body 30405*a*, 31405*a* of the rotating subassembly 30400, 31400 to close against the first end 3010*b*, 3110*b* of the second body 30405*b*, 31405*b* of the rotating subassembly 30400, 31400 and to form a first seal between seal faces 30450*a*, 30450*b*, 31450*a*, 31450*b*.

As the rotating subassembly 30400, 31400 rotates, the first cam roller 30205*a*, 31205*a* travels along the first cam track 30215*a*, 31215*a* and collapses the first body 30405*a*, 31405*a* of the rotating subassembly 30400, 31400 into the body 3005, 3105 to prevent unnecessary wear to the seal faces 30450*a*, 30450*b*, 31450*a*, 31450*b*.

In an embodiment, the second cam roller 30205*b*, 31205*b* may be attached to a second end 30415*b*, 31415*b* of the second body 30405*b*, 31405*b* of the rotating subassembly 30400, 31400. In an embodiment, the second cam roller 30205*b*, 31205*b* may be attached to a second end 30415*b*, 31415*b* of the second body 30405*b*, 31405*b* of the rotating subassembly 30400, 31400 via fasteners. Any suitable fastener may be used for the second cam roller 30205*b*, 31205*b* and the second body 30405*b*, 31405*b* of the rotating subassembly 30400, 31400. For example, suitable fasteners include, but are not limited to, bolts, screws, pins, rivets, welds, and combinations thereof. Fasteners are well known in the art.

In an embodiment, the second roller bracket 30210*b*, 31210*b* may be attached to a first end 30410*c*, 31410*c* of the third body 30405*c*, 31405*c* of the rotating subassembly 30400, 31400. In an embodiment, the second roller bracket 30210*b*, 31210*b* may be attached to a first end 30410*c*, 31410*c* of the third body 30405*c*, 31405*c* of the rotating subassembly 30400, 31400 via fasteners. Any suitable fastener may be used for the second roller bracket 30210*b*, 31210*b* and the third body 30405*c*, 31405*c* of the rotating subassembly 30400, 31400. For example, suitable fasteners include, but are not limited to, bolts, screws, pins, rivets, welds, and combinations thereof. Fasteners are well known in the art.

In an embodiment, the second cam roller 30205*b*, 31205*b* may be attached to the second roller bracket 30210*b*, 31210*b*. In an embodiment, the second cam roller 30205*b*, 31205*b* may be attached to the second roller bracket 30210*b*, 31210*b* via fasteners. Any suitable fastener may be used for the second cam roller 30205*b*, 31205*b* and the second roller bracket 30210*b*, 31210*b*. For example, suitable fasteners include, but are not limited to, bolts, screws, pins, rivets, welds, and combinations thereof. Fasteners are well known in the art.

In an embodiment, the second cam track 30215*b*, 31215*b* may be attached to a second end 30415*b*, 31415*b* of the second body 30405*b*, 31405*b* of the rotating subassembly 30400, 31400. In an embodiment, the second cam track 30215*b*, 31215*b* may be attached to a second end 30415*b*, 31415*b* of the second body 30405*b*, 31405*b* of the rotating subassembly 30400, 31400 via fasteners. Any suitable fasteners may be used for the second cam track 30215*b*, 31215*b* and the second body 30405*b*, 31405*b* of the rotating subassembly 30400, 31400. For example, suitable fasteners include, but are not limited to, bolts, screws, pins, rivets, welds, and combinations thereof. Fasteners are well known in the art.

In a closed position for the rotating subassembly 30400, 31400, the second cam roller 30205*b*, 31205*b* may be disposed in a second recessed portion of the second cam track 30215*b*, 31215*b* allowing the second end 30415*b*, 31415*b* of the second body 30405*b*, 31405*b* of the rotating subassembly 30400, 31400 to close against the first end 30410*c*, 31410*c* of the third body 30405*c*, 31405*c* of the rotating subassembly 30400, 31400 to form a second seal between seal faces 30450*c*, 30450*d*, 31450*c*, 31450*d*.

As the rotating subassembly 30400, 31400 rotates, the second cam roller 30205*b*, 31205*b* travels along the second cam track 30215*b*, 31215*b* and collapses the third body 30405*c*, 31405*c* of the rotating subassembly 30400, 31400 into the body 3005, 3105 to prevent unnecessary wear to the seal faces 30450*c*, 30450*d*, 31450*c*, 31450*d*.

Body with Push-Rod Camming Mechanism

Figure 32A:
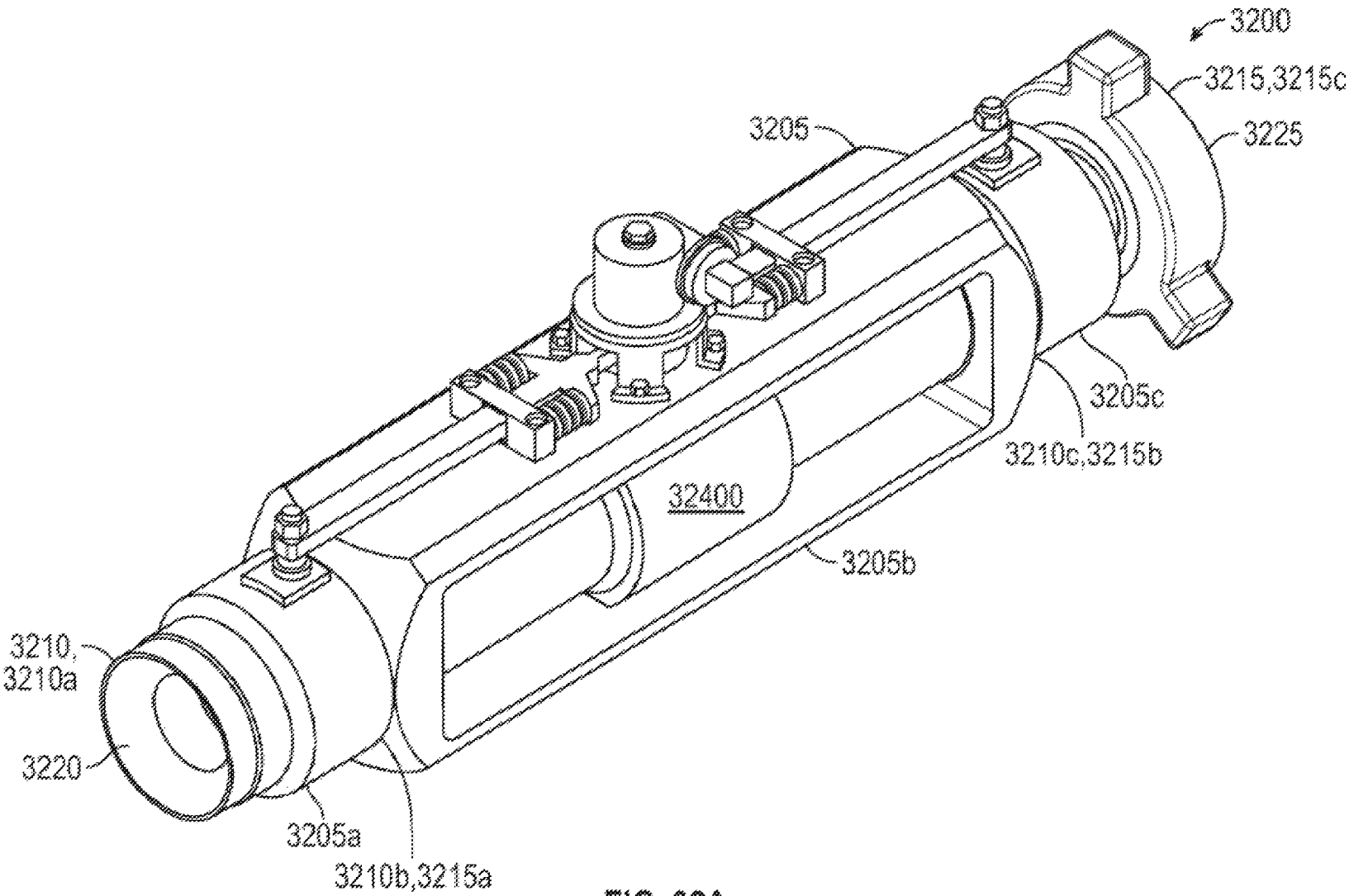
FIG. 32A illustrates an upper, left perspective view of an exemplary drilling mud screen system with a camming seal separator having a push-rod cam mechanism according to an embodiment of the present invention, showing a rotating subassembly in a closed position.
Figure 32B:
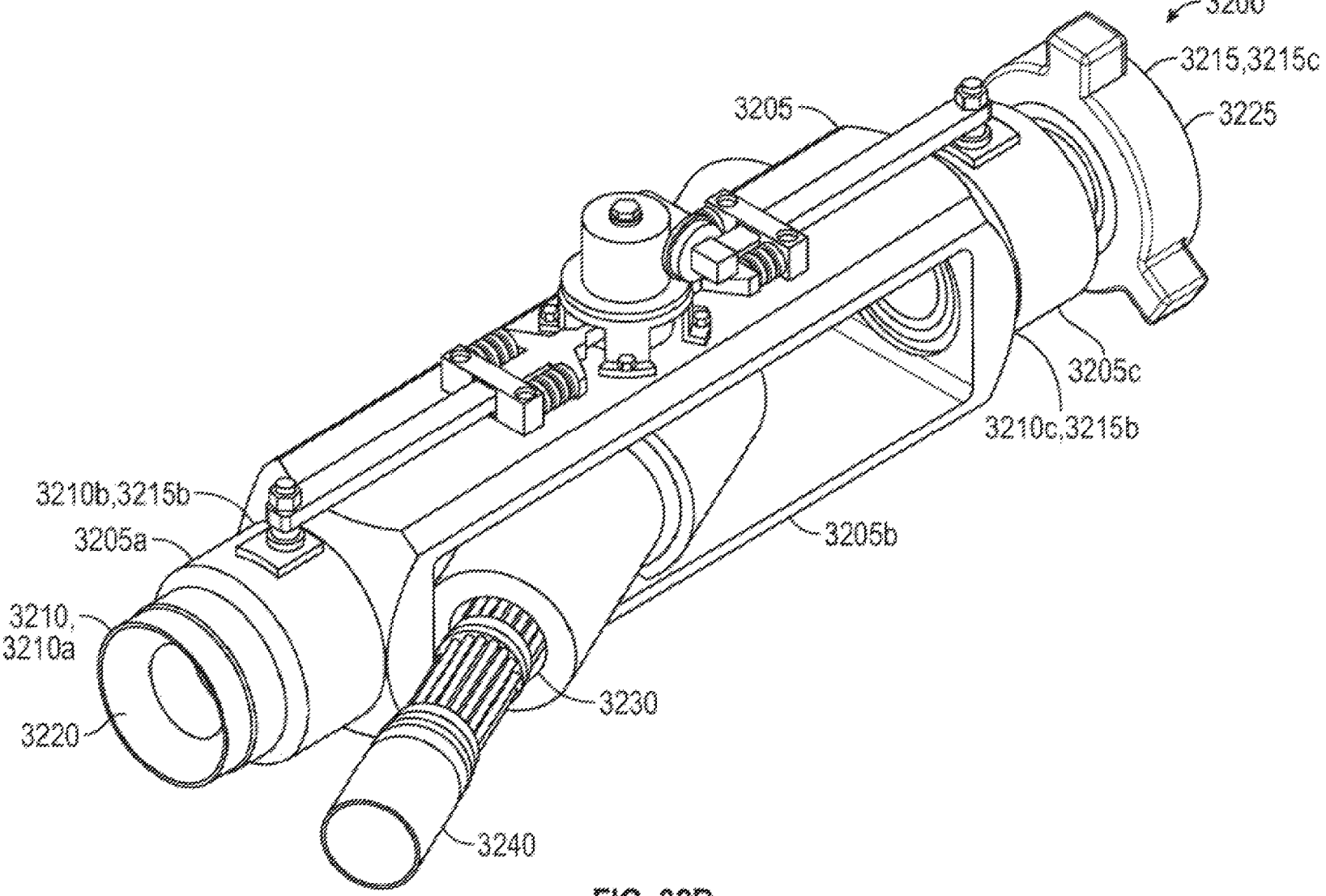
FIG. 32B illustrates the upper, left perspective view of the drilling mud screen system of FIG. 32A, showing the rotating subassembly in an open position.
Figure 32C:
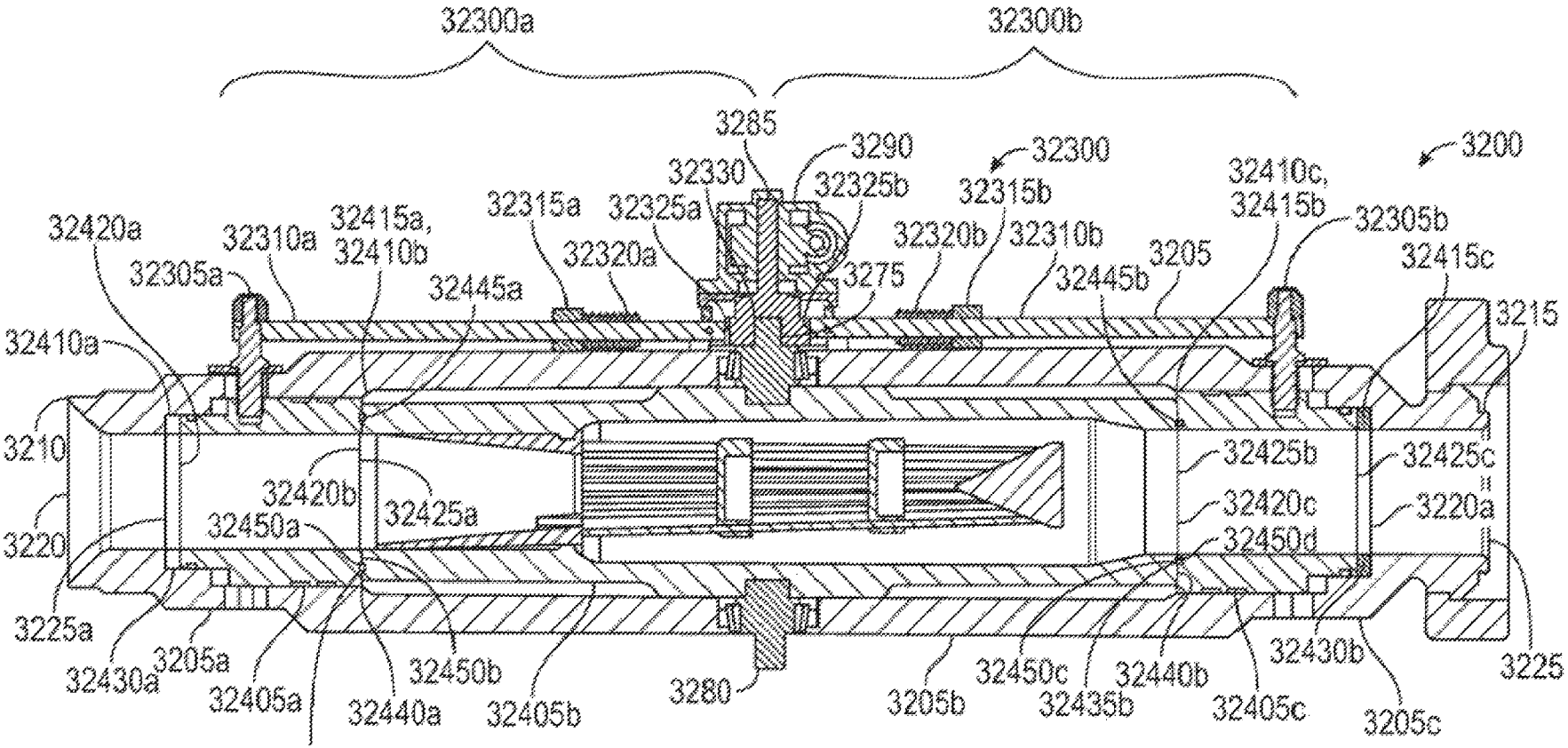
FIG. 32C illustrates a cross-sectional view of the drilling mud screen system of FIG. 32A, showing the rotating subassembly in a closed position.

FIG. 32A illustrates an upper, left perspective view of an exemplary drilling mud screen system 3200 with a camming seal separator 32300 having a push-rod camming mechanism 32300*a* according to an embodiment of the present invention, showing a rotating subassembly 32400 in a closed position; FIG. 32B illustrates the upper, left perspective view of the drilling mud screen system 3200 of FIG. 32A, showing the rotating subassembly 32400 in an open position; and FIG. 32C illustrates a cross-sectional view of the drilling mud screen system 3200 of FIG. 32A, showing the rotating subassembly 32400 in a closed position.

Figure 33A:
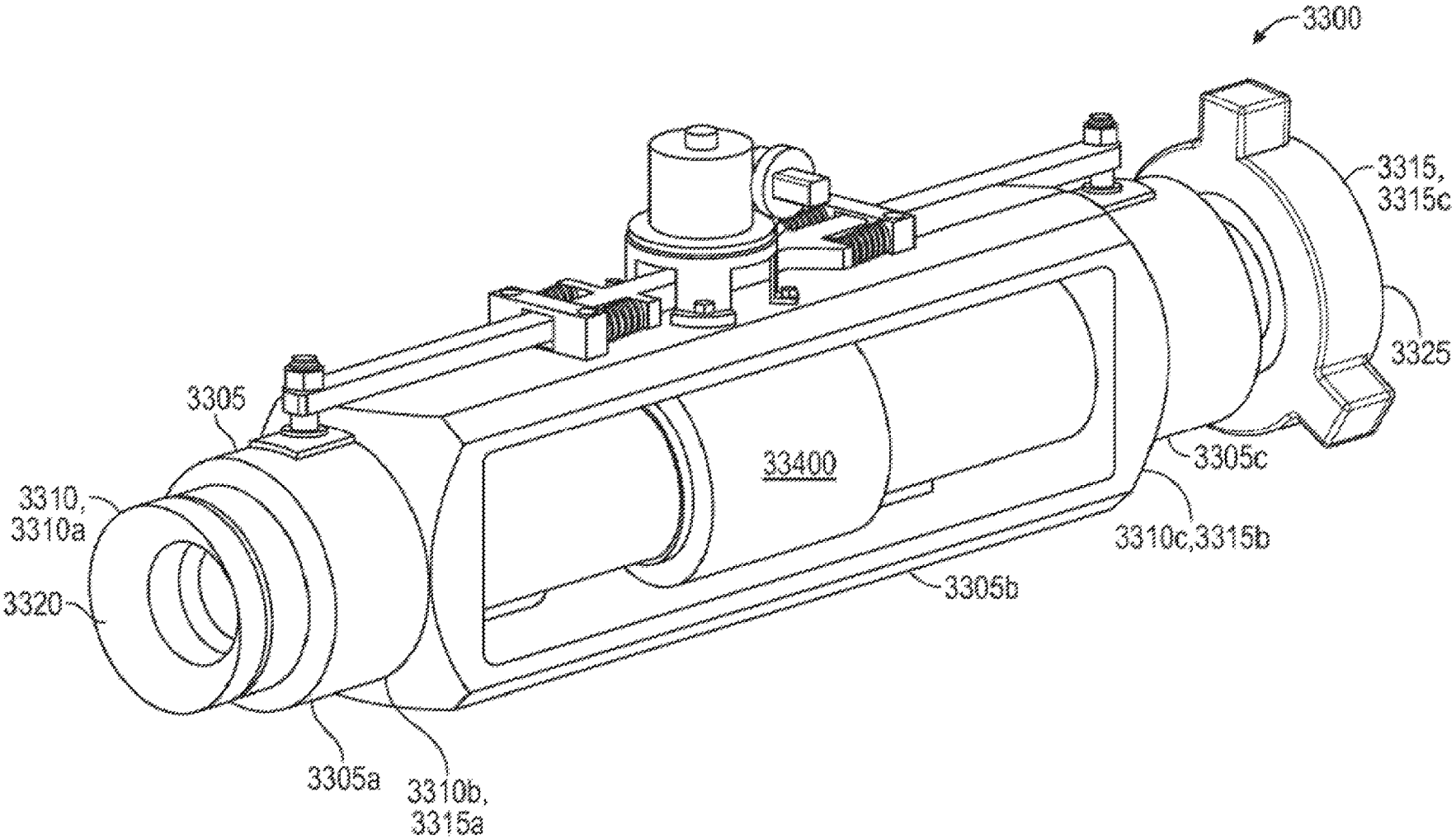
FIG. 33A illustrates a left perspective view of an exemplary drilling mud screen system with a camming seal separator having a push-rod cam mechanism according to an embodiment of the present invention, showing a rotating subassembly in a closed position.
Figure 33B:
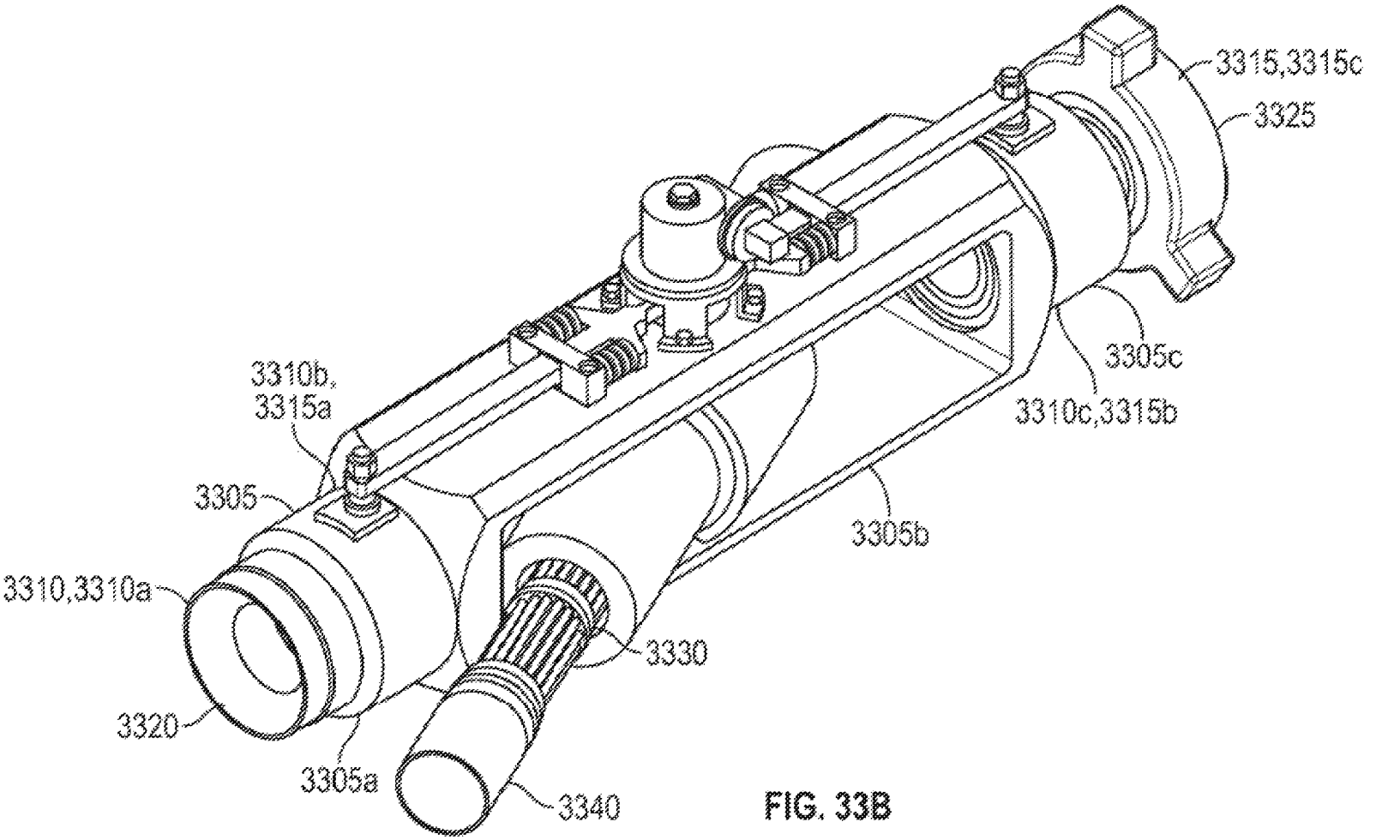
FIG. 33B illustrates a left perspective view of the drilling mud screen system of FIG. 33A, showing the rotating subassembly in an open position.
Figure 33C:
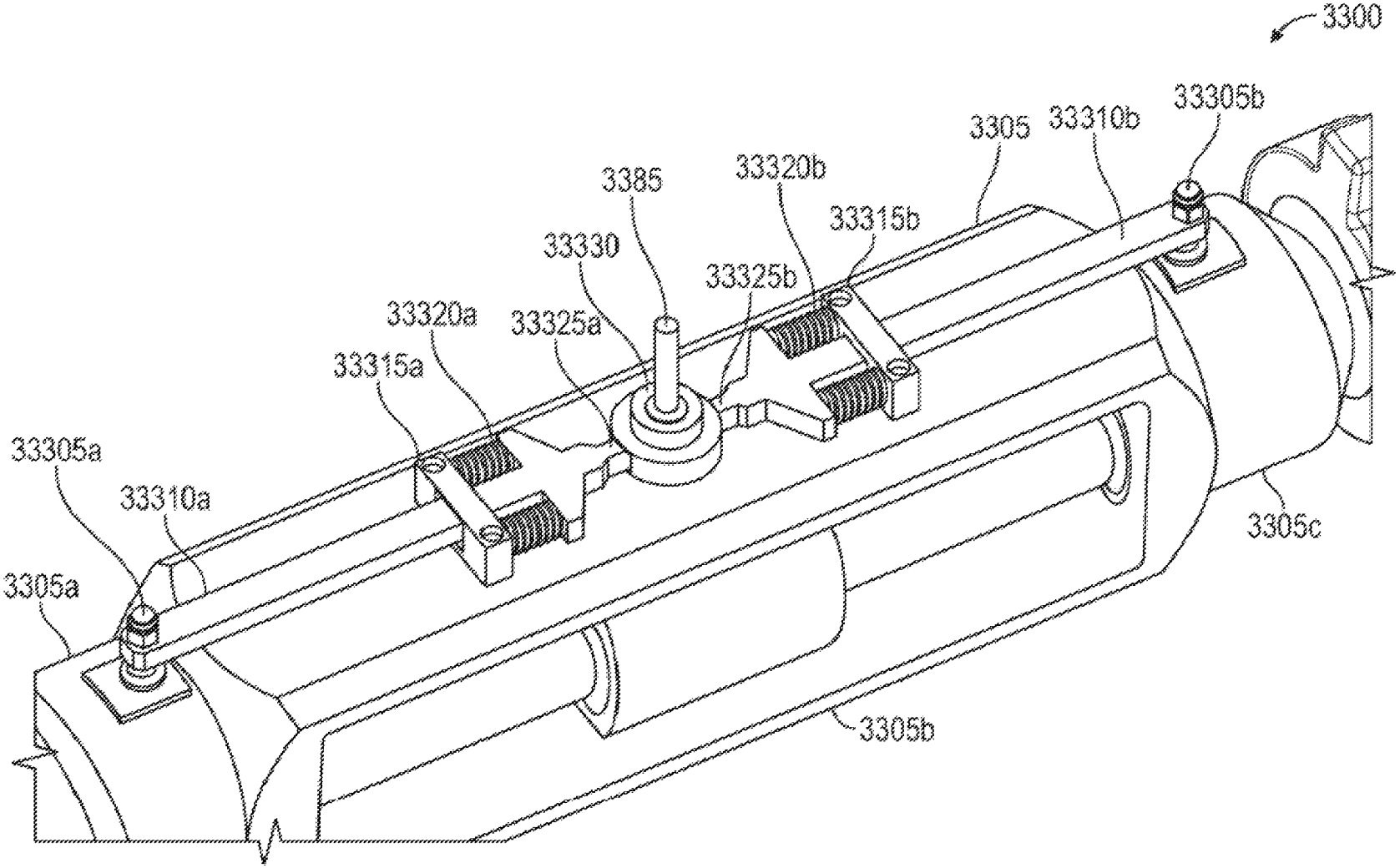
FIG. 33C illustrates a detail view of the push-rod cam mechanism of FIG. 33A, showing the rotating subassembly in a closed position.
Figure 33D:
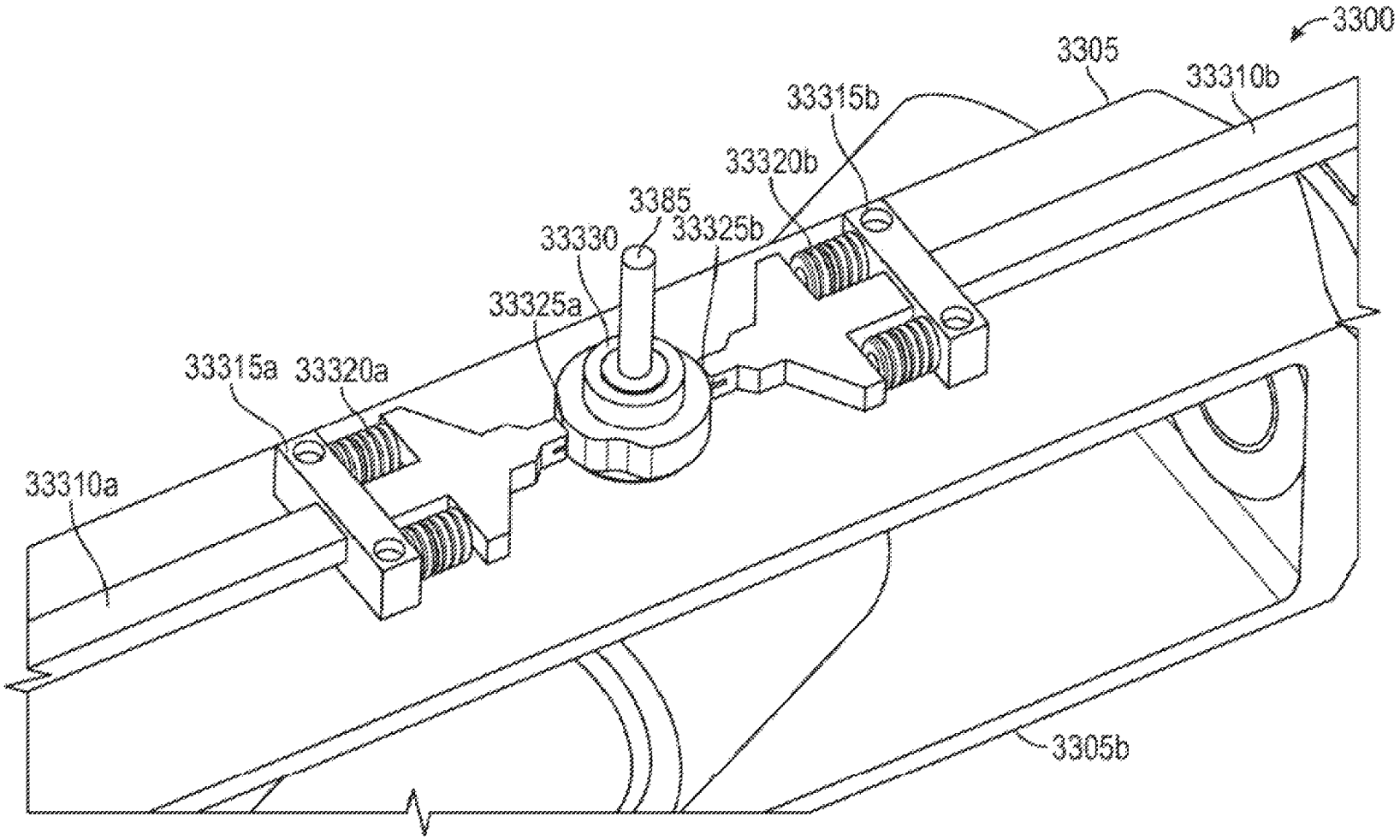
FIG. 33D illustrates a detail view of the push-rod cam mechanism of FIGS. 33A and 33C, showing the rotating subassembly in the open position.
Figure 33E:
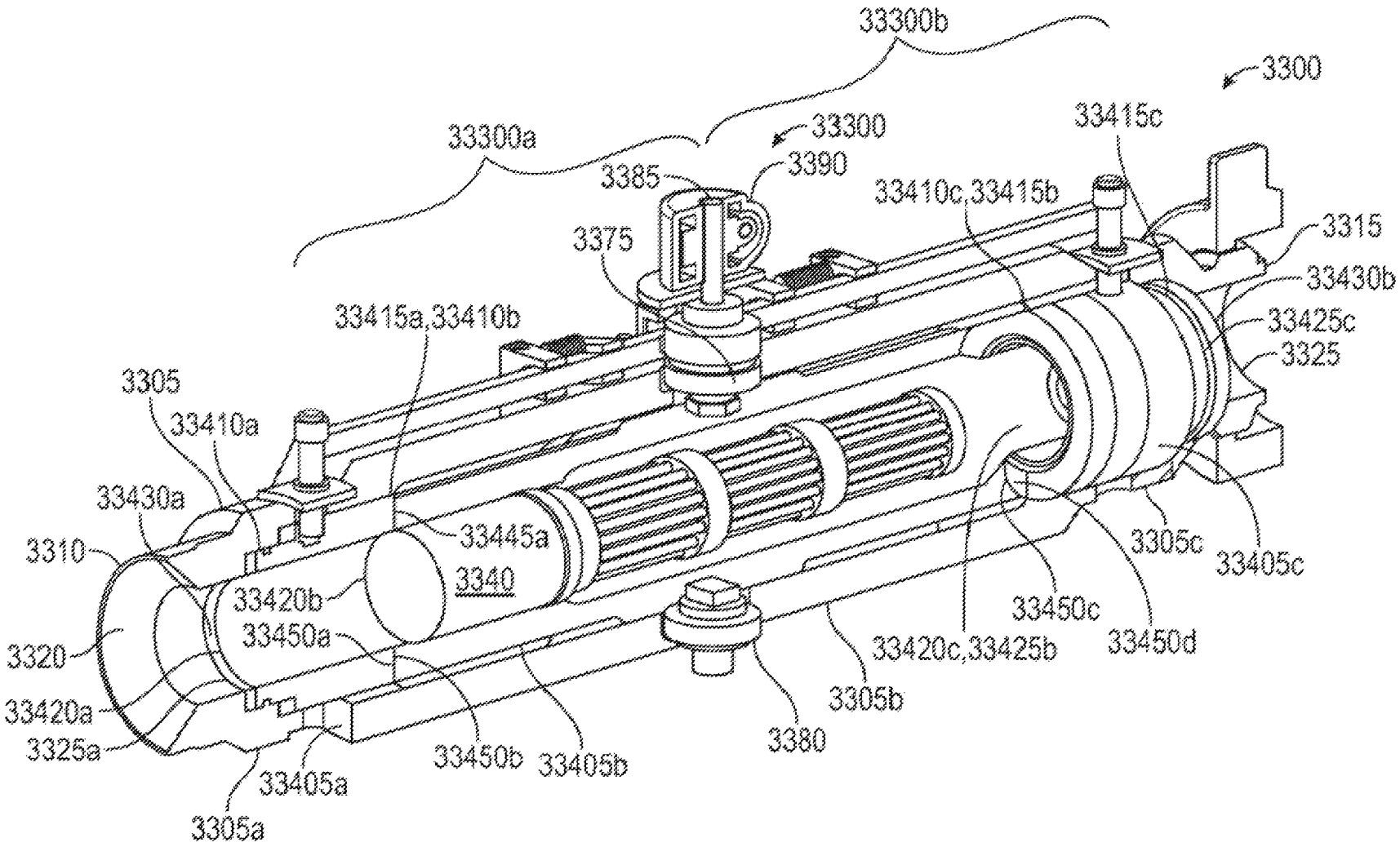
FIG. 33E illustrates a partial cross-sectional view of the drilling mud screen system of FIG. 33A, showing the rotating subassembly in the closed position.

FIG. 33A illustrates a left perspective view of an exemplary drilling mud screen system 3300 with camming seal separator 33300 having a push-rod camming mechanism 33300*a* according to an embodiment of the present invention, showing a rotating subassembly 33400 in a closed position; FIG. 33B illustrates a left perspective view of the drilling mud screen system 3300 of FIG. 33A, showing the rotating subassembly 33400 in an open position; FIG. 33C illustrates a detail view of the push-rod camming mechanism 33300*a* of FIG. 33A, showing the rotating subassembly 33400 in a closed position; FIG. 33D illustrates a detail view of the push-rod camming mechanism 33300*a* of FIGS. 33A and 33C, showing the rotating subassembly 33400 in the open position; and FIG. 33E illustrates a partial cross-sectional view of the drilling mud screen system 3300 of FIG. 33A, showing the rotating subassembly 33400 in the closed position.

As shown in FIGS. 32A-32D and 33A-33E, the drilling mud screen system 3200, 3300 has a body 3205, 3305 having a first end 3210, 3310 and a second end 3215, 3315, an inlet 3220, 3320 and an outlet 3225, 3325, and drilling mud screen access port 3230, 3330.

In an embodiment, the drilling mud screen system 3200, 3300 has a drilling mud screen 3240, 3340 fluidly connected to and disposed between the drilling mud inlet 3220, 3320 and the drilling outlet 3225, 3325.

In an embodiment, the body 3205, 3305 has a first portion 3205*a*, 3305*a*, a second portion 3205*b*, 3305*b* and a third portion 3205*c*, 3305*c*. In an embodiment, the first portion 3205*a*, 3305*a* of the body 3205, 3305 is an inlet portion. In an embodiment, the second portion 3205*b*, 3305*b* of the body 3205, 3305 is a rotating subassembly/drilling mud screen portion. In an embodiment, the third portion 3205*c*, 3305*c* of the body 3205, 3305 is an outlet portion.

In an embodiment, the first portion 3205*a*, 3305*a* and the third portion 3205*c*, 3305*c* may be any suitable shape. For example, suitable shapes include, but are not limited to, a cone, a cylinder, a rectangular prism (e.g., cubic, cuboid), a pentagonal prism, a sphere, a spheroid, a triangular prism, and combinations and/or portions thereof. In an embodiment, the first portion 3205*a*, 3305*a* and the third portion 3205*c*, 3305*c* may be a cylinder or a combination of cylinders.

In an embodiment, the first portion 3205*a*, 3305*a*, and the third portion 3205*c*, 3305*c* may have any suitable inner diameter or dimension. For example, a suitable inner diameter for the first portion 3205*a*, 3305*a* and the third portion 3205*c*, 3305*c* may be from about 2-inches to about 5-inches, and any range or value there between. In an embodiment, the inner diameter of the first portion 3205*a*, 3305*a* and the third portion 3205*c*, 3305*c* may be about 4.06-inches.

In an embodiment, the second portion 3205*b*, 3305*b* may be any suitable shape. For example, suitable shapes include, but are not limited to, a cone, a cylinder, a rectangular prism (e.g., cubic, cuboid), a pentagonal prism, a sphere, a spheroid, a triangular prism, and combinations and/or portions thereof. In an embodiment, the second portion 3205*b*, 3305*b* may be a rectangular prism with open opposing sides. See e.g., FIGS. 30A-30C & 31A-31C (open front and rear sides).

In an embodiment, the second portion 3205*b*, 3305*b* may have any suitable inner diameter or dimension. For example, a suitable inner diameter for the second portion 3205*b*, 3305*b* may be from about 6-inches to about 14-inches, and any range or value there between. In an embodiment, the inner diameter for the second portion 3205*b*, 3305*b* may be about 10-inches.

For example, a suitable inner dimension for the second portion 3205*b*, 3305*b* may be from about 6-inches to about 14-inches square, and any range or value there between. In an embodiment, the inner dimension for the second portion 3205*b*, 3305*b* may be about 10-inches square.

In an embodiment, a drilling mud inlet 3220, 3320 of the drilling mud screen system 3200, 3300 may be fluidly connected to a high-pressure outlet of a drilling mud pump via a connection. In an embodiment, a drilling mud outlet 3225, 3325 of the drilling mud screen system 3200, 3300 may be fluidly connected to an inlet of a vibrator hose to a standpipe via a connection.

Alternatively, the drilling mud screen system 3200, 3300 may be installed between an outlet of the vibrator hose and an inlet of the standpipe, or at any point in the standpipe via a connection.

In an embodiment, the drilling mud inlet 3220, 3320 may be fluidly connected to, for example, an outlet to a drilling mud pump via a connection; and the drilling mud outlet 3225, 3325 may be fluidly connected to, for example, an inlet to a vibrator hose via a connection. Any suitable connection may be used for the drilling mud inlet and the drilling mud outlet. For example, suitable connections include, but are not limited to, pipe fittings and welds. Connections are well known in the art. In an embodiment, the drilling mud inlet 3220, 3320 may be fluidly connected to, for example, an outlet to a drilling mud pump via a weld; and the drilling mud outlet 3225, 3325 may be fluidly connected to, for example, an inlet to a vibrator hose via a weld.

In an embodiment, the body 3205, 3305 of the drilling mud screen system 3200, 3300 may be constructed of any suitable material. For example, suitable materials include, but are not limited to, any alloy suitable for a drilling mud application. In an embodiment, the body 3205, 3305 may be constructed of a low alloy steel (e.g., 4140, 4145, 4330), a stainless steel (e.g., 17-4, 304, 316), a super alloy (e.g., Inconel), a titanium alloy (e.g., Ti-6Al-4V, Ti-6Al-6V-2Sn), a copper alloy (e.g., Beryllium Copper), a Cobalt alloy (e.g., Stellite), an Aluminum alloy (e.g., 2024, 6061, 7075), and combinations thereof. In an embodiment, the body 3205, 3305 may be constructed of an American Iron and Steel Industry (AISI) 4130/75*k* yield or equivalent material. In an embodiment, the inner surface of the body 3205, 3305 may be unpainted. In an embodiment, the outer surface of the body 3205, 3305 may be painted.

Pivot Subassembly

As shown in FIGS. 32A-32D and 33A-33E, the second portion 3205*b*, 3305*b* of the body 3205, 3305 and/or the rotating subassembly 32400, 33400 has a first shaft stud 3275, 3375, a second shaft stud 3280, 3380, a pivot shaft 3285, 3385, and a pivot drive 3290, 3390.

In an embodiment, the rotating subassembly 32400, 33400 may be retained in the second portion 3205*b*, 3305*b* of the body 3205, 3305 via the first shaft stud 3275, 3375 and the second shaft stud 3280, 3380. See e.g., FIGS. 32D & 33E. In an embodiment, the rotating subassembly 32400, 33400 may be retained in the second portion 3205*b*, 3305*b* of the body 3205, 3305 via the first shaft stud 3275, 3375 and the second shaft stud 3280, 3380 such that the rotating subassembly 32400, 33400 may rotate with respect to the second portion 3205*b*, 3305*b* of the body 3205, 3305.

In an embodiment, the first shaft stud 3275, 3375 or the second shaft stud 3280, 3380 may be attached to the pivot drive 3290, 3390 via the pivot shaft 3285, 3385.

In an embodiment, the pivot drive 3290, 3390 may be any suitable means of leverage to rotate the rotating subassembly. For example suitable means of leverage include, but are not limited to a handle, a gear box, or other driving means. In an embodiment, the pivot drive 3290, 3390 has a handle. In an embodiment, the pivot drive 3290, 3390 has a gear box.

Rotating Subassembly

FIG. 32C illustrates a cross-sectional view of the drilling mud screen system 3200 of FIG. 32A, showing the rotating subassembly 32400 in a closed position.

FIG. 33E illustrates a partial cross-sectional view of the drilling mud screen system 3300 of FIG. 33A, showing the rotating subassembly 33400 in the closed position.

As shown in FIGS. 32C and 33E, the rotating subassembly 32400, 33400 has a first body 32405*a*, 33405*a* having a first end 32410*a*, 33410*a*, a second end 32415*a*, 33415*a*, a first drilling mud inlet 32420*a*, 33420*a* and a first drilling mud outlet 32425*a*, 33425*a*, a second body 32405*b*, 33405*b* having a first end 32410*b*, 33410*b*, a second end 32415*b*, 33415*b*, a second drilling mud inlet 32420*b*, 33420*b* and a second drilling mud outlet 32425*b*, 33425*b*, and a third body 32405*c*, 33405*c* having a first end 32410*c*, 33410*c*, a second end 32415*c*, 33415*c*, a third drilling mud inlet 32420*c*, 33420*c* and a third drilling mud outlet 32425*c*, 33425*c*.

In an embodiment, the rotating subassembly 32400, 33400 has a drilling mud screen 3240, 3340 fluidly connected to and disposed between the second drilling mud inlet 32420*b*, 33420*b* and the second drilling outlet 32425*b*, 33425*b*.

In an embodiment, the first body 32405*a*, 33405*a* is an inlet portion. In an embodiment, the second body 32405*b*, 33405*b* is a rotating subassembly/drilling mud screen portion. In an embodiment, the third body 32405*c*, 32405*c* is an outlet portion.

In an embodiment, the first body 32405*a*, 33405*a* and the third body 32405*c*, 33405*c* may be any suitable shape. For example, suitable shapes include, but are not limited to, a cone, a cylinder, a rectangular prism (e.g., cubic, cuboid), a pentagonal prism, a sphere, a spheroid, a triangular prism, and combinations and/or portions thereof. In an embodiment, the first body 32405*a*, 33405*a* and the third body 32405*c*, 33405*c* may be a cylinder or a combination of cylinders. See e.g., FIGS. 32C & 33E-33F.

In an embodiment, the first body 32405*a*, 33405*a* and the third body 32405*c*, 33405*c* may have any suitable inner diameter or dimension. For example, a suitable inner diameter for the first body 32405*a*, 33405*a* and the third body 32405*c*, 33405*c* may be from about 2-inches to about 5-inches, and any range or value there between. In an embodiment, the inner diameter of the first body 32405*a*, 33405*a* and the third body 32405*c*, 33405*c* may be about 4.06-inches.

In an embodiment, the second body 32405*b*, 33405*b* may be any suitable shape. For example, suitable shapes include, but are not limited to, a cone, a cylinder, a rectangular prism (e.g., cubic, cuboid), a pentagonal prism, a sphere, a spheroid, a triangular prism, and combinations and/or portions thereof. In an embodiment, the second body 32405*b*, 33405*b* may be a combination of cylinders. See e.g., FIGS. 32C & 33E-33F.

In an embodiment, the second body 32405*b*, 33405*b* may have any suitable inner diameter or dimension. For example, a suitable inner diameter for the second body 32405*b*, 33405*b* may be from about 4-inches to about 10-inches, and any range or value there between. In an embodiment, the inner diameter for the second body 32405*b*, 33405*b* may be about 6-inches.

In an embodiment, the rotating subassembly 32400, 33400 has a drilling mud screen 3240, 3340 fluidly connected to and disposed between the second drilling mud inlet 32420*b*, 33420*b* and the second drilling outlet 32425*b*, 33425*b*.

In an embodiment, an internal drilling mud outlet 3225*a*, 3325*a* of the body 3205, 3305 of the drilling mud screen system 3200, 3300 may be fluidly connected to the first drilling mud inlet 32420*a*, 33420*a* of the first body 32405*a*, 33405*a* of the rotating subassembly 32400, 33400.

In an embodiment, the first drilling mud outlet 32425*a*, 33425*a* of the first body 32405*a*, 33405*a* of the rotating subassembly 32400, 33400 may be fluidly connected to the second drilling mud inlet 32420*b*, 33420*b* of the second body 32405*b*, 33405*b* of the rotating subassembly 32400, 33400.

In an embodiment, the second drilling mud outlet 32425*b*, 33425*b* of the second body 32405*b*, 33405*b* of the rotating subassembly 32400, 33400 may be fluidly connected to the third drilling mud inlet 32420*c*, 33420*c* of the third body 32405*c*, 33405*c* of the rotating subassembly 32400, 33400.

In an embodiment, the third drilling mud outlet 32425*c*, 33425*c* of the third body 32405*c*, 33405*c* of the rotating subassembly 32400, 33400 may be fluidly connected to an internal drilling mud inlet 3220*a*, 3320*a* of the body 3205, 3305 of the drilling mud screen system 3200, 3300.

In an embodiment, a first guard ring 32430*a*, 33430*a* may be disposed between the body 3205, 3305 of the drilling mud screen system 3200, 3300 and the first end 32410*a*, 33410*a* of the first body 32405*a*, 33405*a* of the rotating subassembly 32400, 33400. See e.g., FIGS. 32D & 33E-33F. In an embodiment, a first guard ring 32430*a*, 33430*a* may be disposed in a first piston cavity 32435*a*, 33435*a* between the body 3205, 3305 of the drilling mud screen system 3200, 3300 and the first end 32410*a*, 33410*a* of the first body 32405*a*, 33405*a* of the rotating subassembly 32400, 33400 to prevent buildup and compaction of debris in the first piston cavity 32435*a*, 33435*a*.

In an embodiment, a second guard ring 32430*b*, 33430*b* may be disposed between the second end 32415*c*, 33415*c* of the third body 32405*c*, 33405*c* of the rotating subassembly 32400, 33400 and the body 3205, 3305 of the drilling mud screen system 3200, 3300. See e.g., FIGS. 32D & 33E-33F. In an embodiment, a second guard ring 32430*b*, 33430*b* may be disposed in a second piston cavity 32435*b*, 33435*b* between the second end 32415*c*, 33415*c* of the third body 32405*c*, 33405*c* of the rotating subassembly 32400, 33400 and the body 3205, 3305 of the drilling mud screen system 3200, 3300 to prevent buildup and compaction of debris in the second piston cavity 32435*b*, 33435*b*.

In an embodiment, the first guard ring 32430*a*, 33430*a* and the second guard ring 32430*b*, 33430*b* may be constructed of any suitable compressible material to prevent buildup and compaction of debris in first piston cavity 32435*a*, 33435*a* and the second piston cavity 32435*b*, 33435*b*, respectively.

In an embodiment, a first spring 32440*a*, 33440*a* may be disposed between the body 3205, 3305 of the drilling mud screen system 3200, 3300 and the first body 32405*a*, 33405*a* of the rotating subassembly 32400, 33400. See e.g., FIGS. 32D & 33E-33F. In an embodiment, a first spring 32440*a*, 33440*a* may be disposed in a first seal piston cavity 32445*a*, 33445*a* between the body 3205, 3305 of the drilling mud screen system 3200, 3300 and the first body 32405*a*, 33405*a* of the rotating subassembly 32400, 33400 to engage and seal a second end 32415*a*, 33415*a* of the first body 32405*a*, 33405*a* with a first end 32410*b*, 33410*b* of a second body 32405*b*, 33405*b* of the rotating subassembly 32400, 33400.

In an embodiment, a second spring 32440*b*, 33440*b* may be disposed between the third body 32405*c*, 33405*c* of the rotating subassembly 32400, 33400 and the body 3205, 3305 of the drilling mud screen system 3200, 3300. See e.g., FIGS. 32D & 33E. In an embodiment, a second spring 32440*b*, 33440*b* may be disposed in a second seal piston cavity 32445*b*, 33445*b* between the third body 32405*c*, 33405*c* of the rotating subassembly 32400, 33400 and the body 3205, 3305 of the drilling mud screen system 3200, 3300 to engage and seal a second end 32415*b*, 33415*b* of the second body 32405*b*, 33405*b* with a first end 32410*c*, 33410*c* of the third body 32405*c*, 33405*c* of the rotating subassembly 32400, 33400.

In an embodiment, the body 3205, 3305 of the drilling mud screen system 3200, 3300 and the first body 32405*a*, 33405*a* of the rotating subassembly 32400, 33400 may be sealed via an O-ring. See e.g., FIGS. 32D & 33E-33F. Any suitable O-ring may be used. For example, suitable O-rings include, but are not limited to, 300 Series O-rings. O-rings are well known in the art.

In an embodiment, the third body 32405*c*, 33405*c* of the rotating subassembly 32400, 33400 and the body 3205, 3305 of the drilling mud screen system 3200, 3300 may be sealed with via an O-ring. See e.g., FIG. 32D. Any suitable O-ring may be used. For example, suitable O-rings include, but are not limited to, 300 Series O-rings. O-rings are well known in the art.

In an embodiment, the second end 32415*a*, 33415*a* of the first body 32405*a*, 33405*a* of the rotating subassembly 32400, 33400 has a first seal face 32450*a*, 33450*a*. See e.g., FIGS. 32D & 33E-33F.

In an embodiment, the first end 32410*b*, 33410*b* of the second body 32405*b*, 33405*b* of the rotating subassembly 32400, 33400 has a second seal face 32450*b*, 33450*b*. See e.g., FIGS. 32D & 33E-33F.

In an embodiment, the first seal face 32450*a*, 33450*a* and the second seal face 32450*b*, 33450*b* may have any suitable shapes to form a seal. For example, suitable shapes may be mating concave and convex surfaces, mating concave and convex surfaces similar to a ball valve, and combinations and variations thereof. In an embodiment, the first seal face 32450*a*, 33450*a* may be concave; and the second seal face 32450*b*, 33450*b* may be convex.

In an embodiment, the second end 32415*b*, 33415*b* of the second body 32405*b*, 33405*b* of the rotating subassembly 3200, 3300 has a third seal face 32450*c*, 334050*c*. See e.g., FIGS. 32D & 33E.

In an embodiment, the first end 324010*c*, 334010*c* of the third body 32405*c*, 33405*c* of the rotating subassembly 32400, 33400 has a fourth seal face 32450*d*, 33450*d*. See e.g., FIGS. 32D & 33E.

In an embodiment, the third seal face 32450*c*, 33450*c* and the fourth seal face 32450*d*, 33450*d* may have any suitable shapes to form a seal. For example, suitable shapes may be mating concave and convex surfaces, mating concave and convex surfaces similar to a ball valve, and combinations and variations thereof. In an embodiment, the third seal face 32450*c*, 33450*c* may be convex; and the fourth seal face 32450*d*, 33450*d* may be concave.

In an embodiment, the first body 32405*a*, 32405*a*, the second body 32405*b*, 33405*b* and the third body 32405*c*, 33405*c* of the rotating subassembly 32400, 33400 may be constructed of any suitable material. For example, suitable materials include, but are not limited to, any alloy suitable for a drilling mud application. In an embodiment, the first body 32405*a*, 33405*a*, the second body 32405*b*, 33405*b* and the third body 32405*c*, 33405*c* may be constructed of a low alloy steel (e.g., 4140, 4145, 4330), a stainless steel (e.g., 17-4, 304, 316), a super alloy (e.g., Inconel), a titanium alloy (e.g., Ti-6Al-4V, Ti-6Al-6V-2Sn), a copper alloy (e.g., Beryllium Copper), a Cobalt alloy (e.g., Stellite), an Aluminum alloy (e.g., 2024, 6061, 7075) and combination thereof. In an embodiment, the first body 32405*a*, 33405*a*, the second body 32405*b*, 33405*b* and the third body 32405*c*, 33405*c* may be constructed of an American Iron and Steel Industry (AISI) 4130/75*k* yield or equivalent material. In an embodiment, the inner surface of the first body 32405*a*, 33405*a*, the inner surface of the second body 32405*b*, 33405*b* and the inner surface of the third body 32405*c*, 33405*c* may be unpainted. In an embodiment, the outer surface of the first body 32405*a*, 33405*a*, the outer surface of the second body 32405*b*, 33405*b* and the outer surface of the third body 32405*c*, 33405*c* may be painted.

Camming Seal Separator

In an embodiment, a camming seal separator 32300, 33300 may be used to prevent unnecessary wear to the seal faces 32450*a*, 32450*b*, 32450*c*, 32450*d*, 33450*a*, 33450*b*, 33450*c*, 33450*d*, as discussed below.

In an embodiment, the camming seal separator 32300, 33300 may be any suitable seal separator. For example, a suitable camming seal separator includes, but is not limited to, a face-rolling camming mechanism, a push-rod camming mechanism, and combinations and variations thereof. In an embodiment, the camming seal separator 32300, 33300 has a push-rod camming mechanism. See e.g., FIGS. 32A & 33C-33F.

Push-Rod Camming Mechanism

FIG. 32A illustrates an upper, left perspective view of an exemplary drilling mud screen system 3200 with a camming seal separator 32300 having a push-rod camming mechanism 32300*a* according to an embodiment of the present invention, showing a rotating subassembly 32400 in a closed position; and FIG. 32B illustrates the upper, left perspective view of the drilling mud screen system 3200 of FIG. 32A, showing the rotating subassembly 32400 in an open position.

Figure 33F:
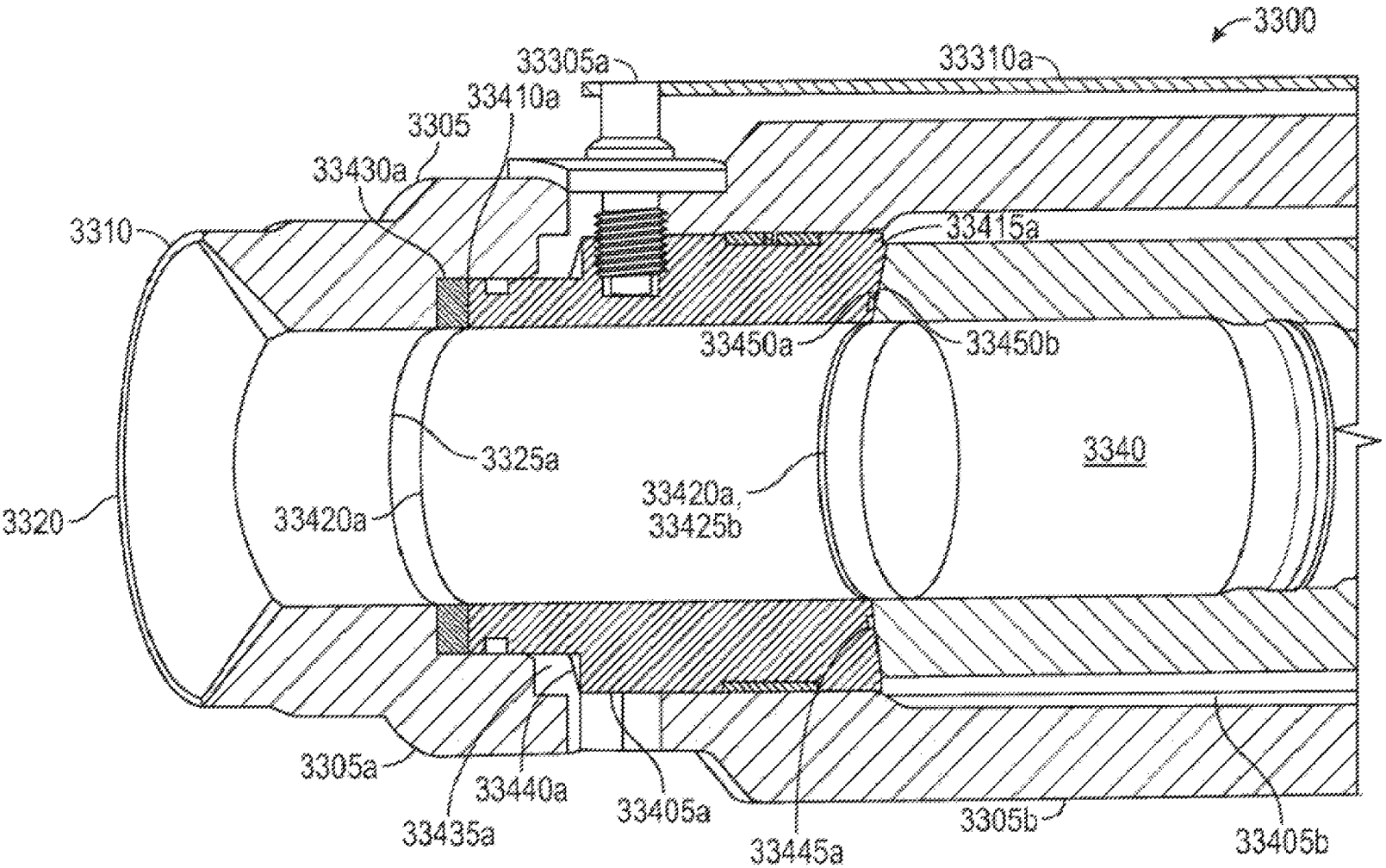
FIG. 33F illustrates a detail view of the push-rod cam mechanism of FIG. 33A, showing the rotating subassembly in the closed position.

FIG. 33C illustrates a detail view of the push-rod camming mechanism 33300*a* of FIG. 33A, showing the rotating subassembly 33400 in a closed position; FIG. 33D illustrates a detail view of the push-rod camming mechanism 33300*a* of FIGS. 33A and 33C, showing the rotating subassembly 33400 in the open position; FIG. 33E illustrates a partial cross-sectional view of the drilling mud screen system 3300 of FIG. 33A, showing the rotating subassembly 33400 in the closed position; and FIG. 33F illustrates a detail view of the push-rod camming mechanism 33300*a* of FIG. 33A, showing the rotating subassembly 33400 in the closed position.

As shown in FIGS. 32A-32B and 33C-33F, the body 3205, 3305 has a first push-rod camming mechanism 32300*a*, 33300*a* and a second push-rod camming mechanism 32300*b*, 33300*b*.

In an embodiment, the first push-rod camming mechanism 32300*a*, 33300*a* has a first pivot pin 32305*a*, 33305*a*, a first push rod 32310*a*, 33310*a*, a first guide block 32315*a*, 33315*a*, a first spring 32320*a*, 33320*a*, a first cam roller 32325*a*, 33325*a* and a cam 32330, 33330.

In an embodiment, the second push-rod camming mechanism 32300*b*, 33300*b* has a second pivot pin 32305*b*, 33305*b*, a second push rod 32310*b*, 33310*b*, a second guide block 32315*b*, 33315*b*, a second spring 32320*b*, 33320*b*, a second cam roller 32325*b*, 33325*b* and a cam 32330, 33330.

In an embodiment, a first end of the first pivot pin 32305*a*, 33305*a* may be attached to the first body 32405*a*, 33405*a* of the rotating subassembly 32400, 33400 through the first portion 3205*a*, 3305*a* of the body 3205, 3305. In an embodiment, a first end of the first pivot pin 32305*a*, 33305*a* may be attached to the first body 32405*a*, 33405*a* of the rotating subassembly 32400, 33400 through the first portion 3205*a*, 3305*a* of the body 3205, 3305 via fasteners. Any suitable fasteners may be used for the first pivot pin 32305*a*, 33305*a* and the first body 32405*a*, 33405*a* of the rotating subassembly 32400, 33400. For example, suitable fasteners include, but are not limited to, bolts, screws, pins, rivets, welds, and combinations thereof. Fasteners are well known in the art.

In an embodiment, a second end of the first pivot pin 32305*a*, 33305*a* may be attached to a first end of the first push rod 32310*a*, 33310*a*. In an embodiment, a second end of the first pivot pin 32305*a*, 33305*a* may be attached to a first end of the first push rod 32310*a*, 33310*a* via fasteners. Any suitable fasteners may be used for the first pivot pin 32305*a*, 33305*a* and the first push rod 32310*a*, 33310*a*. For example, suitable fasteners include, but are not limited to, bolts, screws, pins, rivets, welds, and combinations thereof. Fasteners are well known in the art.

In an embodiment, a second end of the first push rod 32310*a*, 33310*a* may be attached to a first cam roller 32325*a*, 33325*a*. In an embodiment, a second end of the first push rod 32310*a*, 33310*a* may be attached to a first cam roller 32325*a*, 33325*a* via fasteners. Any suitable fasteners may be used for the first push rod 32310*a*, 33310*a* and the first cam roller 32325*a*, 33325*a*. For example, suitable fasteners include, but are not limited to, bolts, screws, pins, rivets, welds, and combinations thereof. Fasteners are well known in the art.

In an embodiment, the first cam roller 32325*a*, 33325*a* may travel along a surface of the cam 32330, 33330.

In an embodiment, the cam 32330, 33330 may be attached to the pivot drive 3290, 3390. In an embodiment, the cam 32330, 33330 may be attached to the pivot drive 3290, 3390 via fasteners. Any suitable fasteners may be used for the cam 32330, 33330 and the pivot drive 3290, 3390. For example, suitable fasteners include, but are not limited to, bolts, screws, pins, rivets, welds, and combinations thereof. Fasteners are well known in the art.

In an embodiment, the cam 32330, 33330 may be any suitable shape. For example, suitable shapes include, but are not limited to, an "∞" shape, an "8" shape, a "0" shape, an "O" shape, and combinations and/or portions thereof. In an embodiment, the cam 32330, 33330 may be a double lobed shape. See e.g., FIGS. 33C-33D.

In an embodiment, the first push rod 32310*a*, 33310*a* may be any suitable shape. For example, suitable shapes include, but are not limited to, a cross shape, a "T" shape, a "Y" shape, and combinations and/or portions thereof. In an embodiment, the second body 32310*b*, 33310*b* may be a cross shape. See e.g., FIGS. 32A-32B & 33A-33D.

In an embodiment, a first guide block 32315*a*, 33315*a* may be attached to the second portion 3205*b*, 3305*b* of the body 3205, 3305. In an embodiment, a first guide block 32315*a*, 33315*a* may be attached to the second portion 3205*b*, 3305*b* of the body 3205, 3305 via fasteners. Any suitable fasteners may be used for the first guide block 32315*a*, 33315*a* and the second portion 3205*b*, 3305*b* of the body 3205, 3305. For example, suitable fasteners include, but are not limited to, bolts, screws, pins, rivets, welds, and combinations thereof. Fasteners are well known in the art.

In an embodiment, the first push rod 32310*a*, 33310*a* may pass through the first guide block 32315*a*, 33315*a*.

In an embodiment, a first end of the first spring 32320*a*, 33320*a* may be attached to the first guide block 32315*a*, 33315*a*. In an embodiment, a first end of the first spring 32320*a*, 33320*a* may be attached to the first guide block 32315*a*, 33315*a* via fasteners. Any suitable fastener may be used for the first spring 32320*a*, 33320*a* and the first guide block 32315*a*, 33315*a*. For example, suitable fasteners include, but are not limited to, bolts, screws, pins, rivets, welds, and combinations thereof. Fasteners are well known in the art.

In an embodiment, a second end of the first spring 32320*a*, 33320*a* may be attached to the first push rod 32310*a*, 33310*a*. In an embodiment, a second end of the first spring 32320*a*, 33320*a* may be attached to the first push rod 32310*a*, 33310*a* via fasteners. Any suitable fastener may be used for the first spring 32320*a*, 33320*a* and the first push rod 32310*a*, 33310*a*. For example, suitable fasteners include, but are not limited to, bolts, screws, pins, rivets, welds, and combinations thereof. Fasteners are well known in the art.

In a closed position for the rotating subassembly 32400, 33400, the first cam roller 32325*a*, 33325*a* may be disposed in a most recessed portion of the cam 32330, 33330 allowing the second end 32415*a*, 32415*a* of the first body 32405*a*, 33405*a* of the rotating subassembly 32400, 33400 to close against the first end 32410*b*, 33410*b* of the second body 32405*b*, 32405*b* of the rotating subassembly 32400, 33400 to form a first seal between seal faces 32450*a*, 32450*b*, 33450*a*, 33450*b*.

As the pivot shaft 3285, 3385 and the cam 32330, 33330 (and rotating subassembly 32400, 33400) rotates, the first cam roller 32325*a*, 33325*a* travels along the cam 32330, 33330 and collapses the first body 32405*a*, 33405*a* of the rotating subassembly 32400, 33400 into the body 3205, 3305 to prevent unnecessary wear to the seal faces 32450*a*, 32450*b*, 33450*a*, 33450*b*.

In an embodiment, the cam 32330, 33330 may be sized and shaped such that the timing of allowing the second end 32415*a*, 32415*a* of the first body 32405*a*, 33405*a* of the rotating subassembly 32400, 33400 to close against the first end 32410*b*, 33410*b* of the second body 32405*b*, 32405*b* of the rotating subassembly 32400, 33400 to form the first seal will best protect the seal faces 32450*a*, 32450*b*, 33450*a*, 33450*b*.

In an embodiment, a first end of the second pivot pin 32305*b*, 33305*b* may be attached to third body 32405*c*, 33405*c* of the rotating subassembly 32400, 33400 through the third portion 3205*c*, 3305*c* of the body 3205, 3305. In an embodiment, a first end of the second pivot pin 32305*b*, 33305*b* may be attached to third body 32405*c*, 33405*c* of the rotating subassembly 32400, 33400 through the third portion 3205*c*, 3305*c* of the body 3205, 3305 via fasteners. Any suitable fasteners may be used for the second pivot pin 32305*b*, 33305*b* and the third body 32405*c*, 33405*c* of the rotating subassembly 32400, 33400. For example, suitable fasteners include, but are not limited to, bolts, screws, pins, rivets, welds, and combinations thereof. Fasteners are well known in the art.

In an embodiment, a second end of the second pivot pin 32305*b*, 33305*b* may be attached to a first end of the second push rod 32310*b*, 33310*b*. In an embodiment, a second end of the second pivot pin 32305*b*, 33305*b* may be attached to a first end of the second push rod 32310*b*, 33310*b* via fasteners. Any suitable fasteners may be used for the second pivot pin 32305*b*, 33305*b* and the second push rod 32310*b*, 33310*b*. For example, suitable fasteners include, but are not limited to, bolts, screws, pins, rivets, welds, and combinations thereof. Fasteners are well known in the art.

In an embodiment, a second end of the second push rod 32310*b*, 33310*b* may be attached to a second cam roller 32325*b*, 33325*b*. In an embodiment, a second end of the second push rod 32310*b*, 33310*b* may be attached to a second cam roller 32325*b*, 33325*b* via fasteners. Any suitable fasteners may be used for the second push rod 32310*b*, 33310*b* and the second cam roller 32325*b*, 33325*b*. For example, suitable fasteners include, but are not limited to, bolts, screws, pins, rivets, welds, and combinations thereof. Fasteners are well known in the art.

In an embodiment, the second cam roller 32325*b*, 33325*b* may travel along a surface of the cam 32330, 33330.

In an embodiment, the cam 32330, 33330 may be attached to the pivot drive 3290, 3390. In an embodiment, the cam 32330, 33330 may be attached to the pivot drive 3290, 3390 via fasteners. Any suitable fasteners may be used for the cam 32330, 33330 and the pivot drive 3290, 3390. For example, suitable fasteners include, but are not limited to, bolts, screws, pins, rivets, welds, and combinations thereof. Fasteners are well known in the art.

In an embodiment, the cam 32330, 33330 may be any suitable shape. For example, suitable shapes include, but are not limited to, an "∞" shape, an "8" shape, a "0" shape, an "O" shape, and combinations and/or portions thereof. In an embodiment, the cam 32330, 33330 may be a double lobed shape. See e.g., FIGS. 33C-33D.

In an embodiment, the second push rod 32310*b*, 33310*b* may be any suitable shape. For example, suitable shapes include, but are not limited to, a cross shape, a "T" shape, a "Y" shape, and combinations and/or portions thereof. In an embodiment, the second push rod 32310*b*, 33310*b* may be a cross shape. See e.g., FIGS. 32A-32B & 33A-33D.

In an embodiment, a second guide block 32315*b*, 33315*b* may be attached to the second portion 3205*b*, 3305*b* of the body 3205, 3305. In an embodiment, a second guide block 32315*b*, 33315*b* may be attached to the second portion 3205*b*, 3305*b* of the body 3205, 3305 via fasteners. Any suitable fasteners may be used for the second guide block 32315*b*, 33315*b* and the second portion 3205*b*, 3305*b* of the body 3205, 3305. For example, suitable fasteners include, but are not limited to, bolts, screws, pins, rivets, welds, and combinations thereof. Fasteners are well known in the art.

In an embodiment, the second push rod 32310*b*, 33310*b* may pass through the second guide block 32315*b*, 33315*b*.

In an embodiment, a second end of the second spring 32320*b*, 33320*b* may be attached to the second guide block 32315*b*, 33315*b*. In an embodiment, a second end of the second spring 32320*b*, 33320*b* may be attached to the second guide block 32315*b*, 33315*b* via fasteners. Any suitable fastener may be used for the second spring 32320*b*, 33320*b* and the second guide block 32315*b*, 33315*b*. For example, suitable fasteners include, but are not limited to, bolts, screws, pins, rivets, welds, and combinations thereof. Fasteners are well known in the art.

In an embodiment, a first end of the second spring 32320*b*, 33320*b* may be attached to the second push rod 32310*b*, 33310*b*. In an embodiment, a first end of the second spring 32320*b*, 33320*b* may be attached to the second push rod 32310*b*, 33310*b* via fasteners. Any suitable fastener may be used for the second spring 32320*b*, 33320*b* and the second push rod 32310*b*, 33310*b*. For example, suitable fasteners include, but are not limited to, bolts, screws, pins, rivets, welds, and combinations thereof. Fasteners are well known in the art.

In a closed position for the rotating subassembly 32400, 33400, the second cam roller 32325*b*, 33325*b* may be disposed in a most recessed portion of the cam 32330, 33330 allowing the second end 32415*b*, 33415*b* of the second body 32405*b*, 33405*b* of the rotating subassembly 32400, 33400 to close against the first end 32410*c*, 33410*c* of the third body 32405*c*, 33405*c* of the rotating subassembly 32400, 33400 to form a second seal between seal faces 32450*c*, 32450*d*, 33450*c*, 33450*d*.

As the pivot shaft 3285, 3385 and the cam 32330, 33330 (and the rotating subassembly 32400, 33400) rotates, the second cam roller 32325*b*, 33325*b* travels along the cam 32330, 33330 and collapses the third body 32405*c*, 33405*c* of the rotating subassembly 32400, 33400 into the body 3205, 3305 to prevent unnecessary wear to the seal faces 32450*c*, 32450*d*, 33450*c*, 33450*d*.

In an embodiment, the cam 32330, 33330 may be sized and shaped such that the timing of allowing the second end 32415*b*, 33415*b* of the second body 32405*b*, 33405*b* of the rotating subassembly 32400, 33400 to close against the first end 32410*c*, 33410*c* of the third body 32405*c*, 33405*c* of the rotating subassembly 32400, 33400 to form the second seal will best protect the seal faces 32450*c*, 32450*d*, 33450*c*, 33450*d*.

Optional Transducer Subassemblies

FIG. 19 illustrates a cross-sectional view of the drilling mud screen system 1900 in a monitoring configuration according to an embodiment of the present invention, showing an optional transducer subassembly 19100, as discussed above.

FIG. 20A illustrates an upper, right side perspective view of an optional transducer subassembly 2000 according to an embodiment of the present invention; and FIG. 20B illustrates a side perspective view of the optional transducer subassembly 2000 of FIG. 20A, as discussed above.

FIG. 30B illustrates the upper, left perspective view of the drilling mud screen system 3000 of FIG. 30A, showing an optional first transducer subassembly 30100*a* and an optional second transducer subassembly 30100*b*; and FIG. 31B illustrates the left perspective view of the drilling mud screen system 3100 of FIG. 31A, showing an optional first transducer subassembly 31100*a* and an optional second transducer subassembly 31100*b*. See also FIGS. 20A & 20B.

As shown in FIGS. 30A and 31A, the drilling mud screen system 3000, 3100 has a body 3005, 3105 having a first end 3010, 3110 and a second end 3015, 3115, a drilling mud inlet 3020, 3120 and a drilling mud outlet 30, 25, 3125, an optional first transducer subassembly 30100*a*, 31100*a* and an optional second transducer subassembly 30100*b*, 31100*b*.

In an embodiment, the drilling mud screen system 3000, 3100 has a drilling mud screen 3040, 3140 fluidly connected to and disposed between the drilling mud inlet 3020, 3120 and the drilling outlet 3025, 3125.

In an embodiment, a drilling mud inlet 3020, 3120 of the drilling mud screen system 3000, 3100 (e.g., via the first transducer subassembly 30100*a*, 31100*a*) may be fluidly connected to a high-pressure outlet of a drilling mud pump via a connection. In an embodiment, a drilling mud outlet 3025, 3125 (e.g., via the second transducer subassembly 30100*b*, 31100*b*) of the drilling mud screen system 3000, 3100 may be fluidly connected to an inlet of a vibrator hose to a standpipe via a connection.

Alternatively, the drilling mud screen system 3000, 3100 (e.g., via the first transducer subassembly 30100*a*, 31100*a*) may be installed between an outlet of the vibrator hose and an inlet of the standpipe, or at any point in the standpipe via a connection.

In an embodiment, the drilling mud inlet 3020, 3120 (e.g., via the first transducer subassembly 30100*a*, 31100*a*) may be fluidly connected to, for example, an outlet of a drilling mud pump via a connection; and the drilling mud outlet 3025, 3125 (e.g., via the second transducer subassembly 30100*b*, 31100*b*) may be fluidly connected to, for example, an inlet of a vibrator hose via a connection. Any suitable connection may be used for the drilling mud inlet 3020, 3120 and the drilling mud outlet 3025, 3125. For example, suitable connections include, but are not limited to, pipe fittings and welds. Connections are well known in the art. In an embodiment, the drilling mud inlet 3020, 3120 (e.g., via the first transducer subassembly 30100*a*, 31100*a*) may be fluidly connected to, for example, an outlet of a drilling mud pump via a weld; and the drilling mud outlet 3025, 3125 (e.g., via the second transducer subassembly 30100*b*, 31100*b*) may be fluidly connected to, for example, an inlet of a vibrator hose via a weld.

In an embodiment, the first transducer access port 3032*a*, 3132*a* of the first transducer subassembly 30100*a*, 31100*a* and/or the second transducer access port 1032*b*, 3132*b* of the second transducer subassembly 30100*b*, 31100*b* may be closed with a transducer 28105 via a fitting. See e.g., FIG. 28. Any suitable type of transducer may be used. For example, suitable types of transducers include, but are not limited to, displacement transducers, flow rate transducers, pressure transducers, temperature transducers and any combination thereof. Any suitable fitting may be used. For example, suitable fittings include, but are not limited to, pipe fittings. Fittings are well known in the art. In an embodiment, the first transducer access port 3032*a*, 3132*a* of the first transducer subassembly 30100*a*, 31100*a* and/or the second transducer access port 3032*b*, 3132*b* of the second transducer subassembly 30100*b*, 31100*b* may be closed with a pressure transducer via a 2-inch 1502 WECO union.

In an embodiment, a computing device (such as a rig computer) may include a bus that directly or indirectly couples the following devices: memory, one or more processors, one or more presentation components, one or more input/output (I/O) ports, I/O components, a user interface and a power supply. The computing device may include a variety of computer-readable media. The memory may include computer-storage media in the form of volatile and/or nonvolatile memory. The presentation component(s) present data indications to a user or other device. The user interface allows the user to input/output information to/from the computing device. The one or more I/O ports may allow the computing device to be logically coupled to other devices including a transducer 28105, and other I/O components, some of which may be built in. See e.g., FIG. 28. Examples of other I/O components include a printer, scanner, wireless device, and the like.

In an embodiment, the first transducer access port 3032*a*, 3132*a* of the first transducer subassembly 30100*a*, 31100*a* and/or the second transducer access port 3032*b*, 3132*b* of the second transducer subassembly 30100*b*, 31100*b* may be sealed with an end cap via an O-ring. Any suitable O-ring may be used. For example, suitable O-rings include, but are not limited to, 300 Series O-rings. O-rings are well known in the art.

In an embodiment, the first transducer subassembly 30100*a*, 31100*b* and the second transducer subassembly 30100*b*, 31100*b* may be constructed of any suitable material. For example, suitable materials include, but are not limited to, any alloy steel suitable for a drilling mud application. in an embodiment, the first transducer subassembly 30100*a*, 31100*a* and/or the second transducer subassembly 30100*b*, 31100*b* may be constructed of a low alloy steel (e.g., 4140, 4145, 4330), a stainless steel (e.g., 17-4, 304, 316), a super alloy (e.g., Inconel), a titanium alloy (e.g., Ti-6Al-4V, Ti-6Al-6V-2Sn), a copper alloy (e.g., Beryllium Copper), a Cobalt alloy (e.g., Stellite), an Aluminum alloy (e.g., 2024, 6061, 7075), and combinations thereof. In an embodiment, the first transducer subassembly 30100*a*, 31100*a* and/or the second transducer subassembly 30100*b*, 31100*b* may be constructed of an American Iron and Steel Industry (AISI) 4130/75k yield or equivalent material. In an embodiment, the inner surface of the first transducer subassembly 30100*a*, 31100*a* and/or the inner surface of the second transducer subassembly 30100*b*, 31100*b* may be unpainted. In an embodiment, the outer surface of the first transducer subassembly 30100*a*, 31100*a* and/or the outer surface of the second transducer subassembly 30100*b*, 31100*b* may be painted.

Exemplary Drilling Mud Screens

FIG. 5A illustrates an upper, cross-sectional view of a drilling mud screen 500 according to an embodiment of the present invention, as discussed above. FIG. 5B illustrates a detailed view of A-A of FIG. 5A; FIG. 5C illustrates a detailed view of B of FIG. 5A; and FIG. 5D illustrates a detailed view of C of FIG. 5A. FIG. 5E illustrates an upper, right side perspective view of the drilling mud screen 500 of FIG. 5A.

Optional Drilling Mud Screen

FIG. 22A illustrates an end view of an optional drilling mud screen 2200 according to an embodiment of the present invention, as discussed above. FIG. 22B illustrates a detailed, cross-sectional view of A-A of FIG. 22A, showing an optional drilling mud screen insert 22105, and optional first end retaining ring 22110, an optional filter length 22115, and an optional retaining ring 22120; FIG. 22C illustrates a detailed view of B of FIG. 22B; and FIG. 22D illustrates a detailed, cross-sectional view of C-C of FIG. 22C. FIG. 22E illustrates an upper, right perspective view of the drilling mud screen 2200 of FIGS. 22A-22B.

Alternative Improved Exemplary Valve-Style Drilling Mud Screen System

Body with Trapdoor Mechanism

Figure 37A:
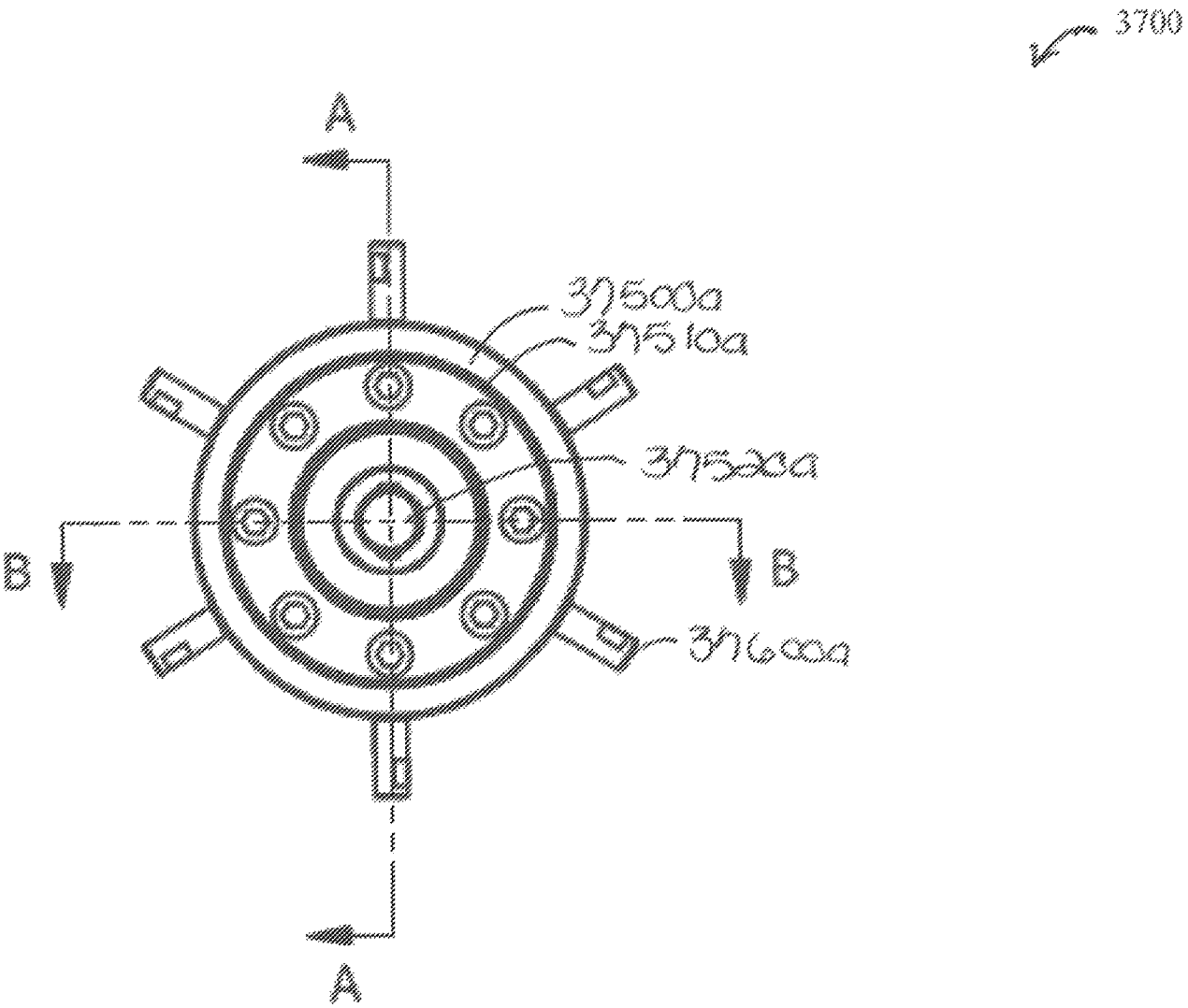
FIG. 37A illustrates an end view of an exemplary trapdoor-style drilling mud screen system according to an embodiment of the present invention.
Figure 37B:
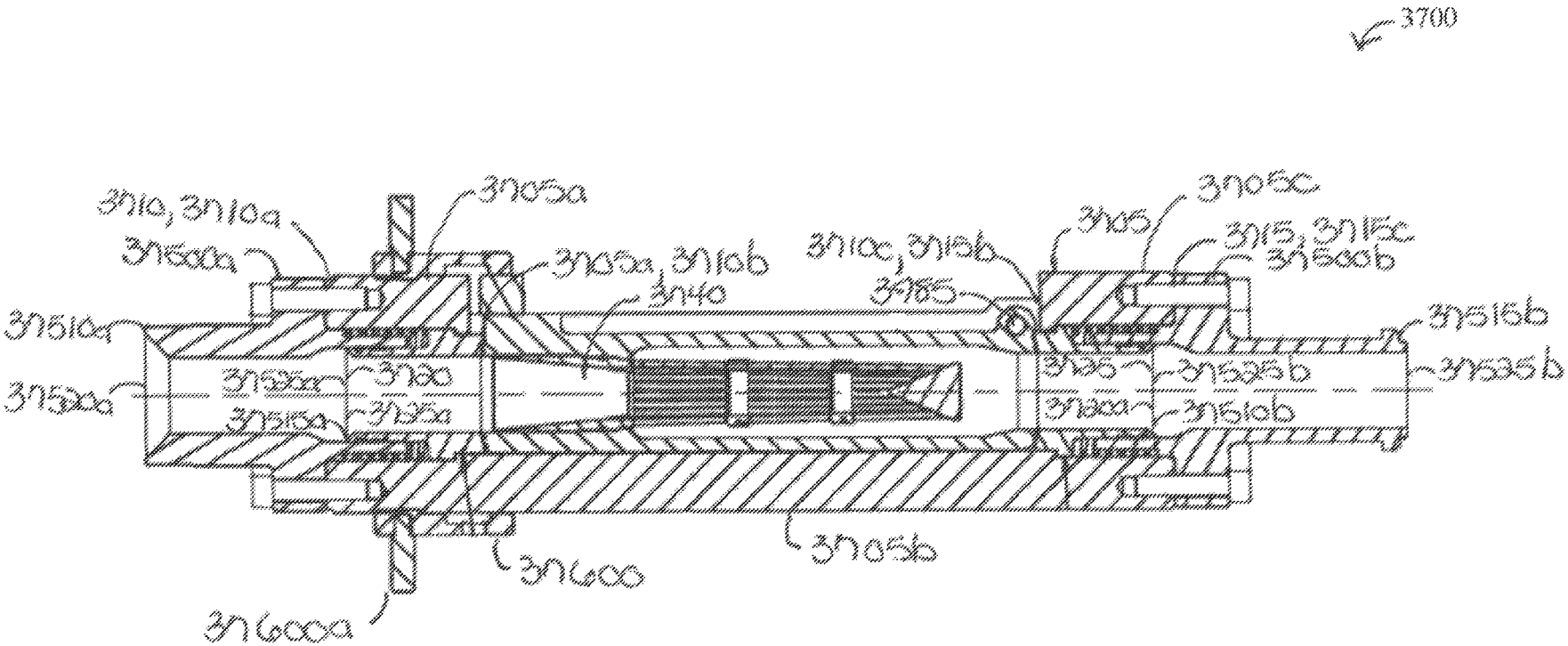
FIG. 37B illustrates a detailed, cross-sectional view A-A of FIG. 37A.
Figure 37C:
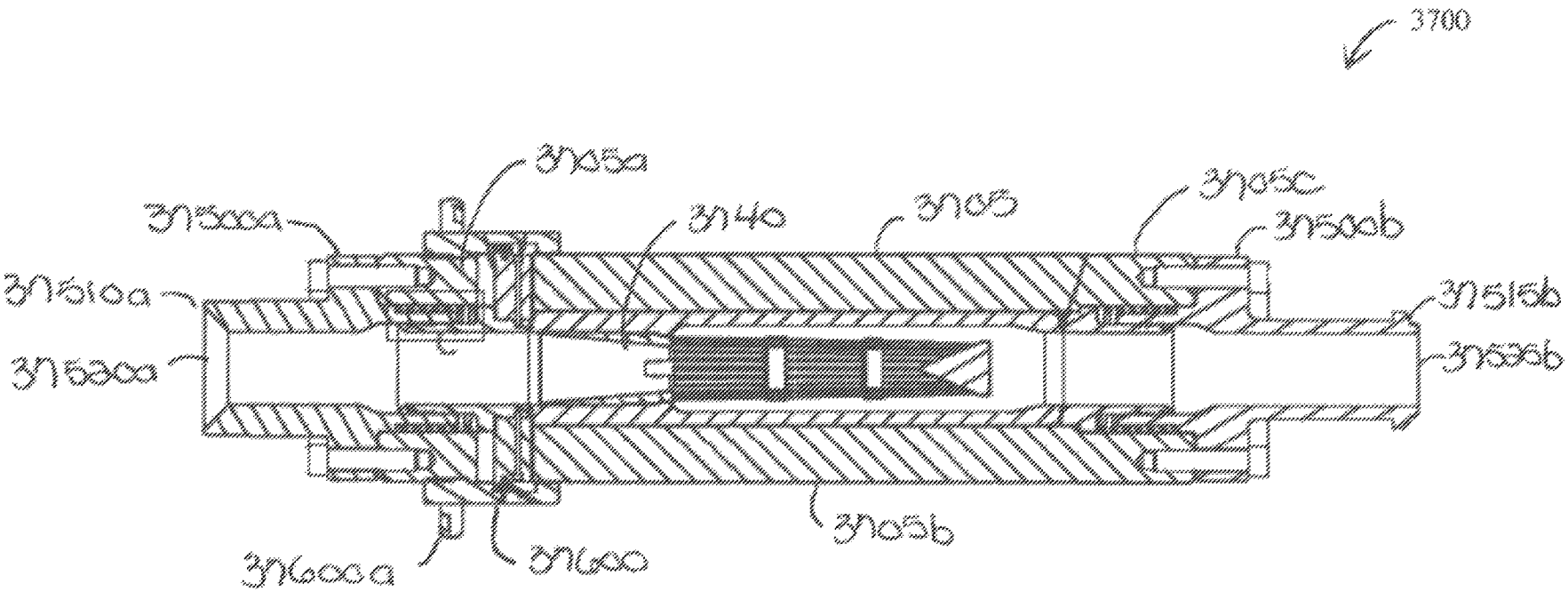
FIG. 37C illustrates a detailed, cross-sectional view B-B of FIG. 37A.
Figure 37E:
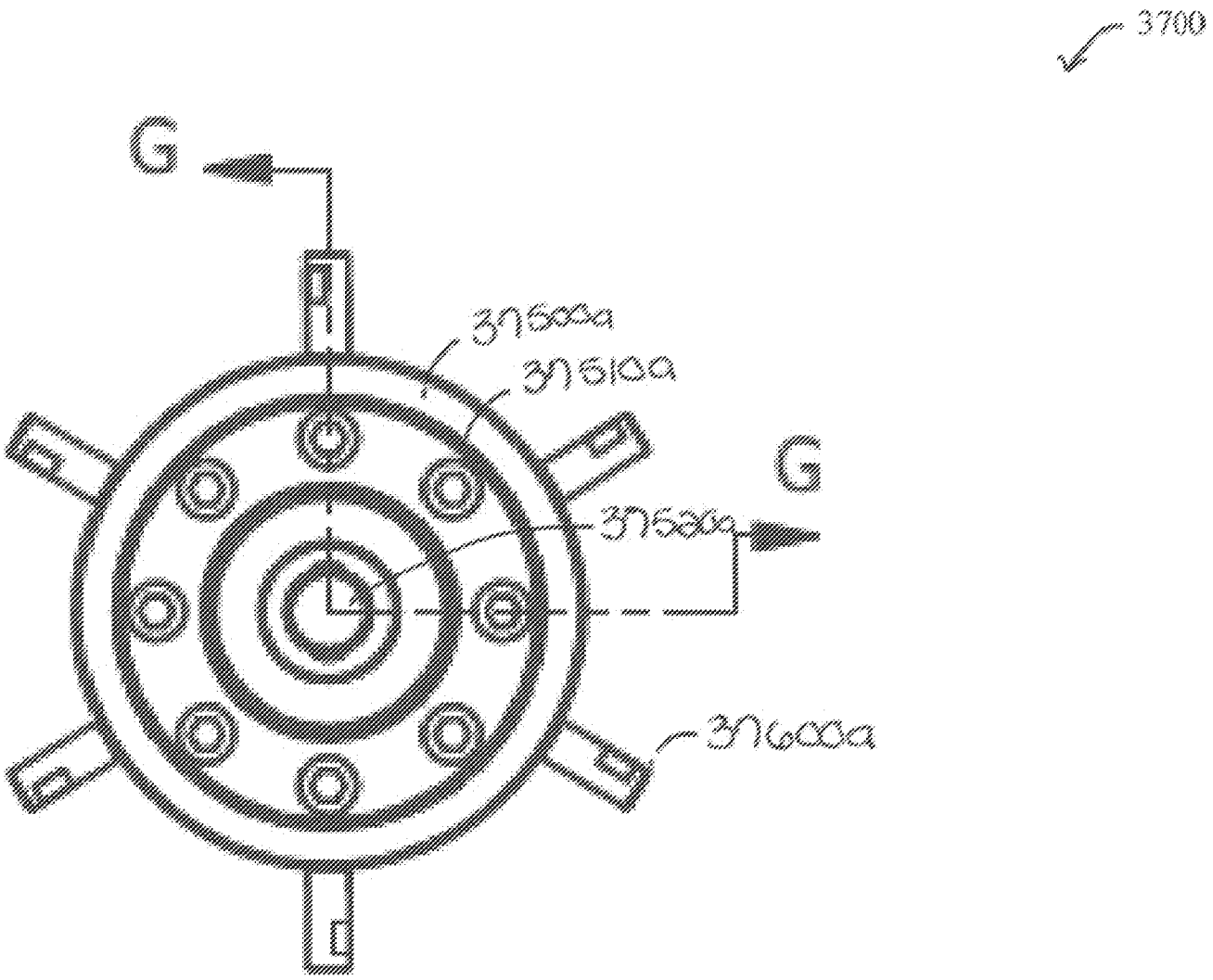
FIG. 37E illustrates an end view of the exemplary trapdoor-style drilling mud screen system of FIGS. 37A-37D.
Figure 37T:
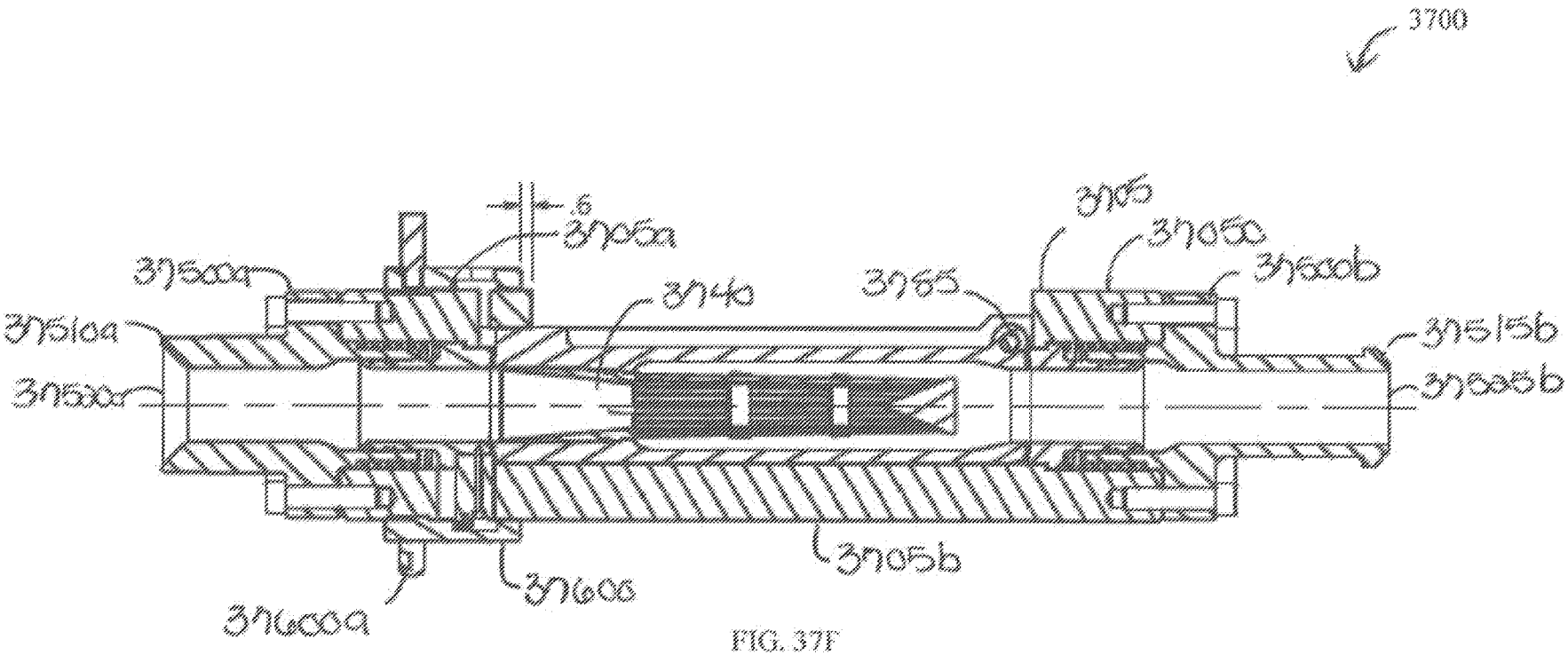
FIG. 37D illustrates a detailed view C of FIG. 37C.
FIG. 37F illustrates a detailed, cross-sectional view G-G of FIG. 37E.
FIG. 37G illustrates an end view of the exemplary trapdoor-style drilling mud screen system of FIGS. 37A-37F.
FIG. 37H illustrates a detailed, cross-sectional view J-J of FIG. 37G.
FIG. 37I illustrates an end view of the exemplary trapdoor-style drilling mud screen system of FIGS. 37A-37H.
FIG. 37J illustrates a detailed cross-sectional view H-H of FIG. 37I.
FIG. 37K illustrates an upper, right perspective view of the exemplary trapdoor-style drilling mud screen system of FIGS. 37A-37J, showing the trapdoor-style drilling mud screen system in a closed position.
FIG. 37L illustrates an upper, right perspective view of the exemplary trapdoor-style drilling mud screen system of FIGS. 37A-37K, showing the trapdoor-style drilling mud screen system in an open position.
FIG. 37M illustrates an exploded view of the exemplary trapdoor-style drilling mud screen system of FIGS. 37A-37L
Figure 37G:
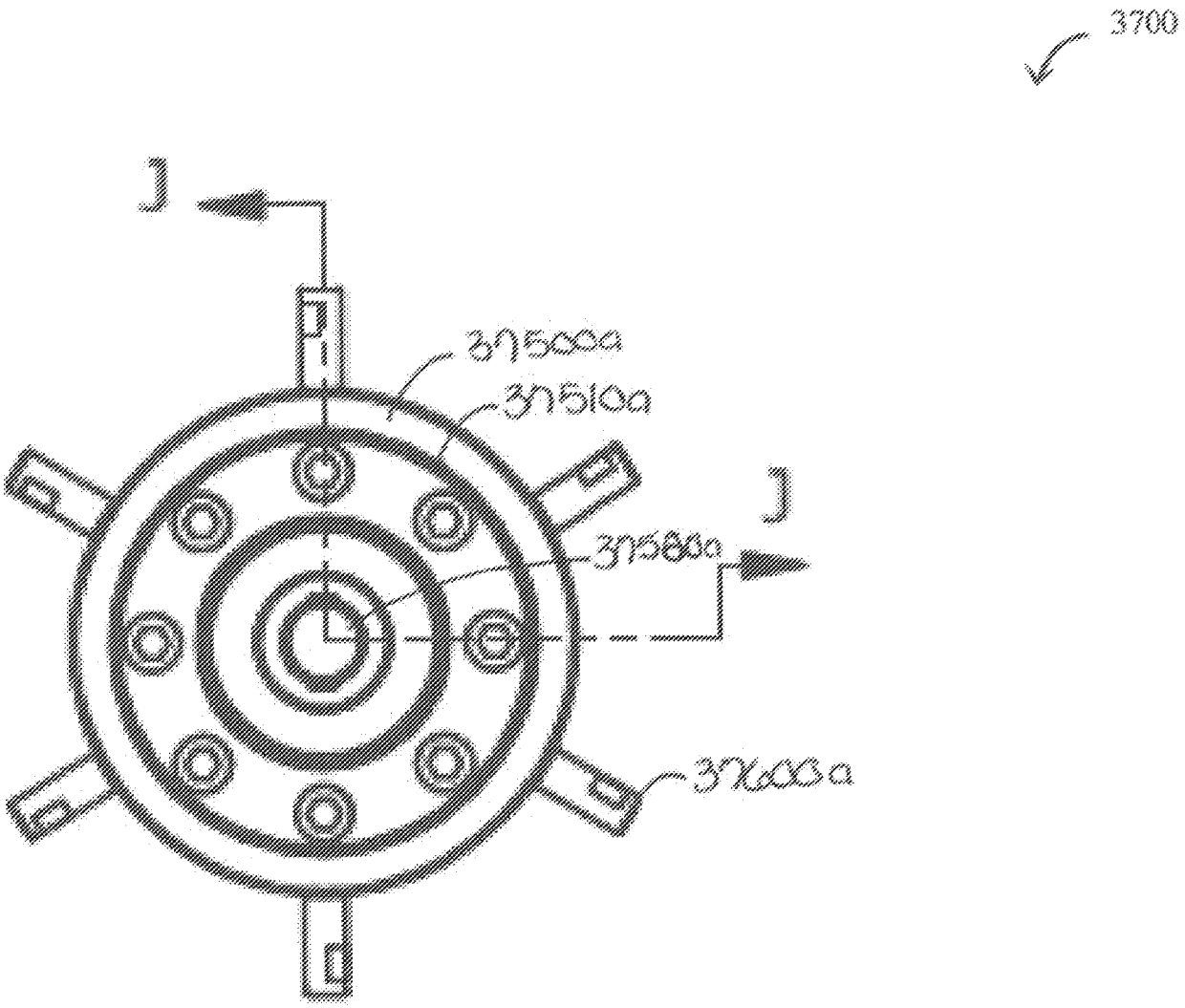
Figure 37H:
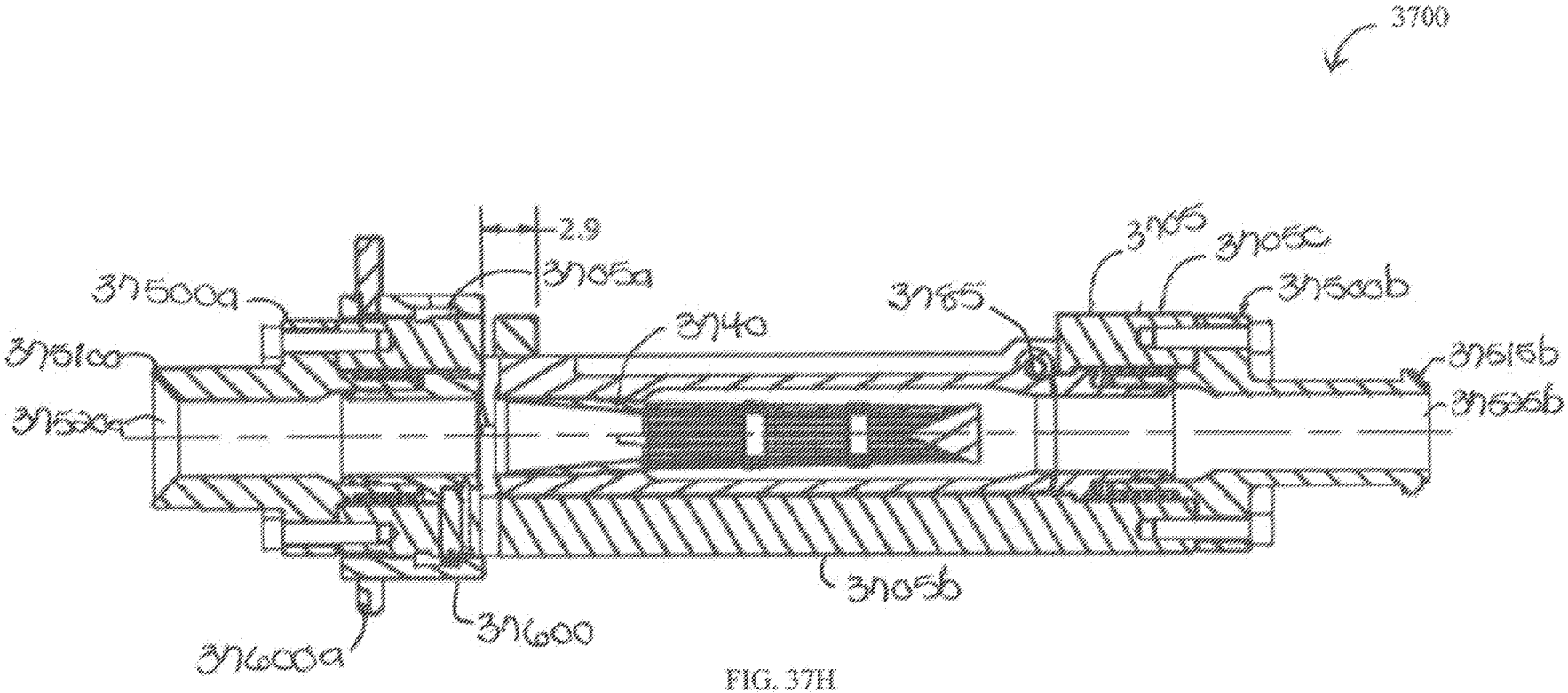
Figure 371:
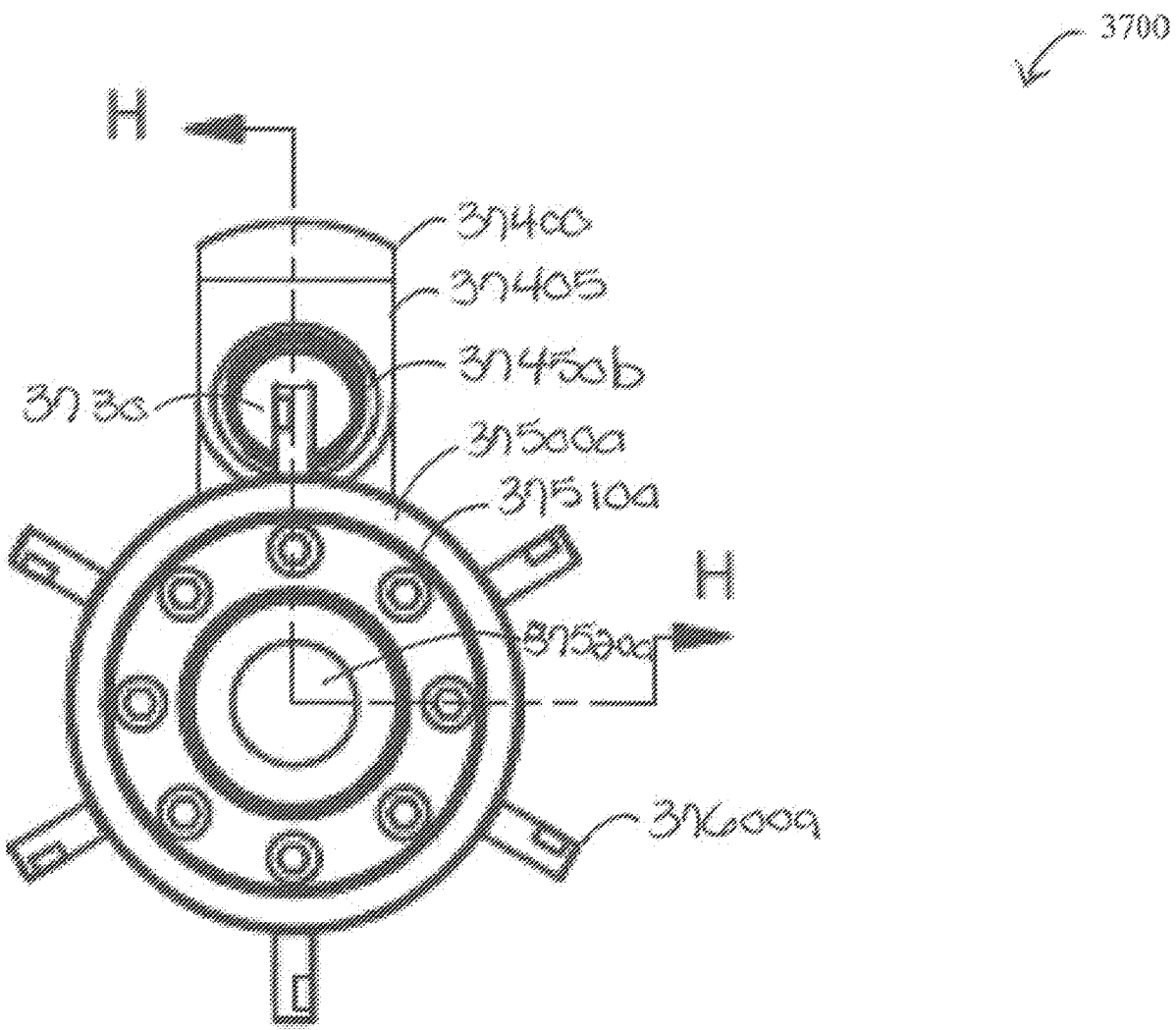
Figure 37I:
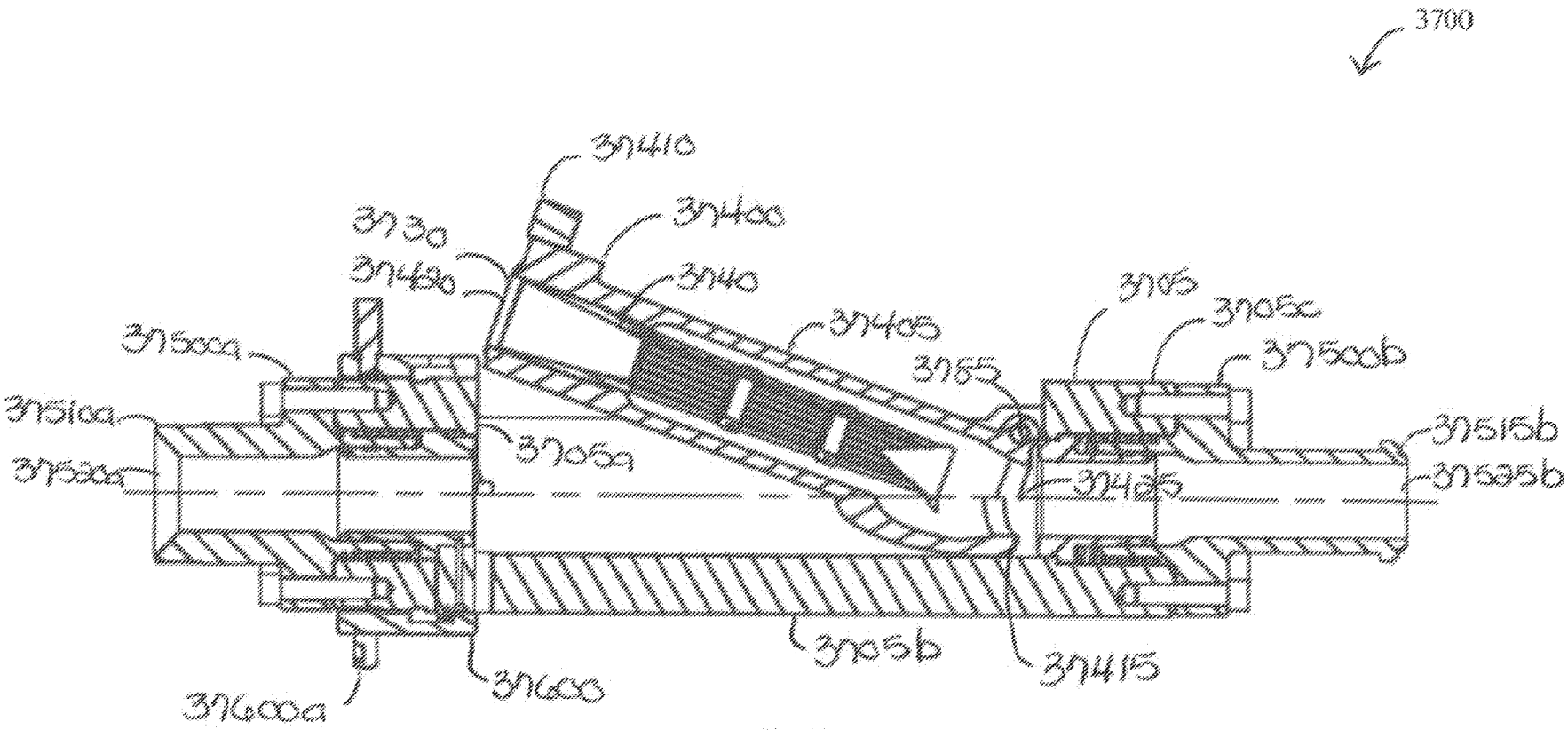
Figure 37L:
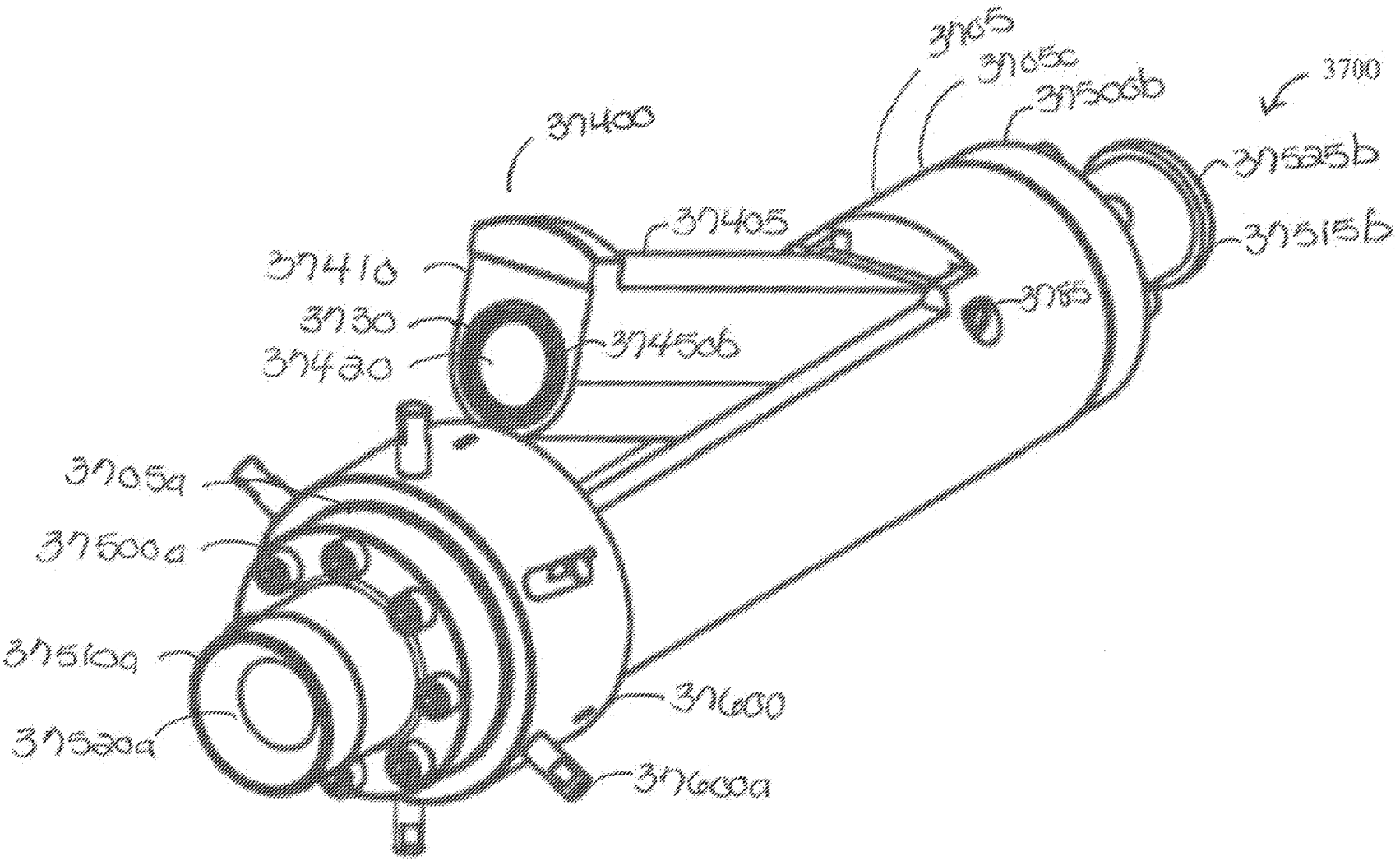

FIG. 37A illustrates an end view of an exemplary trapdoor-style drilling mud screen system 3700; FIG. 37B illustrates a detailed, cross-sectional view A-A of FIG. 37A; FIG. 37C illustrates a detailed, cross-sectional view B-B of FIG. 37A; FIG. 37D illustrates a detailed view C of FIG. 37C; FIG. 37E illustrates an end view of the exemplary trapdoor-style drilling mud screen system 3700 of FIGS. 37A-37D; FIG. 37F illustrates a detailed, cross-sectional view G-G of FIG. 37E; FIG. 37G illustrates an end view of the exemplary trapdoor-style drilling mud screen system 3700 of FIGS. 37A-37F; FIG. 37H illustrates a detailed, cross-sectional view J-J of FIG. 37G; FIG. 37I illustrates an end view of the exemplary trapdoor-style drilling mud screen system 3700 of FIGS. 37A-37H; FIG. 37J illustrates a detailed cross-sectional view H-H of FIG. 37I; FIG. 37K illustrates an upper, right perspective view of the exemplary trapdoor-style drilling mud screen system 3700 of FIGS. 37A-37J, showing the trapdoor-style drilling mud screen system 3700 in a closed position; FIG. 37L illustrates an upper, right perspective view of the exemplary trapdoor-style drilling mud screen system 3700 of FIGS. 37A-37K, showing the trapdoor-style drilling mud screen system 3700 in an open position; and FIG. 37M illustrates an exploded view of the exemplary trapdoor-style drilling mud screen system 3700 of FIGS. 37A-37L.

FIG. 38A illustrates a cross-sectional view of an exemplary trapdoor-style drilling mud screen system 3800 having a reversed drilling mud screen 3840, showing the trapdoor-style drilling mud screen system 3800 in a closed position; and FIG. 38B illustrates a cross-sectional view of the exemplary trapdoor-style drilling mud screen system 3800 of FIG. 38A, showing the trapdoor-style drilling mud screen system 3800 in an open position.

As shown in FIGS. 37A-37M and 38A-38B, the drilling mud screen system 3700, 3800 has a body 3705, 3805 having a first end 3710, 3810 and a second end 3715, 3815, a drilling mud inlet 3720, 3820 and a drilling mud outlet 3725, 3825.

In an embodiment, the drilling mud screen system 3700, 3800 has a drilling mud screen 3740, 3840 fluidly connected to and disposed between the first drilling mud inlet 3720, 3820 and the first drilling outlet 3725, 3825.

In an embodiment, the body 3705, 3805 has a first portion 3705*a*, 3805*a*, a second portion 3705*b*, 3805*b* and a third portion 3705*c*, 3805*c*. In an embodiment, the first portion 3705*a*, 3805*a* of the body 3705, 3805 is an inlet portion. In an embodiment, the second portion 3705*b*, 3805*b* of the body 3705, 3805 is a rotating trapdoor subassembly/drilling mud screen portion. In an embodiment, the third portion 3705*c*, 3805*c* of the body 3705, 3805 is an outlet portion.

In an embodiment, the first portion 3705*a*, 3805*a* and the third portion 3705*c*, 3805*c* may be any suitable shape. For example, suitable shapes include, but are not limited to, a cone, a cylinder, a rectangular prism (e.g., cubic, cuboid), a pentagonal prism, a sphere, a spheroid, a triangular prism, and combinations and/or portions thereof. In an embodiment, the first portion 3705*a*, 3805*a* and the third portion 3705*c*, 3805*c* may be a cylinder or a combination of cylinders.

In an embodiment, the first portion 3705*a*, 3805*a* and the third portion 3705*c*, 3805*c* may have any suitable inner diameter or dimension. For example, a suitable inner diameter for the first portion 3705*a*, 3805*a* and the third portion 3705*c*, 3805*c* may be from about 2-inches to about 5-inches, and any range or value there between. In an embodiment, the inner diameter of the first portion 3705*a*, 3805*a* and the third portion 3705*c*, 3805*c* may be about 4.06-inches.

In an embodiment, the second portion 3705*b*, 3805*b* may be any suitable shape. For example, suitable shapes include, but are not limited to, a cone, a cylinder, a rectangular prism (e.g., cubic, cuboid), a pentagonal prism, a sphere, a spheroid, a triangular prism, and combinations and/or portions thereof. In an embodiment, the second portion 3705*b*, 3805*b* may be a cylinder with open upper portion. See e.g., FIGS. 37A-37M & 38A-38B (open upper portion).

In an embodiment, the second portion 3705*b*, 3805*b* may have any suitable inner diameter or dimension. For example, a suitable inner diameter for the second portion 3705*b*, 3805*b* may be from about 4-inches to about 7-inches, and any range or value there between. In an embodiment, the inner diameter for the second portion 3705*b*, 3805*b* may be about 4.9-inches.

For example, a suitable inner dimension for the second portion 3705*b*, 3805*b* may be from about 4-inches to about 7-inches across, and any range or value there between. In an embodiment, the inner dimension for the second portion 3705*b*, 3805*b* may be about 4.9-inches across.

In an embodiment, a drilling mud inlet 3720, 3820 of the drilling mud screen system 3700, 3800 may be fluidly connected to a high-pressure outlet of a drilling mud pump via a connection. In an embodiment, a drilling mud outlet 3725, 3825 of the drilling mud screen system 3700, 3800 may be fluidly connected to an inlet of a vibrator hose to a standpipe via a connection.

Alternatively, the drilling mud screen system 3700, 3800 may be installed between an outlet of the vibrator hose and an inlet of the standpipe, or at any point in the standpipe via a connection.

In an embodiment, the drilling mud inlet 3720, 3820 may be fluidly connected to, for example, an outlet to a drilling mud pump via a connection; and the drilling mud outlet 3725, 3825 may be fluidly connected to, for example, an inlet to a vibrator hose via a connection. Any suitable connection may be used for the drilling mud inlet and the drilling mud outlet. For example, suitable connections include, but are not limited to, pipe fittings and welds. Connections are well known in the art. In an embodiment, the drilling mud inlet 3720, 3820 may be fluidly connected to, for example, an outlet to a drilling mud pump via a weld; and the drilling mud outlet 3725, 3825 may be fluidly connected to, for example, an inlet to a vibrator hose via a weld.

In an embodiment, the body 3705, 3805 of the drilling mud screen system 3700, 3800 may be constructed of any suitable material. For example, suitable materials include, but are not limited to, any alloy suitable for a drilling mud application. In an embodiment, the body 3705, 3805 may be constructed of a low alloy steel (e.g., 4140, 4145, 4330), a stainless steel (e.g., 17-4, 304, 316), a super alloy (e.g., Inconel), a titanium alloy (e.g., Ti-6Al-4V, Ti-6Al-6V-2Sn), a copper alloy (e.g., Beryllium Copper), a Cobalt alloy (e.g., Stellite), an Aluminum alloy (e.g., 2024, 6061, 7075) and combination thereof. In an embodiment, the body 3005, 3105 may be constructed of an American Iron and Steel Industry (AISI) 4130/75k yield or equivalent material. In an embodiment, the inner surface of the body 3705, 3805 may be unpainted. In an embodiment, the outer surface of the body 3705, 3805 may be painted.

Pivot Subassembly

As shown in FIGS. 37A-37M and 38A-38B, the second portion 3705*b*, 3805*b* of the body 3705, 3805 and/or the rotating trapdoor subassembly 37400, 38400 has a pivot shaft 3785, 3885, a first retaining ring 3785*a* and a second retaining ring 3785*b*.

In an embodiment, the rotating trapdoor subassembly 37400, 38400 may be retained in the second portion 3705*b*, 3805*b* of the body 3705, 3805 via the pivot shaft 3785, 3885. See e.g., FIGS. 37B, 37F, 37H, 37J-37L & 37M. In an embodiment, the rotating trapdoor subassembly 37400, 38400 may be retained in the second portion 3705*b*, 3805*b* of the body 3705, 3805 via the pivot shaft 3785, 3885 such that the rotating trapdoor subassembly 37400, 38400 may rotate with respect to the second portion 3705*b*, 3805*b* of the body 3705, 3805.

Rotating Trapdoor Subassembly

FIG. 37K illustrates an upper, right perspective view of the exemplary trapdoor-style drilling mud screen system 3700 of FIGS. 37A-37J, showing the trapdoor-style drilling mud screen system 3700 in a closed position; FIG. 37L illustrates an upper, right perspective view of the exemplary trapdoor-style drilling mud screen system 3700 of FIGS. 37A-37K, showing the trapdoor-style drilling mud screen system 3700 in an open position; and FIG. 37M illustrates an exploded view of the exemplary trapdoor-style drilling mud screen system 3700 of FIGS. 37A-37L.

FIG. 38A illustrates a cross-sectional view of an exemplary trapdoor-style drilling mud screen system 3800 having a reversed drilling mud screen 3840, showing the trapdoor-style drilling mud screen system 3800 in a closed position; and FIG. 38B illustrates a cross-sectional view of the exemplary trapdoor-style drilling mud screen system 3800 of FIG. 38A, showing the trapdoor-style drilling mud screen system 3800 in an open position.

As shown in FIGS. 37A-37M and 38A-38B, the rotating trapdoor subassembly 37400, 38400 has a trapdoor body 37405, 38405 having a first end 37410, a second end 37415, a first drilling mud inlet 37420, a first drilling mud outlet 37425, and an access port 3730, 3830.

In an embodiment, the rotating subassembly 37400, 38400 has a drilling mud screen 3740, 3840 fluidly connected to and disposed between the first drilling mud inlet 37420 and the first drilling outlet 37425.

In an embodiment, the trapdoor body 37405, 38405 may be any suitable shape. For example, suitable shapes include, but are not limited to, a cone, a cylinder, a rectangular prism (e.g., cubic, cuboid), a pentagonal prism, a sphere, a spheroid, a triangular prism, and combinations and/or portions thereof. In an embodiment, the trapdoor body 37405, 38405 may be a cylinder or a combination of cylinders. In an embodiment, the trapdoor body 37405, 38405 may be a combination of a cylinders and a rectangular prism.

In an embodiment, the trapdoor body 37405, 38405 may have any suitable inner diameter or dimension. For example, a suitable inner diameter for the trapdoor body 37405, 38405 may be from about 2-inches to about 7-inches, and any range or value there between. In an embodiment, the inner diameter of the trapdoor body 37405, 38405 may be about 4.06-inches and/or 4.9-inches.

For example, a suitable inner dimension for the trapdoor body 37405, 38405 may be from about 2-inches to about 7-inches across, and any range or value there between. In an embodiment, the inner dimension for the trapdoor body 37405, 38405 may be about 4.06-inches and/or 4.9-inches across.

In an embodiment, an internal drilling mud outlet 3725*a* of the body 3705, 3805 of the drilling mud screen system 3700, 3800 may be fluidly connected to the first drilling mud inlet 37420 of the trapdoor body 37405, 38405 of the rotating trapdoor subassembly 37400, 38400.

In an embodiment, the first drilling mud outlet 37425*a* of the trapdoor body 37405*a*, 38405*a* of the rotating trapdoor subassembly 37400, 38400 may be fluidly connected to an internal drilling mud inlet 3720*a*, 3820*a* of the body 3705, 3805 of the drilling mud screen system 3700, 3800.

In an embodiment, a first piston ring 37430*a* may be disposed between the first end 3710, 3810 of the body 3705, 3805 of the drilling mud screen system 3700, 3800 and the second end 37515*a*, 38515*a* of the first subassembly 37500, 38500. See e.g., FIG. 37M. In an embodiment, a first piston ring 37430*a* may be disposed in a first piston cavity (not shown) between the body 3705, 3805 of the drilling mud screen system 3700, 3800 and the second end 37510*a*, 38510*a* of the first subassembly 37500, 38500 to prevent buildup and compaction of debris in the first piston cavity (not shown).

In an embodiment, a second piston ring 37430*b* may be disposed between the second end 3715, 3815 of the body 3705, 3805 of the drilling mud screen system 3700, 3800 and the first end 37510*b*, 38510 of the second subassembly 37500*b*, 38500*b*. See e.g., FIG. 37M. In an embodiment, a second piston ring 37430*b* may be disposed in a second piston cavity (not shown) between the second end 3715, 3815 of the body 3705, 3805 of the drilling mud screen system 3700, 3800 and the first end 37510*b*, 38510*b* of the second subassembly 37500*b*, 38500*b* to prevent buildup and compaction of debris in the second piston cavity (not shown).

In an embodiment, the first piston ring 37430*a* and the second piston ring 37430*b* may be constructed of any suitable compressible material to prevent buildup and compaction of debris in a first piston cavity (not shown) and/or a second piston cavity (not shown), respectively.

In an embodiment, a first spring 37440*a* may be disposed between the first subassembly 37500*a*, 38500*a* and the body 3705, 3805 of the drilling mud screen system 3700, 3800. See e.g., FIG. 37M. In an embodiment, a first spring 37440*a* may be disposed in a first seal piston cavity (not shown) between the first subassembly 37500*a*, 38500*a* and the body 3705, 3805 of the drilling mud screen system 3700, 3800 to engage and seal a second end 37515*a*, 38515*a* of the first subassembly 37500*a*, 38500*a* with a first end 3710, 3810 of the body 3705, 3805 of the drilling mud screen system 3700, 3800.

In an embodiment, a second spring 37440*b* may be disposed between the body 3705, 3805 of the drilling mud screen system 3700, 3800 and the second subassembly 37500*b*, 38500*b*. See e.g., FIG. 37M. In an embodiment, a second spring 37440*b* may be disposed in a second seal piston cavity (not shown) between the body 3705, 3805 of the drilling mud screen system 3700, 3800 and the second subassembly 37500*b*, 38500*b* to engage and seal a second end 3715, 3815 of the body 3705, 3805 of the drilling mud screen system 3700, 3800 with a first end 37510*b*, 38510*b* of the second subassembly 37500*b*, 38500*b*.

In an embodiment, the body 3705, 3805 of the drilling mud screen system 3700, 3700 and the trapdoor body 37405, 38405 of the rotating trapdoor subassembly 37400, 38400 may be sealed via an O-ring. See e.g., FIG. 37M. Any suitable O-ring may be used. For example, suitable O-rings include, but are not limited to, 300 Series O-rings. O-rings are well known in the art.

In an embodiment, the second end 3715*a* of the first portion 3705*a*, 3805*a* of the body 3705, 3805 has a first seal face 37450*a*. See e.g., FIG. 37M.

In an embodiment, the first end 37410 of the trapdoor body 37405, 38405 of the rotating trapdoor subassembly 37400, 38400 has a second seal face 37450*b*. See e.g., FIG. 37M.

In an embodiment, the first seal face 37450*a* and the second seal face 37450*b* may have any suitable shapes to form a seal. For example, suitable shapes may be mating concave and convex surfaces, mating concave and convex surfaces similar to a ball valve, and combinations and variations thereof. In an embodiment, the first seal face 37450*a* may be concave; and the second seal face 37450*b* may be convex.

In an embodiment, the second end 37415, 38415 of the trapdoor body 37405, 38405 of the rotating trapdoor subassembly 3700, 3800 has a third seal face 37450*c*. See e.g., FIG. 37M.

In an embodiment, the first end 3710*c* of the third portion 3705*c*, 3805*c* of the body 3705, 3805 has a fourth seal face 37450*d*. See e.g., FIG. 37M.

In an embodiment, the third seal face 37450*c* and the fourth seal face 37450*d* may have any suitable shapes to form a seal. For example, suitable shapes may be mating concave and convex surfaces, mating concave and convex surfaces similar to a ball valve, and combinations and variations thereof. In an embodiment, the third seal face 37450*c* may be convex; and the fourth seal face 37450*d* may be concave.

In an embodiment, the trapdoor body 37405, 38405 of the rotating trapdoor subassembly 37400, 38400 may be constructed of any suitable material. For example, suitable materials include, but are not limited to, any alloy suitable for a drilling mud application. In an embodiment, the trapdoor body 37405, 38405 may be constructed of a low alloy steel (e.g., 4140, 4145, 4330), a stainless steel (e.g., 17-4, 304, 316), a super alloy (e.g., Inconel), a titanium alloy (e.g., Ti-6Al-4V, Ti-6Al-6V-2Sn), a copper alloy (e.g., Beryllium Copper), a Cobalt alloy (e.g., Stellite), an Aluminum alloy (e.g., 2024, 6061, 7075) and combination thereof. In an embodiment, the trapdoor body 37405, 38405 may be constructed of an American Iron and Steel Industry (AISI) 4130/75k yield or equivalent material. In an embodiment, the inner surface of the trapdoor body 37405, 38405 may be unpainted. In an embodiment, the outer surface of the trapdoor body 37405, 38405 may be painted.

Piston Guide Bar

As shown in FIGS. 37A-37M and FIGS. 38A-38B, the drilling mud screen system 3700, 3800 further comprises a first piston guide bar 37315*a* and a second piston guide bar 37315*b* for the first piston 37435*a*.

In an embodiment, the first piston guide bar 37315*a* and the second piston guide bar 37315*b* guides the first piston 37435*a* to engage the first end 37410 of the rotating trapdoor subassembly 37400 when the rotating trapdoor subassembly 37400 is in a closed position.

In an embodiment, the first piston guide bar 37315*a* and the second piston guide bar 37315*b* guides the first piston 37435*a* to engage a first slot 37335*a* and a second slot (not shown), respectively, in the first portion 3705*a*, 3805*a* of the body 3705 or the second portion 3705*b*, 3805*b* of the body 3705, and a third slot 37340*a* and a fourth slot (not shown), respectively, in the first piston 37435*a* when the rotating trapdoor subassembly 37400 is in a closed position. See e.g., FIG. 37M.

In an embodiment, the first piston guide bar 37315*a* and the second piston guide bar 37315*b* guides the first piston 37435*a* to engage a first slot 37335*a* and a second slot (not shown), respectively, in first portion 3705*a*, 3805*a* of the body 3705 or the second portion 3705*b*, 3805*b* of the body 3705, a third slot 37340*a* and a fourth slot (not shown), respectively, in the first piston 37435*a* and a fifth slot 37345*a* and a sixth slot (not shown) in the threaded lock ring 37600 (discussed below) when the rotating trapdoor subassembly 37400 is in a closed position. See e.g., FIG. 37M.

In an embodiment, the first piston guide bar 37315*a* and the second piston guide bar 37315*b* locks the first piston 37435*a* to contact and seal the first end 37410 of the rotating trapdoor subassembly 37400 when the rotating trapdoor subassembly 37400 is in a closed position.

In an embodiment, the first piston guide bar 37315*a* and the second piston guide bar 37315*b* guides the first piston 37435*a* to disengage from the first end 37410 of the rotating trapdoor subassembly 37400 when the rotating trapdoor subassembly 37400 is in an open position.

In an embodiment, the first piston guide bar 37315*a* and the second piston guide bar 37315*b* separates the first piston 37435*a* to disengage and create a gap from the frost end 37410 of the rotating trapdoor subassembly 37400 when the rotating trapdoor subassembly 37400 is in the open position to avoid damage to the first seal face 37450*a* and/or the second seal face 37450*b*.

In an embodiment, the first piston guide bar 37315*a* further comprises a ball bearing for smooth action. In an embodiment, the second piston guide bar 37315*b* further comprises a ball bearing for smooth action. See e.g., FIG. 37M.

In an embodiment, the first piston guide bar 37315*a* and the second piston guide bar 37315*b* may be constructed from any suitable material. For example, suitable materials include, but are not limited to, any alloy suitable for a drilling mud application. In an embodiment, the first piston guide bar 37315*a* and the second piston guide bar 37315*b* may be constructed of a low alloy steel (e.g., 4140, 4145, 4330), a stainless steel (e.g., 17-4, 304, 316), a super alloy (e.g., Inconel), a titanium alloy (e.g., Ti-6Al-4V, Ti-6Al-6V-2Sn), a copper alloy (e.g., Beryllium Copper), a Cobalt alloy (e.g., Stellite), an Aluminum alloy (e.g., 2024, 6061, 7075) and combination thereof. In an embodiment, the first piston guide bar 37315*a* and the second piston guide bar 37315*b* may be constructed of an American Iron and Steel Industry (AISI) 4130/75k yield or equivalent material Subassemblies As shown in FIGS. 37A-37M and FIGS. 38A-38B, the drilling mud screen system 3700, 3800 further comprises a first subassembly 37500*a*, 38500*a* and a second subassembly 37500*b*, 38500*b*. In an embodiment, the drilling mud screen system 3700, 3800 has a first subassembly 37500*a*, 38500*a* having a first end 37510*a*, 38510*a* and a second end 37515*a*, 38515*a*, a first inlet 37520*a*, 38520*a* of the first subassembly 37500*a*, 38500*a* and a first outlet 37525*a*, 38525*a* of the first subassembly 37500*a*, 38500*a*.

In an embodiment, the drilling mud screen system 3700, 3800 has a second subassembly 37500*b*, 38500*b* having a first end 37510*b*, 38510*b* and a second end 37515*b*, 38515*b*, a second inlet 37520*b*, 38520*b* of the second subassembly 37500*b*, 38500*b* and a second outlet 37525*b*, 38525*b* of the second subassembly 37500*b*, 37500*b*.

In an embodiment, the first drilling mud inlet 37520*a*, 38520*a* of the first subassembly 37500*a*, 38500*a* may be fluidly connected to, for example, an outlet of a drilling mud pump via a connection; and the second drilling mud outlet 37525*b*, 38525*b* of the second subassembly 37500*b*, 38500*b* may be fluidly connected to an inlet of a vibrator hose via a connection. Any suitable connection may be used for the first drilling mud inlet 37520*a*, 38520*a* of the first subassembly 37500*a*, 38500*a* and the second drilling mud outlet 37525*b*, 38525*b* of the second subassembly 37500*b*, 38500*b*. For example, suitable connections include, but are not limited to, pipe fittings and welds. Connections are well known in the art. In an embodiment, the first drilling mud inlet 37520*a*, 38520*a* of the first subassembly 37500*a*, 38500*a* may be fluidly connected to, for example, an outlet of a drilling mud pump via a weld; and the second drilling mud outlet 37525*b*, 38525*b* of the second subassembly 37500*b*, 38500*b* may be fluidly connected to an inlet of a vibrator hose via a weld.

In an embodiment, the drilling mud inlet 3720, 3820 of the body 3705, 3805 may be fluidly connected to the first drilling mud outlet 37525*a*, 38525*a* of the first subassembly 37500*a*, 38500*a* via a connection; and the drilling mud outlet 3725, 3825 of the body 3705, 3805 may be fluidly connected to the second drilling mud inlet 37520*b*, 38820*b* of the second subassembly 37500*b*, 38500*b* via a connection. Any suitable connection may be used for the drilling mud inlet 3720, 3820 of the body 3705, 3805 and the drilling mud outlet 3725, 3825 of the body 3705, 3805. For example, suitable connections include, but are not limited to, pipe fittings and other connections. In an embodiment, the first drilling mud inlet 3720, 3820 of the body 3705, 3905 may be fluidly connected to, for example, a first drilling mud outlet 37525*a*, 38525*a* of a first subassembly 37500*a*, 38500*a* via a pipe fitting; and the second drilling mud outlet 3725, 3825 of the body 3705, 3805 may be fluidly connected to a second drilling mud inlet 37520*b*, 38520*b* of the second subassembly 37500*b*, 38500*b* via a pipe fitting.

In an embodiment, the drilling mud outlet 3725*a*, 3825*a* of the body 3705, 3805 may be connected to the first drilling mud inlet 37520*a*, 38520*a* of the first subassembly 37500*a*, 38500*a* via a lock ring 37600, 38600. In an embodiment, the body 3705, 3805 and/or the first subassembly 37500*a*, 38500*a* may be sealed with the lock ring 37600, 38600 via an O-ring. Any suitable O-ring may be used. For example, suitable O-rings include, but are not limited to, 300 Series O-rings. O-rings are well known in the art.

In an embodiment, the first subassembly 37500*a*, 38500*a* and the second subassembly 37500*b*, 38500*b* of the drilling mud screen system 3700, 3800 may be constructed of any suitable material. For example, suitable materials include, but are not limited to, any alloy steel suitable for a drilling mud application. In an embodiment, the first subassembly 37500*a*, 38500*a* and the second subassembly 37500*b*, 38500*b* may be constructed of an AISI 4130/75k yield or equivalent material. In an embodiment, the inner surface of the first subassembly 37500*a*, 38500*a* and the second subassembly 37500*b*, 38500*b* may be unpainted. In an embodiment, the outer surface of the first subassembly 37500*a*, 38500*a* and the second assembly 37500*b*, 38500*b* may be painted.

Threaded Lock Ring

In an embodiment, the drilling mud screen system 3700, 3800 further comprises a threaded lock ring 37600, 38600 having a first end 37610 and a second end 37615.

In an embodiment, the threaded lock ring 37600, 38600 is disposed around a first portion 3705*a*, 3805*a* of the body 3705, 3805 and a first end 37410 of the trapdoor body 37405 of the rotating trapdoor subassembly 37400, 38400.

In an embodiment, the threaded lock ring 37600, 38600 is disposed around a first portion 3705*a*, 3805*a* of the body 3705, 3805 and a first end 37410 of the trapdoor body 37405 of the rotating trapdoor subassembly 37400, 38400 to lock the trapdoor subassembly 37400, 38400 in a closed position.

In an embodiment, the first piston guide bar 37315*a* and the second piston guide bar 37315*b* is disposed through a first slot 37335*a* and a second slot (not shown) in the first portion 3705*a*, 3805*a* of the body 3705 or the second portion 3705*b*, 3805*b* of the body 3705, a third slot 37340*a* and a fourth slot (not shown) in the first piston 37435*a* and a fifth slot and a sixth slot (not shown) in the threaded lock ring 37600 to lock the first piston 37435*a* in an engaged position when the rotating trapdoor subassembly 37400 is in a closed position. See e.g., FIG. 37M.

In an embodiment, the threaded lock ring 37600, 38600 further comprises one or more handles 37600*a*, 38600*a*.

In an embodiment, the threaded lock ring 37600, 38600 may have any suitable inner diameter or dimension. For example, a suitable inner diameter for the threaded lock ring 37600, 38600 may be from about 8-inches to about 15-inches, and any range or value there between. In an embodiment, the inner diameter of the threaded lock ring 37600, 38600 may be about 12.4-inches.

For example, a suitable inner dimension for the threaded lock ring 37600, 38600 may be from about 8-inches to about 15-inches across, and any range or value there between. In an embodiment, the inner dimension for the threaded lock ring 37600, 38600 may be about 12.4-inches across.

In an embodiment, the threaded lock ring 37600, 38600 may be constructed of any suitable material. For example, suitable materials include, but are not limited to, any alloy steel suitable for a drilling mud application. In an embodiment, the threaded lock ring 37600, 38600 may be constructed of an AISI 4130/75k yield or equivalent material. In an embodiment, the inner surface of the threaded lock ring 37600, 38600 may be unpainted. In an embodiment, the outer surface of the threaded lock ring 37600, 38600 may be painted.

Exemplary Drilling Mud Screens

FIG. 5A illustrates an upper, cross-sectional view of a drilling mud screen 500 according to an embodiment of the present invention, as discussed above. FIG. 5B illustrates a detailed view of A-A of FIG. 5A; FIG. 5C illustrates a detailed view of B of FIG. 5A; and FIG. 5D illustrates a detailed view of C of FIG. 5A. FIG. 5E illustrates an upper, right side perspective view of the drilling mud screen 500 of FIG. 5A.

Optional Drilling Mud Screen

FIG. 22A illustrates an end view of an optional drilling mud screen 2200 according to an embodiment of the present invention, as discussed above. FIG. 22B illustrates a detailed, cross-sectional view of A-A of FIG. 22A, showing an optional drilling mud screen insert 22105, and optional first end retaining ring 22110, an optional filter length 22115, and an optional retaining ring 22120; FIG. 22C illustrates a detailed view of B of FIG. 22B; and FIG. 22D illustrates a detailed, cross-sectional view of C-C of FIG. 22C. FIG. 22E illustrates an upper, right perspective view of the drilling mud screen 2200 of FIGS. 22A-22B.

Alternative Reversed Drilling Mud Screen

The drilling mud screen 3840 may be any suitable filter or screen capable of filtering or screening debris from drilling muds and completion fluids. For example, suitable drilling mud screens include, but are not limited to, drill screens and rod screens.

FIGS. 38A-38B illustrates a cross-sectional view of an exemplary drilling mud screen system 3800 according to an embodiment of the invention, showing a reversed drilling mud screen 3840.

As shown in FIGS. 5A-5E, 22A-22E and 38A-38B, the drilling mud screen 3840 has a body 505, 2205 having a first end 515, 2215 and a second end 510, 2210, a drilling mud inlet 525, 2225, a drilling mud outlet 520, 2220, a filter 530, 2230 and an end cap 535, 2235.

In an embodiment, the drilling mud inlet 525, 2225 may be fluidly connected to, for example, an outlet of a drilling mud pump via a connection; and the drilling mud outlet 520, 2220 may be fluidly connected to an inlet of a vibrator hose via a connection. Any suitable connection may be used for the drilling mud inlet 525, 2225 and the drilling mud outlet 520, 2220. For example, suitable connections include, but are not limited to, pipe fittings and welds. Connections are well known in the art. In an embodiment, the drilling mud inlet 525, 2225 may be fluidly connected to, for example, an outlet of a drilling mud pump via a weld; and the drilling mud outlet 520, 2220 may be fluidly connected to an inlet of a vibrator hose via a weld.

In an embodiment, the body 505, 2205 of the drilling mud screen 3840 may be constructed of any suitable material. For example, suitable materials include, but are not limited to, any alloy steel or tool steel. In an embodiment, the body 505, 2205 may be constructed of an AISI 4145 or equivalent material. In an embodiment, the body 505, 2205 may be constructed of tool steel or equivalent material.

In an embodiment, the body 505, 2205 of the drilling mud screen 3840 may have a hardened coating to reduce washing (i.e., erosion) of the screen 3840. For example, suitable hardened coatings include, but are not limited to, any Carbide coating or equivalent. In an embodiment, the body 505, 2205 may have a Carbide coating with about 6% Cobalt binder or equivalent material.

In an embodiment, the drilling mud outlet 520, 2220 of the drilling mud screen 3840 may have any suitable inner diameter 565, 2265; and the drilling mud outlet 520, 2220 may have any suitable outer diameter 570, 2270. In an embodiment, the inner diameter 565, 2265 of the drilling mud outlet 520, 2220 may be from about 3-inches to about 5-inches, and any range or value there between. In an embodiment, the inner diameter 565, 2265 of the drilling mud outlet 520, 2220 may be about 3.9-inches.

In an embodiment, the outer diameter 570, 2270 of the drilling mud outlet 525, 2225 may be from about 4-inches to about 6-inches, and any range or value there between. In an embodiment, the outer diameter 570, 2270 of the drilling mud inlet 525, 2225 may be about 4-inches.

In an embodiment, a first portion 580, 2280 of the body 505, 2205 of the drilling mud screen 3850 may have a filter 535, 2235. In an embodiment, the filter 535, 2235 may comprise a plurality of rods spaced a distance apart to form a filter. In an embodiment, the distance may be less than a particle size (e.g., diameter) desired to be filtered from the drilling mud. For example, the particle size desired to be filtered from drilling mud may be from about 3/16-inches and larger. For example, the particle size desired to be filtered from the completion fluids may be from about 200 microns to about 2500 microns.

In an embodiment, the filter 535, 2235 may comprise a formed sheet having drilled holes spaced a distance apart to form a filter. In an embodiment, the size of the holes (e.g., diameter) may be less than a particle size (e.g., diameter) desired to be filtered. For example, the particle size desired to be filtered from drilling mud may be from about 3/16-inches and larger. For example, the particle size desired to be filtered from the completion fluids may be from about 200 microns to about 2500 microns.

In an embodiment, a first portion 580, 2280 of the body 505, 2205 of the drilling mud screen 3850 may have a drilling mud inlet 525, 2225. In an embodiment, the drilling mud inlet 525, 2225 may comprise a plurality of spaces (i.e., flow passages) between a plurality of rods. In an embodiment, the drilling mud inlet 525, 2225 may comprise a plurality of holes (i.e., flow passages) drilled in a formed sheet. For example, the particle size desired to be filtered from drilling mud may be from about 3/16-inches and larger. For example, the particle size desired to be filtered from the completion fluids may be from about 200 microns to about 2500 microns.

In an embodiment, the first portion 580, 2280 of the body 505, 2205 of the drilling mud screen 3850 may have a first inner diameter 590; and the second portion 575, 2275 of the body 505, 2205 may have a second inner diameter 585, 2285.

In an embodiment, the body 505, 2205 and/or a filter 535, 2235 of the drilling mud screen 3840 may have a tapered drilling mud flow path from a larger inner diameter to a smaller inner diameter to reduce washing (i.e., erosion) of the screen 3840.

In an embodiment, the first inner diameter 590, 2290 of a first end of the body 505, 2205 of the drilling mud screen 3840 may be from about 2-inches to about 3-inches, and any range or value there between. In an embodiment, the first inner diameter 590, 2290 of the first portion 575, 2275 of the body 505, 2205 may be about 2.3-inches.

In an embodiment, an inner diameter of an outlet of the first portion 580, 2280 and an inlet of the second portion 575, 2275 of the body 505, 2205 may be from about 2-inches to about 3-inches, and any range or value there between. In an embodiment, the inner diameter of the outlet of the first portion 580, 2280 of the body 505, 2205 and the inlet of the second portion 575, 2275 of the body 505, 2205 may be about 2.5-inches.

In an embodiment, the second inner diameter 585, 2285 of a second end of the body 505, 2205 of the drilling mud screen 3840 may be from about 2-inches to about 5-inches, and any range or value there between. In an embodiment, the second inner diameter 585, 2285 of the second end of the body 505, 2205 may be about 3.9-inches.

In an embodiment, the outer surface 595, 2295 of the second portion 527, 2275 of the body 505, 2205 of the drilling mud screen 3840 may be adapted to engage one or more shoulders in an inner surface of the trapdoor body 38405. In an embodiment, a first shoulder and a second shoulder of the trapdoor body 38405 may be offset from a second end 38415 of the body 38405. The first and second shoulders may be offset from the second end 38415 of the trapdoor body 38405 at any suitable distance. In an embodiment, the first shoulder may be offset from the second end 38415 of the trapdoor body 38405 from about 4-inches to about 8-inches; and the second shoulder may be offset from the second end 38415 of the trapdoor body 38405 from about 5-inches to about 9-inches, and any range or value there between. In an embodiment, the first shoulder may be offset from the second end 38415 of the trapdoor body 38405 about 4.8-inches; and the second shoulder may be offset from the second end 38415 of the trapdoor body 38405 about 6.8-inches.

In an embodiment, the outer surface 595, 2295 of the body 505, 2205 of the drilling mud screen 4140, 4240 may be sealed against an inner surface of the trapdoor body 38405 via an O-ring. Cf. FIGS. 4A & 5A. Any suitable O-ring may be used. For example, suitable O-rings include, but are not limited to, 300 Series O-rings. O-rings are well known in the art.

In an embodiment, a groove for an O-ring may be offset from a second end 515, 2215 of the body 505, 2205 of the drilling mud screen 3840. The groove for the O-ring may be offset from the second end 515, 2215 of the body 505, 2205 at any suitable distance. In an embodiment, the groove for the O-ring may be offset from the second end 515, 2215 of the body 505, 2205 from about 4-inches to about 8-inches, and any range or value there between. In an embodiment, the groove for the O-ring may be offset from the second end 515, 2215 of the body 505, 2205 about 5.7-inches.

In an embodiment, the filter 530, 2230 may have a plurality of rods spaced a distance apart to form a filter, or, alternatively, a formed sheet having drilled holes spaced a distance apart to form a filter. In an embodiment, the plurality of rods may be tapered from a larger outer diameter to a smaller outer diameter to encourage drilling mud flow to enter in straight lines through the drilling mud inlet 525, 2225 (i.e., through flow passages between the plurality rods) to reduce washing (i.e., erosion) of the screen 3840. In an embodiment, the filter 530, 2230 may have a plurality of straight rows of holes drilled in a formed sheet to encourage drilling mud flow to enter in straight rows of strings through the drilling mud inlet 525, 2225 (i.e., through straight flow passages of the drilled holes) to reduce washing (i.e., erosion) of the screen 3840.

In an embodiment, a first end of a filter 530, 2230 may be connected to a second end of the end cap 535, 2235 via a connection; and a second end of a filter 530, 2230 may be connected to a first end 515, 2215 of the body 505, 2205 via a connection. Any suitable connection may be used for the filter 41230, 42230 and end cap 41235, 42235. For example, suitable connections include, but are not limited to, welds. Connections are well known in the art. In an embodiment, the first end of the filter 530, 2230 may be connected to the second end of the end cap 535, 2235 via a weld; and the second end of the filter 530, 2230 may be connected to the first end 515, 2215 of the body 505, 2205 via a weld.

In an embodiment, the first end of the filter 530, 2230 may fit into a first recess in the second end of the end cap 535, 2235; and the second end of the filter 530, 2230 may fit into a second recess in the first end 515, 2215 of the body 505, 2205. In an embodiment, the first recess and the second recess may be a plurality of recessed holes or a recessed groove. In an embodiment, the first recess and the second recess may be a plurality of recessed holes.

In an embodiment, the filter 530, 2230 may be held together with a retaining ring. In an embodiment, the retaining ring may have a plurality of holes to hold the plurality of rods to form the filter 530, 2230. In an embodiment, the plurality of rods may be connected to the plurality of holes in the retainer ring via a connection. Any suitable connection may be used for the filter 530, 2230 and retaining ring. For example, suitable connections include, but are not limited to, welds. Connections are well known in the art. In an embodiment, the plurality of rods may be connected to the plurality of holes in the retainer ring via a weld.

In an embodiment, the filter 530, 2230, including any retaining rings, of the drilling mud screen 3840 may be constructed of any suitable material. For example, suitable materials include, but are not limited to, any alloy steel. In an embodiment, the filter 530, 2230 may be constructed of 304 stainless steel material. In an embodiment, the filter 530, 2230 may have a hardened coating to reduce washing (i.e., erosion) of the screen 3840.

In an embodiment, the end cap 535, 2235 of the drilling mud screen 3840 has an outer surface. In an embodiment, the outer surface of the end cap 535, 2235 of the drilling mud screen 3840 may redirect the flow to reduce washing (i.e., erosion) of the screen 3840. In an embodiment, the outer surface of the end cap 535, 2235 of the drilling mud screen 3840 forms an inverted cone relative to the first end 515, 2215 of the body 505, 2205 of the drilling mud screen 3840 (i.e., an upstream pointing cone) to redirect the flow. In an embodiment, the tip of the inverted cone may have a rounded or squared shape.

In an embodiment, the body 505, 2205 of the drilling mud screen 3840 has a centerline 545, 2245. In an embodiment, the centerline 545, 2245 extends through the center of the drilling mud screen outlet 525, 2225 to the end cap 535, 2235. In an embodiment, the centerline 545, 2245 of the body 505, 2205 of the drilling mud screen 3840 and the outer surface 555, 2255 of the end cap 535, 2235 form an angle 560, 2260. In an embodiment, the angle 560, 2260 may be from about 30-degrees to about 90-degrees, and any range or value there between. In an embodiment, the angle 560, 2260 may be from about 35-degrees to about 45-degrees.

In an embodiment, the end cap 535, 2235 of the drilling mud screen 3840 may be constructed of any suitable material. For example, suitable materials include, but are not limited to, any alloy steel. In an embodiment, the end cap 535, 2235 may be constructed of 304 stainless steel material. In an embodiment, the end cap 535, 2235 of the drilling mud screen 3840 may have a hardened coating to reduce washing (i.e., erosion) of the screen 3840. For example, suitable hardened coatings include, but are not limited to, any Carbide coating or equivalent. In an embodiment, the end cap 535, 2235 may have a Carbide coating with about 6% Cobalt binder or equivalent material.

Method of Using Valve-Style Drilling Mud Screen System

Figure 34:
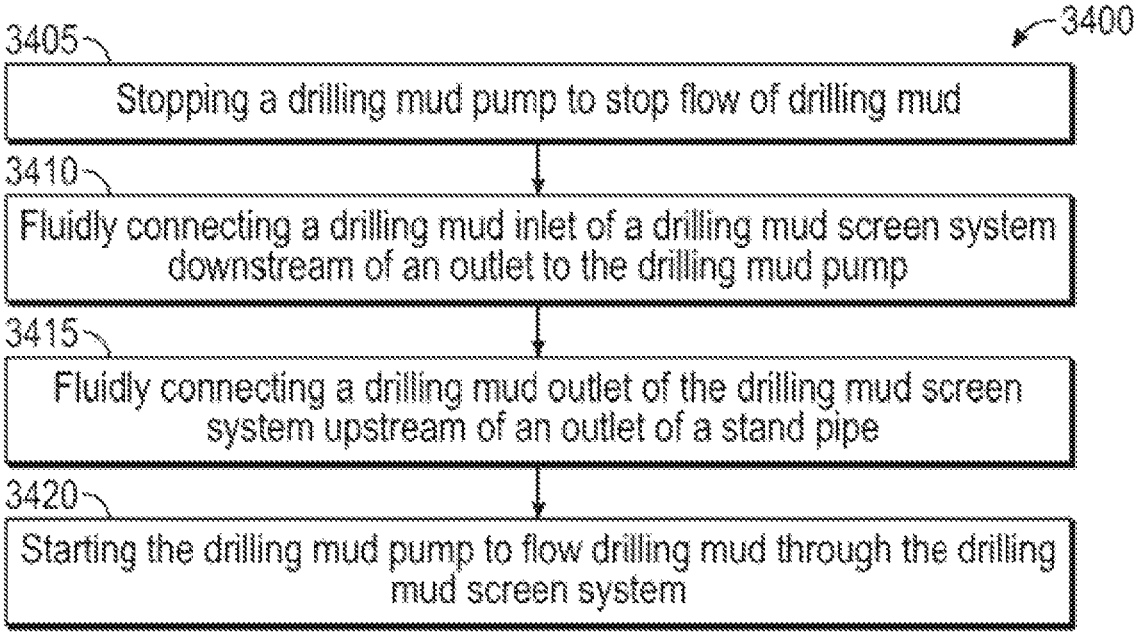
FIG. 34 illustrates a flow chart for a method of using a drilling mud screen system.

FIG. 34 illustrates a flow diagram for a method of using a drilling mud screen system, as discussed above. As shown in FIG. 34, the method of using a drilling mud system 3400 comprises stopping a drilling mud pump to stop flow of drilling mud 3405, fluidly connecting a drilling mud inlet of a drilling mud screen system downstream of an outlet to the drilling mud pump 3410, fluidly connecting a drilling mud outlet of the drilling mud screen system upstream of an outlet of a stand pipe 3415, and starting the drilling mud pump to flow drilling mud through the drilling mud screen system 3420. See also FIG. 10.

In an embodiment, the drilling mud inlet 3020, 3120, 3220, 3320 of the drilling mud screen system 3000, 3100, 3200, 3300 may be fluidly connected to a high pressure outlet of the drilling mud pump via a connection. See also FIGS. 14, 19, 21, 23 & 26. The inlet pressure to the drilling mud inlet 3020, 3120, 3220, 3320 of the drilling mud screen system 3000, 3100, 3200, 3300 may be any suitable pressure. In an embodiment, the inlet pressure may be from about 7500 psi to about 10,000 psi, and any range or value there between.

In an embodiment, the drilling mud outlet 3025, 3125, 3225, 3325 of the drilling mud screen system 3000, 3100, 3200, 3300 may be fluidly connected to an inlet of a vibrator hose to the standpipe via a connection.

In an embodiment, the drilling mud inlet 3020, 3120, 3220, 3320 of the drilling mud screen system 3000, 3100, 3200, 3300 may be fluidly connected to an outlet of a vibrator hose to a standpipe via a connection. In an embodiment, the drilling mud outlet 3025, 3125, 3225, 3325 of the drilling mud screen system 3000, 3100, 3200, 3300 may be fluidly connected to an inlet of the standpipe via a connection.

In an embodiment, the drilling mud screen system 3000, 3100, 3200, 3300 may be fluidly connected at any point in the standpipe via a connection.

Optional Monitoring Configuration

Figure 35A:
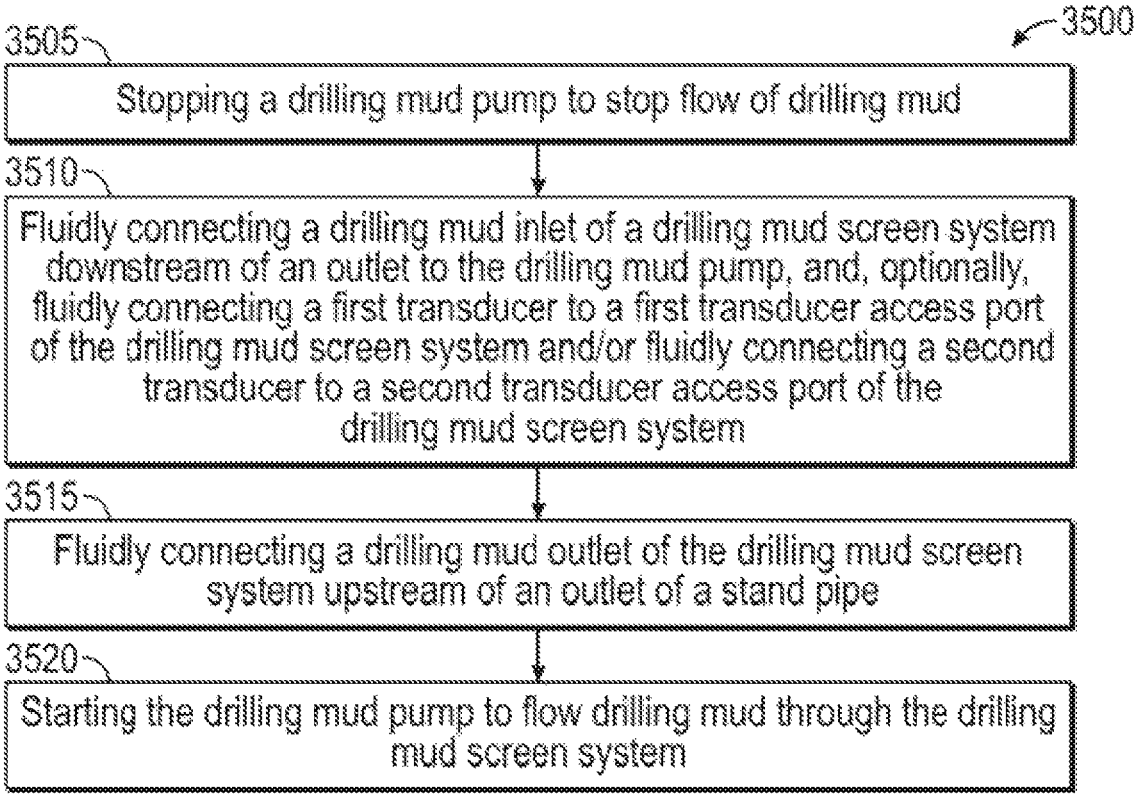
FIG. 35A illustrates a flow chart for a method of using a drilling mud screen system.
Figure 35B:
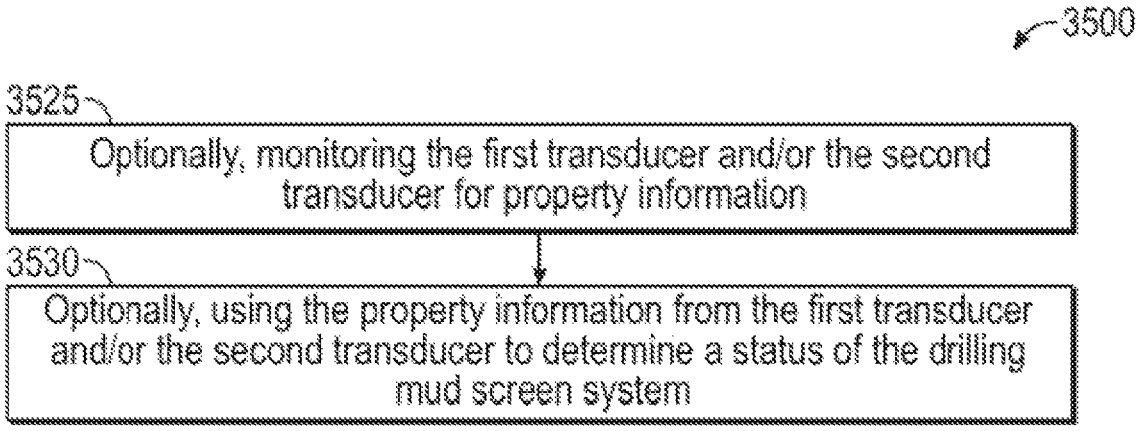
FIG. 35B illustrates a flow chart of optional steps for the method in FIG. 35A.

FIG. 35A illustrates a flow diagram for a method of using a drilling mud screen system; and FIG. 35B illustrates a flow diagram of optional steps for the method of FIG. 35A, as discussed above.

As shown in FIGS. 35A and 35B, the method of using a drilling mud screen system 3500 comprises stopping a drilling mud pump to stop flow of drilling mud 3505, fluidly connecting a drilling mud inlet of a drilling mud screen system downstream of an outlet to the drilling mud pump, and, optionally, fluidly connecting a first transducer to a first transducer access port of the drilling mud screen system (e.g., first transducer subassembly) and/or fluidly connecting a second transducer to a second transducer access port of the drilling mud screen system (e.g., second transducer subassembly) 3510, fluidly connecting a drilling mud outlet of the drilling mud screen system upstream of an outlet of a stand pipe 3515, and starting the drilling mud pump to flow drilling mud through the drilling mud screen system 3520, and optionally, monitoring the first transducer and/or the second transducer for property information 3525.

In an embodiment, step 3510 comprises fluidly connecting a first transducer to a first transducer access port of the drilling mud screen system (e.g., first transducer subassembly); and fluidly connecting a drilling mud inlet of a drilling mud screen system downstream of an outlet to the drilling mud pump.

In an embodiment, step 3510 comprises fluidly connecting a first transducer to a first transducer access port of the drilling mud screen system (e.g., first transducer subassembly); fluidly connecting a second transducer to a second transducer access port of the drilling mud system (e.g., second transducer subassembly); and fluidly connecting a drilling mud inlet of a drilling mud screen system downstream of an outlet to the drilling mud pump.

As shown in FIGS. 30B and 31B, the first transducer (not shown) may be fluidly connected to the first transducer access port 3032*a*, 3132*a* of the drilling mud screen system 3000, 3100 (e.g., first transducer subassembly 30100*a*, 31100*a*) via a connection. Any suitable connection may be used for the first transducer (not shown). For example, suitable connections include, but are not limited to, pipe fittings. Connections are well known in the art. In an embodiment, the first transducer (not shown) may be fluidly connected to a first transducer access port 3032*a*, 3132*a* of the drilling mud screen system 3000, 3100 (e.g., first transducer subassembly 30100*a*, 31100*a*) via a pipe fitting.

As shown in FIGS. 30B and 31B, the second transducer (not shown) may be fluidly connected to the second transducer access port 3032*b*, 3132*b* of the drilling mud screen system 3000, 3100 (e.g., second transducer subassembly 30100*b*, 31100*b*) via a connection. Any suitable connection may be used for the second transducer (not shown). For example, suitable connections include, but are not limited to, pipe fittings. Connections are well known in the art. In an embodiment, the second transducer (not shown) may be fluidly connected to the second transducer access port 3032*b*, 3132*b* of the drilling mud screen system 3000, 3100 (e.g., second transducer subassembly 30100*b*, 31100*b*) via a pipe fitting.

In an embodiment, the method of using a drilling mud screen system 3500 further comprises monitoring the first transducer (not shown) for property information (e.g., displacement, flow rate, pressure, and/or temperature) at the first transducer access port 3032*a*, 3132*a* of the drilling mud screen system 3000, 3100 (e.g., first transducer subassembly 30100*a*, 31100*a*).

In an embodiment, the method of using a drilling mud screen system 3500 further comprises monitoring the first transducer (not shown) for property information (e.g., displacement, flow rate, pressure, and/or temperature) at the first transducer access port 3032*a*, 3132*a* of the drilling mud screen system 3000, 3100 (e.g., first transducer subassembly 30100*a*, 31100*a*). In an embodiment, the first transducer (not shown) may be fluidly connected upstream of the drilling mud screen 3040, 3140 of the drilling mud screen system 3000, 3100.

In an embodiment, the method of using a drilling mud screen system 3500 further comprises monitoring the second transducer (not shown) for property information (e.g., displacement, flow rate, pressure, and/or temperature) at the second transducer access port 3032*b*, 3132*b* of the drilling mud screen system 3000, 3100 (e.g., second transducer subassembly 30100*b*, 31100*b*).

In an embodiment, the method of using a drilling mud screen system 3500 further comprises monitoring the second transducer (not shown) for property information (e.g., displacement, flow rate, pressure, and/or temperature) at the second transducer access port 3032*b*, 3132*b* of the drilling mud screen system 3000, 3100 (e.g., second transducer subassembly 30100*b*, 31100*b*). In an embodiment, the second transducer (not shown) may be fluidly connected downstream of the drilling mud screen 3040, 3140 of the drilling mud screen system 3000, 3100.

In an embodiment, a computing device (such as a rig computer) may include a bus that directly or indirectly couples the following devices: memory, one or more processors, one or more presentation components, one or more input/output (I/O) ports, I/O components, a user interface and a power supply. The computing device may include a variety of computer-readable media. The memory may include computer-storage media in the form of volatile and/or nonvolatile memory. The presentation component(s) present data indications to a user or other device. The user interface allows the user to input/output information to/from the computing device. The one or more I/O ports may allow the computing device to be logically coupled to other devices including a transducer 28105, and other I/O components, some of which may be built in. See e.g., FIG. 28. Examples of other I/O components include a printer, scanner, wireless device, and the like.

In an embodiment, the method of using a drilling mud screen system 3500 further comprises using the property information (e.g., displacement, flow rate, pressure, and/or temperature) from the first transducer (not shown) and/or the second transducer (not shown) to determine a status of the drilling mud screen system 3000, 3100, 3200, 3300. In an embodiment, the method further comprises using the information to determine when to clean, repair or replace the drilling mud screen 3040, 3140, 3240, 3340 in the drilling mud screen system 3000, 3100, 3200, 3330.

In an embodiment, pressure information from, for example, a second pressure transducer (not shown) will allow a driller to know when a drilling mud screen 3040, 3140, 3240, 3340 in a drilling mud screen system 3000, 3100, 3200, 3300 is "packing off" For example, the pressure information from the second pressure transducer (not shown) at the second transducer access port 3032*b*, 3132*b* of the drilling mud screen system 3000, 3100 (e.g., second transducer subassembly 30100*b*, 31100*b*) may be compared to, for example, pressure information from a pressure transducer on a pressure transducer assembly for a stand pipe. If the pressure decreases at the stand pipe and the pressure increases at the second transducer access port 3032*b*, 3132*b* of the drilling mud screen system 3000, 3100 (e.g., second transducer subassembly 30100*b*, 31100*b*), the drilling mud screen 3040, 3140 is likely "packing off." If the pressure decreases or increases at both the stand pipe and the drilling mud screen system 3000, 3100 (e.g., second transducer subassembly 30100*b*, 31100*b*), then the problem is likely down hole and not at the drilling mud screen system 3000, 3100. If the problem is at the drilling mud screen system 3000, 3100, the drilling mud screen 3040, 3140 may be cleaned, repaired or replaced.

Figure 36:
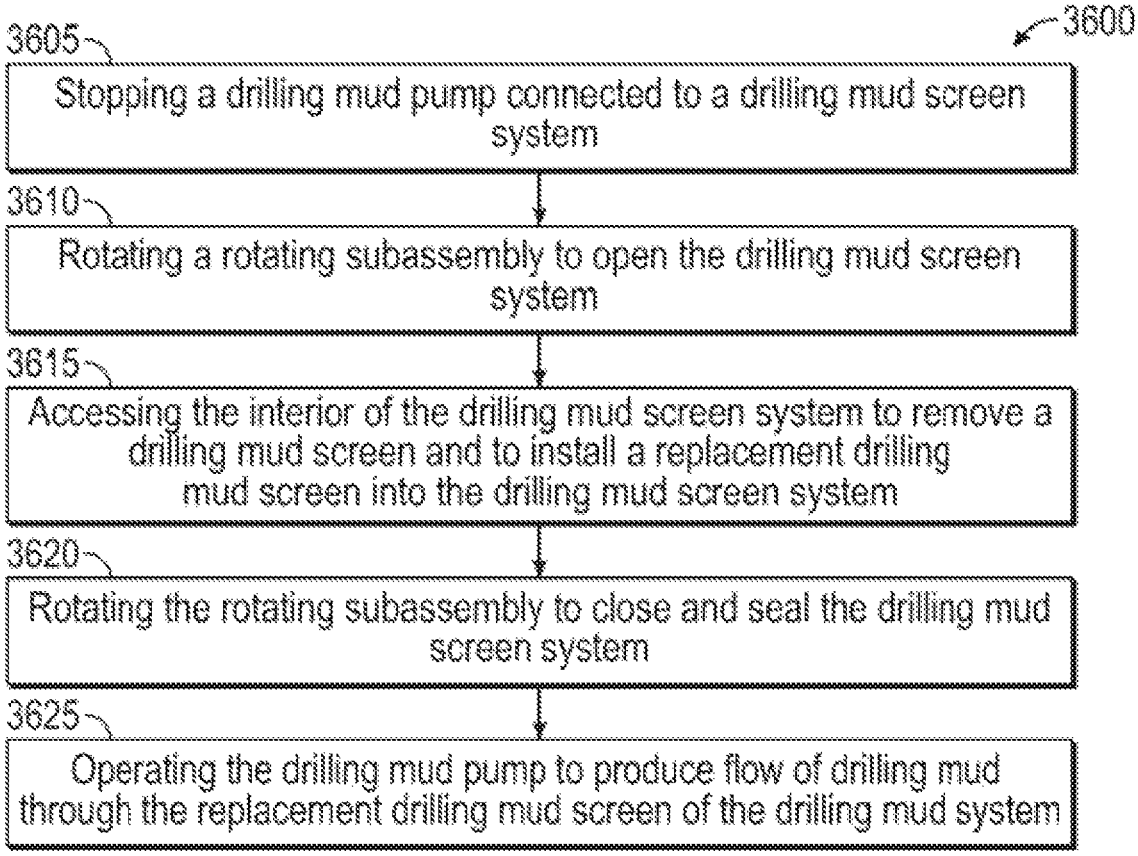
FIG. 36 illustrates a flow chart for a method of removing and replacing a drilling mud screen.

Method of Removing and Replacing Drilling Mud Screen for Improved Drilling Mud Screen System FIG. 36 illustrates a method of removing and replacing a drilling mud screen in a drilling mud screen system, as discussed above. As shown in FIG. 36, the method of removing and replacing a drilling mud screen 3600 comprises stopping a drilling mud pump connected to a drilling mud screen system 3605, rotating a rotating subassembly to open the drilling mud screen system 3610, accessing the interior of the drilling mud screen system to remove a drilling mud screen from the drilling mud screen system and to install a replacement drilling mud screen into the drilling mud screen system 3615, rotating the rotating subassembly to close and seal the drilling mud screen system 3620, and operating the drilling mud pump to produce flow of drilling mud through the replacement drilling mud screen of the drilling mud screen system 3525. See also FIG. 11.

Figure 39:
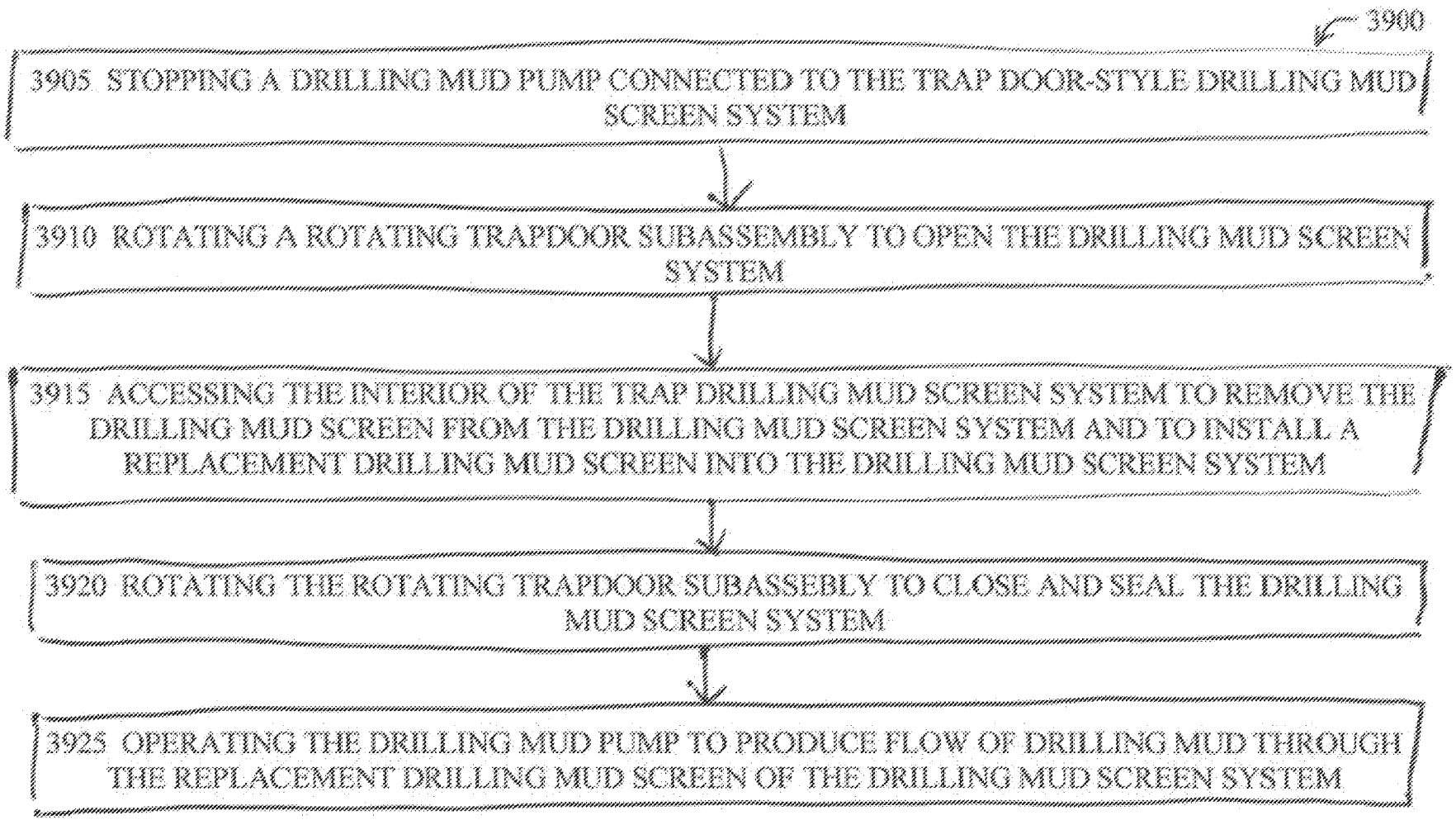
FIG. 39 illustrates a flow diagram for a method of installing and removing a drilling mud screen for the exemplary trapdoor-style drilling mud screen system of FIGS. 39A-39M and 38A-38B.

Method of Removing and Replacing Drilling Mud Screen for Alternative Improved Drilling Mud Screen System FIG. 39 illustrates a method of removing and replacing a drilling mud screen in a four-piece drilling mud screen system, as discussed above. As shown in FIG. 39, the method of removing and replacing a drilling mud screen 3900 comprises stopping a drilling mud pump connected to the trapdoor-style drilling mud screen system 3905, rotating a rotating trapdoor subassembly to open the drilling mud screen system 3910, accessing the interior of the drilling mud screen system to remove a drilling mud screen from the drilling mud screen system and to install a replacement drilling mud screen into the drilling mud screen system 3915, rotating the rotating trapdoor sub assembly to close and seal the drilling mud screen system 3920, and operating the drilling mud pump to produce flow of drilling mud through the replacement drilling mud screen of the drilling mud screen system 3925.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms (e.g., "outer" and "inner," "upper" and "lower," "first" and "second," "internal" and "external," "above" and "below" and the like) are used as words of convenience to provide reference points and, as such, are not to be construed as limiting terms.

The embodiments set forth herein are presented to best explain the present invention and its practical application and to thereby enable those skilled in the art to make and utilize the invention. However, those skilled in the art will recognize that the foregoing description has been presented for the purpose of illustration and example only. The description as set forth is not intended to be exhaustive or to limit the invention to the precise form disclosed. Many modifications and variations are possible in light of the above teaching without departing from the spirit and scope of the following claims.

Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

Definitions

As used herein, the terms "a," "an," "the," and "said" mean one or more, unless the context dictates otherwise.

As used herein, the term "about" means the stated value plus or minus a margin of error plus or minus 10% if no method of measurement is indicated.

As used herein, the term "or" means "and/or" unless explicitly indicated to refer to alternatives only or if the alternatives are mutually exclusive.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "containing," "contains," and "contain" have the same open-ended meaning as "comprising," "comprises," and "comprise," provided above.

As used herein, the terms "having," "has," and "have" have the same open-ended meaning as "comprising," "comprises," and "comprise," provided above.

As used herein, the terms "including," "includes," and "include" have the same open-ended meaning as "comprising," "comprises," and "comprise," provided above.

As used herein, the phrase "consisting of" is a closed transition term used to transition from a subject recited before the term to one or more material elements recited after the term, where the material element or elements listed after the transition term are the only material elements that make up the subject.

As used herein, the term "simultaneously" means occurring at the same time or about the same time, including concurrently.

INCORPORATION BY REFERENCE

All patents and patent applications, articles, reports, and other documents cited herein are fully incorporated by reference to the extent they are not inconsistent with this invention.

What is claimed is:

1. A trapdoor-style drilling mud screen system, comprising:

(a) a first body having a first portion, a second portion and a third portion;

(b) a first drilling mud inlet at a first end of the first portion of the first body;

(c) a first drilling mud outlet at a second end of the third portion of the first body;

(d) a rotating trapdoor subassembly, wherein the rotating trapdoor subassembly is disposed within the second portion of the first body, wherein the first portion of the first body is fluidly connected to a first end of the rotating subassembly, and wherein a second end of the rotating subassembly is fluidly connected to the third portion of the first body;

(e) a pivot subassembly, wherein the pivot subassembly is disposed through the rotating trapdoor subassembly and through the second portion of the first body; and (f) a drilling mud screen, wherein the drilling mud screen is disposed within the rotating trapdoor subassembly between the first drilling mud inlet and the first drilling mud outlet.

2. The drilling mud screen system of claim 1, wherein the rotating trapdoor subassembly comprises:

(a) a second body, wherein a first end of the second body is fluidly connected to a second end of the first portion of the first body and wherein a second end of the second body is fluidly connected to a first end of the third portion of the first body.

3. The drilling mud screen system of claim 1, wherein the pivot subassembly comprises:

(a) a pivot shaft; and (b) a retaining ring, wherein the retaining ring retains the pivot shaft through the second portion of the first body.

4. The drilling mud screen system of claim 1, wherein the first portion of the first body comprises a first piston.

5. The drilling mud screen system of claim 4 further comprising a piston guide bar disposed through the first portion of the first body and into a portion of the first piston, wherein the piston guide bar guides a second end of the first piston to engage a first end of the rotating trapdoor subassembly when the rotating trapdoor subassembly is in a closed position.

6. The drilling mud screen system of claim 4 further comprising a piston guide bar disposed through the first portion of the first body and into a portion of the first piston, wherein the piston guide bar locks a second end of the first piston to contact and seal a first end of the rotating trapdoor subassembly when the rotating trapdoor subassembly is in a closed position.

7. The drilling mud screen system of claim 4 further comprising a piston guide bar disposed through the first portion of the first body first body and into a portion of the first piston, wherein the piston guide bar guides a second end of the first piston to disengage from a first end of the rotating trapdoor subassembly when the rotating trapdoor subassembly is in an open position.

8. The drilling mud screen system of claim 4 further comprising a piston guide bar disposed through the first portion of the first body and into a portion of the first piston, wherein the piston guide bar separates a second end of the first piston to disengage and create a gap from a first end of the rotating trapdoor subassembly when the rotating trapdoor subassembly is in the open position to avoid damage to a first seal face at the second end of the first piston and/or the second seal face at the first end of the rotating trapdoor subassembly.

9. The drilling mud screen system of claim 4, wherein the piston guide bar further comprises a ball bearing for smooth operation.

10. The drilling mud screen system of claim 4 further comprising:

(a) a first spring, wherein the first spring is disposed between the first piston and a first subassembly, wherein the first subassembly comprises:

i. a second body having a first end and a second end;

ii. a second drilling mud inlet at the first end of the second body; and iii. a second drilling mud outlet at the second end of the second body, wherein the second end of the second body is fluidly connected to the first end of the first portion of the first body.

11. The drilling mud screen system of claim 10, wherein the second end of the first piston has a first seal face and wherein the first end of the rotating trapdoor subassembly has a second seal face.

12. The drilling mud screen system of claim 4, wherein the third portion of the first body comprises a second piston.

13. The drilling mud screen system of claim 12 further comprising:

(a) a second spring, wherein the second spring is disposed between the second piston and a second subassembly, wherein the second subassembly comprises:
   i. a third body having a first end and a second end;
   ii. a third drilling mud inlet at the first end of the third body;
   iii. a third drilling mud outlet at the second end of the third body, wherein the second end of the third portion of the first body is fluidly connected to the first end of the third body.

14. The drilling mud screen system of claim 13, wherein the second end of the rotating trapdoor subassembly has a third seal face and wherein the first end of the second piston has a fourth seal face.

15. The drilling mud screen system of claim 4, further comprising a threaded lock ring, wherein the threaded lock ring is disposed around the first portion of the first body and the first end of the trapdoor subassembly.

16. The drilling mud screen system of claim 15, wherein the threaded lock ring further comprises a handle.

17. The drilling mud screen system of claim 4 further comprising a threaded lock ring, wherein the threaded lock ring is disposed around a first portion of the body and a first end of the rotating trapdoor subassembly to lock the trapdoor subassembly in a closed position.

18. The drilling mud screen system of claim 4 further comprising a piston guide bar disposed through a first slot in the first portion of the first body or the second portion of the body, and into a second slot in the first piston, wherein the piston guide bar guides a second end of the first piston to engage a first end of the rotating trapdoor subassembly when the rotating trapdoor subassembly is in a closed position.

19. The drilling mud screen system of claim 4 further comprising a piston guide bar disposed through a first slot in the first portion of the first body or the second portion of the body, and into a second slot of the first piston, wherein the piston guide bar locks a second end of the first piston to contact and seal a first end of the rotating trapdoor subassembly when the rotating trapdoor subassembly is in a closed position.

20. The drilling mud screen system of claim 1, wherein the drilling mud screen comprises:

(a) a second body having a first end and a second end and a first centerline;
(b) a filter having a first end, a second end, and openings, wherein the first end of the filter is fluidly connected to the first end of the second body via a first connection and/or a first end retaining ring;
(c) an end cap fluidly connected at the second end of the filter via a second connection, wherein the filter has a retaining ring disposed between the first connection and the second connection;
(d) a second drilling mud inlet at the first end of the second body; and
(e) a second drilling mud outlet at the openings of the filter.

21. The drilling mud screen system of claim 20, wherein the filter comprises a plurality of rods having a first end and a second end, wherein each of the plurality of rods are spaced a distance apart to form the openings in the filter.

22. The drilling mud screen system of claim 21, wherein each of the plurality of rods are tapered from the first end to the second end.

23. The drilling mud screen system of claim 20, wherein the filter comprises a formed sheet having drilled holes or slots spaced a distance apart to form the openings in the filter.

24. The drilling mud screen system of claim 23, wherein the drilled holes or slots are drilled in offset rows or straight rows from the first end to the second end.

25. The drilling mud screen system of claim 20, wherein the filter is tapered from the first end to the second end.

26. The drilling mud screen system of claim 20, wherein the end cap is a flat plate or a flat plate with holes or slots.

27. The drilling mud screen of claim 20, wherein the end cap is an inverted cone or an inverted cone with holes or slots.

28. The drilling mud screen system of claim 20, wherein the first centerline of the second body and an outer surface of the end cap forms a cap angle, wherein the cap angle is from about 30-degrees to about 90-degrees.

29. The drilling mud screen system of claim 20, wherein the first centerline of the second body and an outer surface of the end cap forms a cap angle, wherein the cap angle is from about 35-degrees to about 45-degrees.

30. The drilling mud screen system of claim 20, wherein the filter, the first end retaining ring and/or the retaining ring are constructed from AISI 4145 or equivalent, stainless steel or combinations thereof.

31. The drilling mud screen system of claim 20, wherein the filter, the first end retaining ring and/or the retaining ring has a hardened coating.

32. The drilling mud screen system of claim 20, wherein one or more of the filter, the first end retaining ring and/or the retaining ring has a Carbide coating with about 6% Cobalt binder.

33. The drilling mud screen system of claim 20, wherein one or more of the first body and the second body are constructed from AISI 4130/75k or equivalent material, AISI 4145 or equivalent, or combinations thereof.

34. The drilling mud screen system of claim 1, wherein the drilling mud screen comprises:

(a) a second body having a first end and a second end and a first centerline;
(b) a filter having a first end and a second end, and openings, wherein the second end of the filter is fluidly connected to the first end of the second body via a first connection and/or a second end retaining ring;
(c) an end cap fluidly connected at the first end of the filter via a second connection, wherein the filter has a retaining ring disposed between the first connection and the second connection;
(d) a second drilling mud inlet at the openings of the filter; and
(e) a second drilling mud outlet at the second end of the second body.

35. The drilling mud screen system of claim 34, wherein the filter comprises a plurality of rods having a first end and a second end, wherein each of the plurality of rods are spaced a distance apart to form the openings in the filter.

36. The drilling mud screen system of claim 35, wherein each of the plurality of rods are tapered from the first end to the second end.

37. The drilling mud screen system of claim 34, wherein the filter comprises a formed sheet having drilled holes or slots spaced a distance apart to form the openings in the filter.

38. The drilling mud screen system of claim 37, wherein the drilled holes or slots are drilled in offset rows or straight rows from the first end to the second end.

39. The drilling mud screen system of claim 34, wherein the filter is tapered from the second end to the first end.

40. The drilling mud screen system of claim 34, wherein the end cap is a flat plate or a flat plate with holes or slots.

41. The drilling mud screen of claim 34, wherein the end cap is a cone or a cone with holes or slots.

42. The drilling mud screen system of claim 34, wherein the first centerline of the second body and an outer surface of the end cap forms a cap angle, wherein the cap angle is from about 30-degrees to about 90-degrees.

43. The drilling mud screen system of claim 34, wherein the first centerline of the second body and an outer surface of the end cap forms a cap angle, wherein the cap angle is from about 35-degrees to about 45-degrees.

44. The drilling mud screen system of claim 34, wherein the filter, the second end retaining ring and/or the retaining ring are constructed from AISI 4145 or equivalent, stainless steel or combinations thereof.

45. The drilling mud screen system of claim 34, wherein the filter, the second end retaining ring and/or the retaining ring has a hardened coating.

46. The drilling mud screen system of claim 34, wherein one or more of the filter, the second end retaining ring and/or the retaining ring has a Carbide coating with about 6% Cobalt binder.

47. The drilling mud screen system of claim 34, wherein one or more of the first body, and the second body are constructed from AISI 4130/75k or equivalent material, AISI 4145 or equivalent, or combinations thereof.

48. A method of installing a trapdoor-style drilling mud screen system comprising:

(a) stopping a drilling mud pump to fluidly connect the drilling mud screen system of claim 1 to the drilling mud pump;

(b) fluidly connecting the drilling mud screen system m line with and immediately upstream or downstream of the drilling mud pump; and (c) operating the drilling mud pump to produce flow of drilling mud through the drilling mud screen system.

49. The method of claim 48, wherein step b) comprises fluidly connecting a drilling mud inlet of the drilling mud screen system to a high-pressure outlet of the drilling mud pump and fluidly connecting a drilling mud outlet of the drilling mud screen system to a vibrator hose or a standpipe.

50. The method of claim 48, wherein step b) comprises fluidly connecting a drilling mud inlet of the drilling mud screen system to a high-pressure inlet of the drilling mud pump and fluidly connecting a drilling mud outlet of the drilling mud screen system to an inlet of a vibrator hose.

51. The method of claim 48, wherein step b) comprises fluidly connecting a drilling mud inlet of the drilling mud screen system to an outlet of a vibrator hose and a drilling mud outlet to an inlet of a standpipe.

52. The method of claim 48, wherein step b) comprises fluidly connecting a drilling mud inlet of the drilling mud screen system to an outlet of a first portion of a standpipe and a drilling mud outlet of the drilling mud screen system to an inlet of a second portion of the standpipe.

53. The method of claim 48, further comprising step d) filtering or screening debris from drilling mud.

54. A method of removing and replacing a drilling mud screen comprising:

(a) stopping a drilling mud pump connected to the drilling mud screen system of claim 1;

(b) rotating a rotating trapdoor subassembly to open the drilling mud screen system;

(c) removing the drilling mud screen;

(d) installing a replacement drilling mud screen;

(e) rotating the rotating trapdoor subassembly to close and seal the drilling mud screen system; and (f) operating the drilling mud pump to produce flow of drilling mud through the drilling mud screen system.

55. The method of claim 54, wherein step b) comprises: step b-1) removing a piston guide bar and/or a threaded lock ring and step b-2) rotating the rotating trapdoor subassembly to open the drilling mud screen system.

56. The method of claim 54, wherein step d) comprises: step d-1) rotating the trapdoor subassembly to close the drilling mud screen system and step d-2) installing a piston guide bar and/or a threaded lock ring to seal the drilling mud screen system.

57. The method of claim 54, wherein step b) comprises: step b-1) removing a piston guide bar and/or a threaded lock ring and step b-2) rotating the rotating trapdoor subassembly to open the drilling mud screen system, and wherein step d) comprises: step d-1) rotating the trapdoor subassembly to close the drilling mud screen system and step d-2) installing a piston guide bar and/or a threaded lock ring to seal the drilling mud screen system.

* * * * *